US012188222B2

(12) United States Patent
Morrow

(10) Patent No.: US 12,188,222 B2
(45) **Date of Patent: *Jan. 7, 2025**

(54) FRAMES AND DERIVATIVE MODULES BASED ON LIGHT WEIGHT CONSTRUCTION SYSTEM WITH STANDARD AND TRANSITION PANELS

(71) Applicant: Blue Tomato, LLC, Provo, UT (US)

(72) Inventor: Brian D. Morrow, Provo, UT (US)

(73) Assignee: BLUE TOMATO, LLC, Provo, UT (US)

( * ) Notice: Subject to any disclaimer, the term of this patent is extended or adjusted under 35 U.S.C. 154(b) by 369 days.

This patent is subject to a terminal disclaimer.

(21) Appl. No.: 17/706,463

(22) Filed: Mar. 28, 2022

(65) Prior Publication Data

US 2022/0220728 A1 Jul. 14, 2022

Related U.S. Application Data

(63) Continuation-in-part of application No. 16/942,166, filed on Jul. 29, 2020, now Pat. No. 11,286,658,
(Continued)

(51) Int. Cl.
*E04B 1/61* (2006.01)
*E04B 1/12* (2006.01)
(Continued)

(52) U.S. Cl.
CPC ..... *E04B 1/6145* (2013.01); *E04B 1/12* (2013.01); *E04B 5/023* (2013.01); *E04B 7/22* (2013.01);
(Continued)

(58) Field of Classification Search
None
See application file for complete search history.

(56) References Cited

U.S. PATENT DOCUMENTS 2,202,783 A * 5/1940 Morrell ..... E04B 2/58 52/475.1
2,321,567 A 6/1943 Wilson
(Continued)

FOREIGN PATENT DOCUMENTS

DE 3034601 A1 4/1982
FR 2359942 A1 2/1978
(Continued)

OTHER PUBLICATIONS

Ex Parte Quayle Action received for U.S. Appl. No. 29/648,685, mailed on Feb. 15, 2019.
(Continued)

*Primary Examiner* — Joshua K Ihezie
(74) *Attorney, Agent, or Firm* — Workman Nydegger

(57) ABSTRACT

Modular building methods and systems using precision machined modular panels. Standard modular panels are used for constructing walls, floor, and roof, with transitions from wall to roof and wall to floor provided by special transition panels. The standard panels include a channel formed configured to receive a flange of a C-channel member. The present method progresses by installation of a foam panel (or stack or row of such panels), followed by installation of a C-channel member, with the flange of such member engaged in the panels, followed by installation of an adjacent row or stack of panels, before installation of the next, adjacent C-channel member. Such alternating placement of panels and frame members eliminates the need for a tape measure, the need for any independent frame for the building, and ensures the walls, floor, and roof are square and plumb, as the precision machined panels ensure these requirements are met.

17 Claims, 119 Drawing Sheets

Related U.S. Application Data which is a continuation-in-part of application No. 16/824,209, filed on Mar. 19, 2020, now Pat. No. 11,352,775, which is a continuation-in-part of application No. 16/709,674, filed on Dec. 10, 2019, now Pat. No. 10,865,560.

(60) Provisional application No. 63/278,042, filed on Nov. 10, 2021, provisional application No. 63/278,040, filed on Nov. 10, 2021, provisional application No. 62/991,889, filed on Mar. 19, 2020, provisional application No. 62/890,818, filed on Aug. 23, 2019, provisional application No. 62/777,648, filed on Dec. 10, 2018.

(51) Int. Cl.

| | |
|---|---|
| ***E04B 2/00*** | (2006.01) |
| ***E04B 5/02*** | (2006.01) |
| ***E04B 7/22*** | (2006.01) |
| ***E04C 2/20*** | (2006.01) |
| *E04C 2/00* | (2006.01) |

(52) U.S. Cl.

CPC ..... *E04C 2/205* (2013.01); *E04C 2/46* (2013.01); *E04C 2/50* (2013.01); *E04B 2103/04* (2013.01); *E04C 2002/004* (2013.01)

(56) References Cited

U.S. PATENT DOCUMENTS 2,844,848 A 7/1958 Couse et al.
3,236,014 A 2/1966 Norman
3,284,980 A 11/1966 Dinkel
3,310,917 A 3/1967 Simon
3,348,459 A * 10/1967 Harvey ..... E01C 9/083 404/35
3,353,315 A 11/1967 Barker
3,374,703 A 3/1968 Davis et al.
3,517,468 A 6/1970 Woods
3,529,390 A * 9/1970 Stetter ..... E04B 2/18 52/447
3,557,670 A * 1/1971 Sutton ..... E01C 9/083 244/114 R
3,646,715 A 3/1972 Pope
3,699,731 A 10/1972 Arnold
3,775,916 A 12/1973 Bair
3,808,085 A 4/1974 Givens
3,888,055 A 6/1975 Gallo
4,035,972 A 7/1977 Timmons
4,435,928 A * 3/1984 Huling, III ..... E04B 1/26 52/309.4
4,443,988 A * 4/1984 Coutu, Sr. ..... E04B 1/80 52/586.1
4,578,909 A * 4/1986 Henley ..... E04B 1/74 52/404.3
4,578,915 A 4/1986 Schneller
4,615,448 A 10/1986 Johnstonbaugh
4,617,219 A 10/1986 Schupack
4,641,468 A 2/1987 Slater
4,656,795 A * 4/1987 Albrecht ..... E04F 15/02435 52/800.1
4,676,036 A * 6/1987 Bessert ..... E04F 15/02452 52/126.6
4,774,794 A * 10/1988 Grieb ..... E04B 7/225 52/309.7
4,893,451 A 1/1990 Valente
4,944,416 A 7/1990 Petersen et al.
5,003,742 A * 4/1991 Dettbarn ..... E04B 2/7409 52/763
5,030,502 A 7/1991 Teare
5,062,387 A 11/1991 Anderson
5,121,578 A 6/1992 Holz
5,138,803 A 8/1992 Grossen
5,152,371 A * 10/1992 Wyse ..... E04G 1/12 182/119
5,172,532 A 12/1992 Gibbar, Jr.
5,173,233 A 12/1992 Kafarowski
5,181,353 A 1/1993 Harrington
5,231,813 A * 8/1993 Drawdy ..... E04C 2/288 52/251
5,268,226 A 12/1993 Sweeney
5,353,560 A * 10/1994 Heydon ..... E04B 7/22 52/592.1
5,353,562 A * 10/1994 Decker ..... E04C 2/205 52/309.7
5,377,470 A 1/1995 Hebinck
5,390,462 A 2/1995 Kreiter
5,403,062 A * 4/1995 Sjostedt ..... B65D 90/0026 296/181.6
5,505,031 A * 4/1996 Heydon ..... E04B 1/7654 52/800.1
D384,108 S 9/1997 Rinicella et al.
5,694,730 A 12/1997 Del et al.
5,803,964 A * 9/1998 Scarborough ..... E04B 1/161 106/737
5,822,940 A * 10/1998 Carlin ..... E04B 2/7453 52/459
5,899,037 A 5/1999 Josey
5,901,522 A 5/1999 Slater
5,921,046 A 7/1999 Hammond, Jr.
5,927,032 A * 7/1999 Record ..... E04C 2/288 52/412
5,950,389 A * 9/1999 Porter ..... E04C 2/296 403/DIG. 15
6,035,594 A 3/2000 Leslie
D444,577 S 7/2001 Neuhofer, Jr.
6,305,135 B1 10/2001 Inaba
6,324,809 B1 12/2001 Nelson
6,460,302 B1 * 10/2002 Neuhaus, III ..... E04B 1/161 52/261
6,470,632 B1 10/2002 Smith
6,481,172 B1 * 11/2002 Porter ..... B32B 5/18 52/794.1
6,571,523 B2 6/2003 Chambers
D477,423 S 7/2003 Campbell et al.
6,694,689 B1 * 2/2004 Scott ..... H02G 3/385 52/460
6,701,683 B2 3/2004 Messenger et al.
6,772,890 B2 8/2004 Campbell et al.
6,985,832 B2 * 1/2006 Saebi ..... G06F 30/13 702/183
D519,651 S 4/2006 Simic
7,028,440 B2 * 4/2006 Brisson ..... E04C 2/288 52/439
7,036,196 B2 5/2006 Salatin et al.
7,093,726 B1 8/2006 Holztrager
7,165,374 B2 * 1/2007 Ohanesian ..... B28B 11/042 52/424
D569,013 S 5/2008 Shuman et al.
7,712,265 B2 5/2010 Overmyer et al.
7,779,600 B1 * 8/2010 Saebi ..... E04B 1/18 52/309.1
7,877,960 B2 * 2/2011 Kennedy ..... E04C 2/384 52/592.1
7,913,730 B2 3/2011 Schaffeld
8,151,539 B2 * 4/2012 Grinsted ..... E04C 2/205 52/745.1
8,220,648 B2 7/2012 Barkdoll et al.
8,468,767 B1 6/2013 McBride
8,627,625 B2 1/2014 Bouchard et al.
8,695,299 B2 4/2014 Propst
9,234,355 B2 1/2016 Sealock et al.
D861,194 S * 9/2019 Morrow ..... D25/138
10,450,736 B2 10/2019 Morrow
10,487,499 B1 11/2019 Berkowitz
10,865,560 B1 * 12/2020 Morrow ..... E04B 2/16
10,988,931 B1 * 4/2021 McManus ..... E04F 15/082
11,352,775 B2 * 6/2022 Morrow ..... E04B 1/02
11,401,724 B2 8/2022 Morrow
11,821,206 B2 * 11/2023 Leahy ..... E04C 2/526

(56) References Cited

U.S. PATENT DOCUMENTS

| | | | | |
|---|---|---|---|---|
| 2004/0067373 | A1* | 4/2004 | Kennedy | B32B 15/08 428/457 |
| 2005/0284060 | A1 | 12/2005 | Ritchie | |
| 2006/0046068 | A1 | 3/2006 | Barancyk et al. | |
| 2006/0207479 | A1 | 9/2006 | Hughes | |
| 2007/0113501 | A1* | 5/2007 | Ohanesian | E04H 17/1404 52/468 |
| 2007/0131308 | A1* | 6/2007 | Martin | E04C 2/386 144/344 |
| 2007/0163197 | A1* | 7/2007 | Payne | E04B 1/14 52/287.1 |
| 2008/0282632 | A1 | 11/2008 | Sleeman | |
| 2009/0100780 | A1* | 4/2009 | Mathis | E04C 2/296 52/794.1 |
| 2009/0205277 | A1* | 8/2009 | Gibson | E04D 13/1625 52/656.1 |
| 2010/0011699 | A1* | 1/2010 | Weimer | E04C 2/52 52/745.1 |
| 2010/0083590 | A1 | 4/2010 | Wochnik | |
| 2010/0095625 | A1 | 4/2010 | Boutaghou et al. | |
| 2010/0136269 | A1 | 6/2010 | Andersen et al. | |
| 2011/0067331 | A1* | 3/2011 | Grinsted | E04B 1/14 52/309.4 |
| 2011/0173911 | A1* | 7/2011 | Propst | B32B 13/045 427/403 |
| 2011/0214374 | A1 | 9/2011 | Propst | |
| 2012/0011793 | A1 | 1/2012 | Clark et al. | |
| 2013/0008129 | A1 | 1/2013 | Hall | |
| 2013/0086850 | A1 | 4/2013 | Morrow | |
| 2013/0216760 | A1 | 8/2013 | Bol | |
| 2013/0227902 | A1* | 9/2013 | Van Sloun | B32B 5/18 264/261 |
| 2013/0266370 | A1 | 10/2013 | Gunther | |
| 2014/0250827 | A1 | 9/2014 | Gillman | |
| 2015/0135634 | A1* | 5/2015 | Hoie | E04C 2/243 52/745.05 |
| 2016/0014995 | A1 | 1/2016 | Bruno | |
| 2016/0208489 | A1* | 7/2016 | Gibson | E04B 1/14 |
| 2017/0096825 | A1 | 4/2017 | Bree | |
| 2017/0121958 | A1 | 5/2017 | Jin | |
| 2017/0211268 | A1 | 7/2017 | Eichhorn et al. | |
| 2018/0298600 | A1* | 10/2018 | Moss | E04B 1/388 |
| 2019/0242109 | A1* | 8/2019 | Morrow | E04B 2/562 |
| 2020/0001583 | A1 | 1/2020 | Eichhorn et al. | |
| 2020/0354945 | A1 | 11/2020 | Morrow | |
| 2021/0040722 | A1 | 2/2021 | Morrow | |
| 2021/0040733 | A1 | 2/2021 | Morrow | |
| 2021/0040759 | A1 | 2/2021 | Morrow | |
| 2021/0207375 | A1* | 7/2021 | Leahy | E04C 2/521 |
| 2021/0301528 | A1 | 9/2021 | Dombowsky et al. | |
| 2023/0009162 | A1 | 1/2023 | Morrow | |

FOREIGN PATENT DOCUMENTS

| | | | |
|---|---|---|---|
| GB | 2261234 | A | 5/1993 |
| JP | 07-102680 | A | 4/1995 |
| JP | 10-148095 | A | 6/1998 |
| JP | 2002-292612 | A | 10/2002 |
| KR | 10-1993-0010328 | A | 6/1993 |
| KR | 10-2009-0065909 | A | 6/2009 |
| WO | 2013/052427 | A2 | 4/2013 |
| WO | 2018/194528 | A1 | 10/2018 |
| WO | 2021/118744 | | 6/2021 |

OTHER PUBLICATIONS

Final Office Action received for U.S. Appl. No. 13/436,403, mailed on Aug. 1, 2013.
Final Office Action received for U.S. Appl. No. 16/549,901, mailed on Mar. 12, 2021, 6 pages.
International Search Report for PCT/US2012/058344 mailed Mar. 28, 2013,3 pages.
Non-Final Office Action received for U.S. Appl. No. 16/549,901, mailed on Sep. 4, 2020.
Non-Final Office Action received for U.S. Appl. No. 16/824,209, mailed on Jul. 29, 2021, 13 pages.
Notice of Allowance received for U.S. Appl. No. 13/866,569, mailed on Jun. 20, 2014.
Notice of Allowance received for U.S. Appl. No. 16/549,901, mailed on Apr. 16, 2021, 8 pages.
Notice of Allowance received for U.S. Appl. No. 16/824,209, mailed on Jan. 20, 2022, 8 pages.
Notice of Allowance received for U.S. Appl. No. 16/942,166, mailed on Nov. 23, 2021, 8 pages.
Notice of Allowance received for U.S. Appl. No. 29/648,685, mailed on May 9, 2019.
Office Action received for U.S. Appl. No. 16/653,579, mailed on Feb. 25, 2022, 8 pages.
Office Action received for U.S. Appl. No. 13/436,403, mailed on Feb. 13, 2013.
Office Action received for U.S. Appl. No. 15/426,756, mailed on Feb. 23, 2018.
Office Action received for U.S. Appl. No. 15/987,366, mailed on Feb. 14, 2019.
Office Action received for U.S. Appl. No. 16/709,674, mailed on Apr. 6, 2020.
U.S. Application filed on Apr. 19, 2013 by Morrow., U.S. Appl. No. 13/866,569.
U.S. Application filed on Aug. 23, 2019. by Morrow., U.S. Appl. No. 16/549,901.
U.S. Application filed on Feb. 7, 2017 by Morrow., U.S. Appl. No. 15/426,756.
U.S. Application filed on Jul. 31, 2018, by Morrow., U.S. Appl. No. 29/658,417.
U.S. Application filed on Mar. 19, 2020 by Morrow., U.S. Appl. No. 16/824,209.
U.S. Application filed on May 23, 2018, by Morrow., U.S. Appl. No. 29/648,685.
U.S. Appl. No. 16/653,579, filed Oct. 15, 2019.
U.S. Appl. No. 13/436,403 U.S. filed Mar. 30, 2012.
U.S. Appl. No. 62/722,591, filed Aug. 24, 2018.
U.S. Appl. No. 62/890,818, filed Aug. 23, 2019.
U.S. Appl. No. 62/991,889, filed Mar. 19, 2020.
U.S. Appl. No. 16/942,166, filed Jul. 29, 2020.
U.S. Appl. No. 29/744,477, filed Jul. 29, 2020.
Non-Final Office Action received for U.S. Appl. No. 17/465,666, mailed on Nov. 25, 2022, 10 pages.
Notice of Allowance received for U.S. Appl. No. 17/465,666, mailed on Feb. 27, 2023, 7 pages.
Restriction Requirement received for U.S. Appl. No. 29/744,477, mailed on Nov. 30, 2022, 6 pages.
Notice of Allowance received for U.S. Appl. No. 29/744,477, mailed on Mar. 20, 2023, 9 pages.

* cited by examiner

FRAMES AND DERIVATIVE MODULES BASED ON LIGHT WEIGHT CONSTRUCTION SYSTEM WITH STANDARD AND TRANSITION PANELS

CROSS-REFERENCE TO RELATED APPLICATION

The present application is a continuation-in-part under 35 U.S.C. 120 of U.S. patent application Ser. No. 16/942,166 (now U.S. Pat. No. 11,286,658), filed Jul. 29, 2020, which is a continuation-in-part under 35 U.S.C. 120 of U.S. patent application Ser. No. 16/824,209 filed Mar. 19, 2020, which claims priority to and the benefit of U.S. Provisional Patent Application No. 62/991,889, filed Mar. 19, 2020, which is herein incorporated by reference in its entirety. application Ser. No. 16/824,209 is also a continuation-in part under 35 U.S.C. 120 of U.S. patent application Ser. No. 16/709,674 (now U.S. Pat. No. 10,865,560) filed Dec. 10, 2019, which claims priority to and the benefit of U.S. Provisional Patent Application Nos. 62/777,648 and 62/890,818 filed Dec. 10, 2018 and Aug. 23, 2019, respectively. The present application also claims the benefit of U.S. Provisional Patent Application Nos. 63/278,040 (18944.23) and 63/278,042 (18944.24), both filed Nov. 10, 2021. Each of the above applications is herein incorporated by reference in its entirety.

BACKGROUND OF THE INVENTION

1. The Field of the Invention

The present invention is in the field of modular building construction methods and systems used within the construction industry.

2. The Relevant Technology

Building construction systems including modular features are sometimes used in the construction field. For example, particularly in third world countries where skilled labor is not readily available, and building materials must be relatively inexpensive, cinder block or brick materials are used in constructing homes, schools, agricultural buildings, and other buildings. It can be difficult to learn to lay block or brick while keeping the walls square and plumb. In addition, such systems require mortar to hold the individual blocks or bricks together. A roof formed from a different material (other than block or brick) is needed. In addition, insulating and/or providing an air-tight seal (e.g., to employ negative pressurization) within such structures is difficult.

Stick frame construction methods are of course also well known, although such systems also require a considerable amount of skilled labor to construct a building therefrom. In addition to requiring skilled labor, such existing methods also require considerable strength for those involved in the construction. Because of such requirements, in practice, such construction systems are not readily usable by groups of both men and women, where women often make up the vast majority of the labor pool available in third world humanitarian construction projects.

Various other building materials and systems are also used in the art. Structural insulated panels (SIPs) are used in some circumstances within the construction industry as an alternative to stick frame construction with insulation blown or laid within the cavities between stick framing members. A typical structural insulated panel may include an insulating layer sandwiched between two layers of structural plywood or oriented strand board ("OSB"). The use of such panels within residential, commercial or other construction projects can often significantly decrease the time required for construction, and also typically provides superior insulating ability as compared to a traditional structure constructed of block or brick, or even stick frame construction with insulation blown or laid between frame members. That said, drawbacks with such systems include that stick frame construction and SIP construction typically require some level of skilled labor, and thus are not particularly well suited for use in environments where such skills are not readily available, and shipping such panels can represent a significant expense. In addition, heavy equipment (e.g., cranes) are often required to install such panels, as well as other components (e.g., frame members).

SUMMARY

In one aspect, the present invention is directed to various building construction systems and methods. Such systems and methods may employ a plurality of modular panels, which may be based on a common modularity within each panel. The system could also be a fractal system, e.g., where larger panels could be provided, based on multiples of such a base panel. In any case, the modularity and particular panel design of the system also allows the modular panels to be easily and quickly cut, where the building blueprints dictate the need for only a portion of the overall modular panel length. Such modular characteristics will be apparent, in the following disclosure.

Furthermore, many existing systems provide excellent flexibility, but with that flexibility, there is significant room for error, such that skilled labor is required. Other systems that may employ a system of panels may reduce the room for error, but greatly reduce the available flexibility, necessitating use of many custom components and solutions to accommodate needs that the system does not anticipate. The present system provides a happy medium between providing flexibility, and requiring only little if any skilled labor.

A modular panel for use in construction may include a lightweight (e.g., foam) body, and one or more channels extending horizontally through a length of the panel. Each channel may be configured in size and shape to receive a flexible elongate spline therein, wherein each spline once received in the channel is at least partially disposed within the lightweight body, without the spline being exposed on the large outside planar face of the body.

One advantage of the present system is that the splines may simply be ripped strips of oriented strand board (OSB) or the like, which is readily available throughout nearly the entire world, and which is also more flexible in a direction that is normal to the width of the OSB spline (i.e., in the direction of its thickness), than would be typical for dimensional lumber, even of the same dimensions. Metal splines (e.g., aluminum) may also be used. For example, while Applicant has also developed earlier systems which use dimensional lumber as splines, it was found that because such lumber is notorious for being warped, it can be difficult to easily insert each spline into its corresponding channel, when a significant fraction of 2×4s or other dimensional lumber is warped, particularly where the channel is closed on all sides of a transverse cross section through the panel and channel. Flexible strips of OSB or similar material, or metal splines are far more easily inserted into the channels, as described herein, particularly where the channels are open along top or bottom edges of the panel (but are closed once the next panel is stacked thereon). In addition to wood splines, it will be apparent that metal or other splines (e.g., steel or aluminum, plastic, etc.) are of course also usable, e.g., where it may be desirable to avoid the use of wood.

The channels may include pairs of top and bottom channels, offset from the center of the thickness of the foam body, for use in providing horizontally extending I-beams at the top and bottom of each panel. For example, stacked panels may include an I-beam that is formed in-situ (or provided pre-formed), during construction of the wall, between such stacked panels. For example, as the panel is placed, the elongate splines are positioned in the top and/or bottom channels, another spline is positioned between such splines to form the central web portion of the I-beam (where the splines in the channels form the end flanges of the I-beam), and the next panel is stacked on top of the first panel. Of course, a pre-fabricated I-beam (e.g., formed of OSB, aluminum, or other suitable material) could also be similarly placed. The bottom channels of the second panel receive initially exposed portions of the splines forming the flanges of the I-beam inserted in the first panel, hiding these splines (and the I-beam) between and within the pair of stacked panels. It is advantageous that the splines run only one direction (e.g., horizontally) through the panel, without any transverse splines (e.g., vertical splines) required. It is also advantageous that the panel be of a consistent cross-section along its length (i.e., the cross-sectional shape does not change, as taken anywhere from one end to the other), which allows the panel to be easily formed by extrusion, or by hot wire CNC cutting, for example. While other panels exist, e.g., as disclosed in U.S. Pat. No. 2,202,783 to Morrell, such panels require placement of splines both horizontally and vertically, and necessarily include both horizontal and vertical channels within the panel to accommodate such splines. Where both horizontal and vertical channels are included in such a panel, it is impossible for the panel to include a transverse cross-section that remains consistent across its entire length, from one end to the other. As such, such panels cannot be formed by extrusion, or a simple single step hot-wire CNC cutting method, making them more expensive and complex.

The panels may optionally include one or more interior channels (e.g., for receipt of stiffening members, e.g., such as a furring strip), as well as a pre-cut slot in a first face of the modular panel, centered on the interior channel, where the pre-cut slot extends through the thickness of the foam at the first face of the panel, into the interior channel. In other words, such a narrow pre-cut slot may provide access into the channel from one exterior face of the panel. The width of such a pre-cut slot may be relatively thin, to ensure that a stiffening member (e.g., spline or furring strip) that may also be inserted into such interior channel remains restrained in the channel. For example, such a pre-cut slot may be no more than 0.25 inch, or no more than 0.125 inch wide, e.g., less than 20%, less than 15%, less than 10%, or less than 5% of the transverse cross-sectional length (e.g., a length of 2-6 inches may be typical) of the channel.

The opposite face of the modular panel may similarly include a pre-cut slot also aligned with an interior channel corresponding to the second (opposite) face of the panel, having similar characteristics as described above relative to the pre-cut slot in the first face of the panel.

When it becomes necessary to cut a modular panel (e.g., where a wall being built requires only a portion of the length of such a "full" panel), this is easily accomplished, as the panel may be formed from expanded polystyrene ("EPS") or another similar insulative foam material.

The panels themselves are cut on a CNC controlled hot wire cutting device, which is capable of making very precise cuts, so that the panels themselves are very accurate in their geometry (e.g., to within 0.001 inch). Thus, the panels may be of any desired thickness, e.g., as dictated by the particular desired wall thickness. For example, a foam panel thickness of 5.5 inches may be equal in width to a 2×6 (which is actually 5.5 inches wide, rather than 6 inches wide). By way of further example, a panel corresponding to 2×8 dimensions may be 7.25 inches thick. A typical 7.25 inch thick foam panel may include channels cut with the CNC device that are sized to accept ½ inch or ⅝ inch thick OSB ripped splines, having a width of typically 2-6 inches (e.g., 3-4 inches), although it will be apparent that such dimensions could be varied, as needed. Where aluminum or other material splines are used instead of OSB, they may be thinner, while still providing similar strength characteristics.

The various channels may be off-center relative to the thickness of the foam body, and parallel to one another. For example, the various first channels (at least one top, and one bottom) may be positioned closer to the first face of the foam body, and the various second channels (also at least one top and one bottom) may be positioned closer to the second face of the foam body. Any of such channels may be generally rectangular in cross-section, with a length (i.e., the channel's height) of the transverse cross-section rectangle oriented vertically, for desired orientation of the flexible splines therein. As described above, an exemplary panel may include a pair of spaced apart top channels, exposed at the top end of the panel, a pair of spaced apart bottom channels, exposed at the bottom end of the panel, and optionally, a pair of interior channels, between the top and bottom channels. All such channels may receive splines during wall construction, and are configured so that such splines received therein are not exposed at the large planar exterior faces of the panel. The splines in the top (or bottom) channels may initially be exposed, until covered by the next panel, which is stacked over the initially placed panel. For example, the uncovered portion of splines positioned in the top channels becomes received in the bottom channels of the next panel, stacked over the first panel. Walls, floors, and roofs can be constructed from such a series of repeating placement of panels, connected by the I-beam (or other shaped) splines between adjacent panels. Specially configured transition panels are also described herein, for making the transition from wall to floor, or from wall to roof, which transition panels include similar channels, for joining with the standard panels in the same manner (i.e., using the same I-beam or similar splines) as the standard panels are joined to one another.

For example, first and second top channels extend horizontally through the length of the body, with the first and second top channels being aligned above the first and second interior channels, respectively (if interior channels are even present). There may also be provided first and second bottom channels extending horizontally through a length of the body, where the first bottom channel is aligned with and below the first top channel, and the second bottom channel is aligned with and below the second top channel. The top and bottom channels may be exposed and open at their top and bottom edges respectively, of the body. Each of the top and bottom channels may be generally rectangular in cross section, with the length of the transverse cross-section rectangle oriented vertically, so that each top and bottom channel is configured to also receive a flexible elongate spline therein. For example, where I-beam splines are used, the channels receive a portion of (e.g., one end of) flanges of such an I-beam. The central web of such an I-beam lays on the top (or bottom) edge of the panel, while the other portion of the flanges (the opposite end) is received in the adjacent panel, as the panels are stacked (in a wall) or laid adjacent to one another (in a roof or floor).

The panel may be configured to provide a horizontal I-beam at the top and bottom of the panel, so that the splines (or portions thereof in the case of a pre-assembled I-beam) in the top channels become flanges of such a top positioned I-beam, and the splines (or portions thereof in the case of a pre-assembled I-beam) in the bottom channels become flanges of a bottom positioned I-beam. A web center portion of each I-beam member can be positioned on a top (or bottom) edge of the foam body, so as to be positioned between the splines inserted in the top (or bottom) channels, so as to form I-beams at the top and bottom edges of the foam body. Such a construction results in horizontal I-beams running horizontally through the wall (or floor, or roof) being constructed with such a building system. The panels can be positioned between adjacent vertical post members, such that there is actually no need at all for vertical stud members within the panels of the wall construction, although the building system is still fully compatible with existing building codes.

The present disclosure also relates to wall systems, as well as methods of construction that use modular panels such as those described herein. For example, such a wall system may include a plurality of modular panels such as those described herein, in combination with a plurality of flexible splines that may serve as interior splines, as well as forming the horizontally extending I-beam members at the top and/or bottom of each panel. The modular panels are typically of a size such that they will not provide the entire height of a typical wall or room being constructed (e.g., they may only be 2 or 4 feet high), but it will typically be required to stack such panels one on top of another to achieve a desired wall height. The top and bottom exposed channels of each panel may be of a depth such that they only receive a portion (e.g., about half) of the width of the spline being received therein, which forms the flange of the I-beam member. The adjacent channels of the next adjacent channel may receive the other portion of the spline (I-beam flange). In other words, the top exposed channels may receive the bottom portion (e.g., bottom half) of the splines that form the flanges of the I-beam member positioned at the top of that panel, while another panel is positioned directly over the web of the I-beam member at the top of the first panel, into which the top portion (e.g., top half) of the splines that form the flanges of the I-beam member are also received. This arrangement may be repeated as necessary, depending on the desired wall height.

Another advantage of the present systems is that because the horizontal splines (or entire I-beam) are generally restricted to movement within a single degree of freedom (only along the longitudinal direction of the channel—horizontally, either left to right), once the wall is assembled, it is not necessary that the splines inserted into a given channel be of a single, unitary piece of spline material. For example, scraps of OSB or other spline materials may be advanced or inserted into the channels, to make up the needed spline length. Such ability reduces on-site construction waste, as such small spline lengths may be simply pushed sequentially into the channel, forming the needed spline. There may even be no need to attach such small spline segments together in at least some cases, although they could be attached to one another (e.g., glued, nailed, screwed, or the like) if desired. For example, they may simply become trapped in the interior channels of the panel, between adjacent posts of the wall. Post members positioned between panels may be formed of dimensional lumber, or other standard dimensional material, steel, etc. For example, in an embodiment, a frame is formed, providing the overall shape of the building (e.g., from steel, aluminum, or other standard dimensional material), and then the panels are then used to fill in the space between such frame members, forming the walls, floor, and roof. I-beam or other splines extend between (e.g., horizontally) adjacent panels. Ear brackets or the like can be used to connect the spline within the panel channels to the adjacent frame member (i.e., so that the spline (including the ear bracket) extends beyond the panel, for integration/attachment to the post positioned between adjacent side-by-side panels). Specially configured transition panels provide transitions between wall-to-floor, and wall-to-roof, where the transition panels include the same channel structures, to connect to the adjacent standard panel (of the wall, floor or roof) in the same manner (panel connected to I-beam spline, connected to adjacent panel).

As mentioned, the present building systems may include a specially configured transition panel for making a transition from a wall (e.g., constructed using the standard panels described herein) to a roof structure, or from a wall to a floor (which can also be constructed using the standard panels). In an embodiment, the roof and/or floor may similarly be constructed of the same standardized panels as the wall. Such transition panels are similarly lightweight (e.g., formed from EPS foam). The wall-to-roof transition panel may be formed as a single piece of lightweight foam material, forming a transition between the wall structure and the roof structure. The wall-to-roof transition panel may similarly include channels for receiving splines as the standard wall panels described herein, for providing a horizontally extending I-beam between the wall-to-roof transition panel and the top standard panel of the wall structure below. The wall-to-roof transition panel may include another pair of exposed channels for receiving splines, for forming an I-beam between the wall-to-roof transition panel and the adjacent roof panel (which may be a standard panel, identical or similar to the standard wall panel).

Such a wall-to-roof transition panel may dictate the pitch of the roof structure, by having the desired pitch built into the panel, as the angle between the channels that engage with the adjacent wall panel (in a wall leg of the transition panel), and the channels that engage with the adjacent roof panel (in a roof leg of the transition panel).

The wall-to-roof transition panel may also include any desired overhanging eave structure that overhangs the underlying wall structure. Such transition panel includes the eave, with a desired eave length. It is advantageous to be able to provide such an eave as part of the single piece transition panel (e.g., rather than assembling an eave from numerous components that are typically nailed/screwed together). In an embodiment, the wall-to-roof transition panel may include additional slots or channels into which stiffeners (e.g., OSB, aluminum, or other material) could be inserted. For example, such slots or channels (used interchangeably) could be positioned in the overhanging eave portion of the panel so that when such stiffeners are inserted, they strengthen the foam in the eave portion of the panel, or provide an underlying attachment point, reducing any risk of damage to the eave. Such eave slots may run parallel to the other channels of the panel (e.g., horizontally). Such furring slot may be of any desired cross-sectional geometry (e.g., an I-beam shape, H-shape, C-shaped, L-shaped, or the like).

A wall-to-floor transition panel may similarly be provided, for providing a transition from standard panels used in constructing a wall, to standard panels used in constructing a floor. Such a wall-to-floor transition panel may include a top portion that is identically configured to the standard panels, with channels at a top edge of the panel, for receipt of flanges of an I-beam spline therein. Rather than positioning the bottom channels in the bottom edge of the wall-to-floor transition panel, the bottom channels may be in the major face of the panel, at a lower portion thereof, for engagement with a corresponding I-beam spline. It is important that even though the bottom channels are in the major planar face of the wall-to-floor transition panel, they are at a position where they will not be exposed on the planar face, once the wall-to-floor transition panel is connected to an adjacent standard panel of the floor (which receives the other portion or half of the flanges of the I-beam spline, as the wall-to-floor transition panel is connected to the first standard panel of the floor.

Differences necessary to accommodate any desired wall height (which may not be a multiple of the standard panel height (e.g., 2 feet) can be accommodated by adjusting the height of the wall-to-floor transition panel, and/or by adjusting the height of the wall leg of the wall-to-roof transition panel. It will be apparent that a wall is formed by a wall-to-floor transition panel (at the bottom of the wall), any desired number of standard panels stacked one on top of another, capped by a wall-to-roof transition panel (at the top of the wall). Between each panel is the I-beam or other spline, connecting the adjacent panels, for example, with the bottom portion of the flanges (below the web) of the I-beam in the channels of the lower panel, and the top portion of the flanges (above the web) of the I-beam in the channels of the upper panel (i.e., that panel stacked on top of the lower panel). This same structure is used, whether the adjacent panels are two standard panels adjacent to one another (e.g., in the roof, walls, or floor), or the two adjacent panels are a wall-to-floor transition panel adjacent to a standard panel (at the bottom of the wall), or the two adjacent panels are a wall-to-roof transition panel adjacent to a standard panel (at the top of the wall).

The above described wall-to-floor transition panel may be L-shaped. A T-shaped wall-to-floor transition panel is also possible, e.g., for use in constructions where a transition from a lower floor to an upper floor is desired. Such a T-shaped wall-to-floor transition panel may include two wall legs (e.g., each 180° apart), with a floor leg therebetween (e.g., at 90° relative to the wall legs). Each of the wall legs and the floor leg may similarly include the described channels, to allow such legs to be mated to adjacent standard panels (forming the lower story wall, the upper story wall, and the upper floor).

It will be apparent that methods of construction may involve (i) providing a frame that defines an overall shape for the building; (ii) installing a spline so as to span between two frame members of the framed (e.g., using ear brackets to extend the length of the spline); (iii) installing a wall-to-floor transition panel between the two frame members, with the spline of (ii) at least partially engaged in a channel of the wall-to-floor transition panel; (iv) installing a standard modular panel adjacent the wall-to-floor transition panel of (iii), with at least a portion of the spline of (ii) engaged in a channel of the standard modular panel, so that the spline of (ii) joins the wall-to-floor transition panel with the adjacent standard modular panel, with the spline of (ii) engaged in opposed facing channels of the wall-to-floor transition panel and the standard modular panel; (v) installing another of the plurality of splines in another channel on an opposite end of the standard modular panel of (iv), followed by installation of any number of a series of additional standard modular panels and splines, until reaching another transition, from wall-to-floor, where another wall-to-floor transition panel is installed; (vi) installing a spline into a top channel of the wall-to-floor transition panel of (v); (vii) installing any number of a series of additional standard modular panels and splines to form a wall, until reaching another transition, from wall-to-roof, where a wall-to-roof transition panel is installed, the wall-to-roof transition panel dictating a roof pitch and shape and length of an eave associated with the roof of the building; and (viii) installing a spline in a roof leg of the wall-to-roof transition panel, and installing any number of a series of additional standard modular panels and splines to form a roof.

Where the roof is a pitched roof (e.g., not a flat roof, at 90° to the wall), a roof cap transition panel may also be employed, at the apex of such a pitched roof, with the roof cap transition panel at the apex, with standard panels on either side thereof, sloping downward, with the same spline-panel-spline arrangement as any of the other panels. While the steps are identified above with roman numerals, it will be appreciated that the steps may be performed in numerical order, or in another order, if desired.

Another embodiment employs standard modular panels for the walls, floor, and roof, as well as wall-to-floor transition panels, and wall-to-roof transition panels, with C-channel frame members used as splines for placement between adjacent panels. Each standard panel (as well as the various transition panels) may include a body, and one or more channels extending through a length or width of the panel, each channel being configured to receive an elongate spline therein, wherein each elongate spline once received in the channel is disposed within the body, so that the elongate spline is restrained once received within the channel. The flange received in the channel may not be disposed on a major face of the panel, although where two flanges are present (e.g., as in a C-channel member), one flange may be received in the channel, while the other wraps around the edge of the panel (so as to be exposed on a major face of the panel), as will be shown. In any case, the splines are received within a channel of the body of the modular panel, and the splines can be flanges of a C-channel frame member or back-to-back C-channel frame members that form an I-beam that runs vertically along a length of the modular panel.

In such a system each wall-to-floor transition panel can be configured for transitioning from a wall to a floor in a building construction, the wall-to-floor transition panel being configured to be positioned between one or a stack of the modular panels forming a wall, and one or more of the modular panels that form a floor structure. The wall-to-floor transition panel includes (i) a floor leg or a floor connection portion where a floor panel is attachable and (ii) a wall leg where a wall panel is attachable, where the floor leg or floor connection portion is at an angle (e.g., 90° or other desired angle) relative to the wall leg. A wall-to-roof transition panel can also be provided for use in transitioning from a wall to a roof in a building construction, the wall-to-roof transition panel being configured to be positioned between one or a stack of the modular panels forming a wall, and one or more of the modular panels that form a roof structure. The wall-to-roof transition panel includes (i) a roof leg or a roof connection portion and (ii) a wall leg or a wall connection portion, which are at an angle relative to one another, a vertical length of the wall leg or wall connection portion accommodating an increased height to the wall by including a vertical length that adds to a height of the wall, the angle between the roof leg or roof connection portion and the wall leg or wall connection portion dictating a roof pitch or angle associated with the roof.

Associated progressive methods of construction are also described herein, e.g., whereby installation of panels (or stacks or rows of panels) are installed alternating with installation of associated C-channel frame members. For example, a foam panel (or stack or row of such panels), is installed, followed by installation of a C-channel member, with the flange of such member engaged in the panel(s), followed by installation of an adjacent panel (or row or stack of panels), before installation of the next, adjacent C-channel member. Such alternating placement of panels and frame members eliminates the need for a tape measure, the need for any independent frame for the building, and ensures the walls, floor, and roof are square and plumb, as the precision machined panels ensure these requirements are met.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The drawings illustrate several embodiments of the invention, wherein identical reference numerals refer to identical or similar elements or features in different views or embodiments shown in the drawings.

FIG. 13 shows several transition panels, including a roof cap transition panel for transitioning from one side of a pitched roof apex to the other side; a wall-to-roof transition panel for transitioning from a wall to a roof; and a wall-to-floor transition panel for transitioning from a wall to a floor. A spline configured as an I-beam is also shown, e.g., for positioning between each given pair of panels (whether standard panel to standard panel, or standard panel to transition panel).

FIG. 14 illustrates a frame of the building system supported on pier footings.

FIG. 15 shows attachment of a spline between horizontal frame members (using ear brackets of the spline, or ear brackets attached to the spline), and positioning of the wall-to-floor transition panel for attachment to such spline.

FIG. 16 is similar to FIG. 15, after the flanges of the I-beam spline have been received into the corresponding slots of the wall-to-floor transition panel.

FIG. 17 shows positioning of a standard panel, as the first floor panel, positioned adjacent to the wall-to-floor transition panel, with the I-beam spline between the two panels (with flanges on either side of the I-beam received into slots of each of the corresponding panels).

FIG. 18 illustrates construction of the remainder of the floor, with standard panels, coupled together by splines between each adjacent pair of panels, with the splines attached by ear brackets to the horizontal frame members.

FIG. 19 shows another wall-to-floor transition panel being positioned at the opposite end of the floor, for transitioning to a wall.

FIG. 20 shows the same configuration as FIG. 19, with the wall-to-floor transition panel now in place.

FIG. 21 shows an I-beam spline positioned into the top channels of the wall-to-floor transition panel, in preparation for placement of a standard panel thereover, for construction of the wall.

FIG. 22 shows a top standard panel of the wall in place, at the top portion of the wall, with a wall-to-roof transition panel being positioned for placement thereover, for providing a transition from the wall to the roof. In FIG. 22, a spline is being inserted into a furring channel in the free eave end of the eave portion of the wall-to-roof transition panel.

FIG. 23 is similar to FIG. 22, with the spline now inserted into the furring slot of the eave portion of the transition panel, showing the transition panel ready for positioning over the top standard panel (and its accompanying spline) of the wall, for providing a transition from the wall to the roof.

FIG. 24 is similar to FIG. 23, but shows the wall-to-roof transition panel now in place, with its wall leg (e.g., vertical wall leg) coupled by the spline, to the top-most standard panel of the wall.

FIG. 25 shows both sides of the pitched roof having been constructed with standard panels, joined together by I-beam splines (with the splines attached to the truss members of the frame, by ear brackets), ready for capping of the apex by the roof cap transition panel.

FIG. 26 shows one side of the roof cap transition panel positioned for mating with one side of the pitched roof structure, with the opposite side ready for rotation downward, for mating with the other side of the pitched roof structure.

FIG. 27 shows the apex of the roof, after the roof cap transition panel is in place, forming the roof apex, joining together the standard panels that form either side of the pitched roof.

FIG. 28 shows the completed building construction.

FIG. 30 shows formation of a continuous concrete footing in a frost foam form.

FIG. 31 shows erection of an endwall frame using C-channel frame members over an end of the continuous concrete footing.

FIG. 32 shows installation of foam modular wall panels prior to sliding vertical C-channel frame members into slots of the foam modular wall panels. As shown, the two wall frames assemblies (back-to-back C-channel frame members) are mirror images of one another (with one short and one longer C-channel frame member, oriented back-to-back).

FIG. 33 shows installation of foam modular floor panels as one end of a C-channel floor frame member is connected to one side of one of the wall frame assemblies, allowing the modular floor panels to be slid in place from the wide end, where the C-channel floor frame member is unattached, towards the narrow end, where the C-channel floor frame member is attached.

FIG. 34 shows installation of a wall-to-roof transition panel at the top of one of the stack of modular wall panels.

FIG. 35 shows connection of one end of the wall frame assembly to a C-channel roof frame member, with the opening of the C-channel oriented towards the opening of the C-channel of the roof frame member of the endwall frame of FIG. 31. FIG. 35 also shows installation of a temporary support ledger to support the C-channel roof frame member that is rotated out of parallel relative to the C-channel roof frame member of the endwall frame, to facilitate insertion of the roof modular foam panels for sandwiching them between the C-channel roof frame member of the endwall frame, and the adjacent C-channel roof frame member.

FIG. 36 shows the configuration of FIG. 35, once the full row of roof modular foam panels have been slid into place, and the wall-to-roof transition panel at the opposite stack of wall panels is installed.

FIG. 37 shows attachment of an extension portion of the roof C-channel frame member, which forms the eave.

As shown in FIG. 38, the steps associated with FIGS. 32-37 are repeated, as necessary, to add additional sections (wall sections, floor sections, and roof sections) to the building. Typical frame spacing may be 4 feet, although of course other spacings are possible.

FIG. 39 shows placement of purlins (e.g., wood or metal) to which roofing material (e.g., shingles, sheet metal, etc.) can be attached. The top of the purlins are flush with the top of the foam roof panels.

FIG. 58 shows positioning of the base of a frost foam form over a compacted pea gravel base.

A corner of a sheet of plywood, OSB or similar square material can be used to ensure that the horizontal and vertical C-channel frame members are square.

Figure 75:
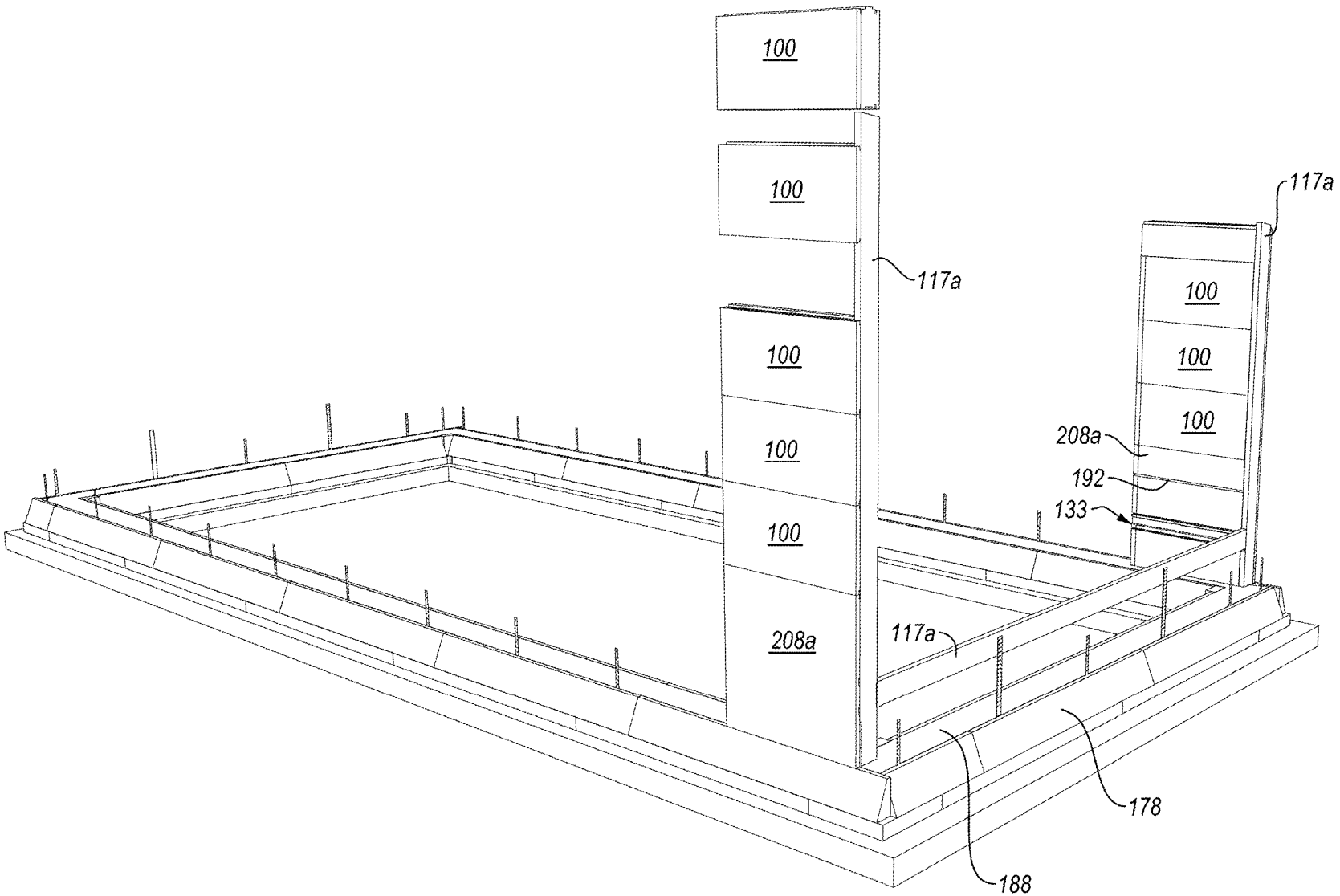

FIG. 75 shows placement of additional wall panels.

Figure 76:
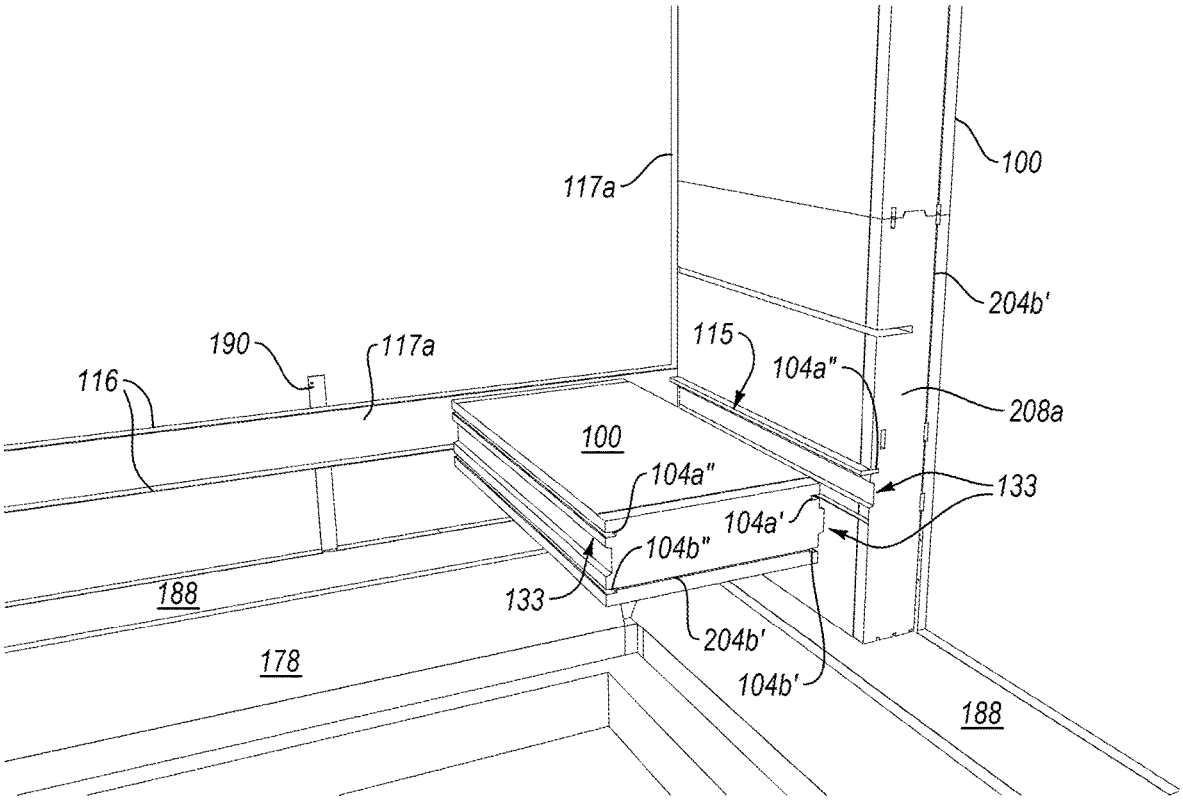

FIG. 76 shows placement of a furring strip into a channel of the transition panel, and positioning of a first standard floor panel (the same as a standard wall panel) for attachment to the transition panel and the horizontal C-channel frame member.

Figure 77:
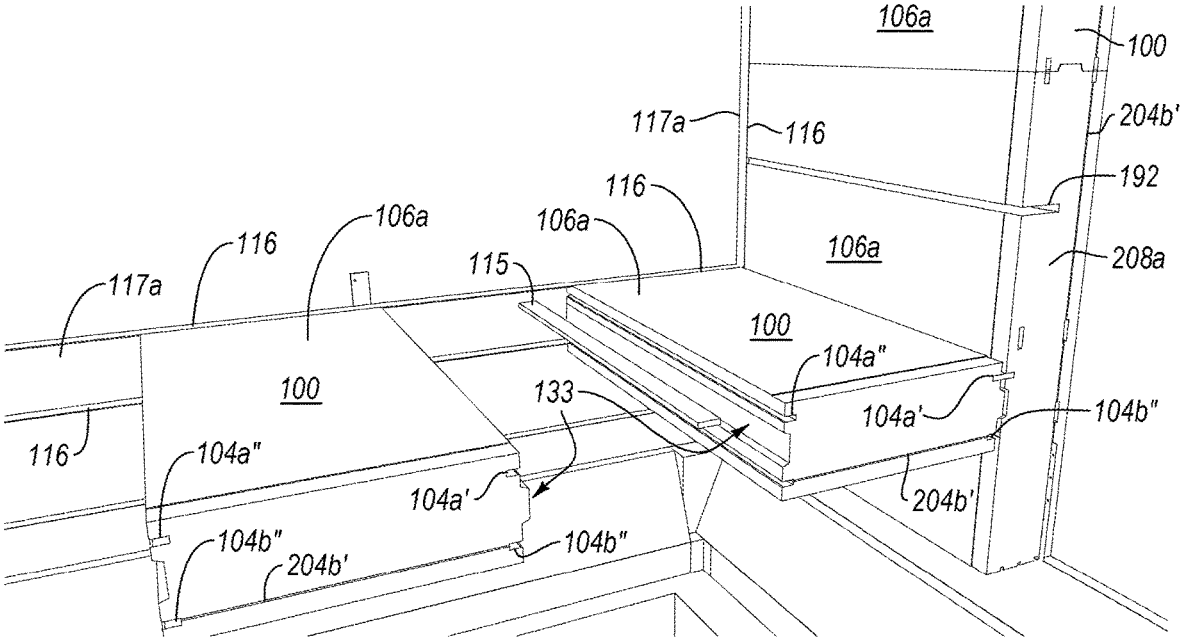

FIG. 77 shows positioning of a next furring strip for receipt into channels of the standard floor panels, as well as positioning of a next standard floor panel.

Figure 78:
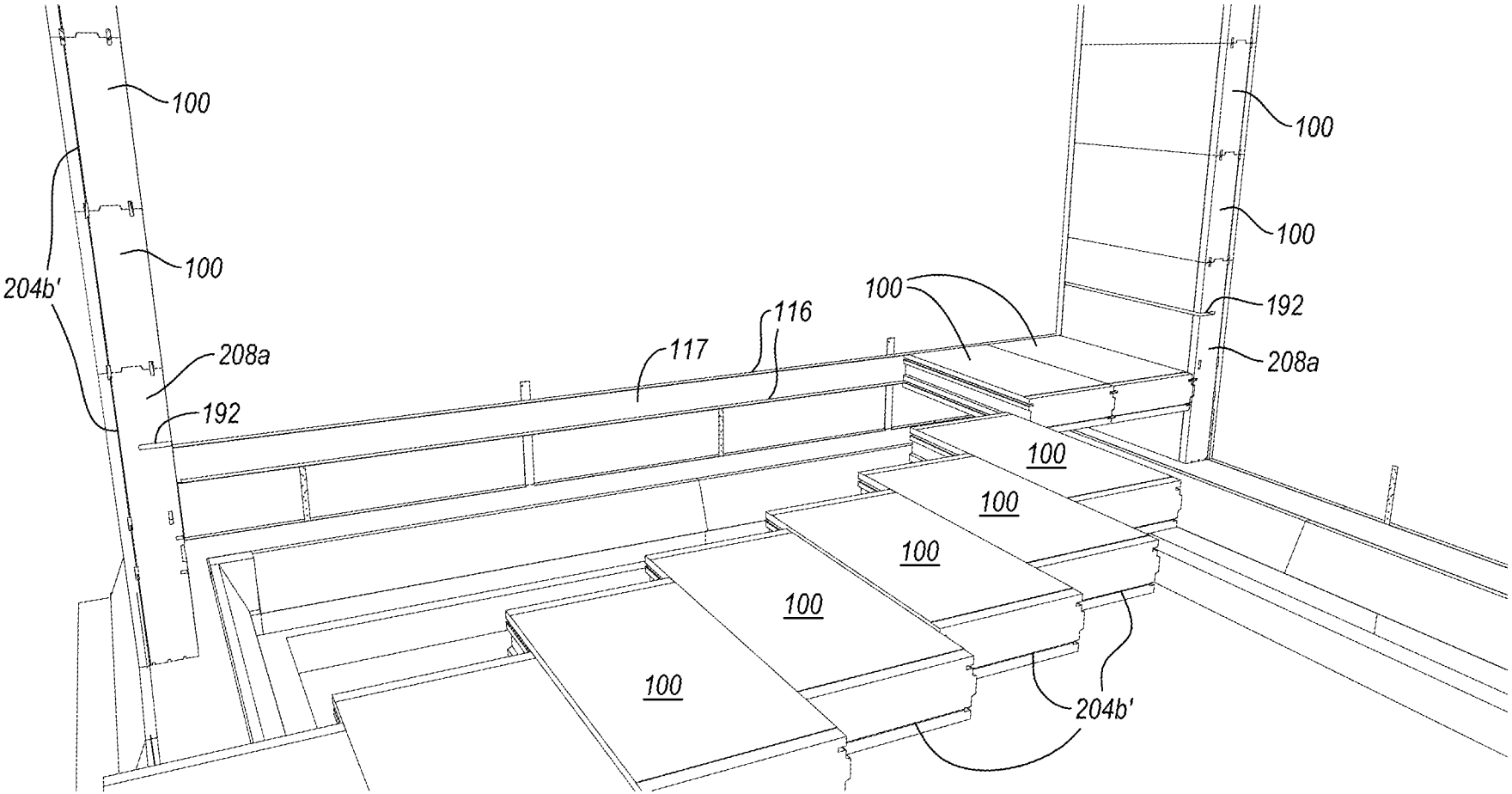

FIG. 78 shows positioning of additional floor panels (and furring strips) for attachment to the horizontal C-channel member of the floor. The top flange of the horizontal C-channel member wraps over the top face of the standard floor panels, while the bottom flange of the horizontal C-channel member is received into a corresponding channel formed into a bottom portion of the standard floor panels.

Figure 79:
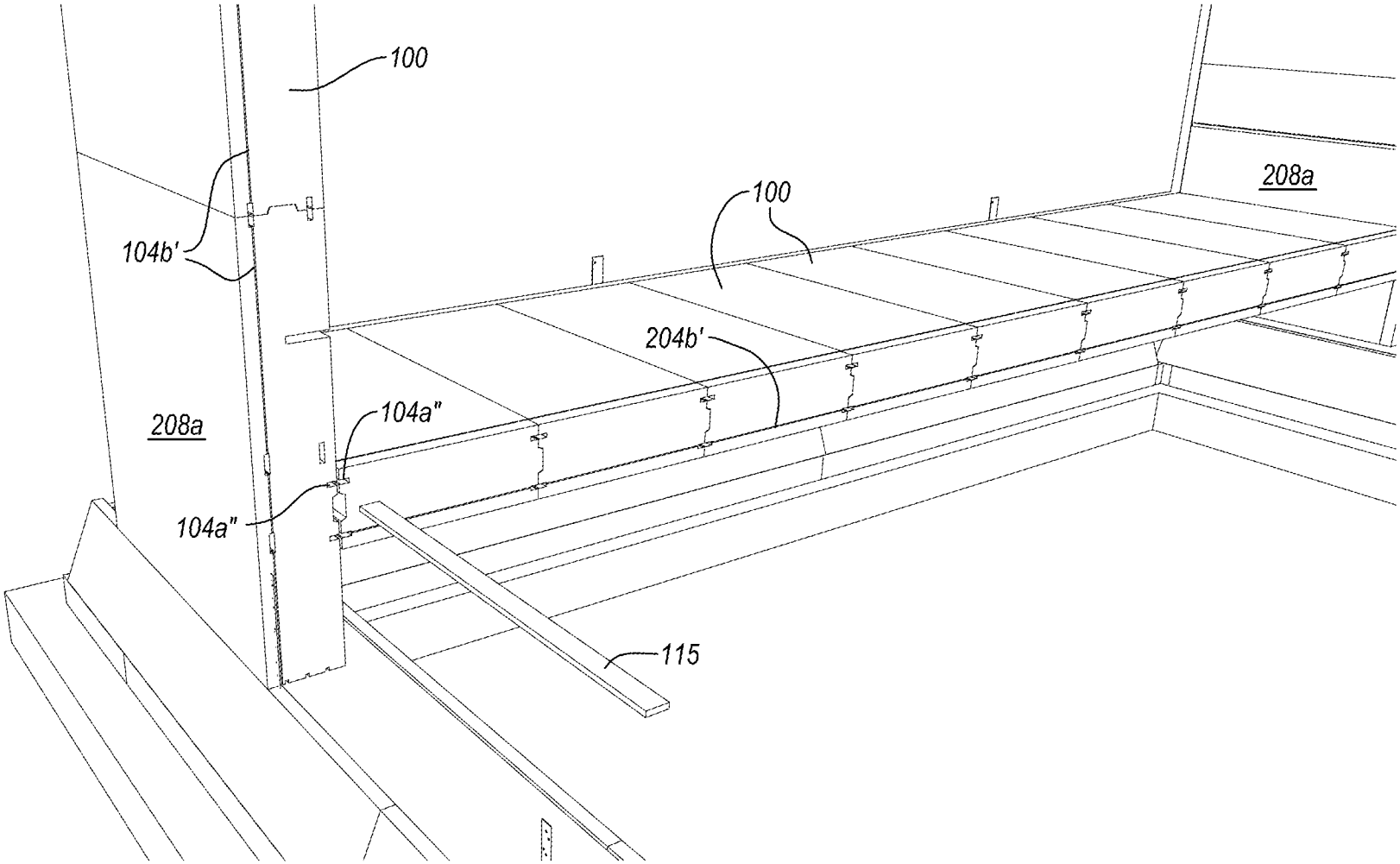

FIG. 79 shows insertion of a final furring strip of the row of floor panels, connecting the final floor panel of the row to the opposite wall-to-floor transition panel, with the furring strip received into corresponding channels of the floor panel and the wall-to-floor transition panel.

Figure 80:
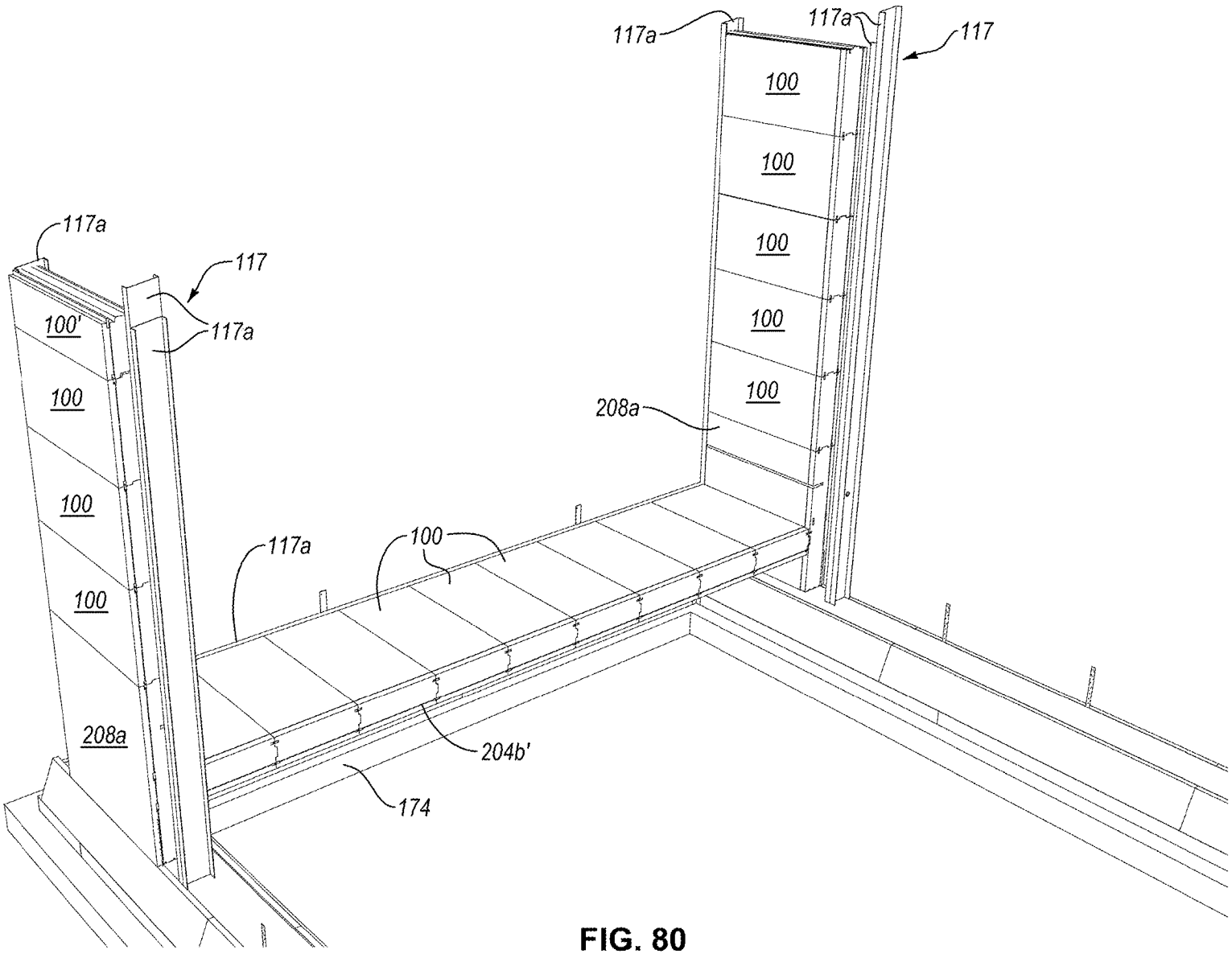

FIG. 80 shows positioning of vertical back-to-back C-channel frame members (forming I-beams) between stacks of wall panels forming the wall.

Figure 81:
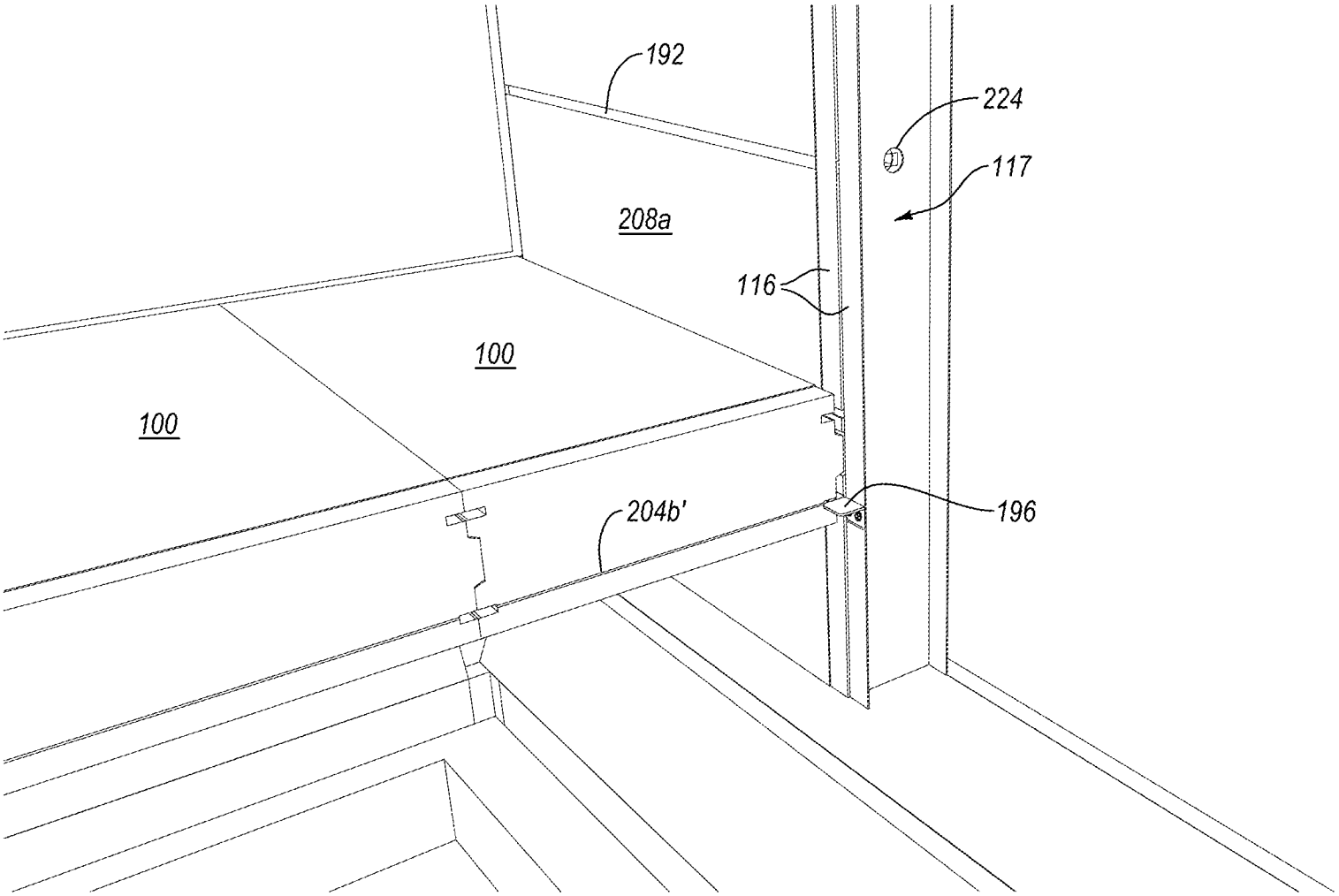

FIG. 81 shows engagement of the vertical I-beams into the stack of panels of the wall. It will be noted that one of the vertical C-channel members of each back-to-back pair is taller than the other, to facilitate attachment of roof I-beam frame members (formed from back-to-back C-channel members), as will be explained hereafter.

Figure 82:
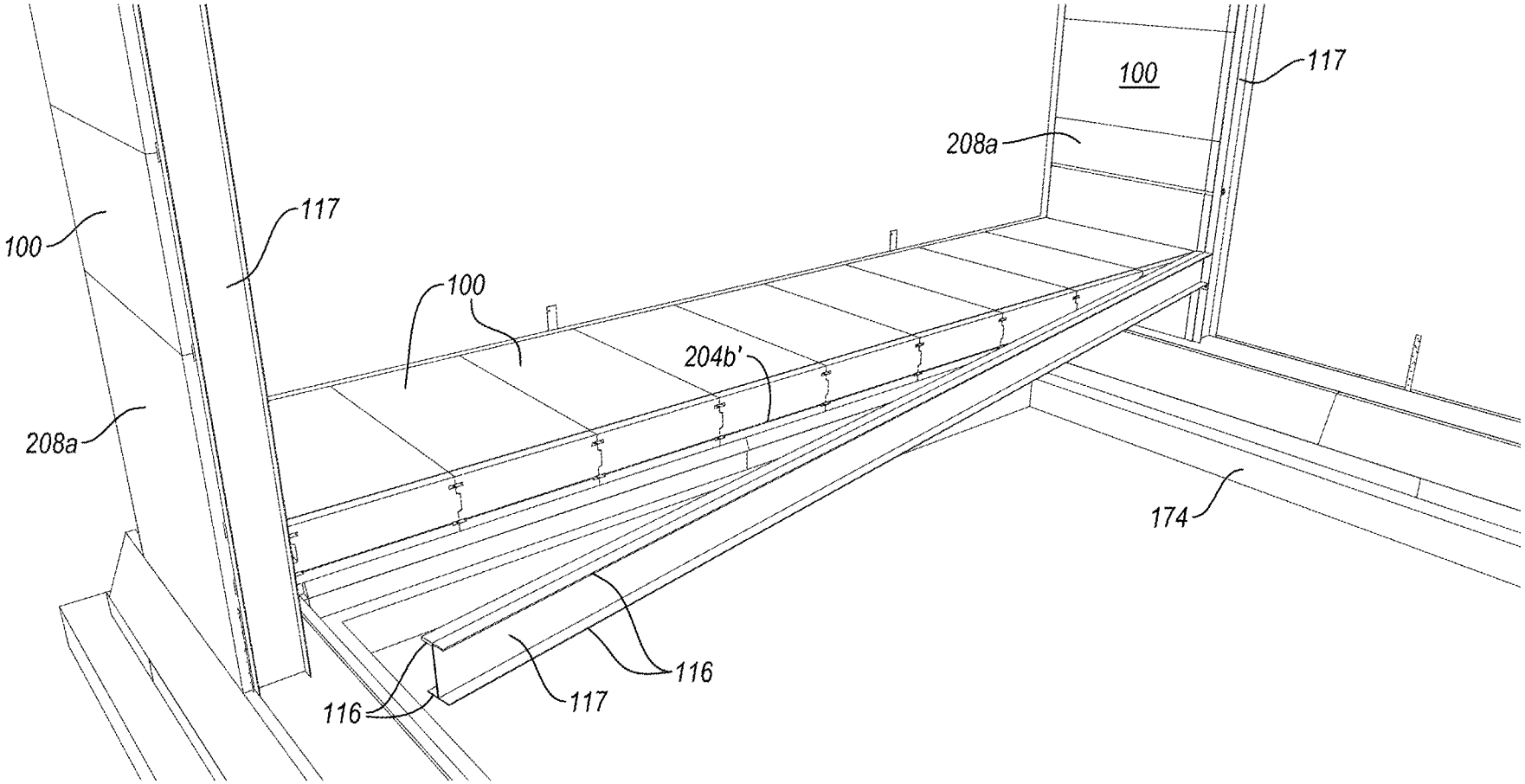

FIG. 82 shows positioning of a floor I-beam (formed from back-to-back C-channel frame members) in preparation for positioning another row of floor panels, to form another floor section.

Figure 83:
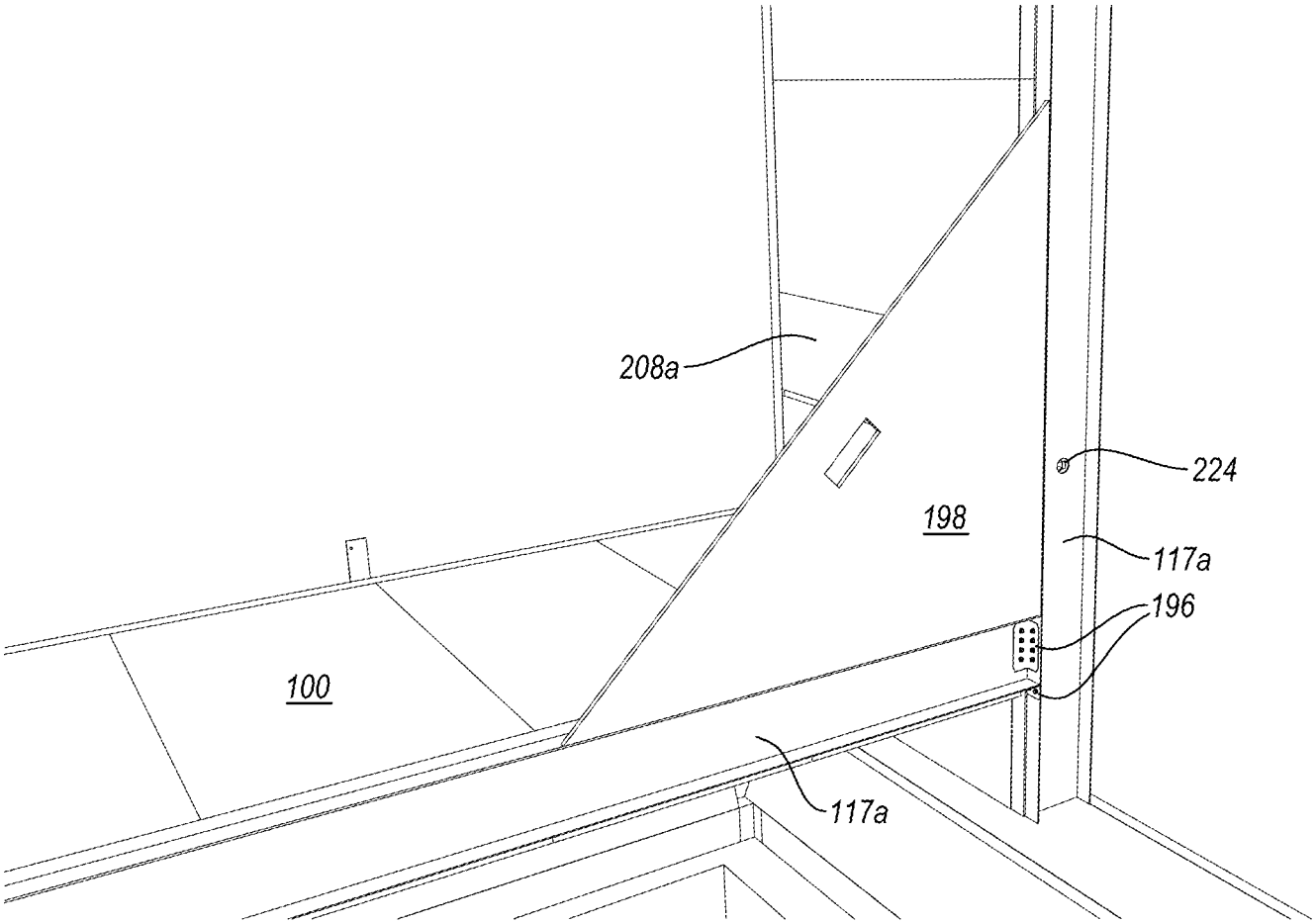

FIG. 83 shows use of an ear bracket to attach the horizontal floor C-channel frame members to the vertical wall C-channel frame members. FIG. 83 also shows use of a corner of a sheet of plywood, OSB or similar square material and a level to ensure that the horizontal and vertical C-channel frame members are square. A hole in the vertical C-channel frame member is also is provided so as to be aligned with the pre-cut electrical cutout (for electrical outlets) of the wall-to-floor transition panel.

Figure 84:
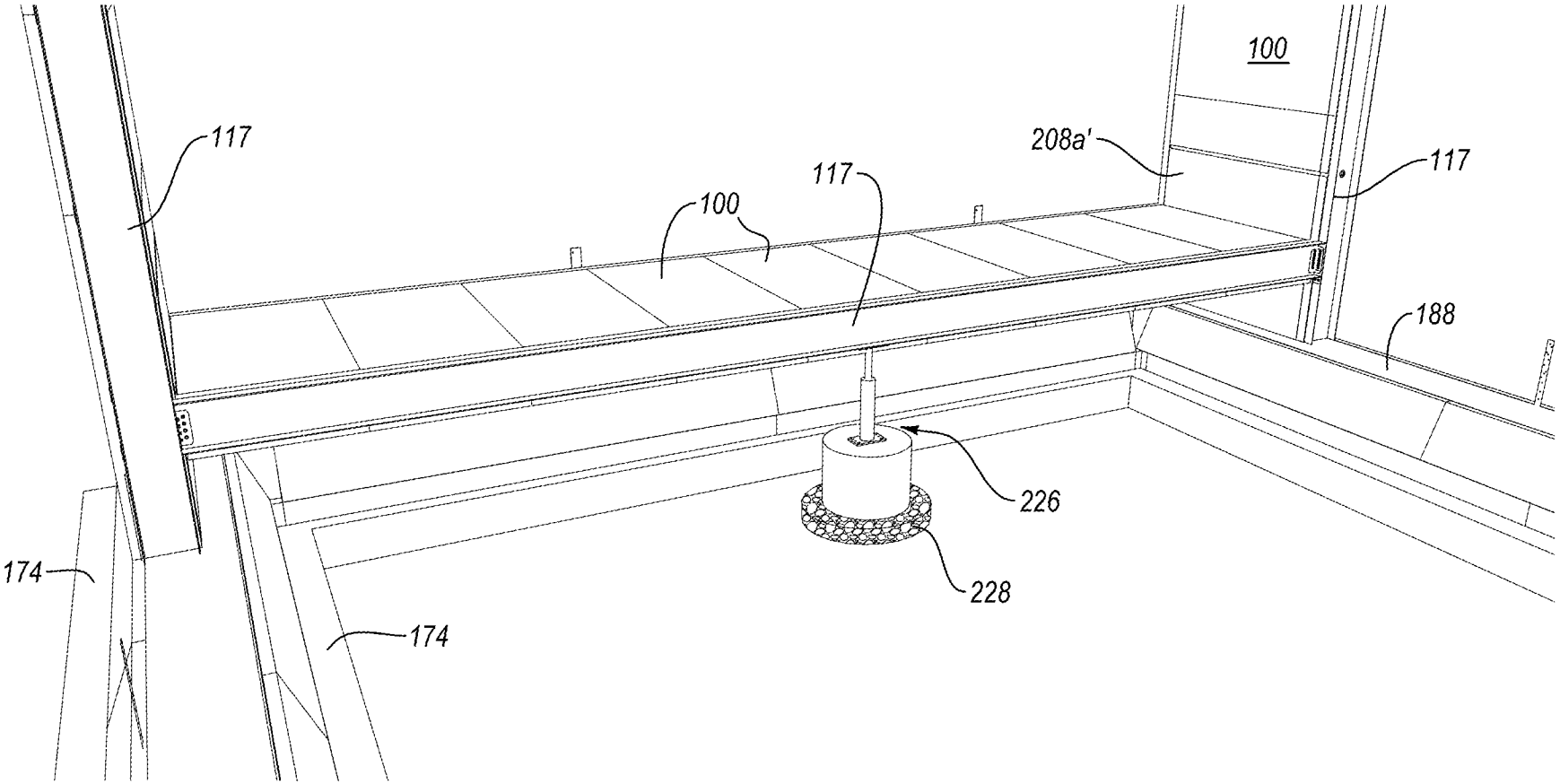

FIG. 84 shows positioning of an adjustable floor jack in e.g., a center of the floor span, if needed, to support floor spans of greater than 14 feet. A spot footing may be provided under any such optional adjustable floor jack. The floor jack may engage with the corresponding above located floor I-beam member.

Figure 85:
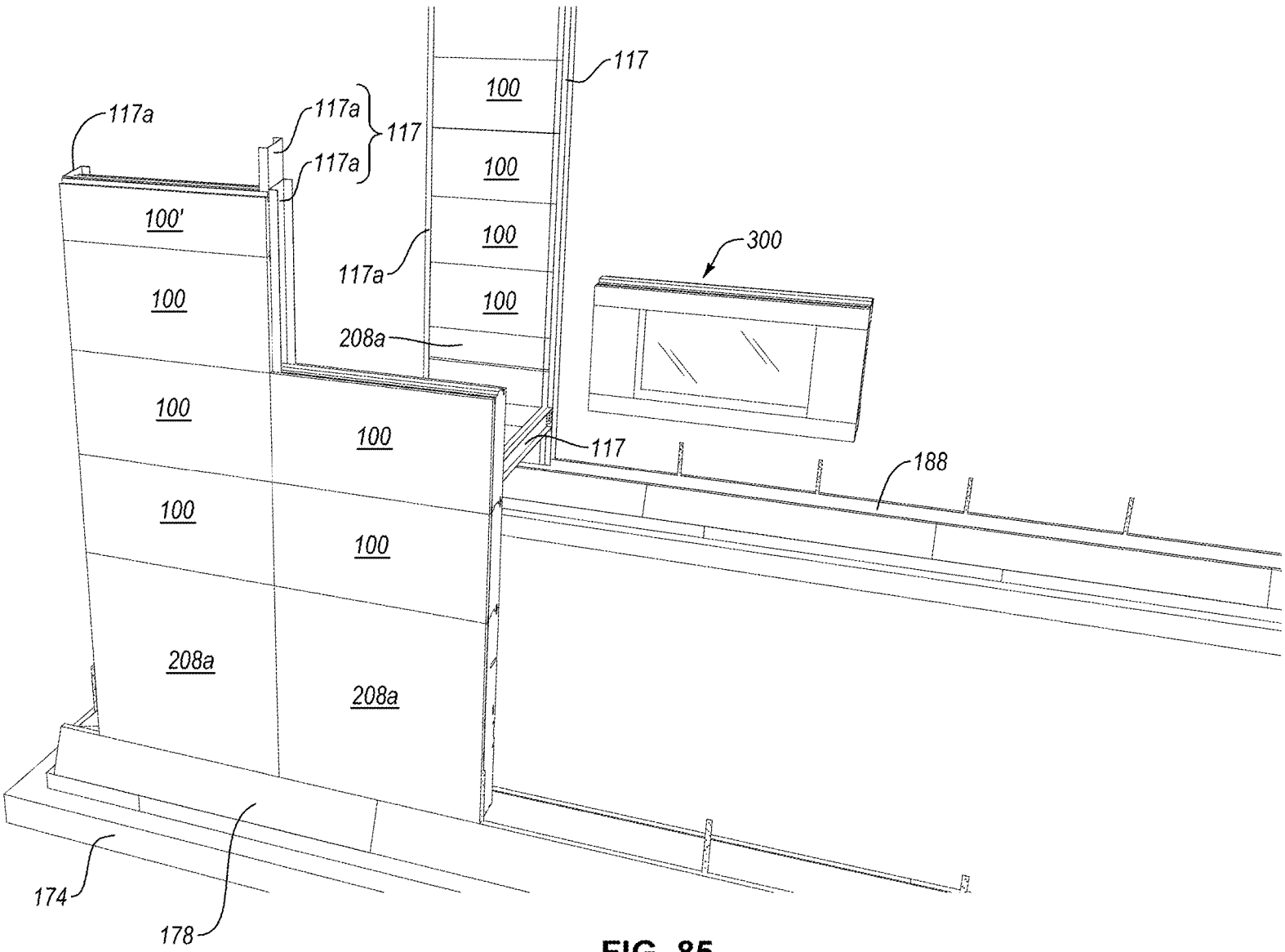

FIG. 85 shows placement of additional wall panels (e.g., another wall-to-floor transition panel, and associated standard wall panels). FIG. 85 also shows positioning of a specialized window module that takes the place of any desired panel(s), where a window is to be placed. Such specialized functional modules may be used for placement of windows, doors, or other desired structures (e.g., plumbing, electrical or other modules for sinks, toilets, ovens, or the like).

Figure 86:
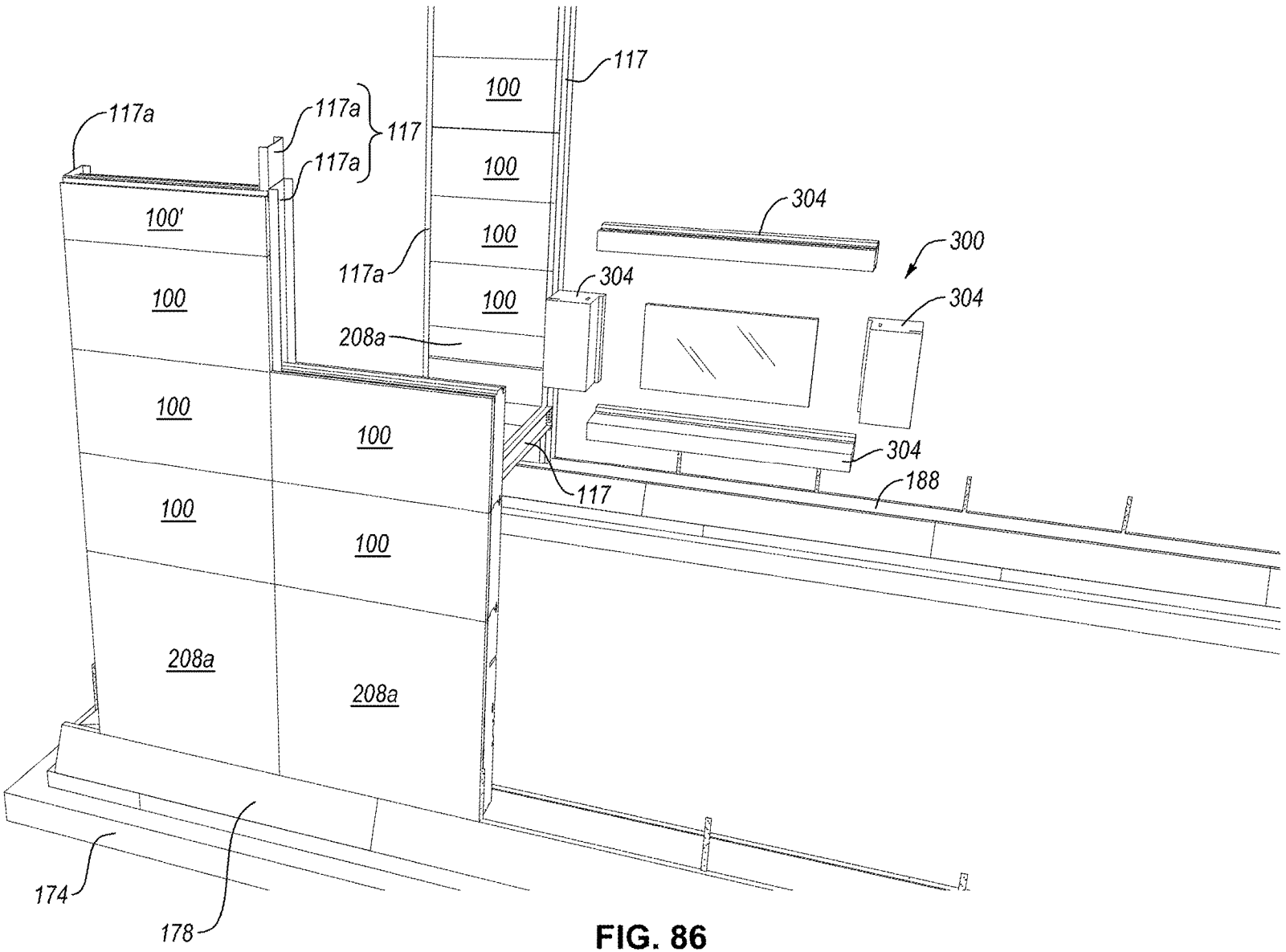

FIG. 86 shows the window module of FIG. 85 in an exploded configuration, showing how it can be formed from pane(s) of window glass surrounded by appropriate foam, so that the exterior surfaces (particularly the top and bottom surfaces, and the right and left edges) include the same channels and other structure as any other modular panel that the specialized panel is replacing, allowing such a window module (or other functional module) to simply replace one or more standard panels (or combination of transition panel (s) and standard panels). For example, the window module panel of FIG. 85 is sized identical to a standard 2'×4' wall panel, with identical channels and other features on the 4 minor surfaces thereof, so that such surfaces function identically to any other standard wall panel.

Figure 87:
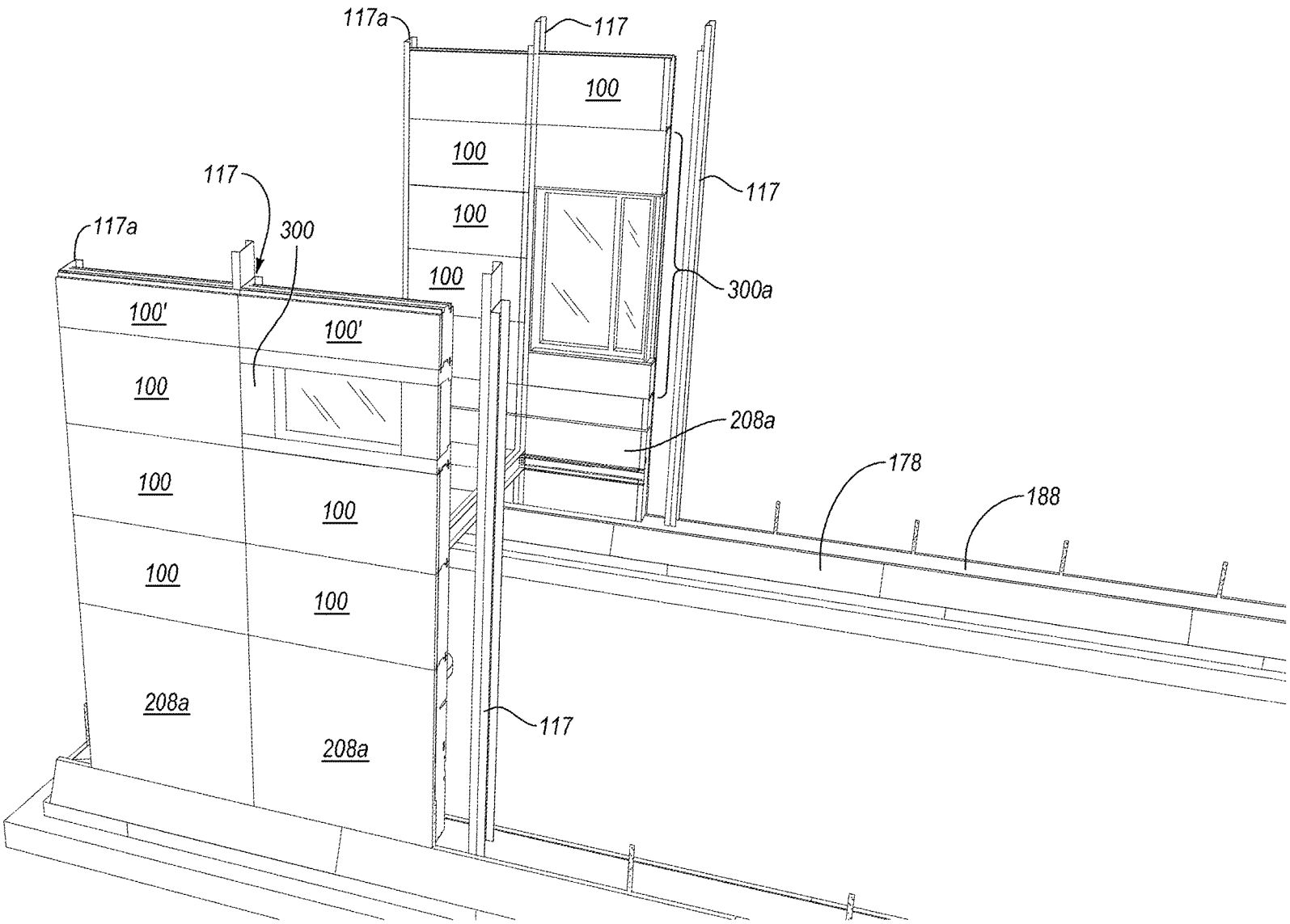

FIG. 87 shows completion of the wall stack of panels shown in FIG. 85, incorporating a window module panel, while also showing positioning of vertical I-beam members between adjacent stacks of wall panels. FIG. 87 also shows completion of the opposite stack of wall panels, also incorporating a window module.

Figure 88:
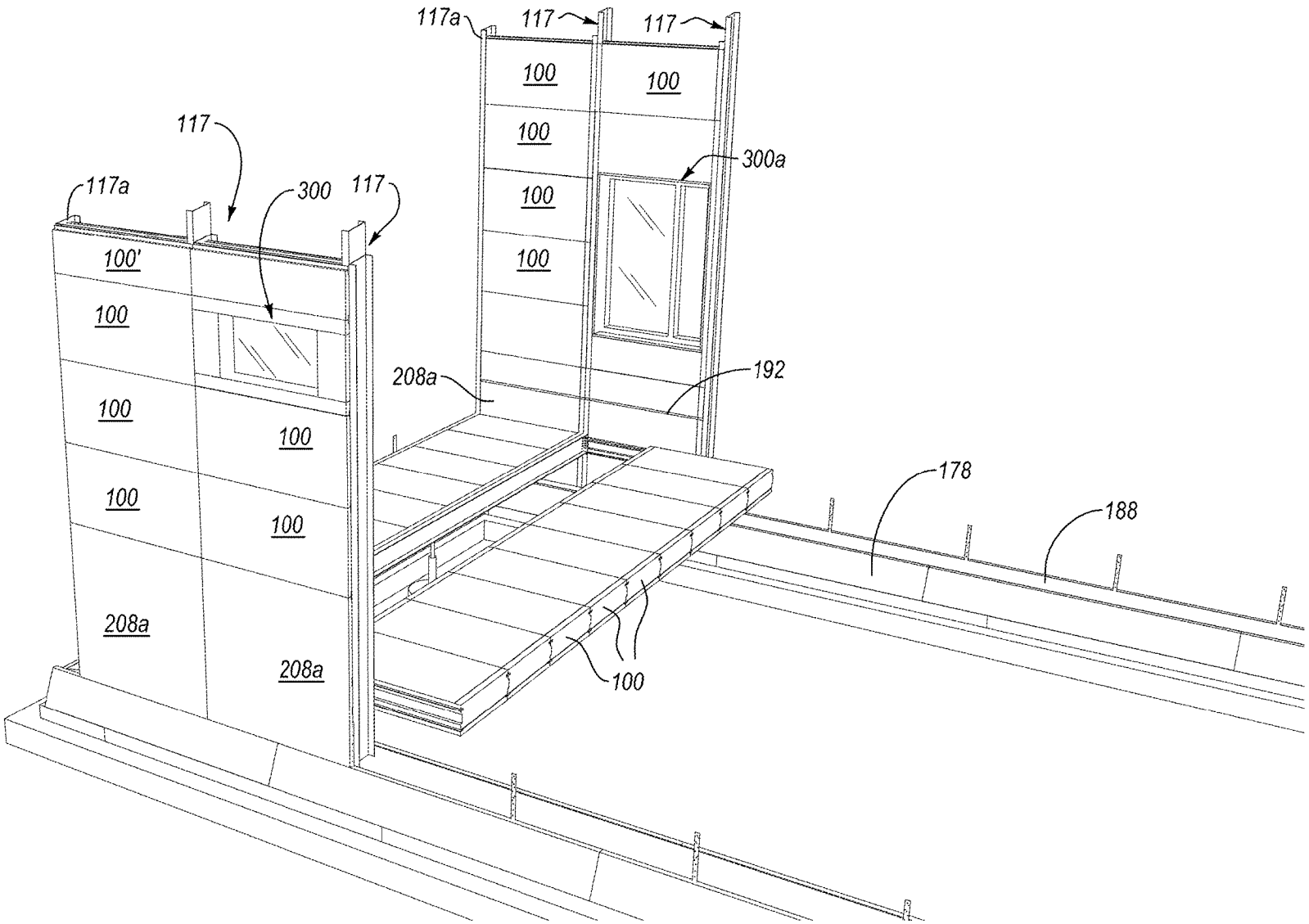

FIG. 88 shows the vertical I-beams having been engaged with the stacks of wall panels, and the row of next floor panels (and associated furring strips) positioned for placement.

Figure 89:
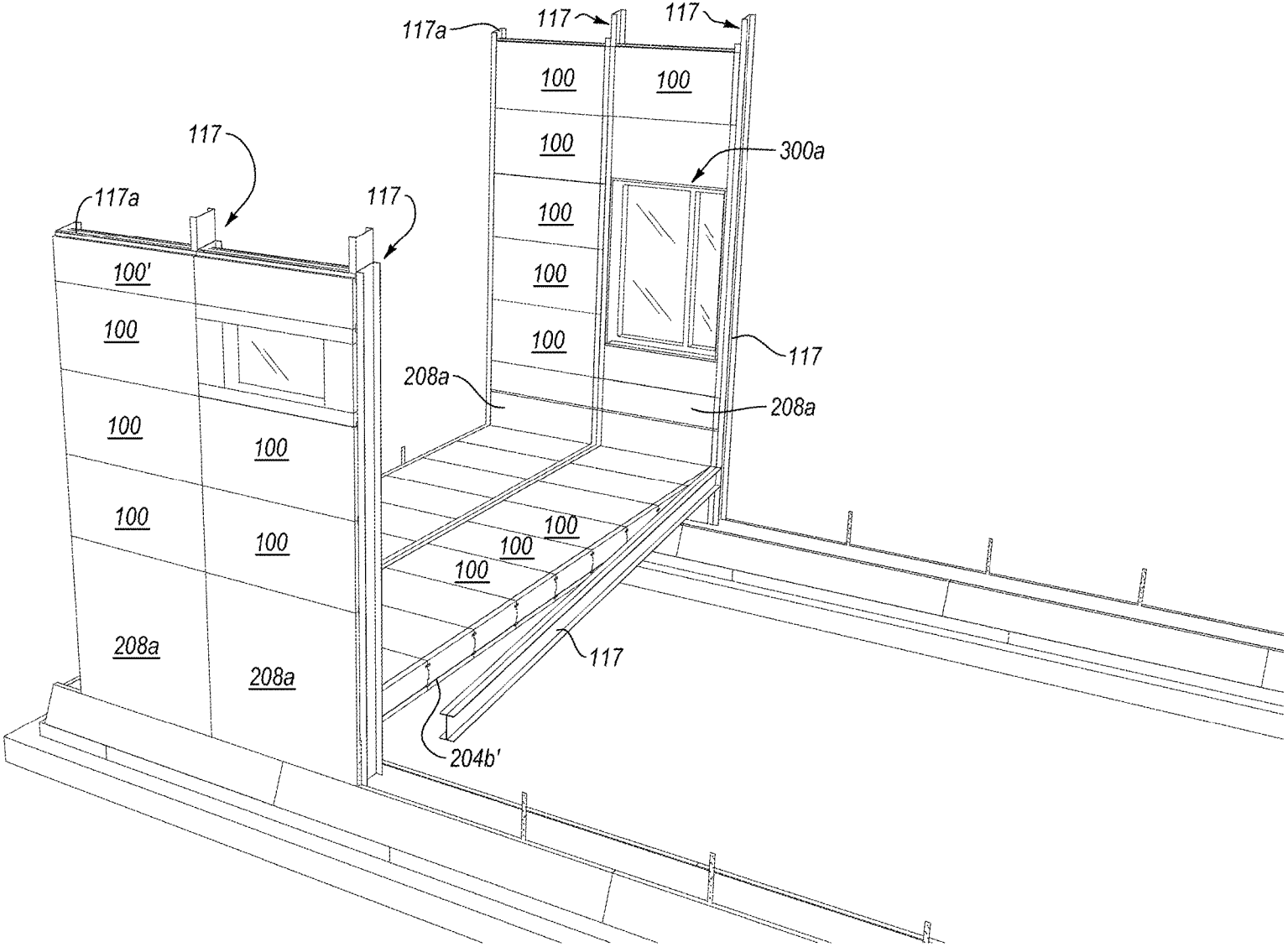

FIG. 89 shows the row of floor panels of FIG. 88 having been appropriately engaged, and the next I-beam member of the floor being positioned, in preparation for the next row of floor panels.

Figure 90:
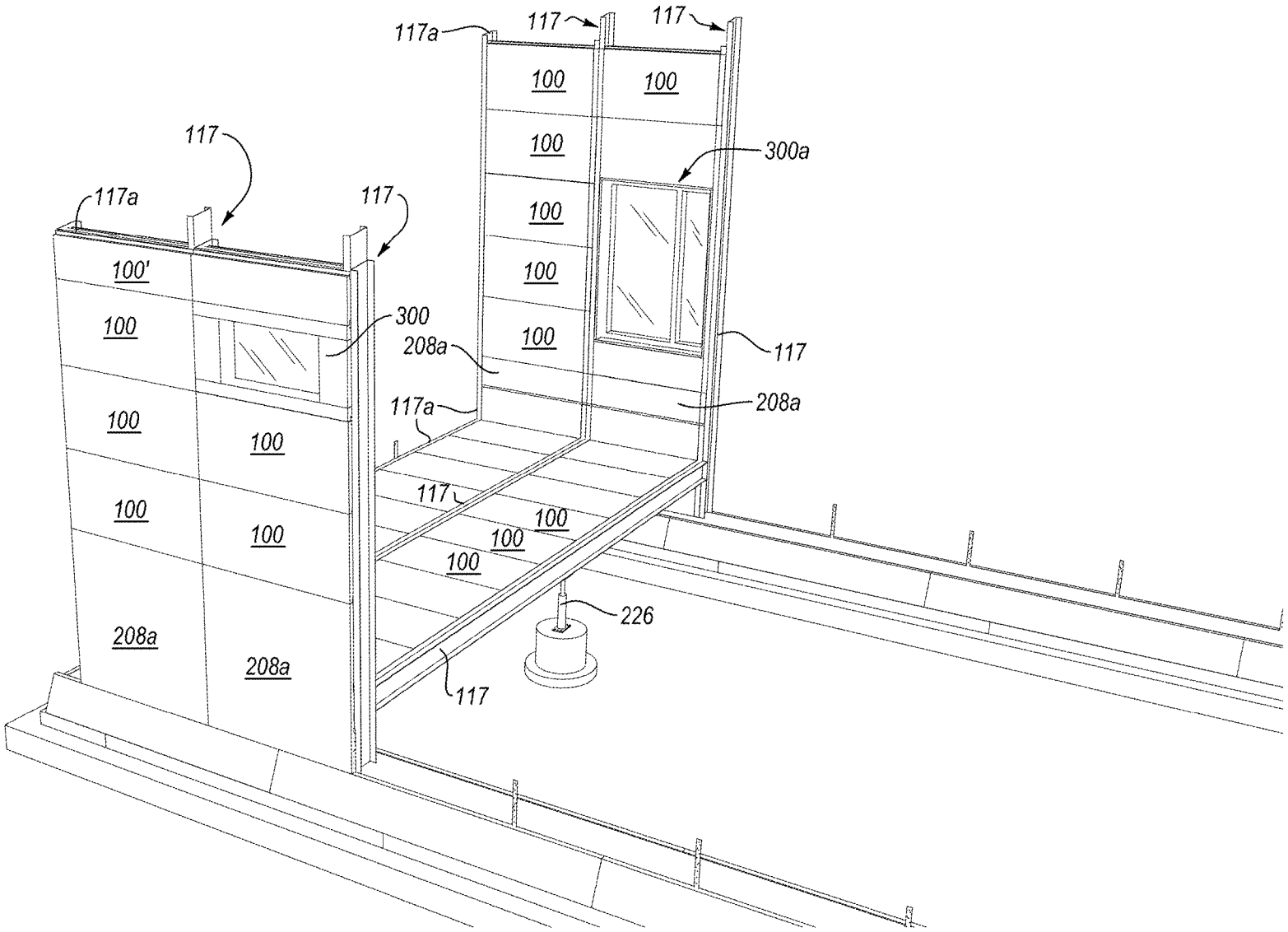

FIG. 90 shows the next I-beam member engaged with the floor panels, and an adjustable floor jack positioned under the most recently placed horizontal I-beam. Such floor jacks are optional, depending on the span of the floor.

Figure 91:
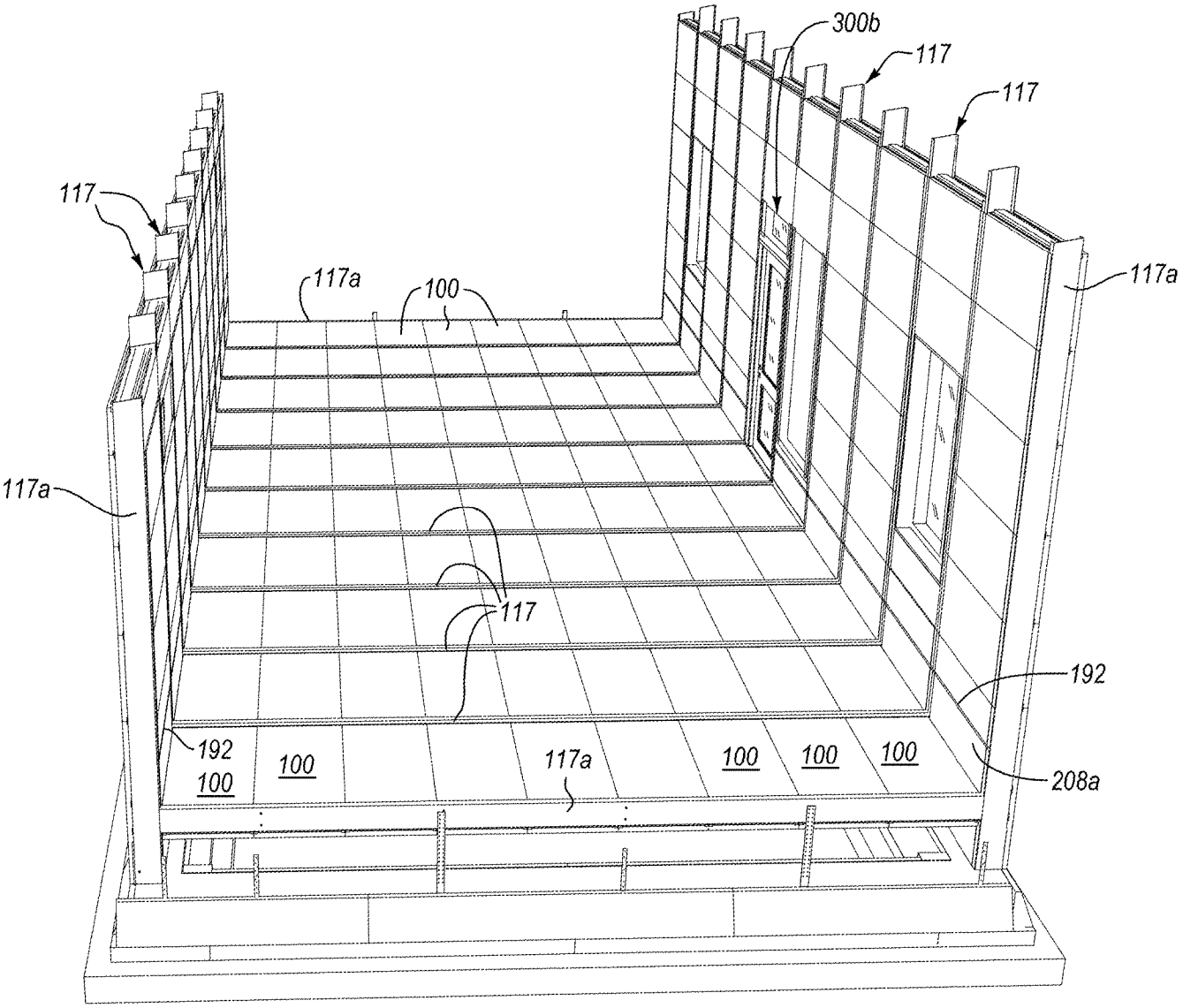

FIG. 91 shows how such wall and floor sections may be placed, in the same manner as already shown, until the endwalls are to be assembled.

Figure 92:
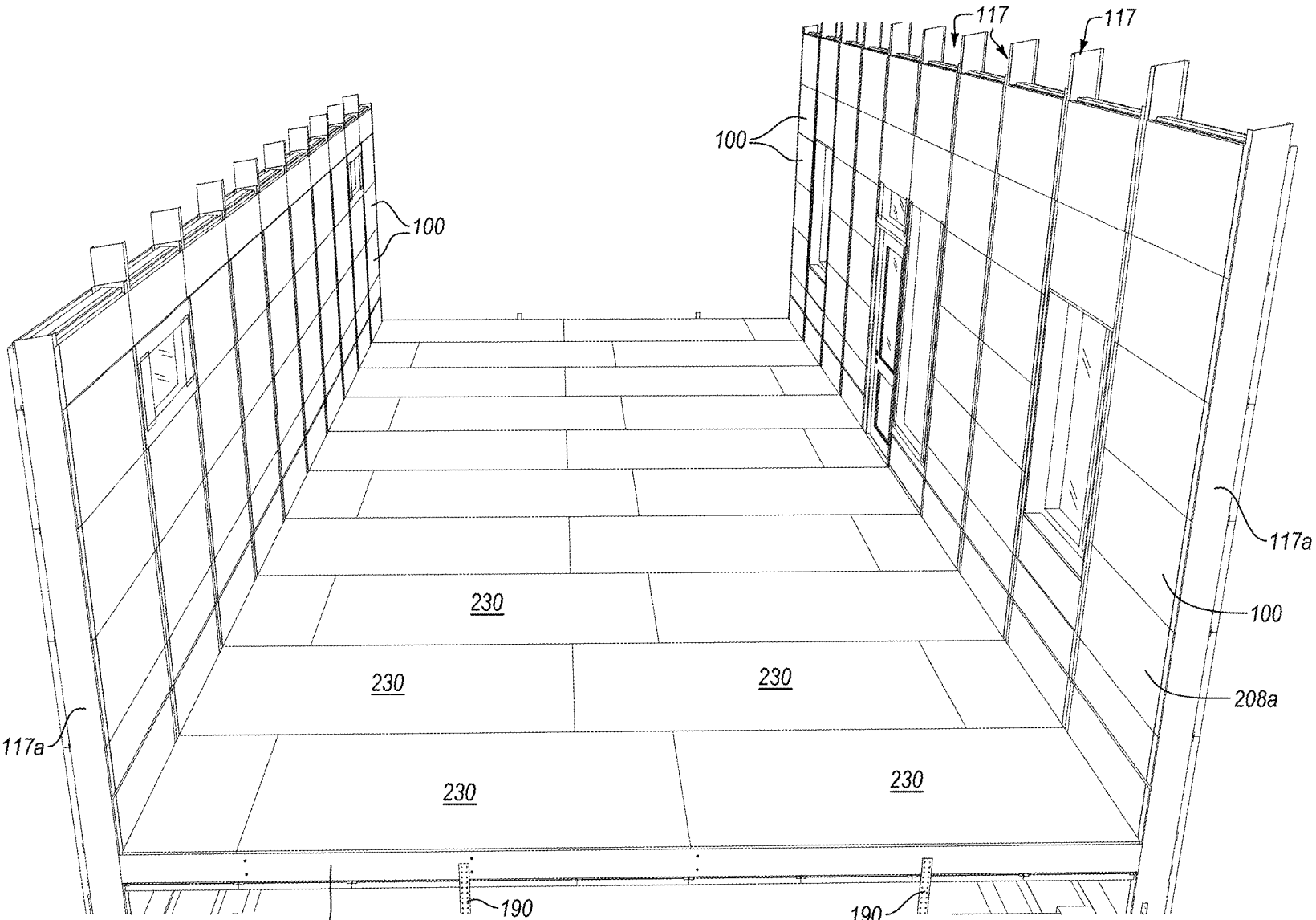

FIG. 92 shows attachment of floor sheathing (e.g., ¾ inch tongue and groove OSB or plywood sheathing). The floor sheathing may be attached before the endwalls are assembled. As shown, the C-channel member at the end of each wall is not made up of dual back-to-back C-channel members (forming an I-beam), as such is not needed at the end of the wall. The metal C-channel member (e.g., steel) may be glued to the wall panels, e.g., when inserting the flanges of the C-channel frame member into the wall panels. Back-to-back C-channel members (i.e., forming I-beams) can be secured together with screws.

Figure 93:
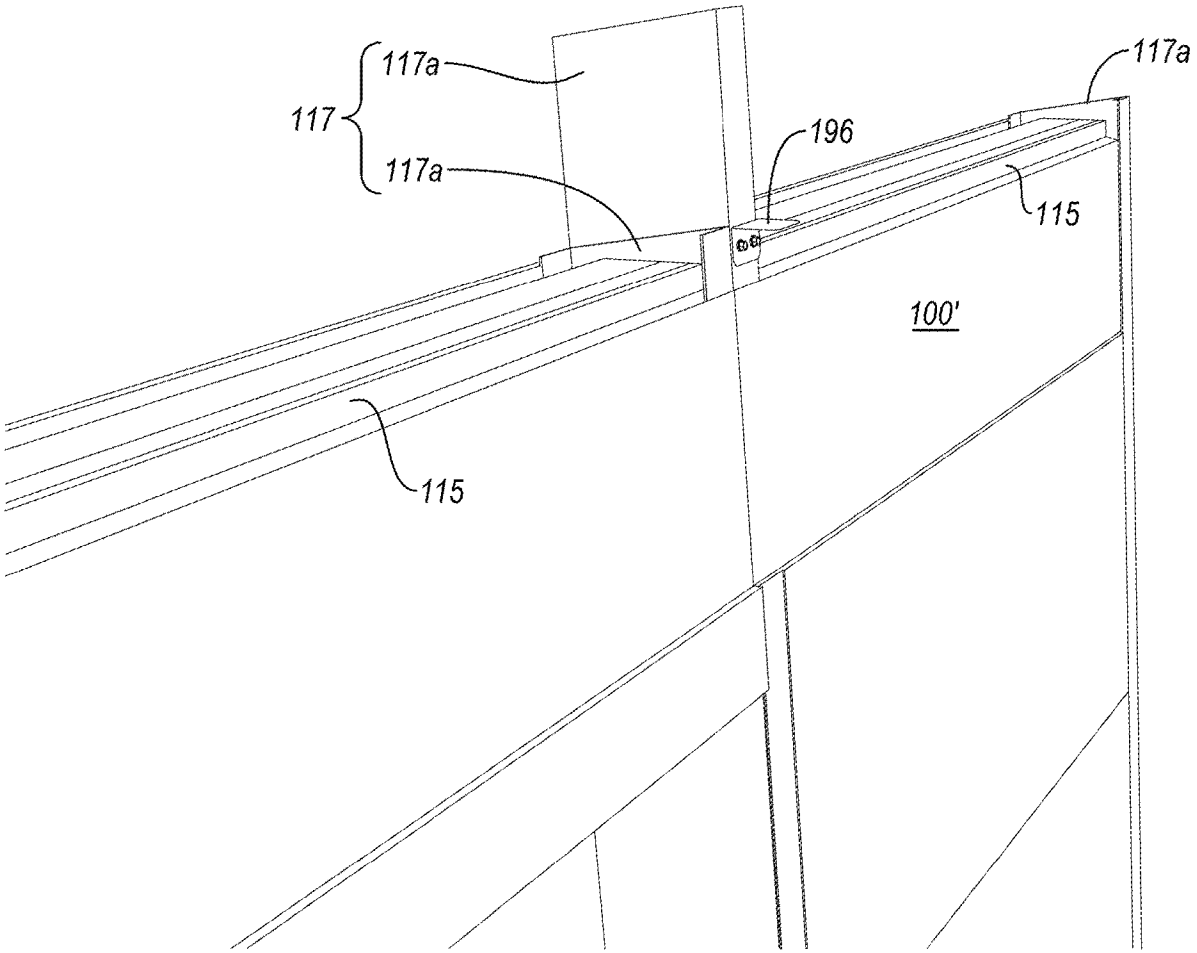

FIG. 93 shows attachment of a temporary ear bracket to the taller C-channel member, at a height so as to be flush with the shorter C-channel member of the first I-beam vertical frame member. FIG. 93 also shows positioning of 2'×4' lumber adjacent the top end of the last wall panel in the stack of wall panels. As shown in FIG. 93, the top wall panel may be shorter, if desired to accommodate a desired wall height (such adjustments in wall height can also be accomplished by adjusting the height of wall leg of the wall-to-roof transition panel).

Figure 94:
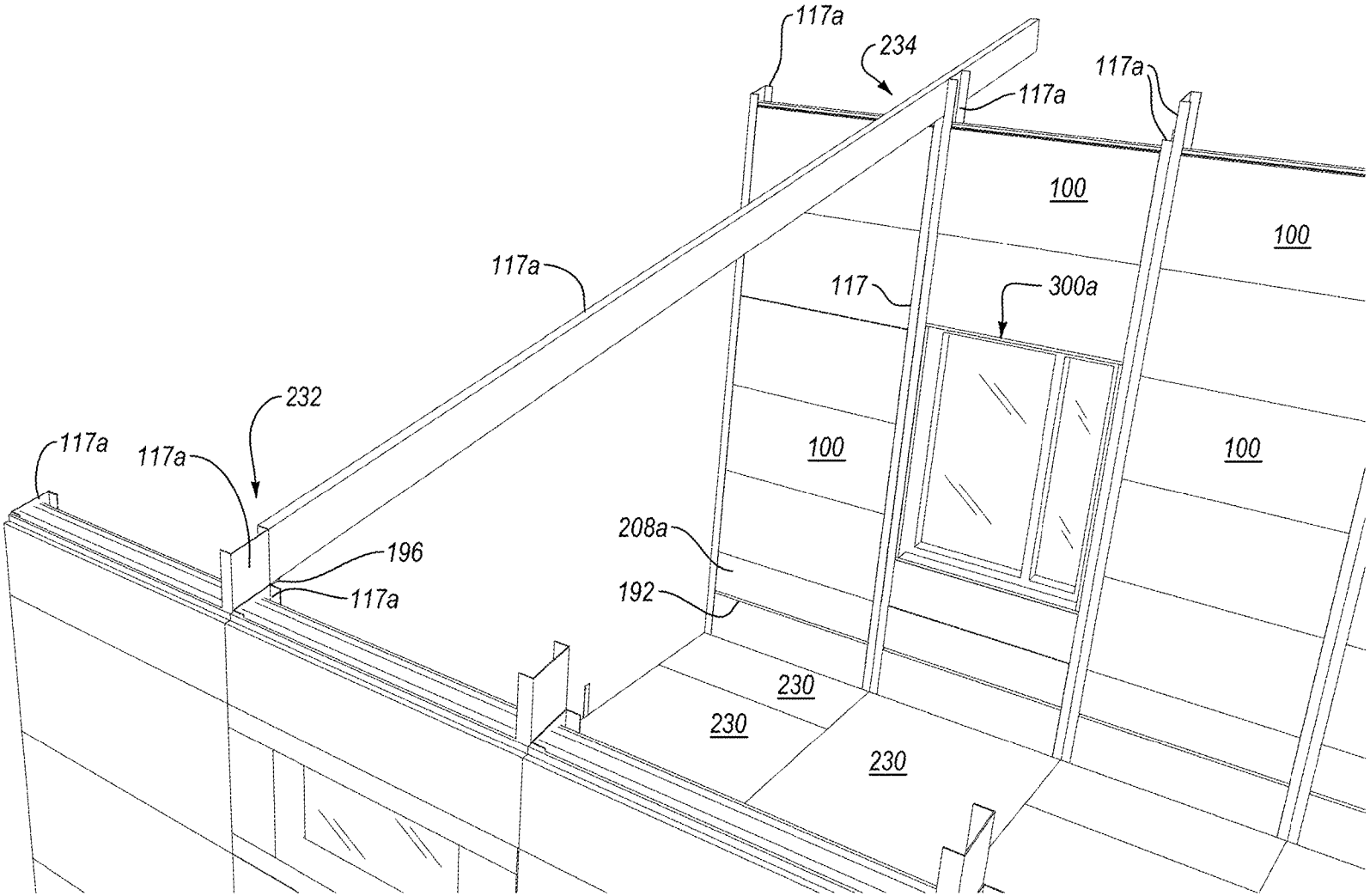

FIG. 94 shows attachment of a roof C-channel frame member, with the lower end of such roof frame member supported on the temporary ear bracket of FIG. 93, and the higher end of the roof frame member attached to the higher of the vertical back-to-back C-channel members of the opposite higher wall. Attachment may be made with screws (e.g., 2 screws every 24").

Figure 95:
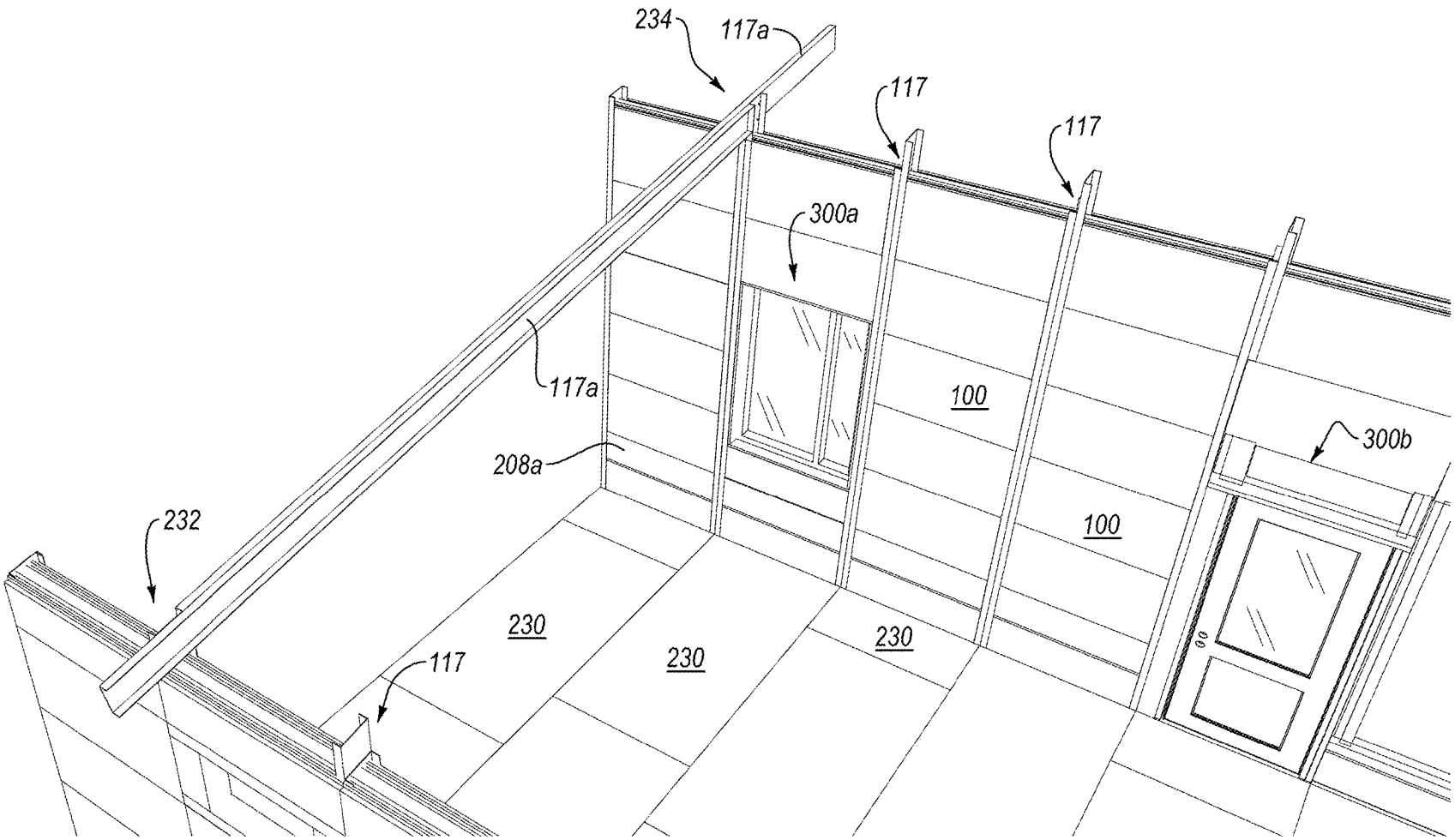

FIG. 95 shows attachment of an associated roof C-channel frame member, attached back-to-back with the C-channel frame member of FIG. 94. The high end of the $2^{nd}$ roof C-channel member is positioned so as to abut against the taller vertical C-channel frame member of the taller wall, while the lower end may rest on the top of the shorter vertical C-channel frame member of the shorter wall. While the walls shown are exemplary of a roof sloped in only 1 direction, it will be appreciated that the present building systems can be used for any type roof (e.g., pitched, sloped, flat, etc.), with appropriate accommodations that will be apparent to those of skill in the art, in light of the present disclosure.

Figure 96:
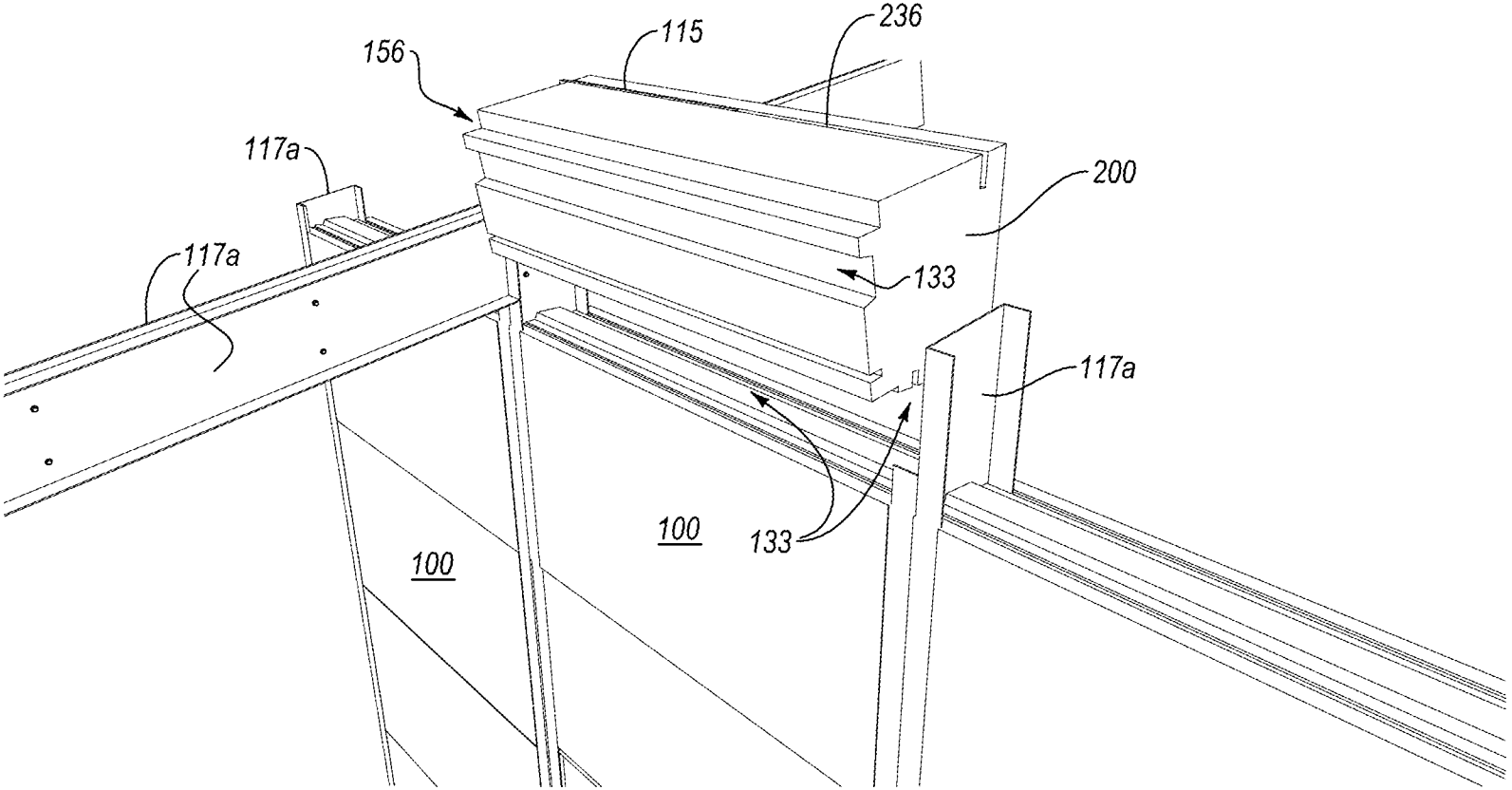

FIG. 96 shows positioning of a first wall-to-roof transition panel at the top of a stack of wall panels, with a 2×4 positioned between the top wall panel and the wall-to-roof transition panel.

Figure 97:
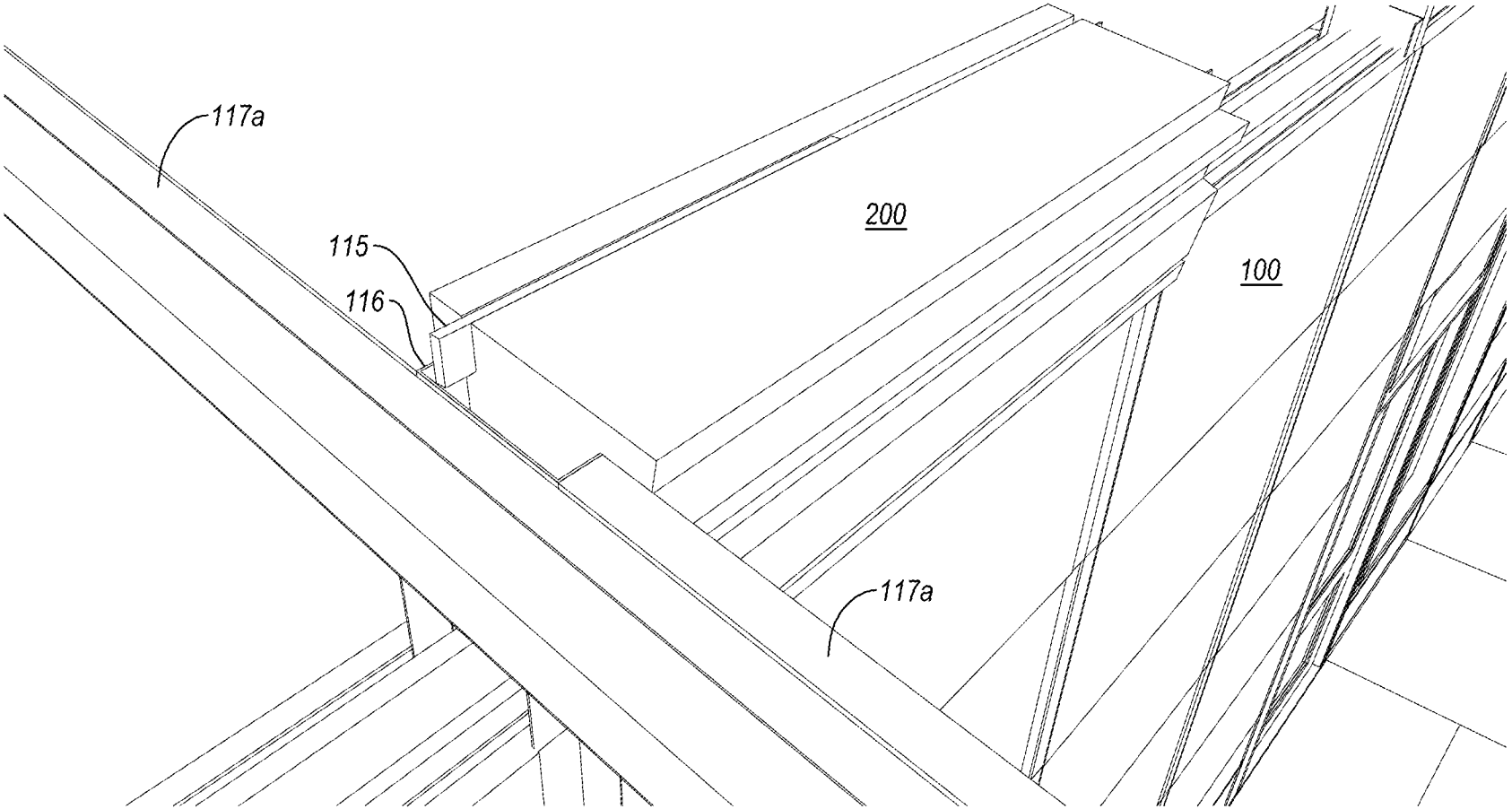

FIG. 97 shows the wall-to-roof transition panel in place at the top of the wall, with a furring strip inserted into the channel in the top of the wall-to-roof transition panel, with a portion of the furring strip extending out of the end of the channel so that the plane of the furring strip can be positioned against the plane of the adjacent flange of the taller of the C-channel vertical frame members. This ensures that when a roof panel is placed adjacent the transition panel, the transition panel remains where it should be, rather than splaying in or out, relative to the wall.

Figure 98:
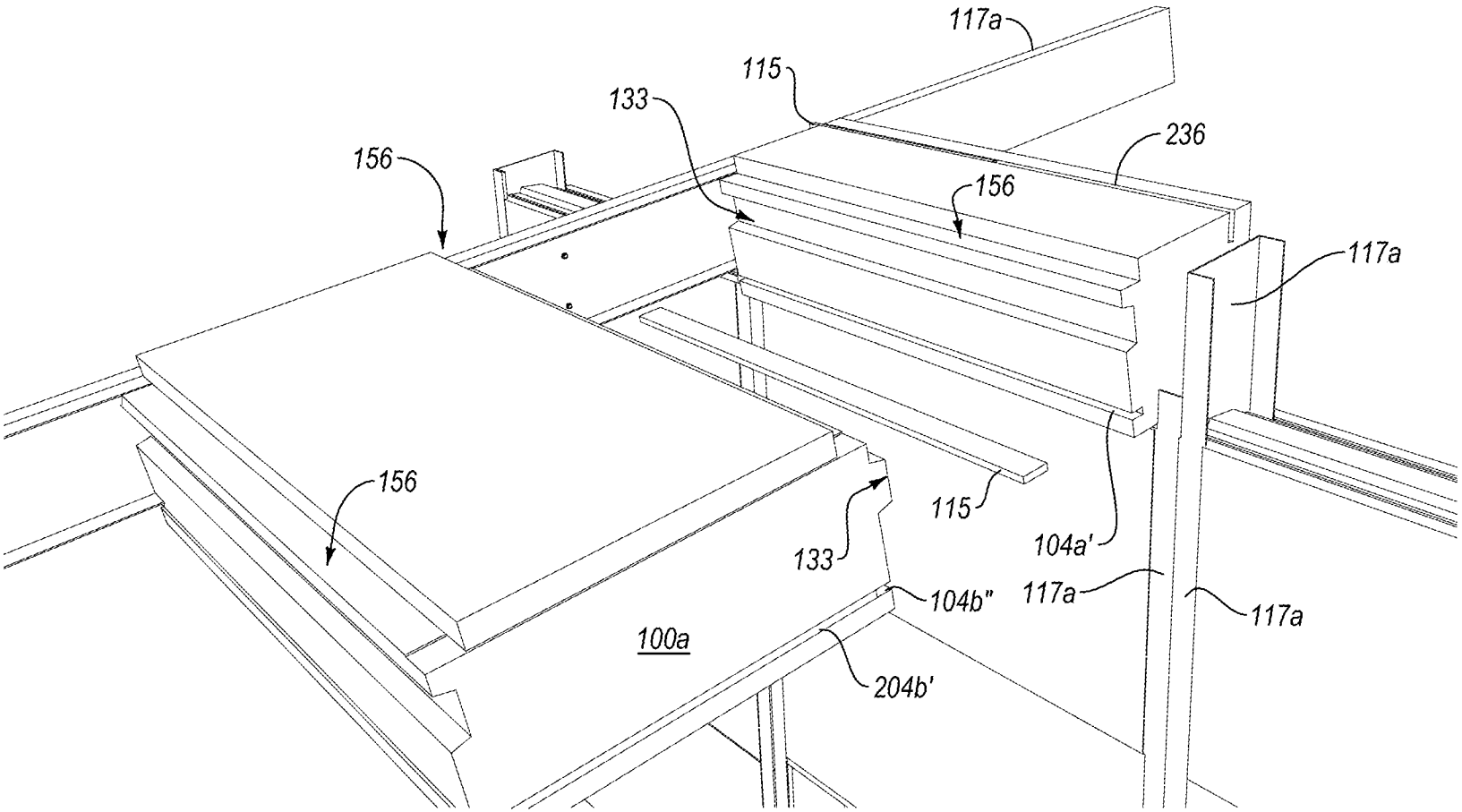

FIG. 98 shows positioning of the first roof panel, with an associated furring strip, for insertion into corresponding channels of the transition panel and the roof panel.

Figure 99:
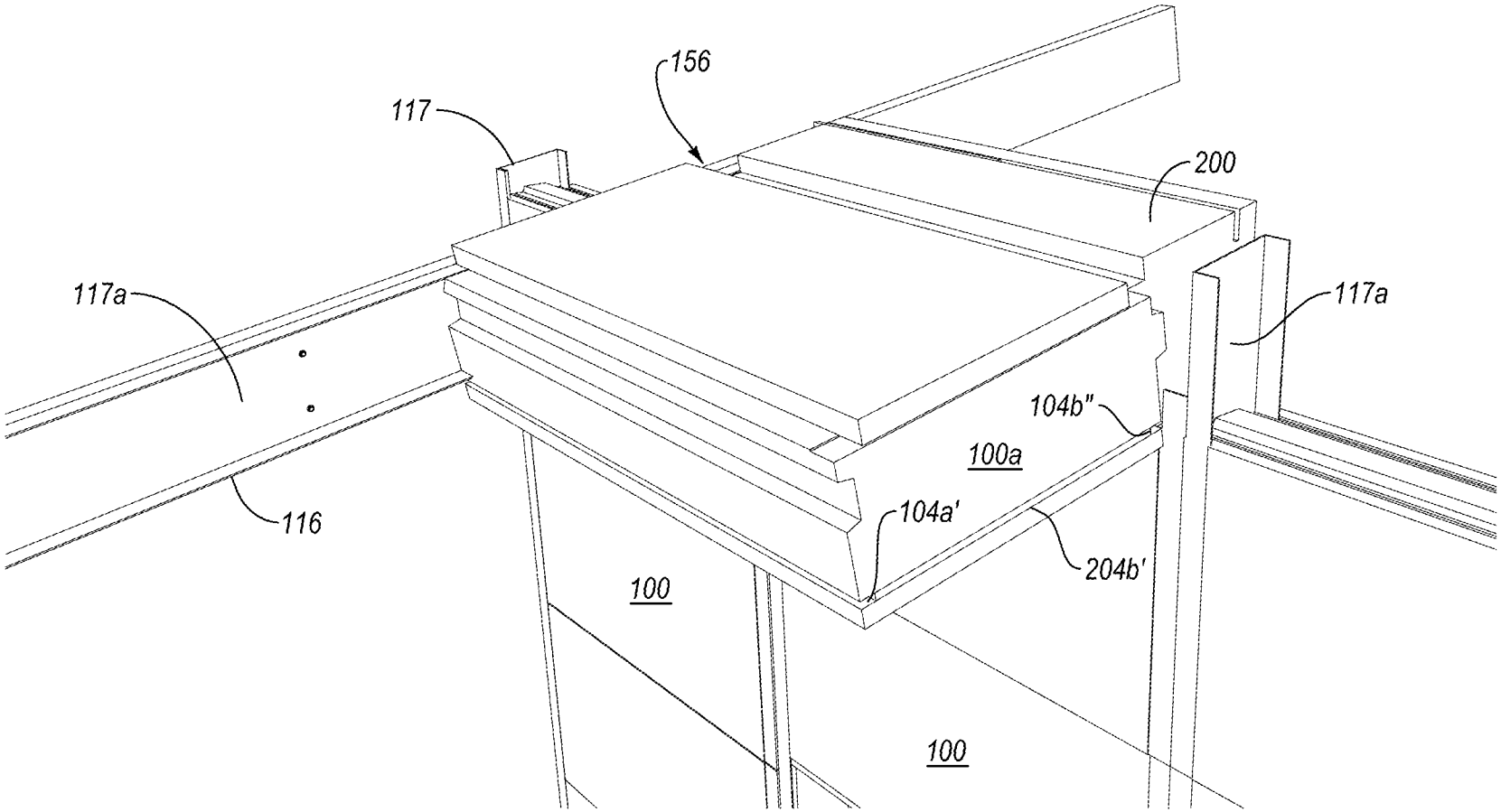

FIG. 99 shows the roof panel and furring strip of FIG. 98 attached, where the roof panel is attached to the transition panel by the furring strip, and through engagement of the flanges of the roof C-channel member with corresponding channels of the roof panel.

Figure 100:
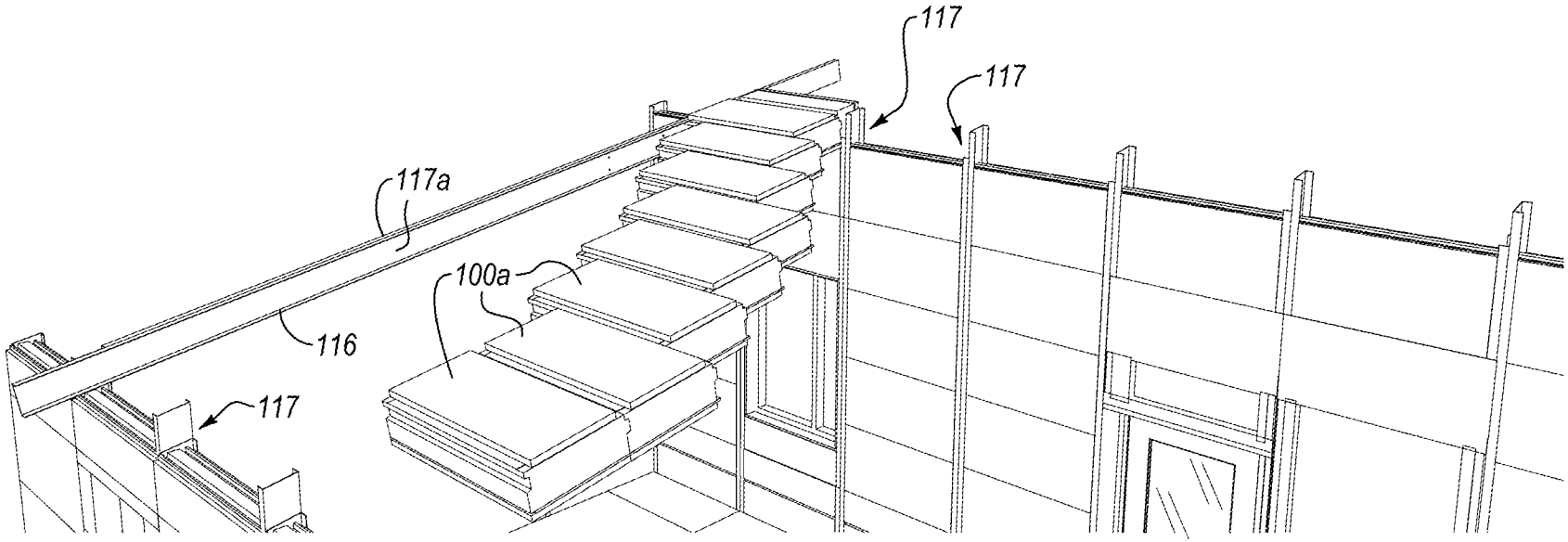

FIG. 100 shows positioning of the rest of the roof panels to form a row of roof panels, which will form a section of the roof. Furring strips may similarly be used, along with the flanges of the roof C-channel member, to secure these components together. The roof panels may be slid into the flange of the roof C-channel member. The male/female profile of the roof panels, as well as furring strips between adjacent roof panels, may serve to support the roof panels in place against gravity, until the next roof C-channel member is installed. The row of roof panels may be allowed to sag somewhat until the next C-channel member is installed, which is not a problem.

Figure 101:
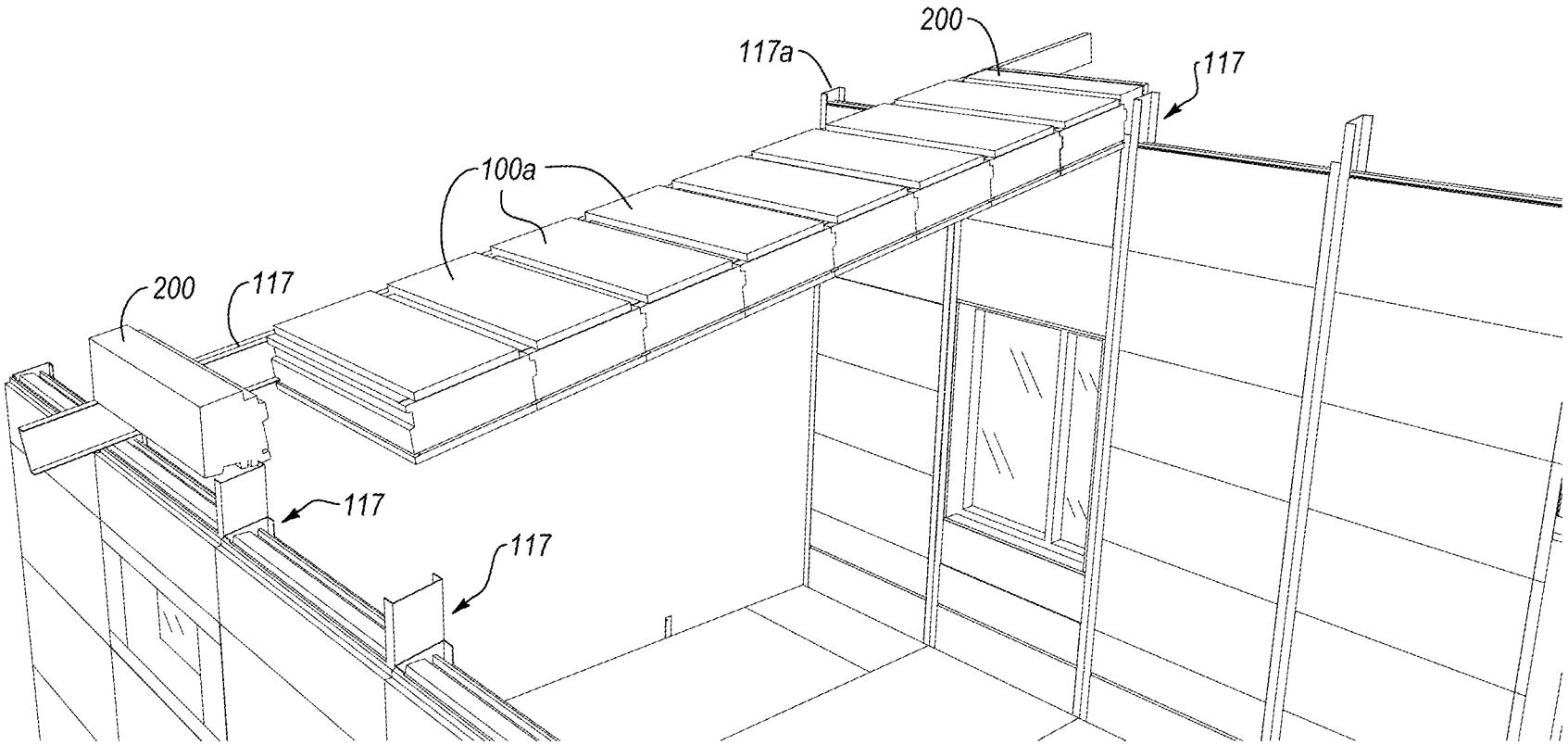

FIG. 101 shows positioning of the next wall-to-roof transition panel at the opposite wall.

Figure 102:
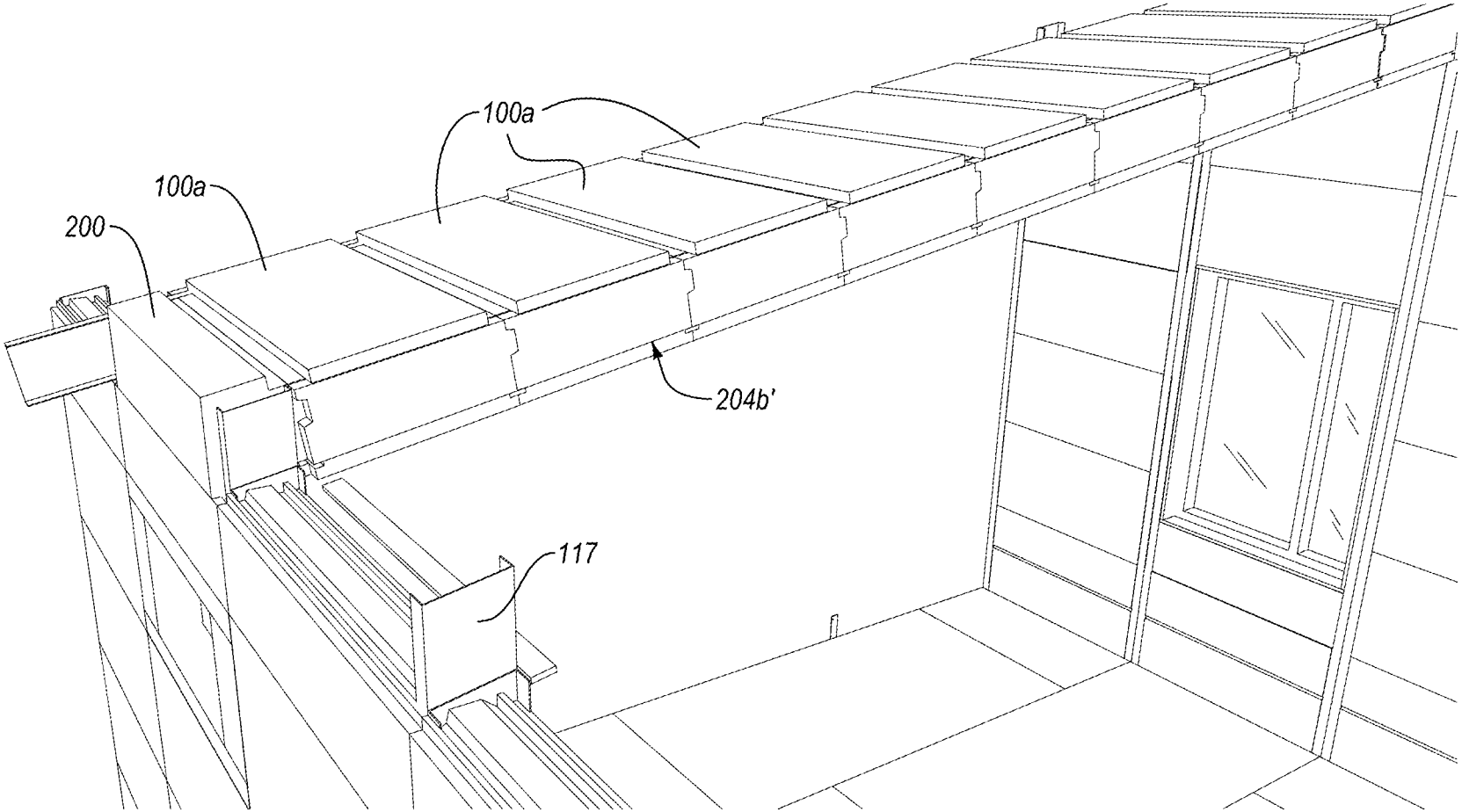

FIG. 102 shows insertion of the final roof panel of the row, as well as the furring strip, to secure the final roof panel to the wall-to-roof transition panel of FIG. 101.

Figure 103:
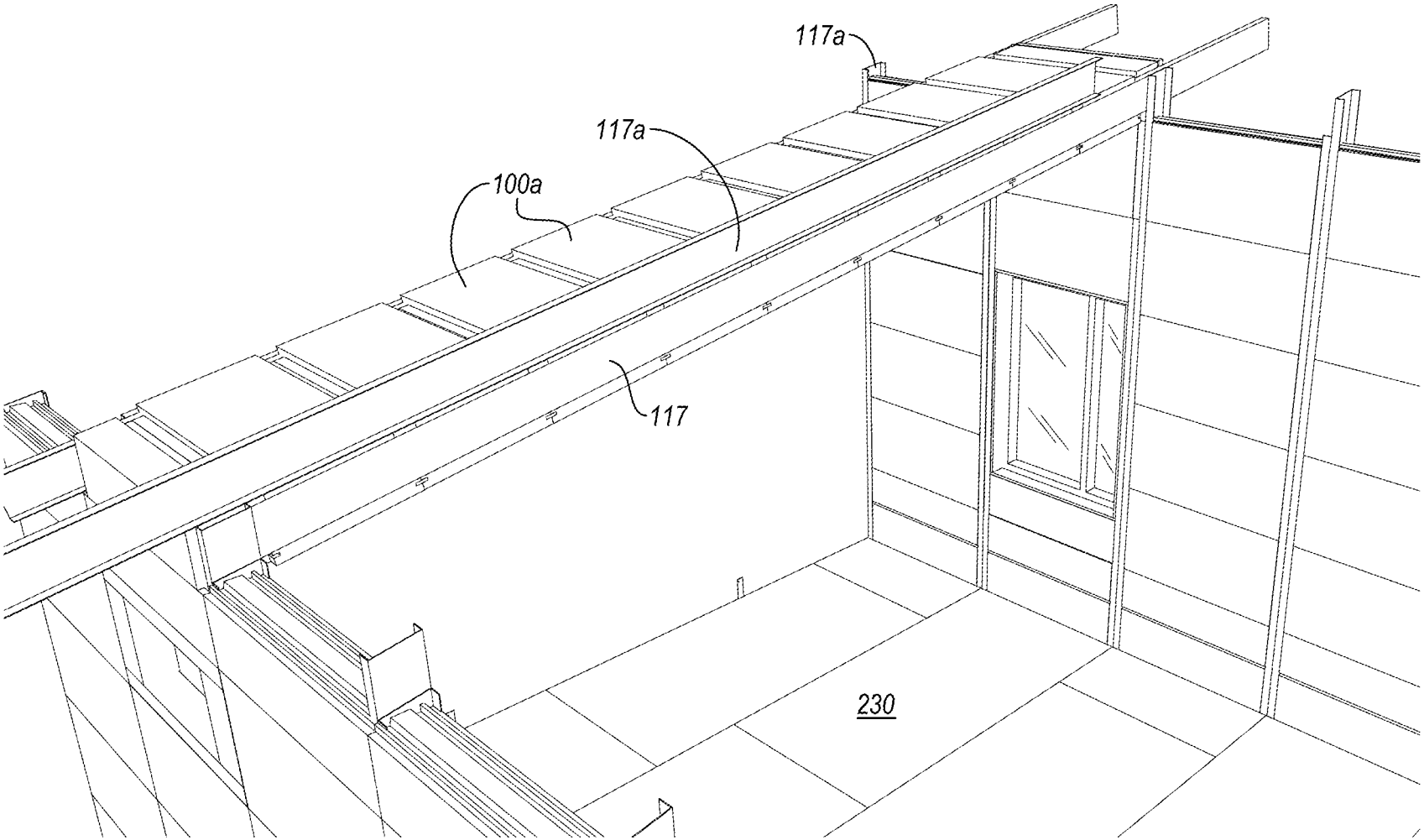

FIG. 103 shows insertion of the next roof C-channel member into the flanges of the panel, and positioning of another roof C-channel member, to form the roof I-beam, to support the next row of roof panels.

Figure 104:
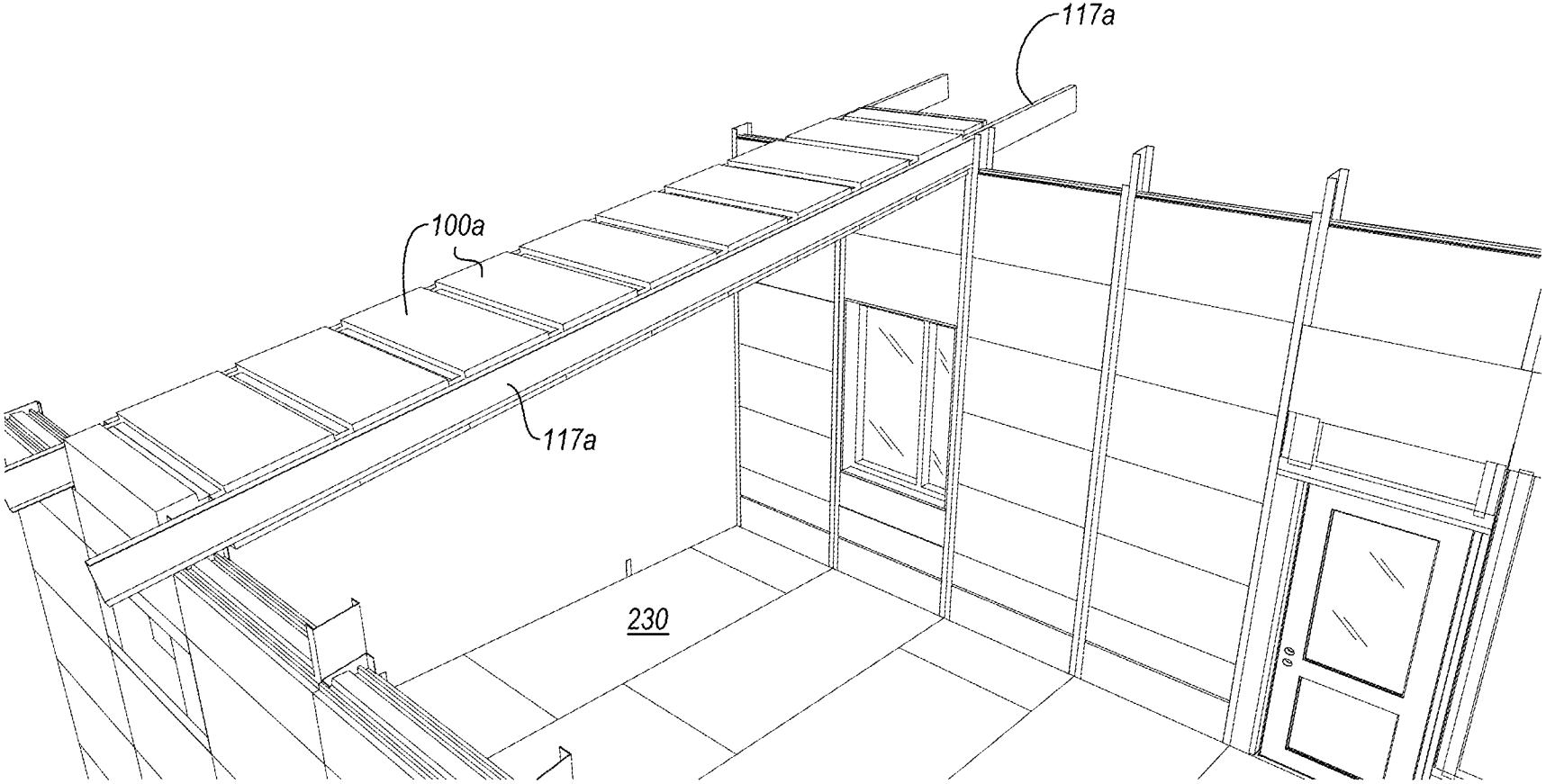

FIG. 104 shows attachment of the $2^{nd}$ roof C-channel member of the back-to-back C-channel members that form the roof I-beam member that provides support for rows of roof panels.

Figure 105:
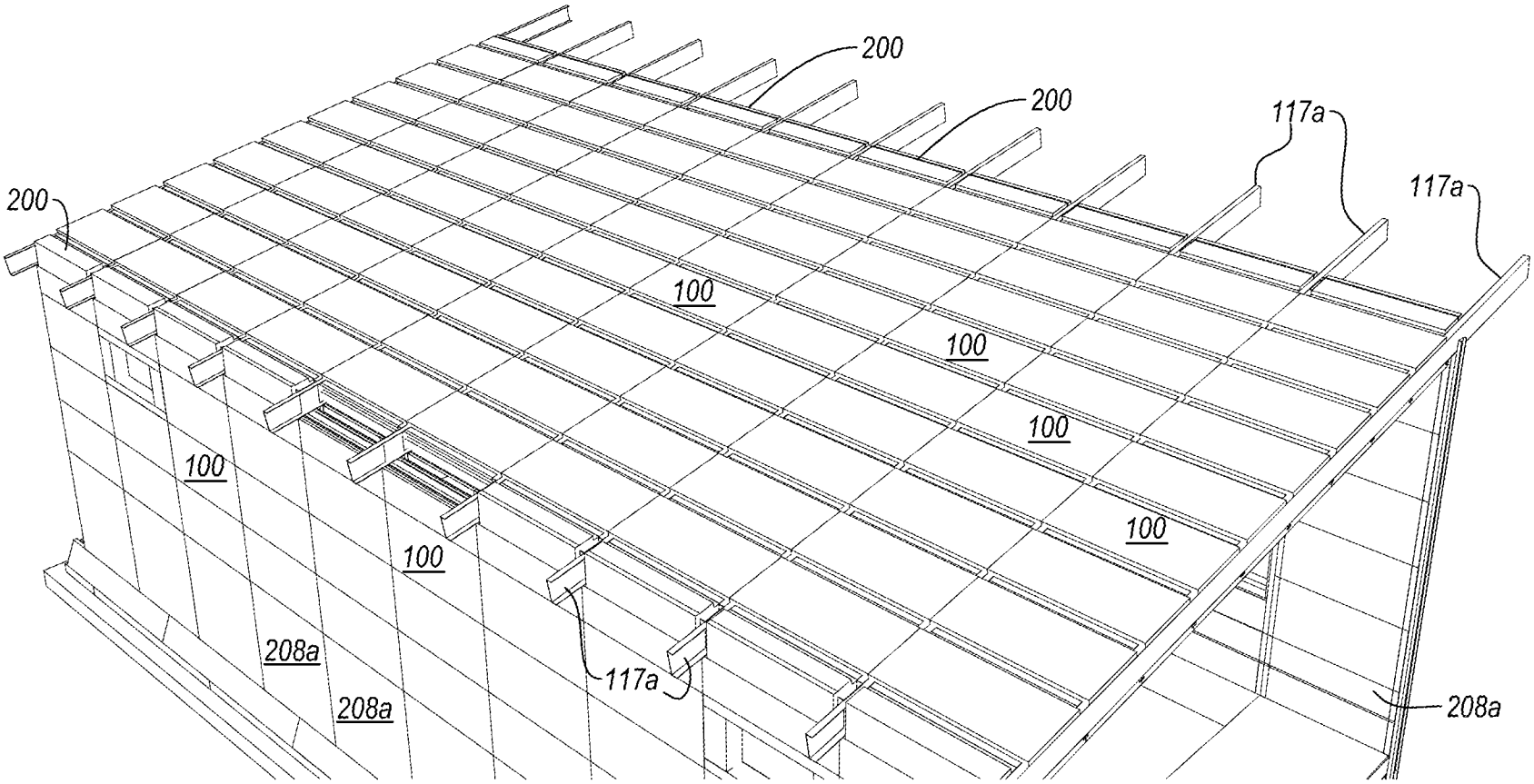

FIG. 105 shows placement of the rest of the roof panels and the roof C-channel frame members. It will be appreciated that panels and C-channel members are placed intermittently, with placement of a row or stack of panels followed by placement of back-to-back C-channel members, followed by placement of another row (or stack for a wall) of panels, when constructing walls, floors, or the roof structure.

Figure 106:
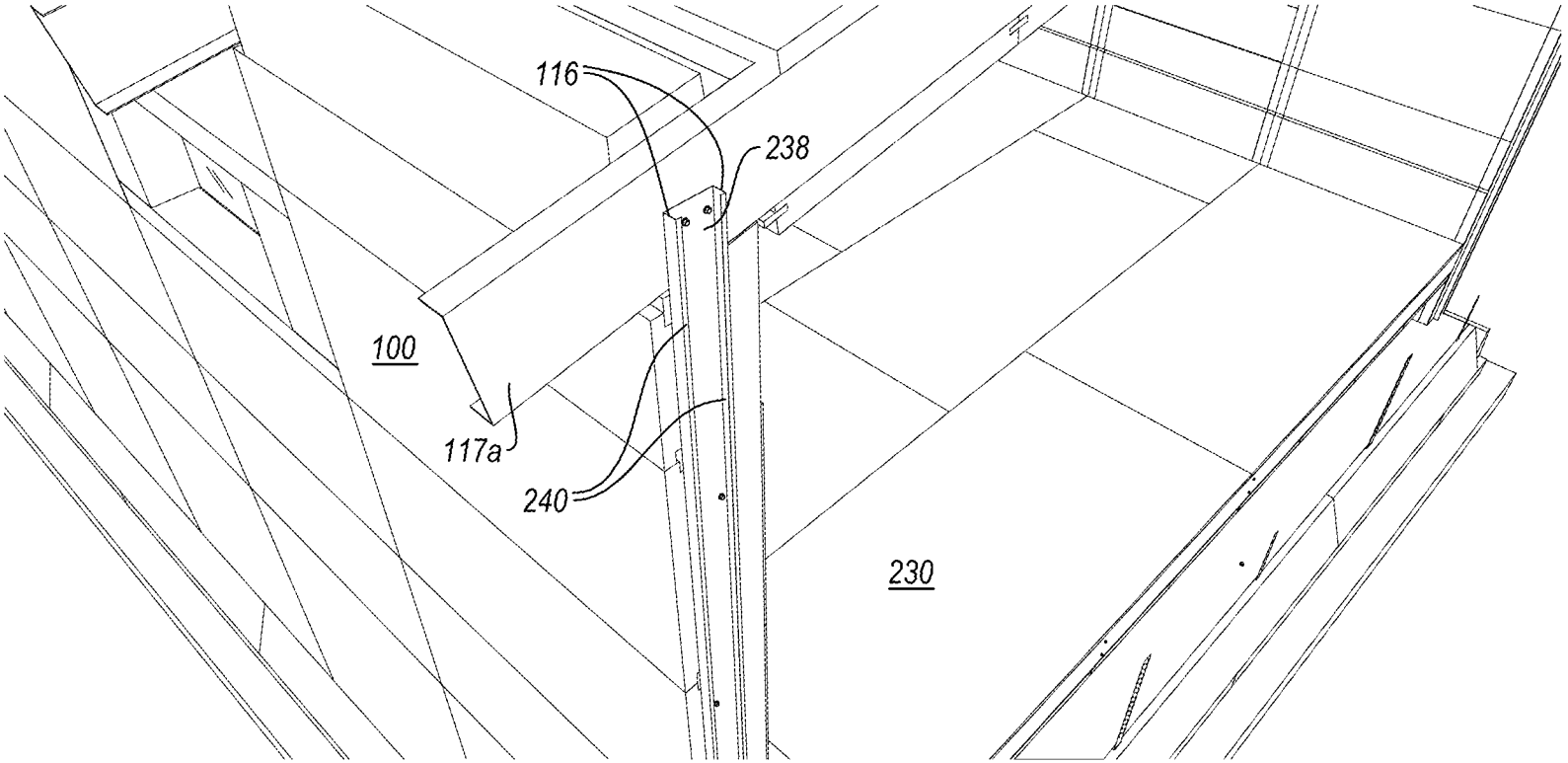

FIG. 106 shows attachment of a special C-channel member (special in that it includes return lips on the flanges) to the outside of the end C-channel member at the ends of each wall, with the open portion of the special C-channel member facing outwards, towards where the endwall will be assembled. The special C-channel member may be attached to the underlying standard C-channel every 3 feet.

Figure 107:
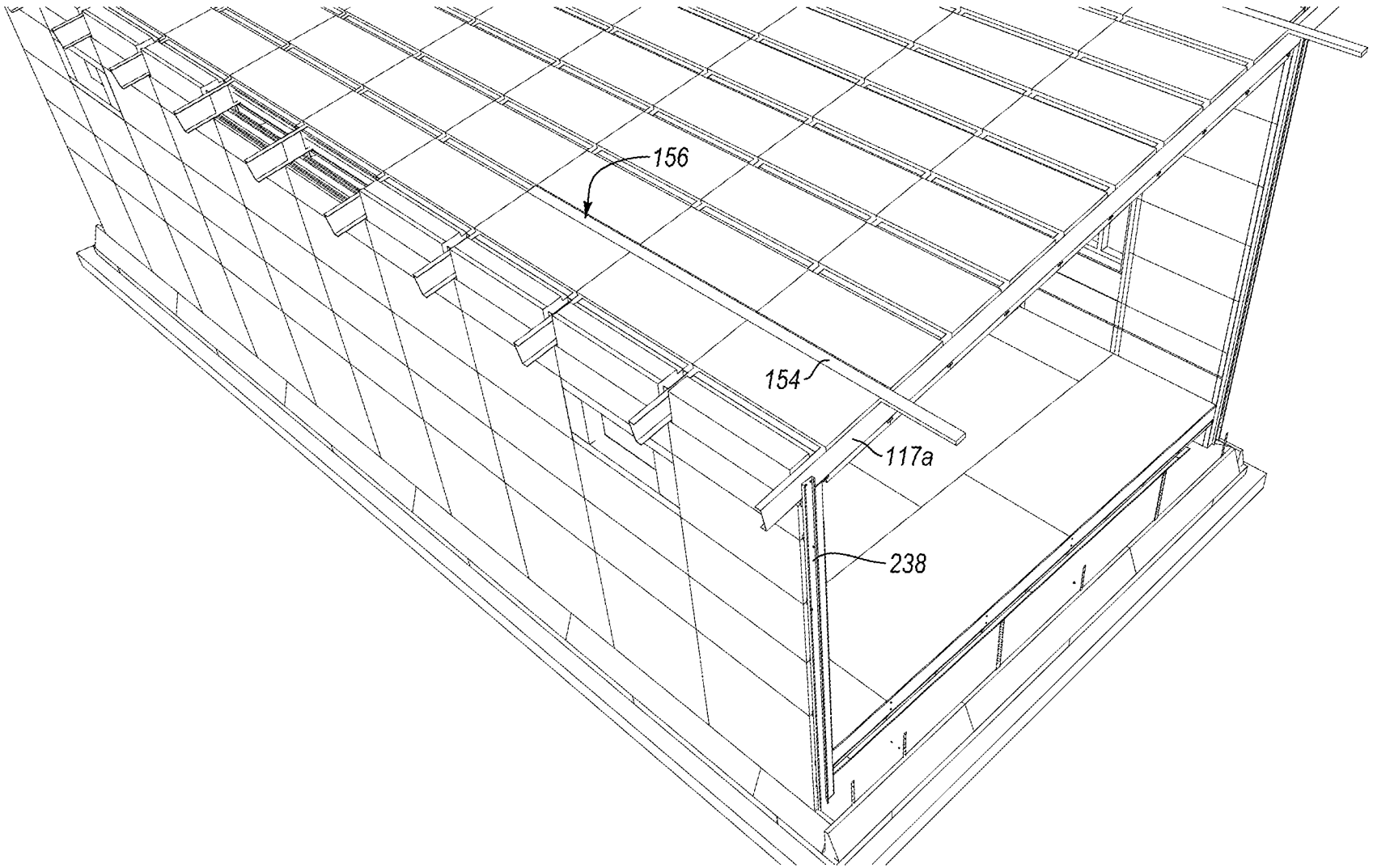

FIG. 107 shows insertion of a 2×4 purlin into purlin channels of the roof panels, with the purlin overhanging the roof panels, for use in tying the roof frame members of the endwall to the remainder of the building. The purlin may be attached to the roof C-channel members already shown in place with screws (e.g., two 2½ inch long #12 screws).

Figure 108:
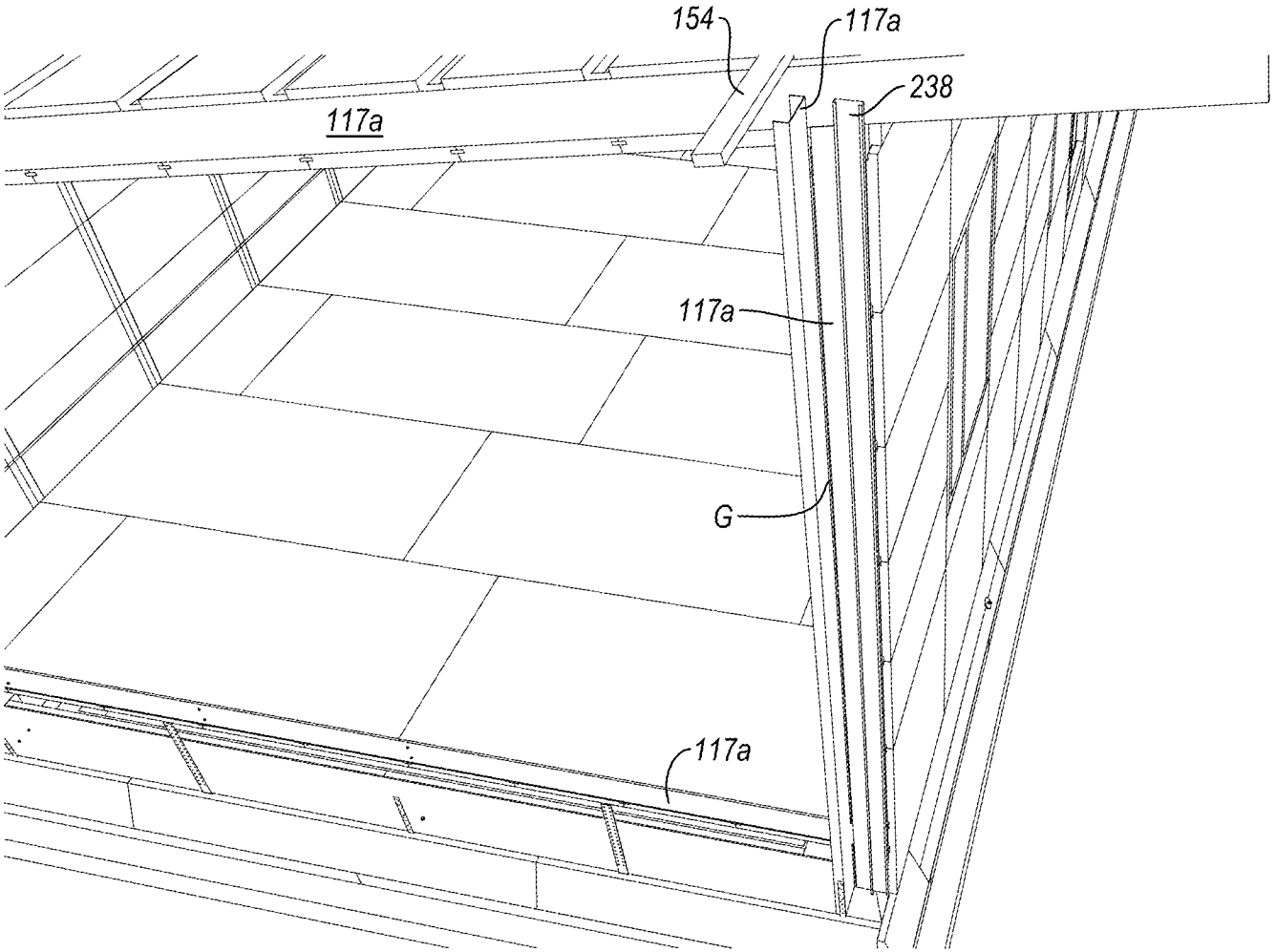

FIG. 108 shows installation of a first vertical C-channel frame member of the endwall. This C-channel member may be installed ½ inch inward from the vertical member, on the tall wall of the building. It may be attached with two screws at the top, connecting the C-channel member to the adjacent C-channel member of the roof, and two screws at the bottom, connecting the C-channel member to the C-channel member of the floor.

Figure 109:
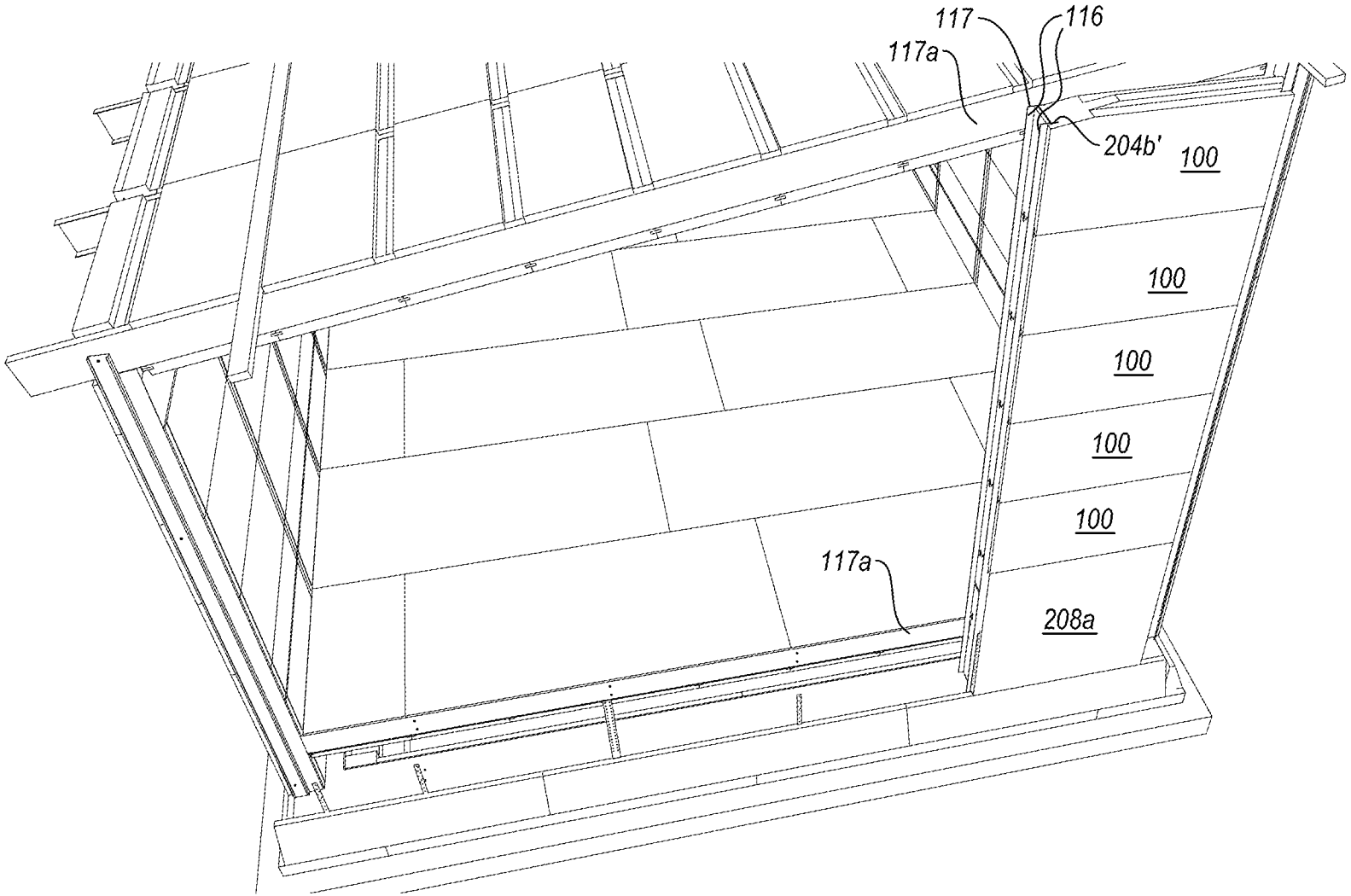

FIG. 109 shows stacking of a wall-to-floor transition panel, and standard wall panels, and insertion of vertical back-to-back C-channel members at the end, with flanges of one of the C-channel members received into the flanges of the wall panels. An I-beam formed from back-to-back C-channel members may be attached with screws to the roof C-channel member and the floor C-channel member.

Figure 110:
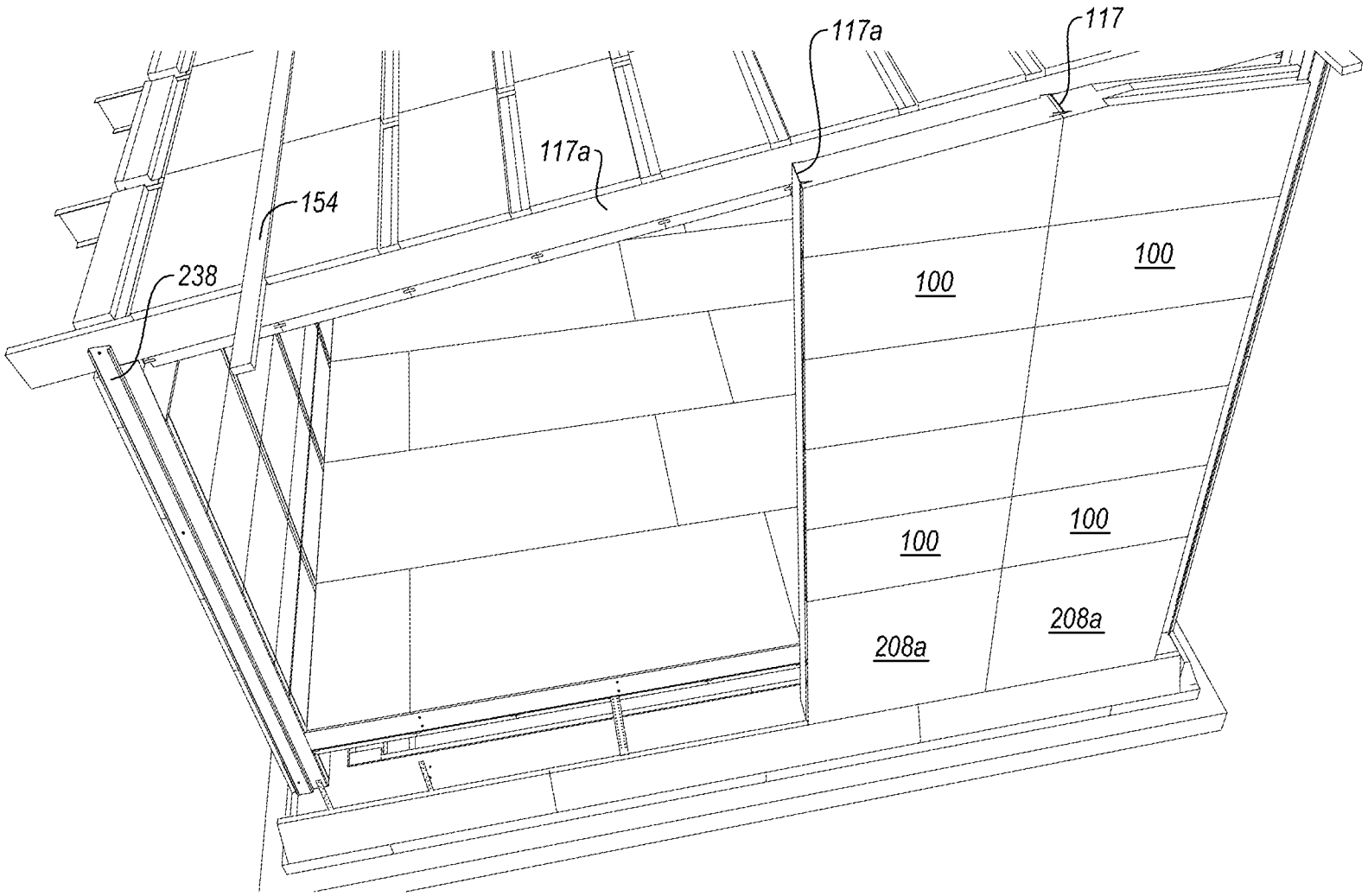

FIG. 110 shows installation of another stack of wall panels, and associated I-beam member formed from back-to-back C-channel members (or simply a single C-channel member).

Figure 111:
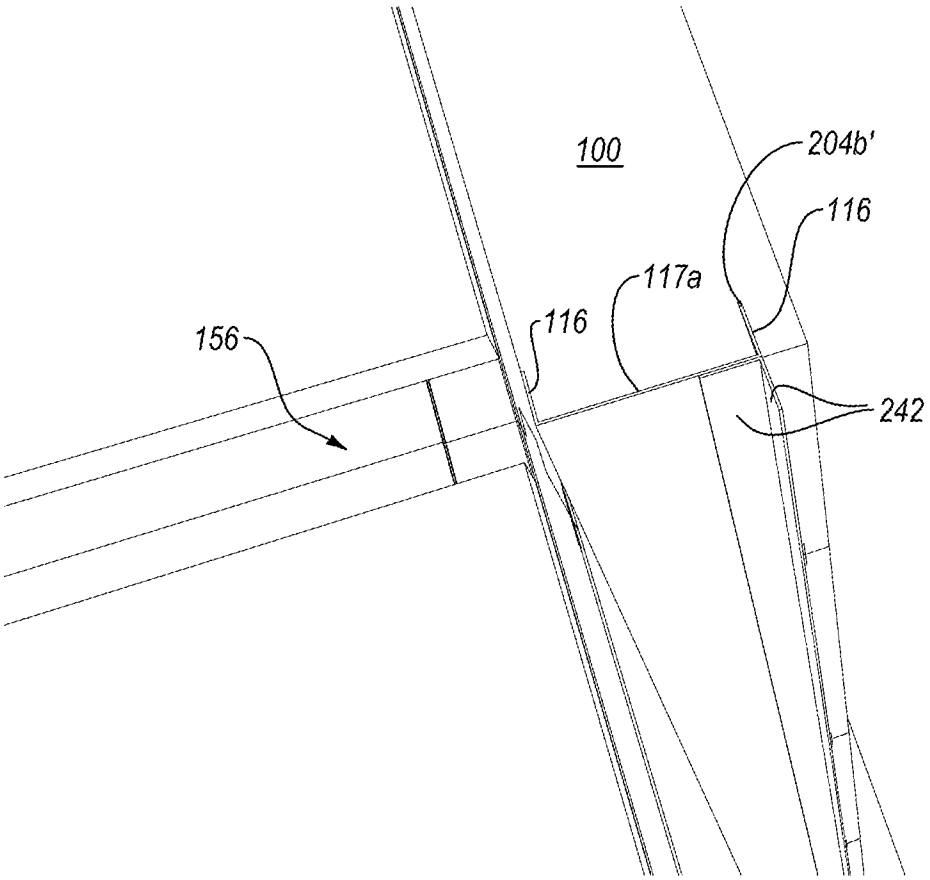

FIG. 111 shows how if a vertical end wall frame member is not at a shear brace location, then an L-shaped angle frame member may be attached to the C-channel frame member, as shown. Such may be used anywhere where shear brace holddowns were not placed.

Figure 112:
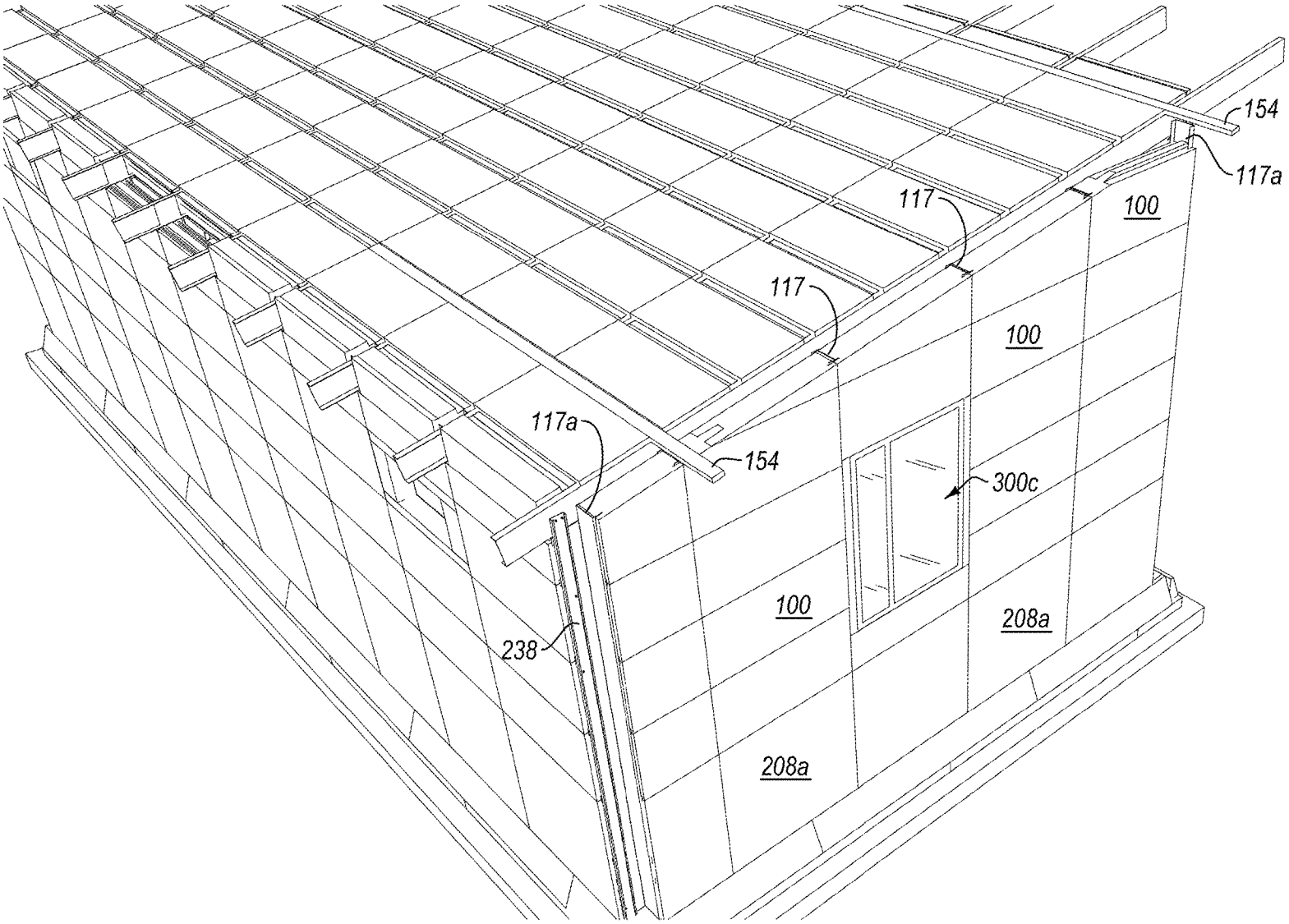

FIG. 112 shows construction of the remainder of the endwall, showing how specialized window modules or other specialized functional modules (e.g., doors, plumbing, or specialized electrical modules) can be included in the endwall (just as they can be included anywhere in any wall, floor, or roof).

Figure 113:
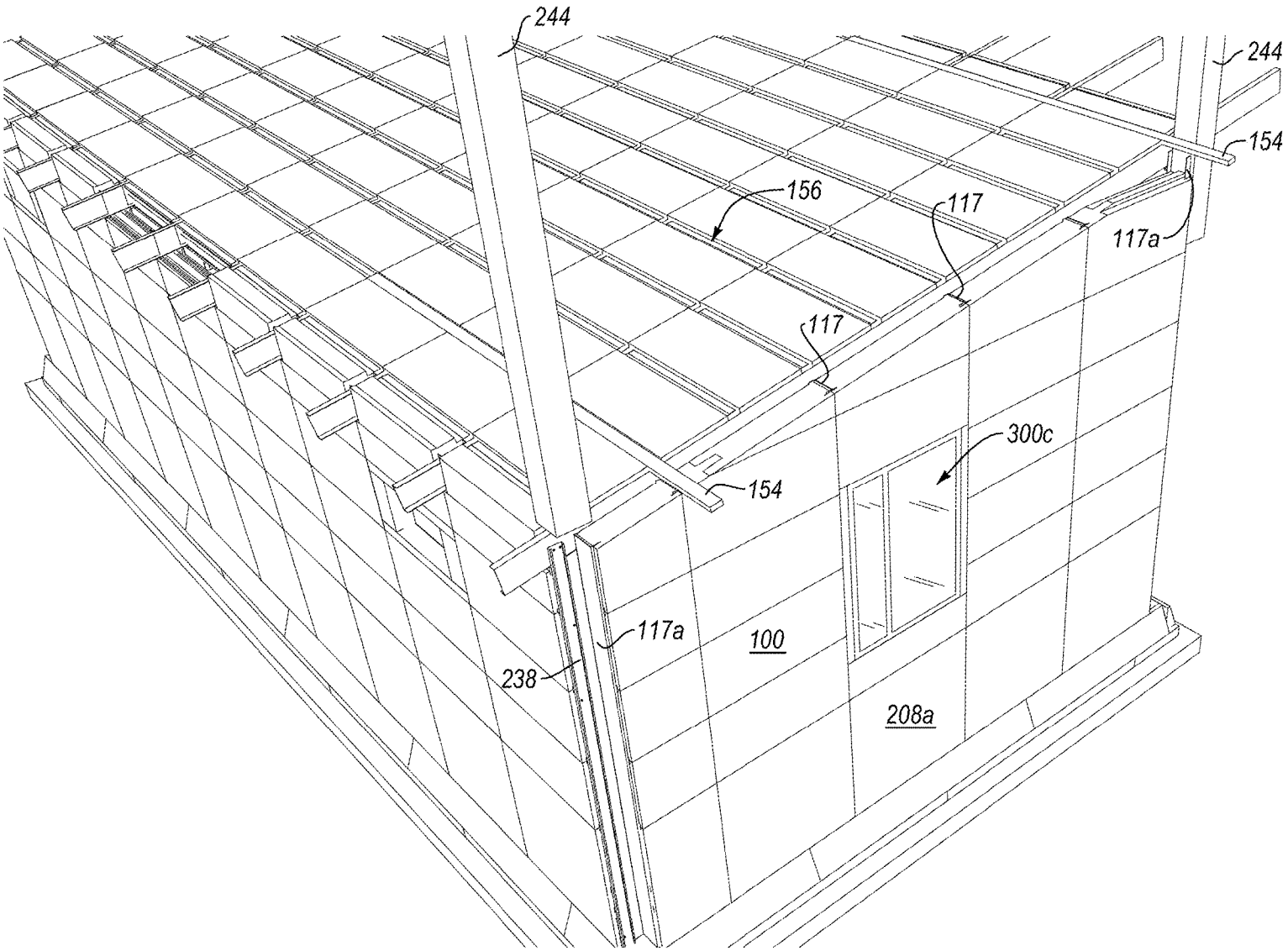

FIG. 113 shows positioning of corner foam members, which can be slid vertically down, over the special C-channel having flanges with a return lip. The corner foam members may include correspondingly shaped channels formed therein, to receive the flanges with a return lip. In other words, the corner foam member may be keyed in shape to the flange, allowing insertion of one into the other. Because of the return lip, such insertion may only be achieved by sliding the corner foam member down over the flange from above, rather than laterally from the side.

Figure 114:
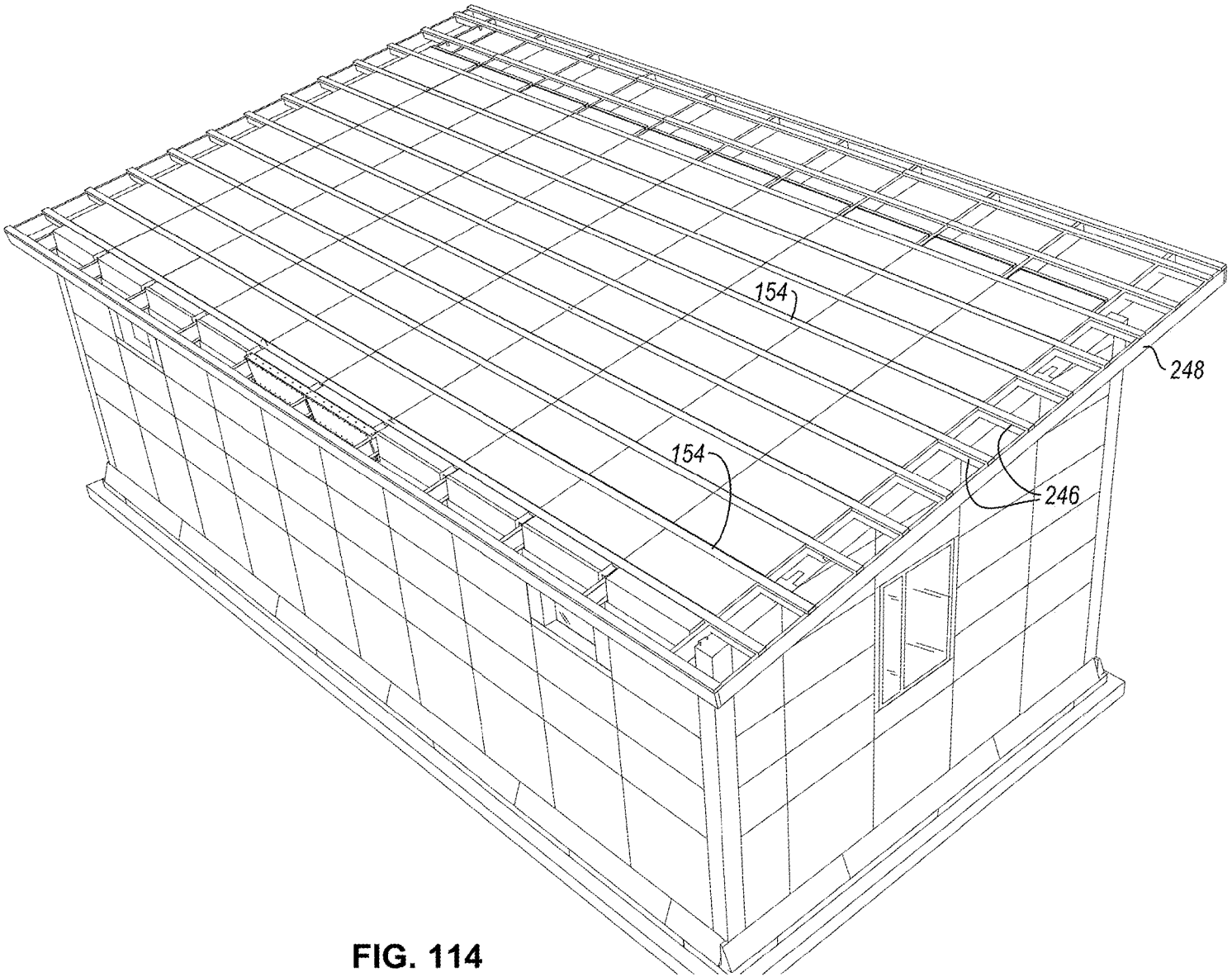

FIG. 114 shows insertion of roof purlins into the purlin channels of the roof panels. Each 2×4 purlin may be attached to each roof C-channel member at the intersections thereof, with screws (e.g., two 2½ inch #12 screws at each intersection). As shown, for each overhanging portion, short lengths of 2×4 may be attached under the purlins (e.g., with screws). Such small 2×4 pieces can be pushed snugly against the metal roof C-channel member prior to screwing to the corresponding purlin. 2×8 facia boards may be attached under the purlins, and to the short pieces of 2×4s, as shown.

Figure 115:
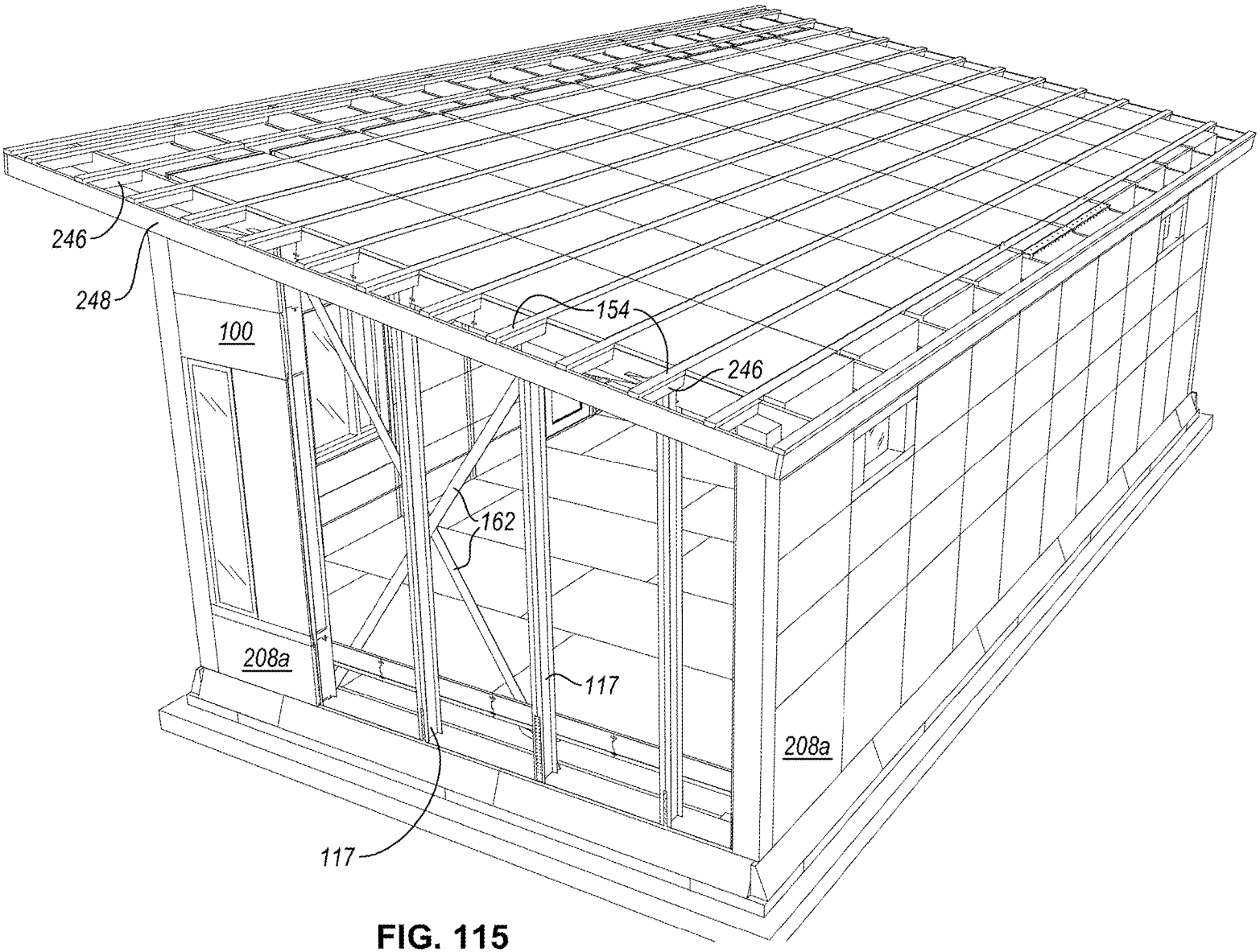

FIG. 115 shows how bracing may be added to the endwalls, or any desired wall, e.g., as 4" flat metal strap extending diagonally between desired vertical C-channel members, as shown. Attachment may be made with six ¼ inch screws at each attachment location (e.g., top and bottom). Such shear bracing may be positioned as desired, to achieve desired engineering objectives.

Figure 116:
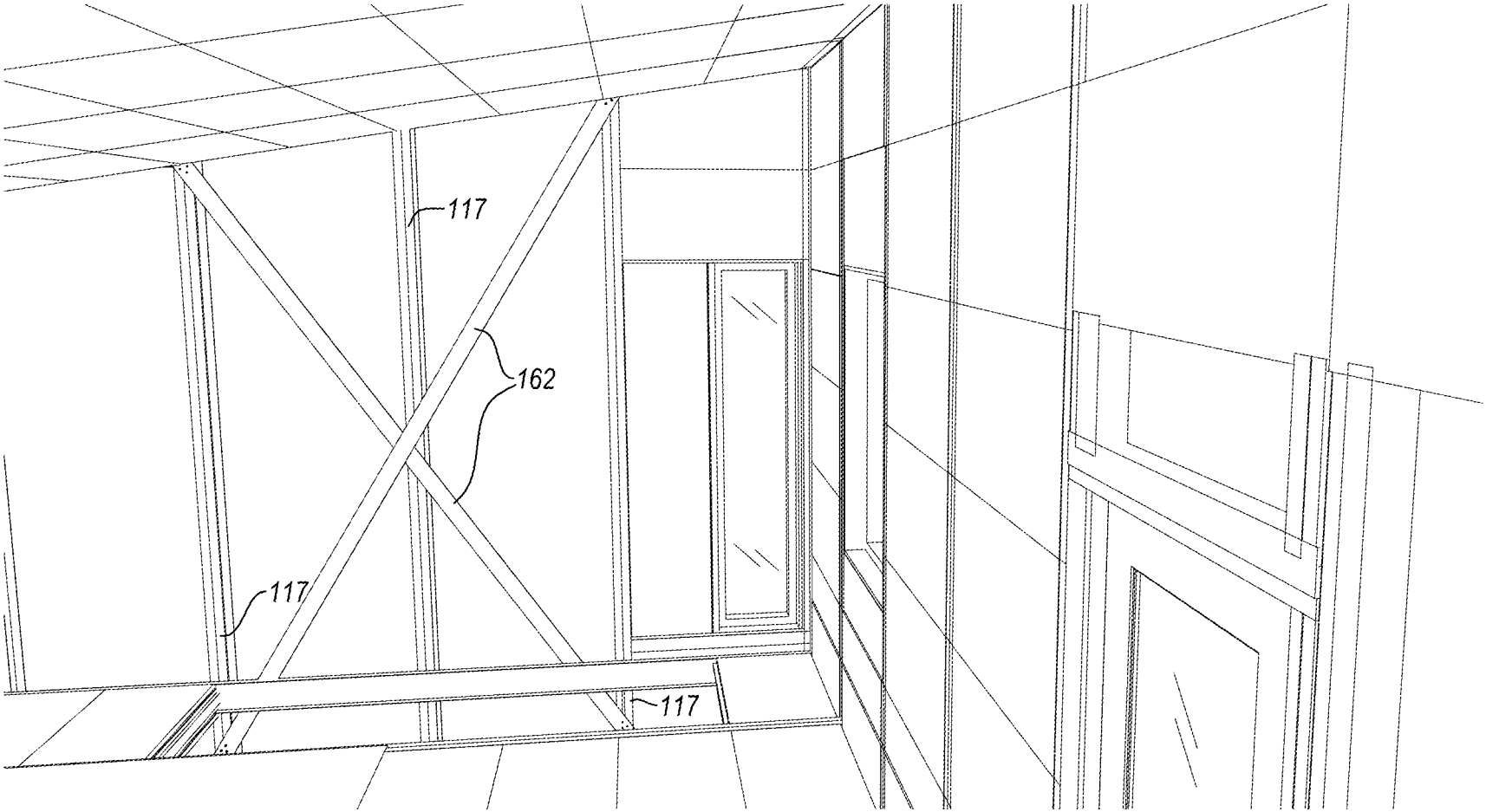

FIG. 116 shows an inside view of the shear bracing of FIG. 115.

Figure 117:
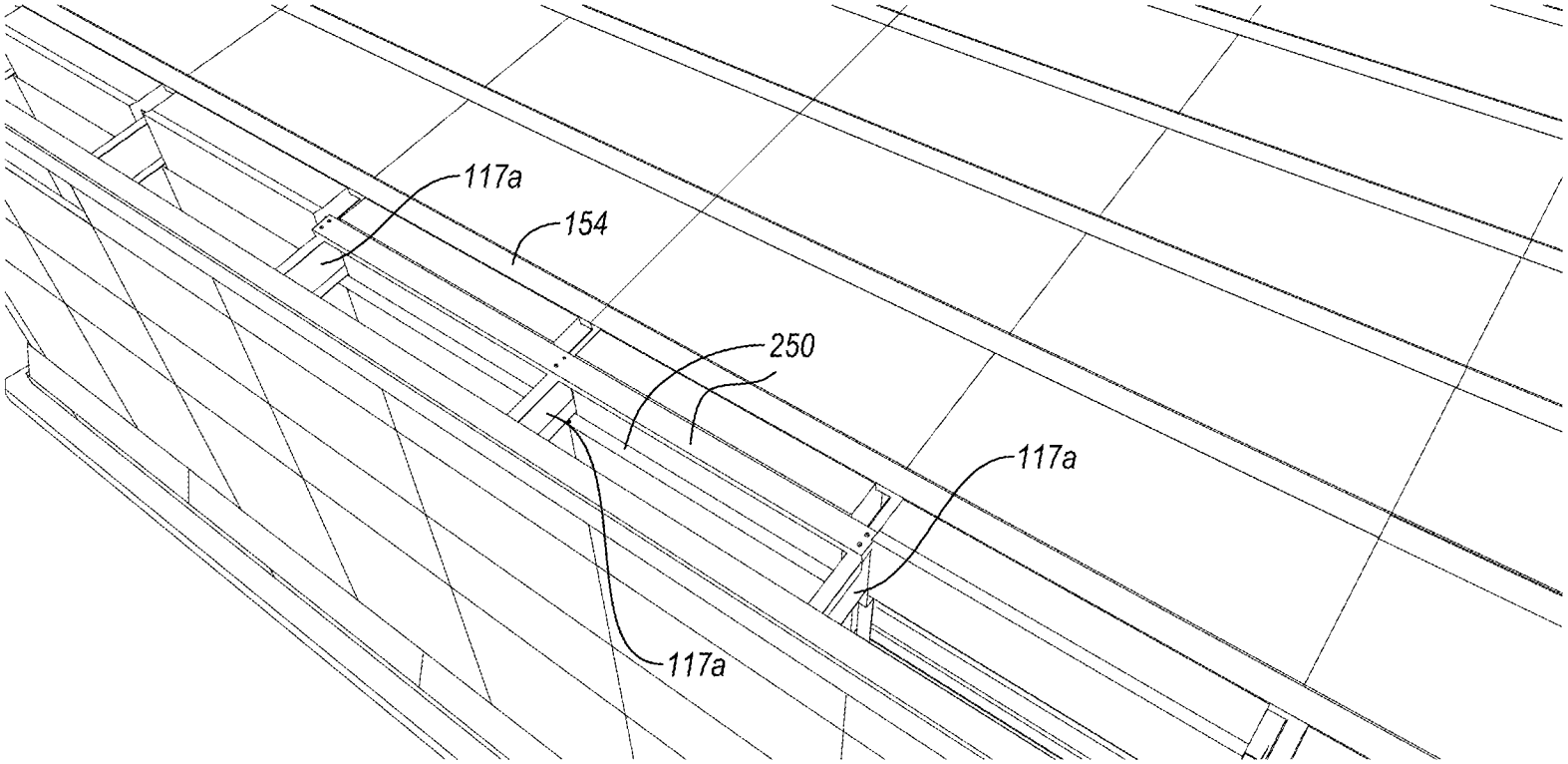

FIG. 117 shows how at any shear brace locations, a 2×4 may be attached below the roof frame members, e.g., with two screws into each vertical frame member. This Figure also shows how at such a shear brace location, an additional 2×4 may be attached to the roof frame members with two screws at each such intersection. The purlins and other lumber members provide attachment points for attaching metal roofing (e.g., screw metal roofing at 6" centers to the 2×4s).

Figure 118:
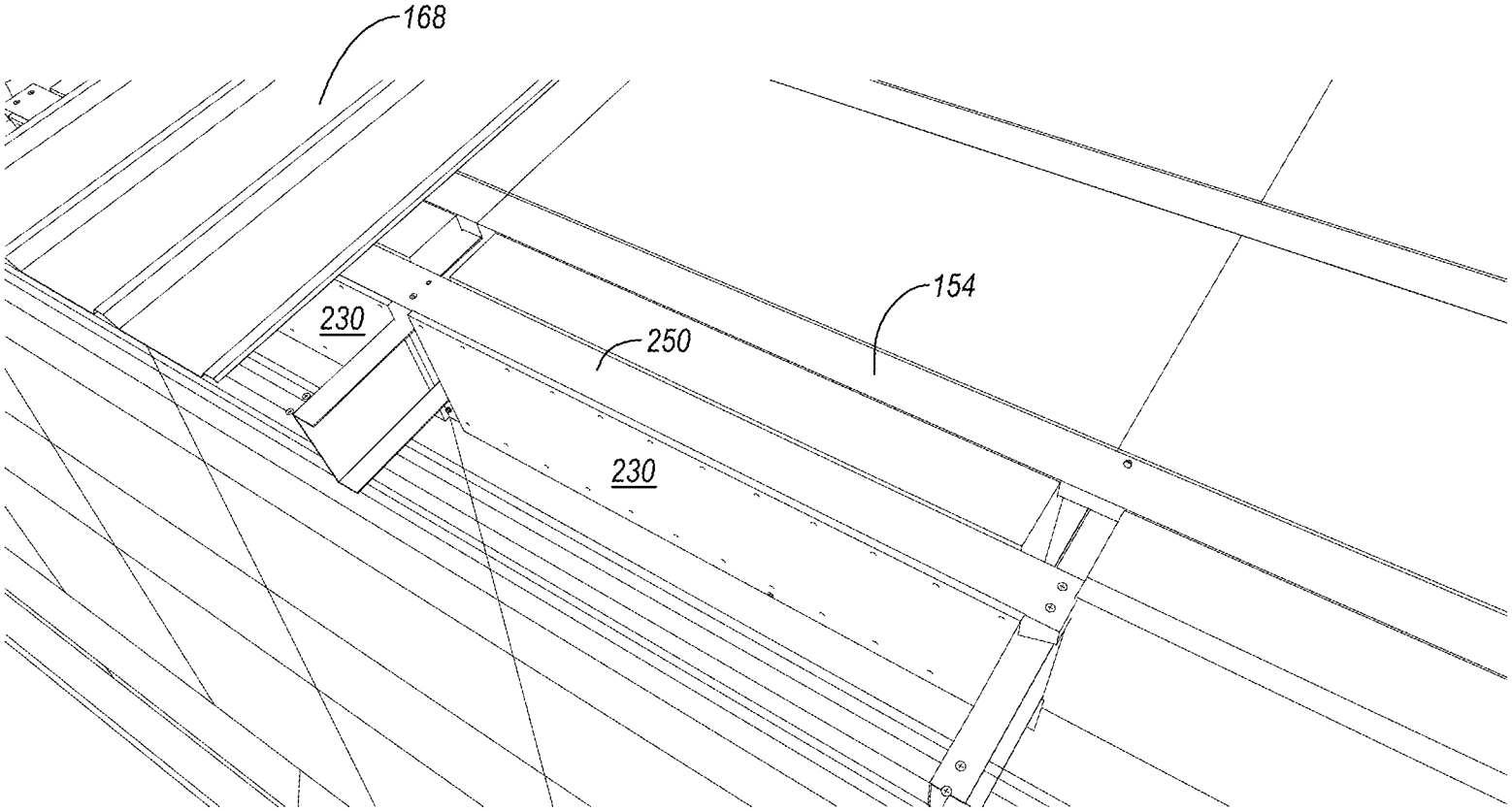

FIG. 118 shows attachment of plywood or OSB (e.g., 7/16" thick) sheathing to the top and bottom 2×4s every 6"), essentially forming a header, as shown.

DETAILED DESCRIPTION OF THE PREFERRED EMBODIMENTS

I. Definitions

Some ranges may be disclosed herein. Additional ranges may be defined between any values disclosed herein as being exemplary of a particular parameter. All such ranges are contemplated and within the scope of the present disclosure.

Numbers, percentages, ratios, or other values stated herein may include that value, and also other values that are about or approximately the stated value, as would be appreciated by one of ordinary skill in the art. A stated value should therefore be interpreted broadly enough to encompass values that are at least close enough to the stated value to perform a desired function or achieve a desired result, and/or values that round to the stated value. The stated values for example thus include values that are within 20%, 10%, within 5%, within 1%, etc. of a stated value.

All numbers used in the specification and claims are to be understood as being modified in all instances by the term "about", unless otherwise indicated. The use of "about", "substantially" and the like may particularly include values within the above stated variance (e.g., within 20%, 10%, 5%, 1%). Notwithstanding that the numerical ranges and parameters setting forth the broad scope of the subject matter presented herein are approximations, the numerical values set forth in the specific examples are reported as precisely as possible. Any numerical value, however, inherently contains certain errors necessarily resulting from the standard deviation found in their respective testing measurements.

It must be noted that, as used in this specification and the appended claims, the singular forms "a," "an" and "the" include plural referents unless the content clearly dictates otherwise.

Any directions or reference frames in the description are merely relative directions (or movements). For example, any references to "top", "bottom", "up" "down", "above", "below" or the like are merely descriptive of the relative position or movement of the related elements as shown, and it will be understood that these may change as the structure is rotated, moved, the perspective changes, etc.

All publications, patents and patent applications cited herein, whether supra or infra, are hereby incorporated by reference in their entirety to the same extent as if each individual publication, patent or patent application was specifically and individually indicated to be incorporated by reference.

II. Introduction

In one embodiment, the present invention is directed to modular building methods and systems where the building is constructed using lightweight foam modular panels in which the panels include one or more horizontal channels formed through the length of the lightweight foam body of the panel, and in which the panel is of a geometry where the cross-section is consistent, across its entire length (i.e., a geometry that could be extruded). The channels are configured to receive elongate splines, which may simply be flexible strips of OSB, plywood, aluminum, or the like. It will be appreciated that such splines do not necessary need to be formed of wood, such that metal splines, or even other materials (e.g., plastic, or otherwise) could be used. The splines and associated channels into which they are received are configured so that the splines are not exposed on an outside face of the lightweight body (at least once the construction is finished, if not before), but so that the spline is restrained in the wall (e.g., it can only slide in and out of the channel once placed—with 1 degree of freedom).

The channels may be configured to provide an interior horizontally positioned I-beam or other geometry beam in a wall (or floor or roof) constructed with such panels, where each horizontal I-beam is positioned between adjacent panels (e.g., vertically stacked panels in the case of a wall). The flanges and web of each I-beam may be formed from individual flexible elongate splines, such that the I-beam is not prefabricated, but is actually assembled in-situ, at the construction site, as the panels are positioned to build the wall structure. Of course, in another embodiment, the I-beam spline may be prefabricated, e.g., as shown in FIGS. 13-28. The horizontal I-beams may form part of a post and beam wall system, which the building system is particularly suited for. For example, the modular panels may be positioned between appropriately spaced apart vertical post members, while the horizontal I-beams run horizontally, between vertically stacked modular panels (i.e., along the wall's length). Where the panels are used for a floor, they may similarly be positioned adjacent one another (with the I-beam or other spline therebetween), with the panels positioned between appropriately spaced frame members. The frame may provide the overall shape of the building, and may actually bear substantially the full load, such that the panels of the walls are not necessarily load bearing. The roof may be similarly constructed from adjacent placed panels, with splines between each pair of panels.

The panels may include channels for additional horizontal splines, beyond those that accommodate the I-beams. For example, the panels may include top and bottom channels which receive splines, which may become or be the flanges of the I-beam. The panels may also include one or more interior channels (i.e., furring slots), e.g., positioned off-center relative to a thickness of the foam panel, towards the first and opposite second faces of the panel (which faces correspond to the inside and outside of a constructed wall structure). Such interior splines may serve as furring strips, for attachment points for nails, screws or the like, e.g., for sheathing or other material positioned over the wall, floor, or ceiling, away from the panel's top and bottom edges. In an embodiment, the standard panels used in constructing the walls, floor, and roof may not include any such furring slots, but such furring slots may be provided in one or more of the various types of transition panels (e.g., wall-to-floor transition panel, wall-to-roof transition panel or roof cap transition panel).

The modular panels may have a thickness (e.g., foam thickness) that is typically greater than 4 inches, e.g., 5.5 inches, (the same width as a 2×6) or 7.25 inches (the same width as a 2×8). Because the panels include a cross-sectional geometry that is consistent across the length of the panel, they provide excellent flexibility in constructing any desired wall structure or building. For example, the foam panels may easily be cut off at whatever appropriate length, where the wall ends, or where a door, window or other opening is needed, in the horizontal direction of the wall. The vertical direction of the wall is easily formed by simply stacking a desired number of the panels on top of one another, forming the in-situ formed I-beams between each pair of stacked panels. Where desired, the top of a top-most panel could also be cut off, to accommodate an overall desired wall height, or the top-most standard wall panel may be topped with a transition panel (e.g., an upper story wall-to-floor transition panel or a wall-to-roof transition panel) as described herein that is configured to connect the wall panels to roof panels (in the case of a wall-to-roof transition panel) or to connect the wall panel to floor panels and wall panels of an upper story (in the case of a upper story wall-to-floor transition panel). Such a transition panel may include one or more wall portions (e.g., wall leg(s)) that engages with the top-most wall panel, making up any desired additional wall height, allowing a user to accommodate any desired wall height. The wall-to-roof transition panel also includes a roof portion (e.g., roof leg) that similarly engages with the adjacent standard roof panel. The roof leg can be configured to have a desired length, to accommodate any desired roof length (e.g., where the length of the roof is not divisible into a whole number of standard panels (e.g., each 2 feet). An upper story wall-to-floor transition panel can be T-shaped, including two wall legs (one for the lower story wall, one for the upper story wall, and a floor leg), therebetween.

The modular panels can be formed on a CNC hot wire cutting device, where all necessary deep cuts are formed (as it can be difficult to accurately cut foam material thicker than about 2 inches without such a device). Because the panels are formed under such conditions, during manufacture, high precision and accuracy are possible (which may not be practical to achieve on a job site). Furthermore, by cutting the panels on such a CNC device, the rectangular panels themselves can be formed to very high precision and accuracy dimensions. For example, a 2 foot by 4 foot, or 2 foot by 8 foot panel, 5.5 or 7.25 inches thick will be perfectly "square" and plumb, allowing the panel itself to be used as a square, level, or jig. This characteristic greatly reduces the need for skilled labor, as the panel itself serves as a template (i.e., no tape measure or square is needed). This helps to ensure a robust composite structure having the proper geometry (e.g., right angled walls where such is desired, level floors, level ceilings, and the like).

The present methods and systems of assembly allow for relatively open source construction, with a relatively high degree of customizability to the building being constructed, all achievable at lower cost and/or time as compared to existing methods of construction. Furthermore, even with such relative flexibility, little if any skilled labor is required. For example, a model or blueprint image of the building to be constructed could simply be provided, with the crew only being required to connect the modules as shown in the model or blueprint (e.g., akin to LEGO instructions).

It is also advantageous that the foam material (e.g., expanded polystyrene, or other foamed insulative materials) from which the modular panels are constructed may be readily available nearly anywhere, such that the foam panels may be manufactured at a foam production facility near the construction site (minimizing shipping distance and expense). This provides savings and convenience in that the foam panels can be manufactured locally, avoiding the significant expense of shipping foam (which occupies a large volume, even though it weights little).

For example, such foam may typically have a density from about 1 lb/ft$^3$ to 2 lb/ft$^3$, and provide an insulative value of about R4 per inch of foam thickness. A wall constructed using a 5.5 inch or 7.25 inch thick foam panel as described herein may provide an R value of about R25 or R30, respectively.

III. Exemplary Construction Methods and Systems

Figure 1:
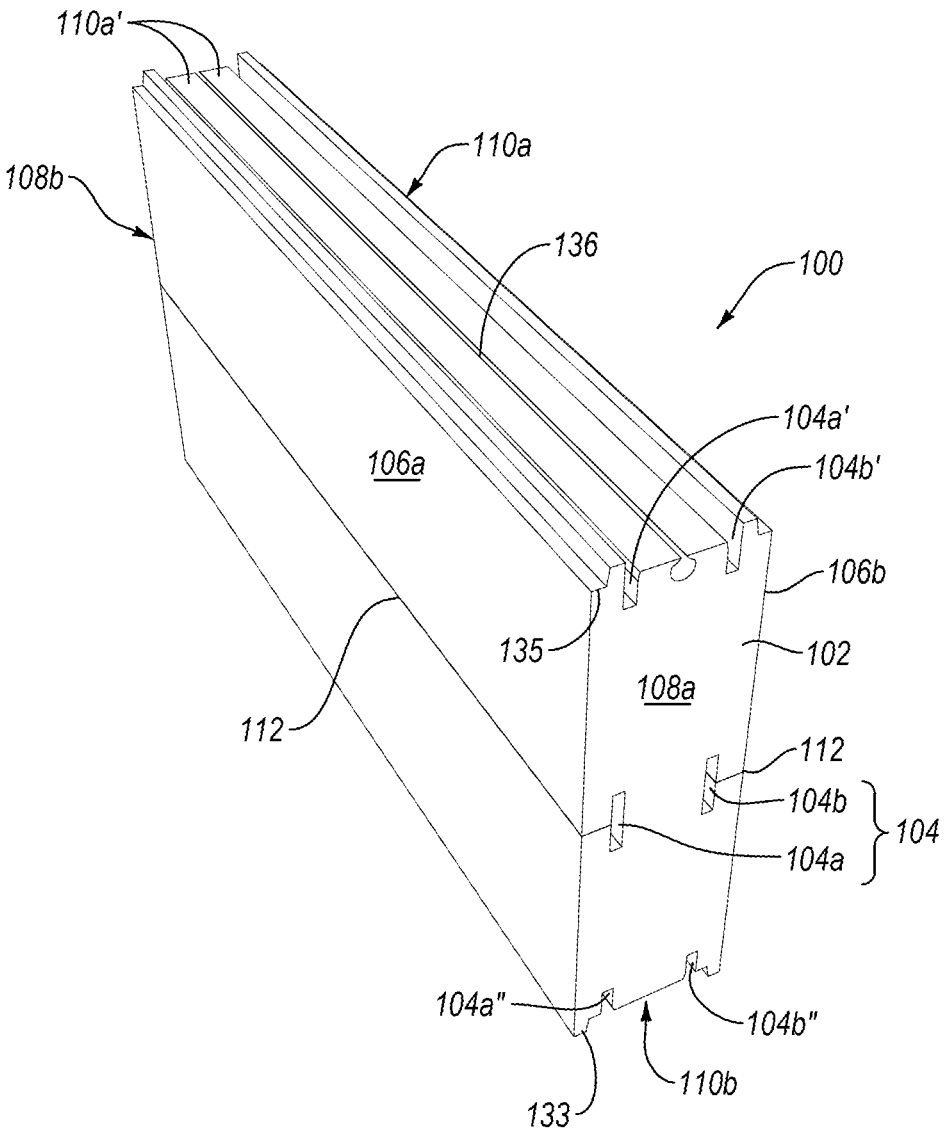
FIG. 1 is a top isometric view of an exemplary modular panel as described herein.
Figure 2:
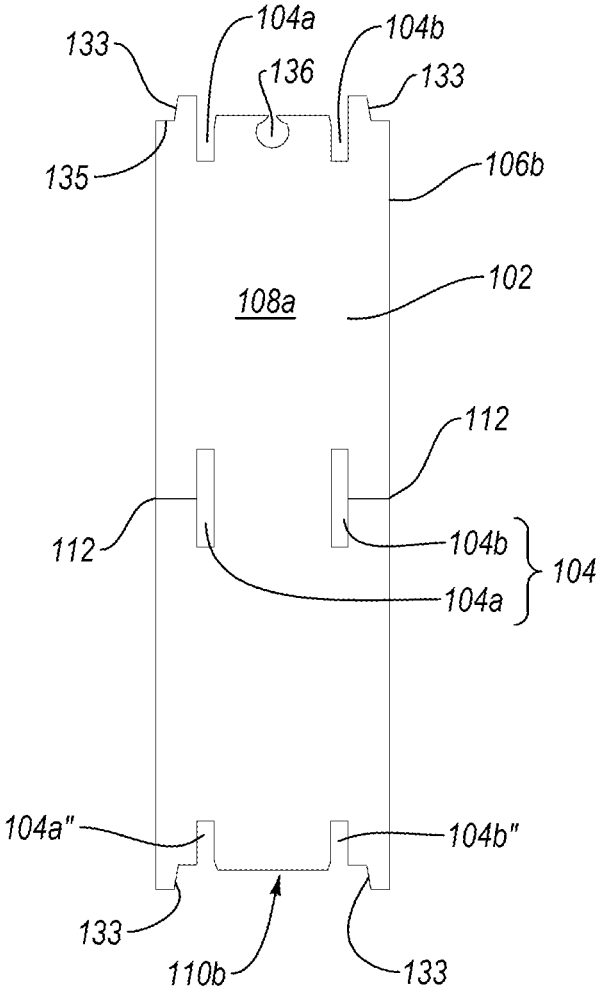
FIG. 2 is an end view of the modular panel of FIG. 1.
Figure 3:
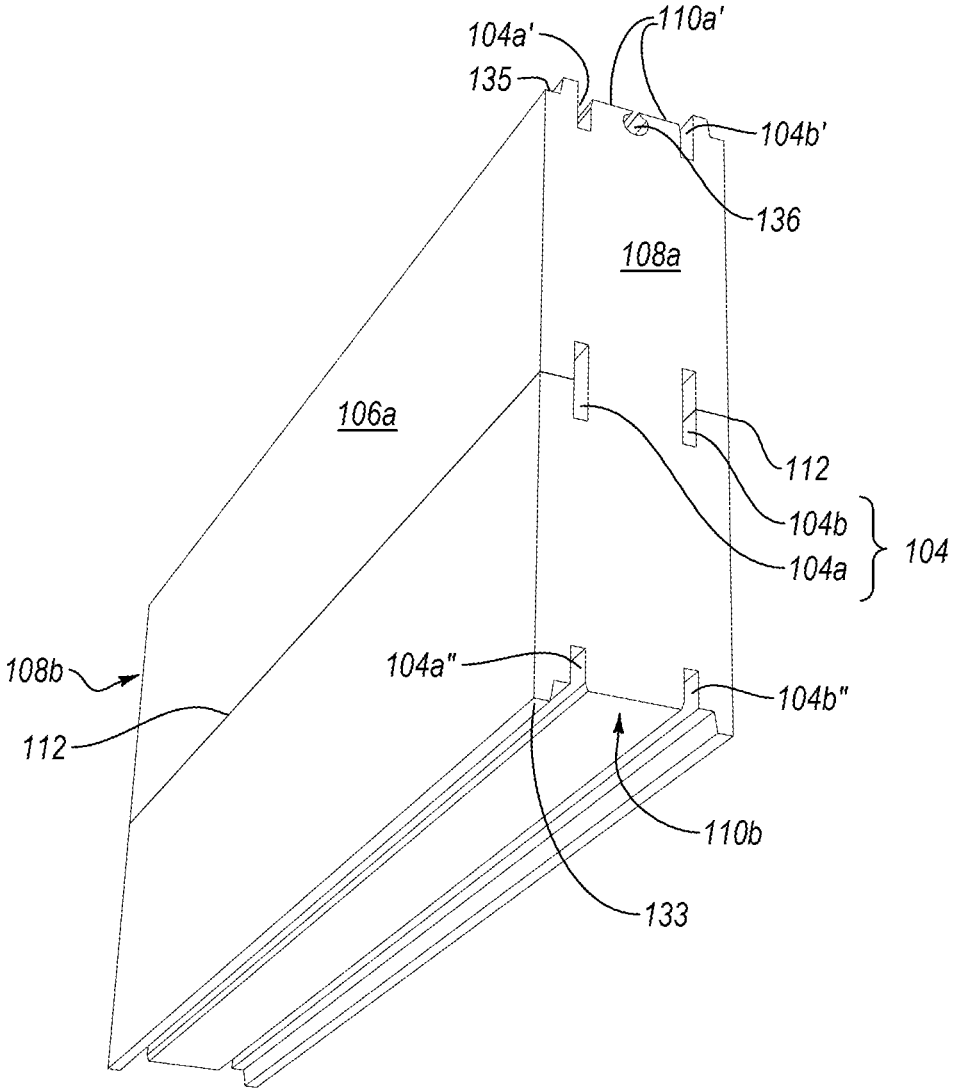
FIG. 3 is a bottom isometric view of the modular panel of FIG. 1.

FIGS. 1-3 show a modular panel 100 according to the present invention. Such panels can be used in building construction, and advantageously are typically fully compatible with existing building codes and standard construction practices, such that adoption of such a building system would not present the many regulatory and other hurdles associated with various other construction systems that have been proposed, some by the present Applicant.

Modular panel 100 includes a lightweight body 102. Body 102 may comprise or otherwise be formed from a foam material, such as expanded polystyrene (EPS) foam. Such material may be rigid. Such panels may be precision cut from blocks of rigid, already cured EPS foam. For example, EPS foam is often available as 3×4×8 foot blocks. Such a block may be sufficient to produce several modular panels as shown in FIG. 1, which may each measure 2×4 feet (or 2×8 feet), with a thickness of 7.25 inches (width of 2×8 dimensional lumber). While EPS foam may be particularly appropriate, other lightweight materials that can be molded (as the 3×4×8 foot EPS blocks are molded), easily cut using CNC hot wire cutting device, formed by extrusion etc. may also be used.

Each panel 100 includes one or more (e.g., a plurality of) channels 104 extending horizontally through the length of panel 100. In the illustrated configuration, panel 100 includes first and second interior channels 104*a*, 104*b*, each of which is positioned off-center relative to the thickness of foam body 102, with channel 104*a* positioned towards (i.e., closer to) panel face 106*a* and channel 104*b* positioned towards panel face 106*b* (i.e., closer to panel face 106*b* than the center of the thickness of foam body 102). Panel 100 also includes top and bottom channels, which will be discussed in further detail hereafter. In an embodiment, such a panel may actually not include the interior channels 104*a*, 104*b*, but only the top and bottom channels (i.e., the interior channels are optional). Each of channels 104*a*, 104*b* is sized and shaped to receive therein a flexible elongate spline, where the channels 104*a*, 104*b* are not open at faces 106*a* and 106*b* of panel 100, but are only open at left and right sides 108*a*, 108*b* of panel 100. In an embodiment, splines 116 are advantageously not dimensional lumber, which although readily available, is notorious for being warped, making it difficult to slide such a spline through any of such channels. Rather, splines may be formed from oriented strand board ("OSB"), plywood, aluminum or another material that is easily inserted into such a channel. The spline may exhibit significant flexibility in the direction of the thickness of such sheet material. Such flexibility is readily apparent when holding such a strip of such sheet material at one end, as the other end will flex significantly downward under the weight of the sheet or strip alone. Such does not occur to the same degree with dimensional lumber, even in the same dimensions, as such dimensional lumber is significantly more rigid. Such OSB or similar spline materials are easily obtained, e.g., by ripping sheets of OSB or the like, which are as readily available as dimensional lumber, but with better flexibility in such direction, while exhibiting minimal if any warping. Although such OSB strips are a particularly suitable material, it will be apparent that a variety of other wood, plastic, or even metal materials (e.g., aluminum) could alternatively be used for splines.

Channels 104*a*, 104*b* within panel 100 have dimensions just slightly larger than those of the elongate spline so as to not bind within the channel, but so as to be freely slidable therein (e.g., a clearance of 1/16 inch or so, as will be apparent to those of skill in the art, may be provided). FIG. 1 also illustrates the presence of reduced-size (e.g., half-size) top channels 104*a*' and 104*b*' at top end 110*a* of panel 100, and reduced-size (e.g., half-size) bottom channels 104*a*" and 104*a*" at bottom end 110*b* of panel 100. Such reduced-size (e.g., half-size) channels may be similar to interior channels 104, but are exposed at the top or bottom of the panel (although not exposed at the panel faces 106*a*, 106*b*), and may be intended to accommodate splines that run through the reduced-size channel (e.g., half height), and another reduced-size (e.g., half-size) channel of an adjacent panel 100 stacked above or below the illustrated panel, when constructing a wall. Such splines in top and bottom channels 104*a*', 104*b*', 104*a*" and 104*b*" may form the flanges of an I-beam which is horizontally positioned, between adjacent stacked panels. It will be apparent that geometries other than an I-beam could also be used, although the term "I-beam" is used for simplicity, and can be construed broadly, to include other such possible geometries. As shown in FIGS. 13-28, rather than using initially separate splines, pre-fabricated I-beams may be employed. Splines within interior channels 104 may not form part of an I-beam, but may serve as furring strips providing excellent attachment points within the panel, e.g., when securing drywall or other sheathing material over one or both panel faces 106*a*, 106*b*. Such splines in interior channels 104 may thus be optional, and may also increase the strength characteristics (e.g., shear) of the resulting wall, where included.

The channels (particularly top and bottom channels 104*a*', 104*b*', 104*a*" and 104*b*") which are associated with the internal horizontally extending I-beams that are formed in-situ, as the wall is assembled (or provided installed prefabricated) may be spaced apart from one another to accommodate any particular desired spacing of such I-beams, as dictated by the height of each modular panel. For example, in the illustrated configuration where the panel 100 is 2 feet high, such I-beams will be provided horizontally, 2 feet apart, between adjacent panels. Taller or shorter panels could be provided where it is desired to adjust such spacing. Similarly, the panel length (e.g., 4 or 8 feet) may dictate the spacing of adjacent vertical posts of the frame in the wall, which may be provided between adjacent panels placed side by side (while I-beams are provided between adjacent panels stacked one on top of another). Spacings other than 4 feet (e.g., 8 feet, 12 feet, etc.) for such posts or other frame members, and for the panel length may be possible. Such spacing characteristics are well accepted within the building industry, and compatible with existing building codes, which allows the present panels and systems to be readily accepted and implemented, once made known by Applicant. Importantly, when a spline is received into any of the channels (104*a*, 104*b*, 104*a*', 104*b*', 104*a*" or 104*b*"), the spline is not exposed on either exterior face 106*a* or 106*b* of panel 100. Applicant has found that other systems that provide for structural members or other features that are exposed on the exterior of a panel exhibit a "ghosting" problem, in that even once such structures are finished over, because of the different material characteristics underlying drywall or other sheathing associated with such surface exposure at the face during framing, there is a noticeable "ghost" that shows up through paint or other interior or exterior wall finishes that plague such systems. It is thus important that no such spline surface exposure is provided with the present panels. For example, particularly in the standard panels, the full interior and exterior faces 106*a*, 106*b* are provided entirely by the material from which the lightweight foam body is formed (e.g., EPS). Even in the wall-to-floor transition panel described in further detail below, even though the I-beam spline is provided exposed on the major planar face of the panel, this portion of the major planar face is covered, adjoining the adjacent standard floor panel in the finished construction, preventing any ghosting problem that might otherwise be associated therewith.

In addition to "ghosting" issues, exposure of splines on the exterior surface also can result in thermal bridging problems, e.g., particularly where metal sheathing is present (e.g., on a roof or otherwise). By ensuring that the splines are positioned internally, rather than externally exposed, there is less of a problem of thermal bridging through the wall, which increases overall insulative efficiency of the wall, roof, floor, or other building structure constructed therefrom. Where thermal bridging occurs, undesired condensation can often occur in such spots due to a thermal gradient associated with such thermal bridging. The present systems ensure there is a thermal break between such structural spline members and any metal or other sheathing that may eventually be placed over roofs, walls, or the like.

Furthermore, because the splines are positioned within the panel thickness, with approximately 1 to 2 inches of foam thickness between the spline and the nearest face, building codes do not require that electrical wiring (e.g., 120V) be run within conduit, as there is at least 1.5 inches between the exterior of any sheathing (e.g., ½ inch or ⅝ inch drywall or the like) applied over the panel and such electrical wiring. In addition, as shown in FIG. 1, the panel may actually include an internal raceway 136 for receipt of electrical wiring, etc.

In FIG. 1, channels 104*a*, 104*a*' and 104*a*" are all vertically aligned with one another, spaced an equal distance from the face 106*a* of panel 100. Similarly, channels 104*b*, 104*b*' and 104*b*" are all also vertically aligned with one another, spaced an equal distance from face 106*b*. Because the channels are not centered in the panel's thickness, but are offset towards the respective faces, two such channels are provided at a given height, horizontally aligned with one another (e.g., channels 104*a* and 104*b* are at the same height, channels 104*a*" and 104*b*" are at the same height, and channels 104*a*' and 104*b*' are at the same height). While it may be possible to flip the panel 90°, such that the I-beams would run vertically, the illustrated horizontal orientation of the panel (horizontal length greater than vertical height) is particularly advantageous in wall construction, as most variation in wall constructions occurs horizontally, rather than vertically (e.g., most walls are of a given height, with little variation beyond such standard heights). That said, in some constructions, at least some of the panels may be flipped, to be oriented with the length dimension running vertically.

The channels are offset towards one of the two faces 106*a*, 106*b* of the foam body 102, with two channels at each given height (e.g., interior channels 104*a*, 104*b* are at a central portion (e.g., the middle) of the height, channels 104*a*" and 104*b*" are at the bottom of the panel, and channels 104*a*' and 104*b*' are at the top of the panel. Because 2 channels are present at any given height, equally spaced from their respective faces, the same length fasteners can be used to attach sheathing on one face of the panel versus the other face.

In any case, when attaching such drywall or other sheathing, the present system avoids point loading onto screws, nails, or other fasteners employed, because of the foam thickness (e.g., 1 to 2 inches) between the sheathing and the spline encased within the foam panel. Such avoidance of point loading can be beneficial in an earthquake or the like, which may otherwise cause such fasteners to shear off.

In addition to the various internal, top and bottom channels described, the illustrated panel 100 further includes a pre-cut slot 112 in face 106*a* of panel 100, centered relative to channel 104*a*. Pre-cut slot 112 extends from first face 106*a* into channel 104*a*. For example, such a pre-cut slot allows internal formation of channel 104*a* in body 102 with a CNC controlled hot wire cutter. The width of slot 112 is advantageously very narrow, e.g., rather than providing a wide opening from channel 104*a* to the area adjacent face 106*a*. For example, where the height of channel 104*a* may be just over 3 inches (e.g., to accommodate a 3 inch spline), the width of slot 112 (the width of which is parallel thereto) may be no more than 0.25 inch, or no more than 0.125 inch. Stated another way, the width of slot 112 may be no more than 20% of, 15% of, 10% of, or no more than 5% of the transverse cross-sectional height of channel 104*a*. On the face 106*b*, opposite face 106*a*, there is shown another pre-cut slot 112, identically configured, but with respect to channel 104*b* and face 106*b*. The alignment of slots 112 with interior channels 104 is further beneficial once a wall structure has been built, where the panels are stacked one over another, as the channels and splines may no longer be visible. The slots 112 are visible in such circumstances, allowing a user to quickly and easily see where the splines are located within a given wall structure. Such slots 112 make attachment of drywall or other sheathing over the foam panels very easy, as the slots 112 mark the location of the center of the splines, which are easily nailed or screwed into, through the thickness of the foam between channels 104 and each respective face 106*a*, 106*b*. As internal channels 104*a*, 104*b* are optional, if they are not included, the pre-cut slots may also be omitted. In such instances, the positioning of the I-beam flanges (which also serve as attachment points for drywall or other sheathing) at the edge, or interface between adjacent panels similarly allows a user to quickly and easily see where the splines are located, for easy attachment of drywall, etc.

Figure 4:
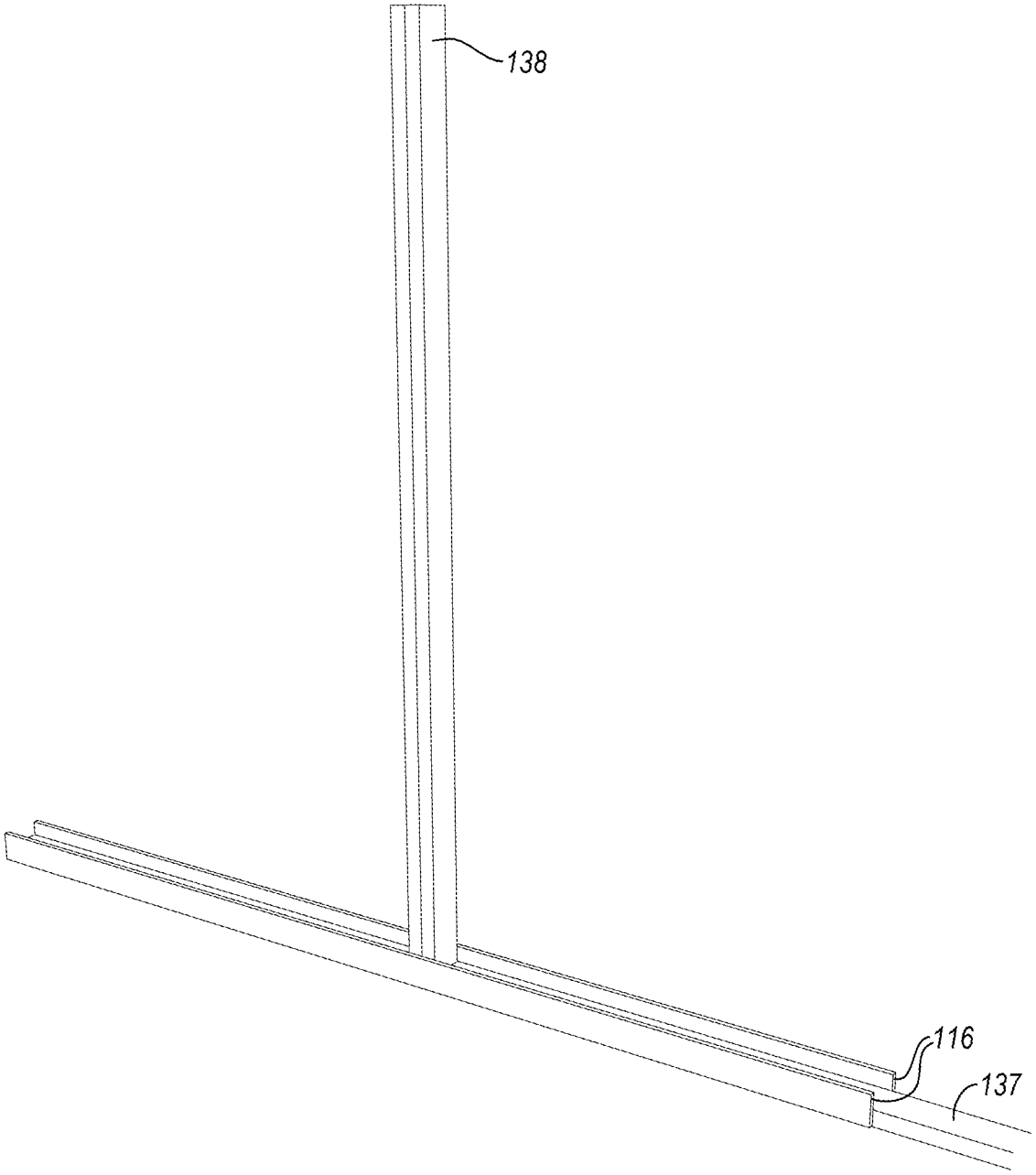
FIG. 4 is a isometric view showing a vertical post against which the modular panel can be positioned and attached to, as well as a bottom plate and bottom flange splines, for reception into a first layer of placed modular panels.
Figure 5:
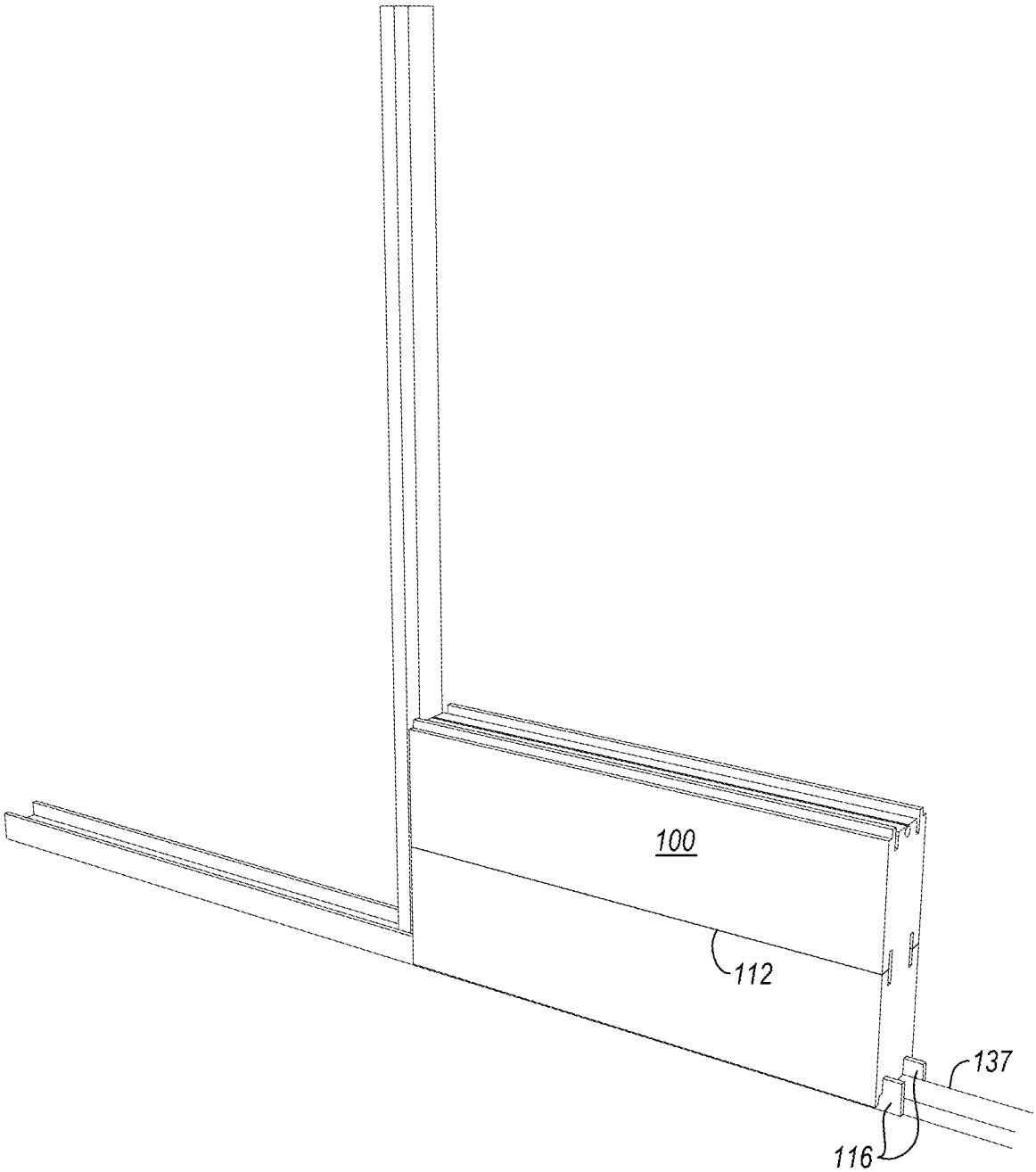
FIG. 5 is a isometric view showing the vertical post, bottom plate and bottom flange splines of FIG. 4, with a modular panel positioned over the bottom plate, with the splines inserted into the bottom channels of the modular panel.

FIGS. 4-8 show progression of construction of a wall structure using a plurality of exemplary panels 100, in a post and beam type construction. The horizontal beams are provided by in-situ formed I-beams, that can be initially provided to the construction site prior to installation as lengths of separate OSB or similar elongate spline material, which splines are positioned in channels or on top and/or bottom of such panels to form the I-beams in place, as the wall is constructed. Prefabricated I-beams could also be used. The vertical posts of the system are placed between adjacent panels oriented side by side, for the wall. In FIG. 4, there is shown a vertical post 138 (e.g., two 2×4s), positioned on a bottom plate 137 (e.g., a 2×4, other dimensional lumber, or the like) sandwiched between two splines 116 (which splines 116 will be inserted into bottom channels 104*a*" and 104*b*") of panel 100. FIG. 5 shows one panel 100 in place relative to vertical post 138, bottom plate 137 and bottom splines 116.

Figure 6:
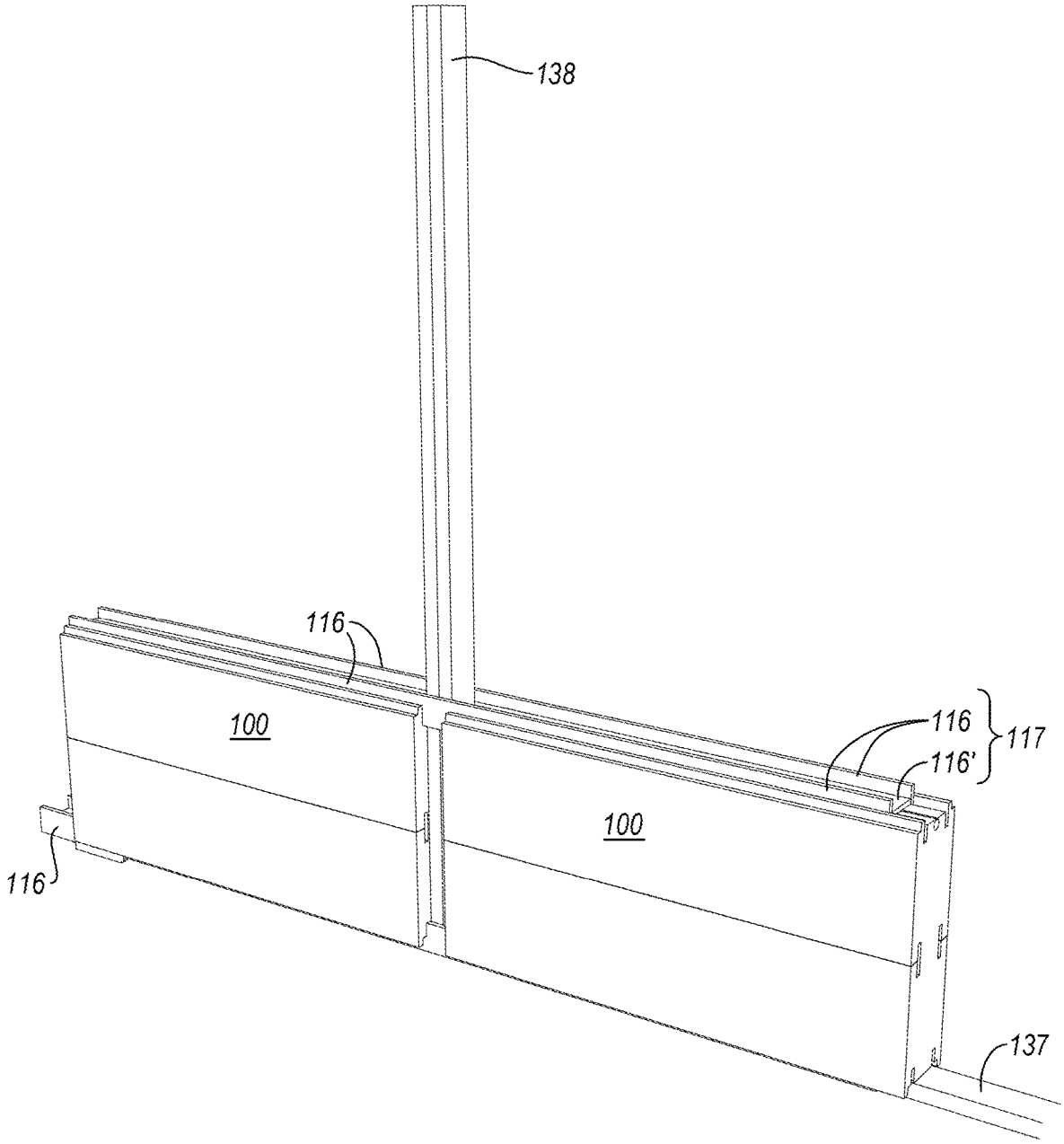
FIG. 6 is a progression from FIG. 5, showing placement of another panel on the opposite side of the post, showing how the various splines may span across both modular panels, sandwiching the post between the splines, and also showing splines positioned to form an I-beam formed from components placed into the top channels, and over the top of the modular panel. In another embodiment where the spline extends beyond the end of the panel, this may be accomplished with an ear bracket, spanning between the portion of the flange in the panel, and the post.

FIG. 6 shows two panels 100, positioned side by side, with vertical post 138 there between, separating the panels 100. FIG. 6 also shows the 3 components for the in-situ formed I-beam positioned on the top of panels 100. The vertical flanges of the horizontally extending I-beam are provided by splines 116 positioned in top channels 104*a*' and 104*b*', while the web 116' of the I-beam 117 is provided by another spline (e.g., also an elongate strip of OSB or other suitable material), laid on the top planar edge 110*a*' at the top of panel 100. The web spline 116' has a width equal to the spacing between top channels 104*a*' and 104*b*', so as to span the distance between splines 116 placed therein, so that the two splines 116 (flanges of I-beam 117) and web 116' together form the I-beam. The 3 pieces of the I-beam 117 may be inserted one at a time, and glued together where such members 116, 116' contact one another (i.e., the sides of web 116'). Adhesive may also be applied in channels 104*a*' and 104*b*' and on planar surface 110*a*', to secure the I-beam 117 within panel 100. A panel could be provided with web spline 116' already glued or otherwise secured to the top planar face 110*a*' of panel 100, if desired. A pre-assembled I-beam 117 could also be used, e.g., as shown in FIGS. 13-28.

While web spline 116' may only have a length that is equal to that of the panel 100 (e.g., 4 or 8 feet), the splines that form the flanges of the I-beam 117 may have a length greater than the panel, so as to extend across the vertical post 138, as shown in FIG. 6. Such extension beyond the panel 100 of the flange 117 can also be achieved with ear brackets, as shown in FIGS. 13-28. Splines 116 of I-beam 117 could be nailed, screwed, glued, or otherwise secured to vertical post 138 at this junction, between adjacent side-by-side panels 100. Use of "ear brackets" for attachment of the I-beam to the frame members is described and shown in further detail below, in conjunction with FIGS. 13-28. In an embodiment, shorter splines could also be used, e.g., but still span from one panel 100, across vertical post 138, to the adjacent panel 100 (e.g., length of 4 feet, or even less). It is not necessary that the flanges of the I-beam be formed from single continuous pieces of OSB or other suitable material. For example, short lengths of OSB or metal waste material, which could be short pieces (e.g., 1 foot, 2 feet, 3 feet, 4 feet, etc.) could be fed into channels 104*a*', 104*b*' to form each flange of the I-beam 117. Because such short lengths would be constrained within stacked top and bottom channels (e.g., 104*a*' and 104*a*"), and may be glued in place, they will provide a sufficiently strong I-beam for the post and beam wall construction systems described herein.

Figure 7:
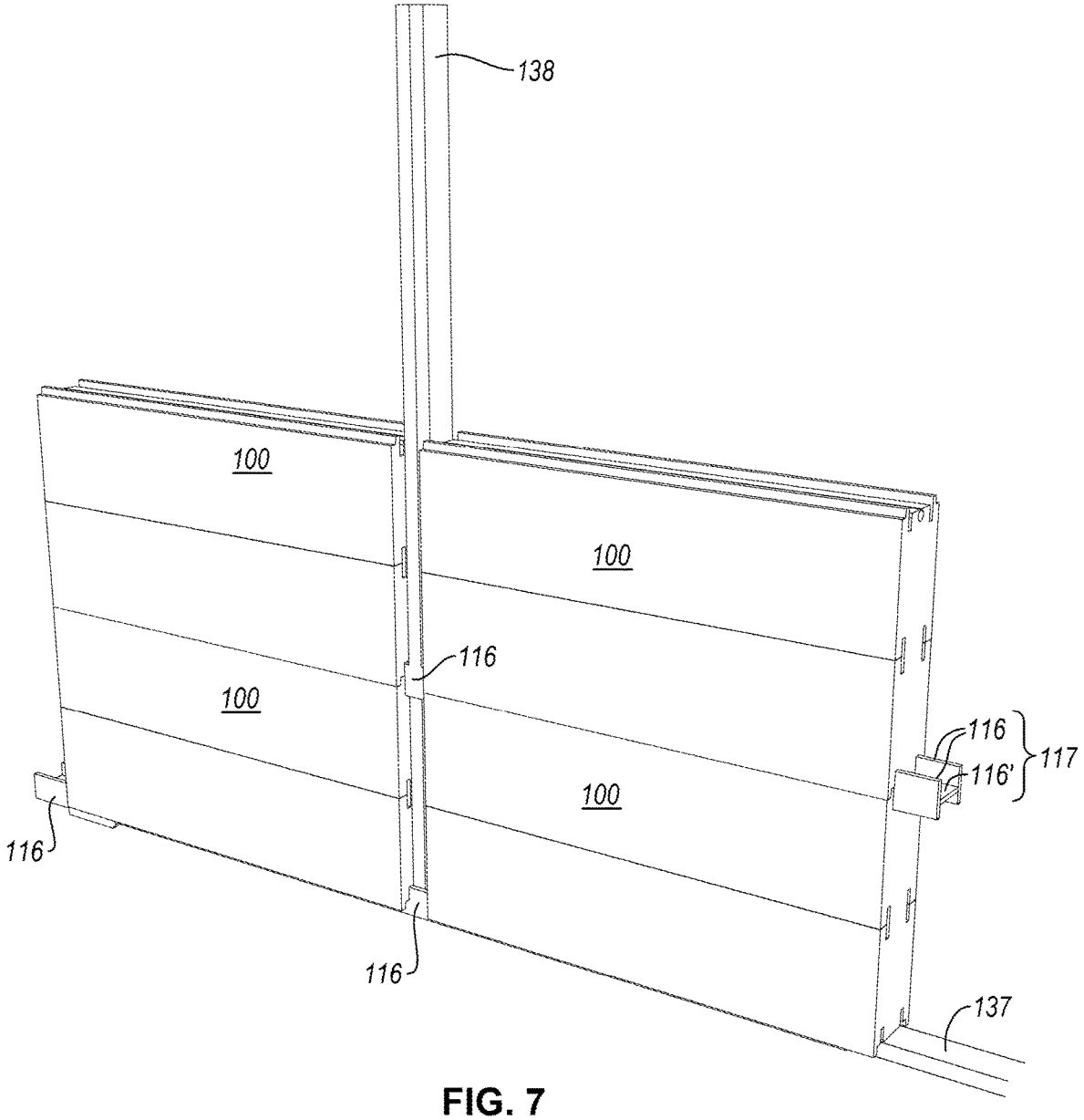
FIG. 7 is a progression from FIG. 6, showing placement of an additional stack of panels over the first layer of panels, with an in-situ formed I-beam constructed on site, therebetween.

FIG. 7 shows a further progression of the wall construction, now with 4 panels 100, two side-by-side, and two stacked one on top of another. There is no need to stagger seams between panels, although they could be staggered, if desired. While FIGS. 5-7 do not show splines 116 inserted into interior channels 104 of the panels 100 in order to better show other features, it will be appreciated that splines 116 can be inserted into any or all of such interior channels 104, as desired.

Figure 8:
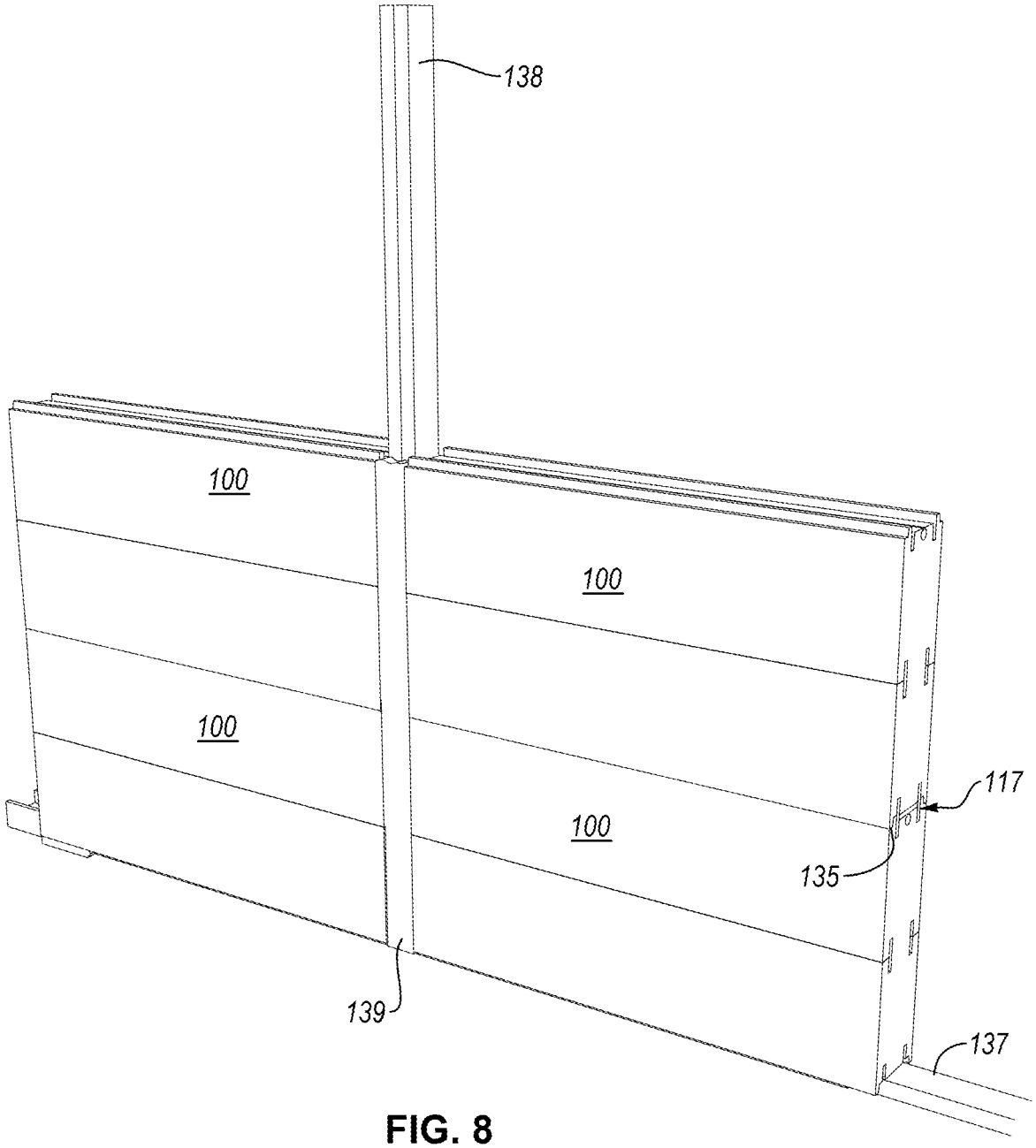
FIG. 8 is a progression from FIG. 7, showing a foam filler member installed over the vertical post, creating a flush surface across the panels on either side of the post.

FIG. 8 is similar to FIG. 7, but shows a filler piece 139 of foam positioned over the vertical post 138, to fill the gap between adjacent side by side positioned panels 100. For example, the illustrated wall may be 2 panels wide, and 2 panels high (e.g., about 8 feet long, 4 feet high). By stacking another 2 heights of panels, the wall may be 8 feet high. Any height may be achieved by simply stacking the needed number of panels, with an I-beam horizontally oriented between each set of stacked panels. Any length may be provided to such a wall, by simply placing additional vertical posts (e.g., at 4 foot intervals, or other interval), with one column of panels positioned between such posts. As is further evident from FIG. 8, where one panel 100 is stacked on top of another panel 100, there is an overlap profile between the adjoining panels at the seam 135, which prevents water from entering at what might otherwise be a simple horizontal seam between such stacked foam panels. In other words, the top and bottom outer edges (i.e., top and bottom sides) of each panel include a stair stepped configuration at 133, as perhaps best shown in FIGS. 1-3, so that the horizontal seam 135 (FIG. 8) is followed by an inclined or stair-stepped surface, preventing water from seeping into channels 104*a*', 104*b*', 104*a*" or 104*b*".

Any of the splines may be more securely retained within any of the channels with any suitable adhesive. Without use of such an adhesive, the building system may actually be reversible, allowing dis-assembly of the components in a way that allows them to easily and quickly be re-assembled, e.g., at a different time, or in a different location. Such characteristics may be particularly beneficial for temporary structures (e.g., emergency housing, sets for plays or other drama productions, and the like). Where an adhesive is used, such adhesive may be injected into the channel through pre-cut slot 112 (for channels 104), injected directly into the open top or bottom channels (for channels 104*a*', 104*b*' 104*a*" or 104*b*"), or placed on the splines 116, prior to channel insertion. Once drywall or other sheathing is placed over the foam panel faces 106*a* or 106*b*, nails or screws may further be used to secure such sheathing to the splines 116 within any of such channels.

As described above, the splines 116 may have a length that is greater than the length of a given modular panel 100. In one such embodiment, a single spline 116 can run through aligned channels (similarly numbered) of more than one modular panel, positioned side by side. FIG. 8 further shows how once the splines 116 are inserted into any of the various channels, splines disposed therein are not exposed on the outside faces 106*a*, 106*b* of the foam bodies of panels 100. The splines are constrained within their channels, having only 1 degree of freedom therein (i.e., the ability to slide axially, within the channel).

Figure 9:
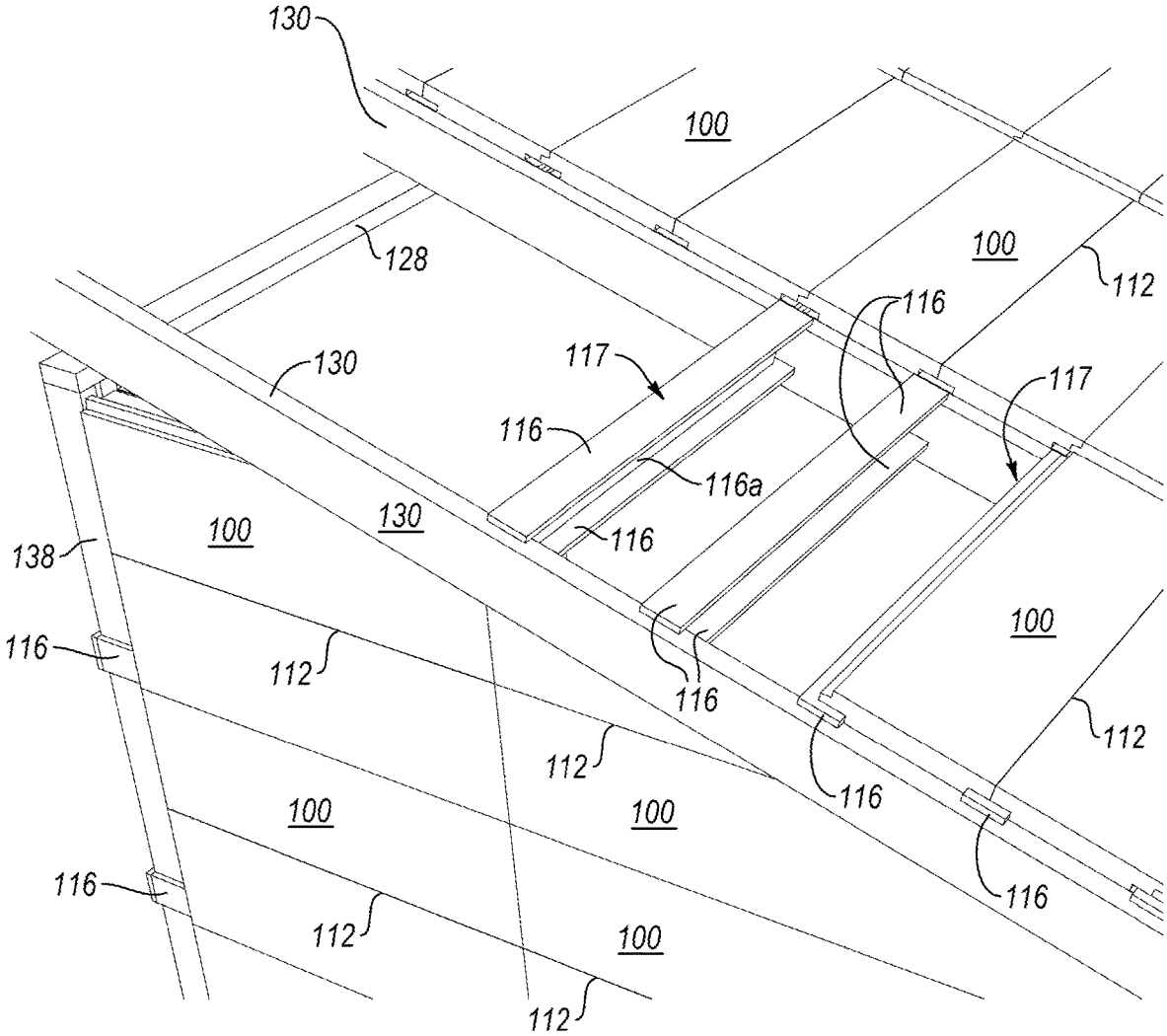
FIG. 9 shows a wall constructed similar to that of FIG. 8, further showing how the same panels may be use for a roof, positioned between truss members.

Many of the following Figures described hereafter show various configurations and uses in which the panels, splines, and building systems may be employed, as well as methods of use therefore. FIG. 9 shows a wall formed from a plurality of panels 100, as well as how the panels may be used to form a roof structure, with panels positioned between adjacent truss members 130. In a similar manner as with the wall structures seen in FIGS. 5-8, I-beams 117 may be provided between adjacent stacked panels 100, while additional splines 116 may be provided, in interior central channels 104. The splines 116 in any such channels may extend beyond the length of each panel (e.g., due to use of ear brackets or the like), for attachment to truss members 130, as shown. The truss members may simply be spaced apart at a distance equal to the length of the panels (e.g., 4 feet). The wall may include a cap plate 128, as shown (e.g., to which truss members 130 may be attached).

Any desired roof pitch may be accommodated by such construction. Exemplary pitches include any desired pitch ratio, such as from 12/1 to 12/18 (e.g., 12/1; 12/2, 12/3; 12/4; 12/5; 12/6; 12/7; 12/8; 12/9; 12/10; 12/11; 12/12; 12/13; 12/14; 12/15; 12/16; 12/17; or 12/18). Another roof configuration using a transition panel is shown and described hereafter, in FIG. 11, and FIGS. 13-28. A flat roof is of course also possible. As shown in FIG. 9, where roof panels 100 may not extend down the full height of trusses 130, any unfilled space below panels 100 can be used for electrical and/or plumbing runs.

Figure 10:
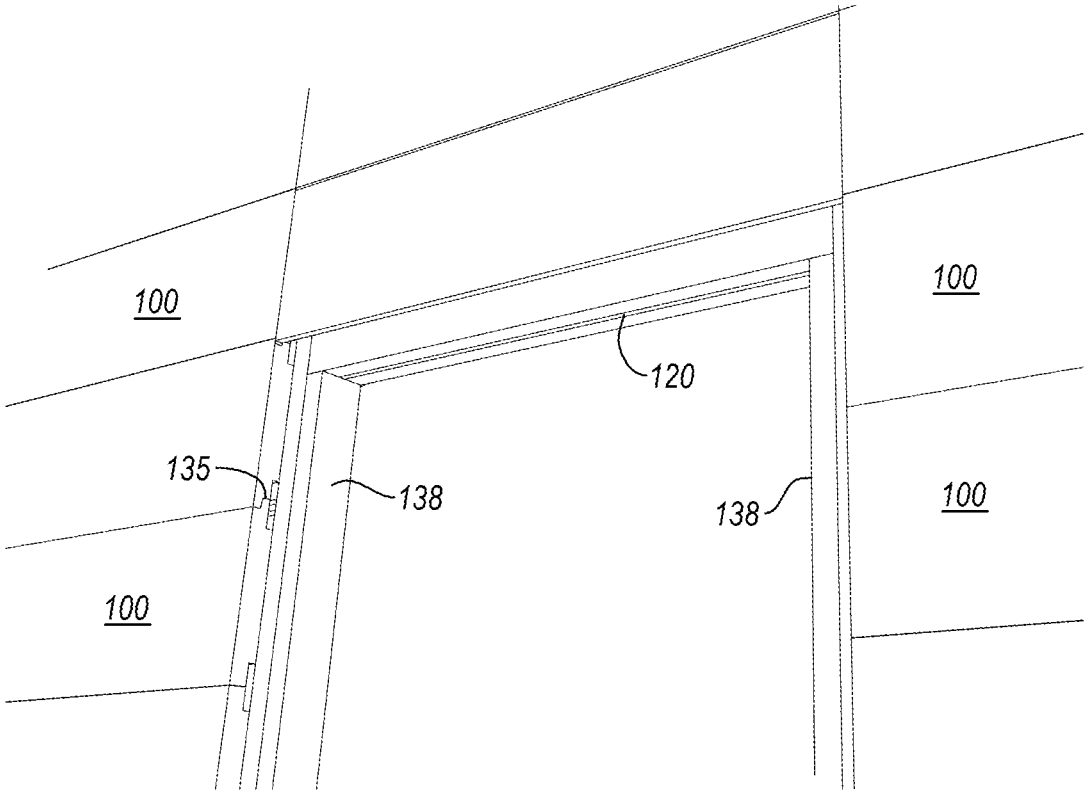
FIG. 10 shows how an opening, e.g., for a door or window, may be provided for in the post and beam construction systems including the modular panels of the present invention.

FIG. 10 illustrates how a door (or window) opening may be provided in any given wall, e.g., by placing vertical beams 138 at the ends of such an opening, which may be spanned by a conventional header 120. While the panels may be provided in lengths of 4 or 8 feet or any other desired length, they are easily cut, e.g., using a conventional circular saw (e.g., with a deep blade). They can easily be cut before insertion of any spline flanges and/or I-beams (in which case one is simply cutting through foam), or after such splines are inserted (in which case one is simply cutting through foam and typically OSB, or other spline material (e.g., aluminum)). Where desired, specialty header panels could be provided, e.g., including a header slot formed into panels 100, e.g., as disclosed in Applicant's U.S. Pat. No. 10,450,736, herein incorporated by reference in its entirety. Any of the concepts disclosed therein may be adapted for use with the present wall panels.

While shown with straight planar walls, it will be appreciated that curved walls are also possible, e.g., by providing closely spaced (e.g., 6 inches or less, 4 inches or less, 3 inches or less, or 2 inches or less, such as 1 inch spacing) pre-cut slits into at least one face of the panel that is to be used in forming a curved wall. Such slits would allow the panel to be flexed, creating a curved continuous face along the opposite major planar face. Such slits could of course be filled in on the cut face, for finishing, if desired.

A strap or any other desired typical connector may be used to attach any of the vertical posts 138 to a foundation, as will be appreciated by those of skill in the art, in light of the present disclosure.

While electrical raceways 136 may provide a simple way to make electrical runs, other methods for wiring a structure using the present panel, post and beam constructions are also possible. For example, because the exterior of the wall prior to sheathing is formed from a material such as EPS foam that is easily worked, a portable hot wire cutting tool may be used to quickly cut traces or raceways through the foam face, in any configuration desired, for receipt of electrical wiring. Furthermore, current code allows such wiring to not need any conduit, where there is 1.5 inches or more between the exterior of any eventually applied sheathing, and the location of the wiring. The 1-2 inch foam thickness before reaching any of the channels (i.e., spline), coupled with a typical ½ inch or ⅝ inch drywall sheathing allows the wiring to simply be pressed into grooves cut into the foam face during wiring of the building, without the need for any conduit for housing such wiring. No posts or splines need be drilled or cut to accommodate such.

Where the wiring crosses over a spline or post, a spiked or other metal plate may simply be pressed over the wiring, over the spline or post, to prevent a fastener from penetrating the wiring, when attempting to fasten into the spline or post. Such forming of a raceway in the face of the panels can be quickly and easily accomplished after the panels have been raised into the desired wall structures, during wiring of the building. A portable hot wire groove cutting tool can be used for such raceway formation. Such a tool is very quick (e.g., an 8 foot groove length may be formed in a matter of seconds, and the grooves may be freely run over the face of the panels, without regard to spline location, and without passage through any splines or posts (as would be typical in traditional framing). For example, such a groove may simply be "drawn" from a switch or other location to where the power is to be delivered (e.g., a light, outlet, etc.) in a straight line, across the panel(s) face(s).

In an embodiment, either the interior, exterior, or both foam panel faces of walls of a building may be tiled over with cementitious panels, e.g., such as available from Applicant. Because of the presence of the splines within the channels of the wall system, screws or other fasteners may be used for such attachment. An adhesive may additionally or alternatively be used. Any suitable adhesive may be used to adhere such panels to the foam face. While epoxy or urethane adhesives may be suitable in theory, a polymer modified cement based adhesive may be preferred, as the urethane and epoxy adhesives have been found by the present inventor to be finicky, making it difficult if a user wishes to reposition a panel once it has initially been placed over the adhesive coated foam.

For example, the epoxy and urethane adhesives typically set very quickly, providing little time for the user to perform any needed repositioning or adjustment of a placed panel. Furthermore, because the bonding strength is so great, when attempting to reposition such a bonded panel, chunks of underlying foam may be pulled from the foam frame structure (floor, wall, ceiling, roof, or the like) when attempting debonding, which is of course problematic. A polymer modified cement based adhesive provides greater cure time, allowing some flexibility in positioning, and repositioning, before the bond between the panel and foam frame member becomes permanent and strong. That said, urethane and epoxy adhesives (e.g., foaming adhesives) may also be used, where desired. Methods and other characteristics for such tiling, information relative to adhesives, and the like is found within Applicant's Application Serial No. U.S. patent application Ser. No. 15/426,756 (18944.9), herein incorporated by reference in its entirety. Examples of Applicant's other building systems which may include various features that can be incorporated to some degree herein include U.S. patent application Ser. Nos. 13/866,569; 13/436,403; 62/722,591; 62/746,118; Ser. No. 16/549,901, and Ser. No. 16/653,579, each of which is incorporated herein by reference in its entirety. The last four patent applications describe exterior applied sealants that may be used, as such, in the present invention.

All components and steps of the method and system can be handled without heavy equipment (e.g., cranes), with the possible exception of any very large, heavy reinforcing structural frame members that may be embedded in any of the foam modular panel members, positioned between such panels, or the like. In fact, the modular panels and splines are so light as to be easily handled and positioned by a crew of women. For example, the panels (e.g., 2 feet×4 feet) may weigh less than 40 lbs, less than 30 lbs, less than 20 lbs, or less than 15 lbs. A 2 foot×8 foot panel (e.g., see FIGS. 13-28) weighs only about 6-7 lbs. Corresponding aluminum splines as shown in FIGS. 13-28 similarly only weigh about 6-7 lbs each.

In the case of OSB or similar splines, because strips of such OSB material are very light (e.g., less than 10, 5 or even 3 lbs), and/or because there is typically no need to use splines that are of a single piece of continuous material, such crew members could push scrap material (e.g., scrap OSB strips) into the channels, which scrap material could serve as the splines. As a result, a construction site using such methods may generate very little, if any waste, e.g., far less such waste than is generated when using traditional framing techniques. In addition, it will be apparent that when constructing a given building, far fewer 2×4s will be needed, as there are no conventional single "studs" present in the construction, but rather use of OSB or similar elongate strips of material, as the splines are used, in conjunction with vertical post members and other members of the frame (which may be formed from pairs of 2×4s, steel, or the like), but which are only spaced typically every 4 feet, 8 feet or 12 feet (depending on structural requirements), requiring far fewer 2×4s than a typical frame construction in which 2×4 studs are spaced at 24 or 16 inches on center.

Figure 11:
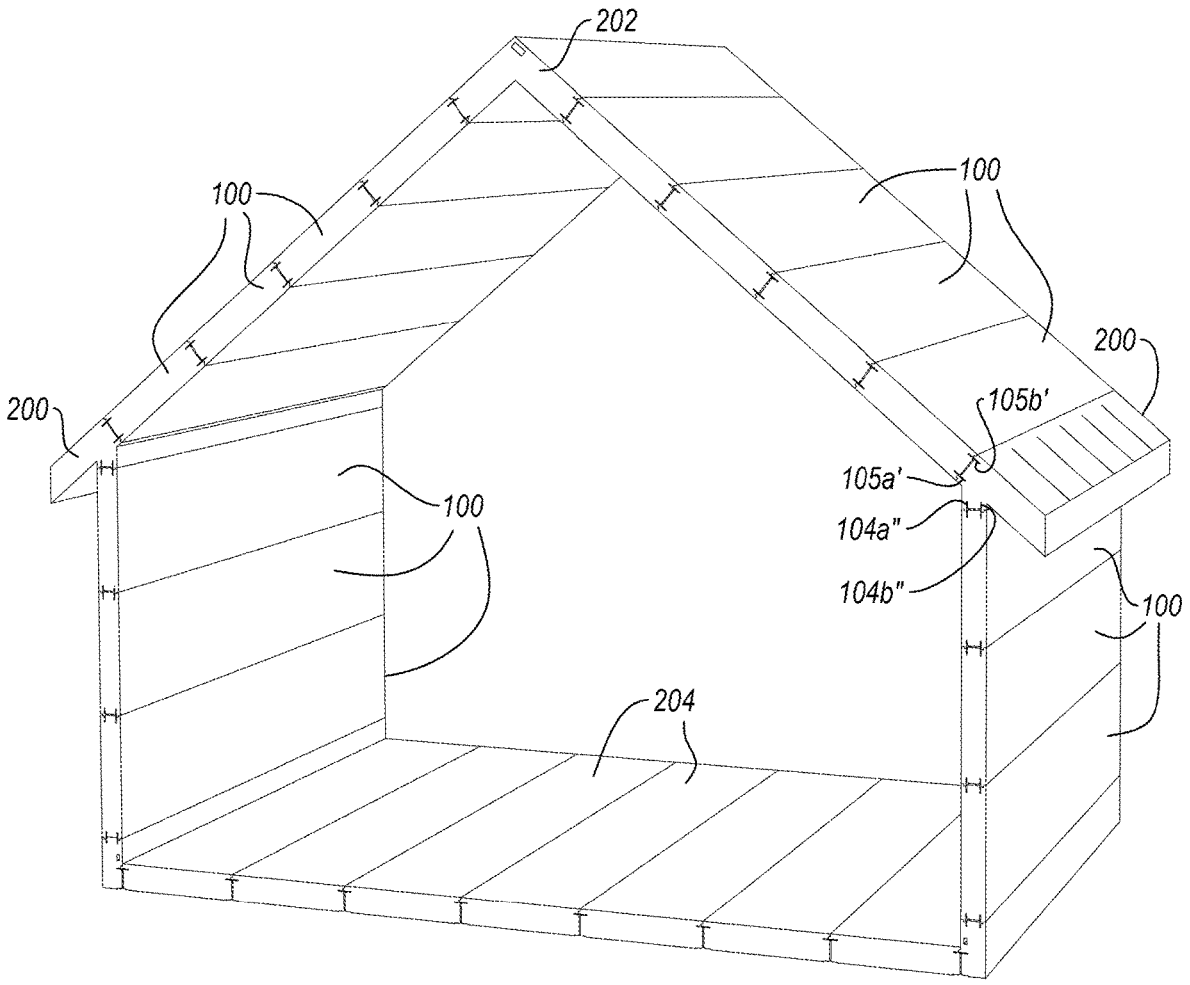
FIG. 11 shows how transition panels may be provided for connecting the panels used in a wall structure (e.g., such as that of FIG. 8) to the same standard panels used to form a roof structure.

FIG. 11 shows an exemplary building construction that employs the panels 100 as described herein for construction of the walls, and which shows use of a wall-to-roof transition panel 200 at the top of the wall structure, for providing a transition from such standard panels 100, to the same standard panels 100 used for the roof construction. Similar to panel 100, wall-to-roof transition panel 200 is shown as including a pair of lower channels 104*a*" and 104*b*", allowing formation of an I-beam the same as with any of the standard wall panels 100, between the top most wall panel 100 and wall-to-roof transition panel 200. Panel 200 is also shown as including an additional pair of channels 105*a*' and 105*b*', which are analogous to the top channels 104*a*' and 104*b*' of any of the standard wall panels, but which are oriented at an angle relative to bottom channels 104*a*", 104*b*", where the angle corresponds to the pitch of the roof being constructed. Channels 105*a*', 105*b*' thus line up with the bottom channels 104*a*" and 104*b*", respectively, of the standard panel 100 positioned as the first roof panel, adjacent wall-to-roof transition panel 200, as shown.

Figure 12A:
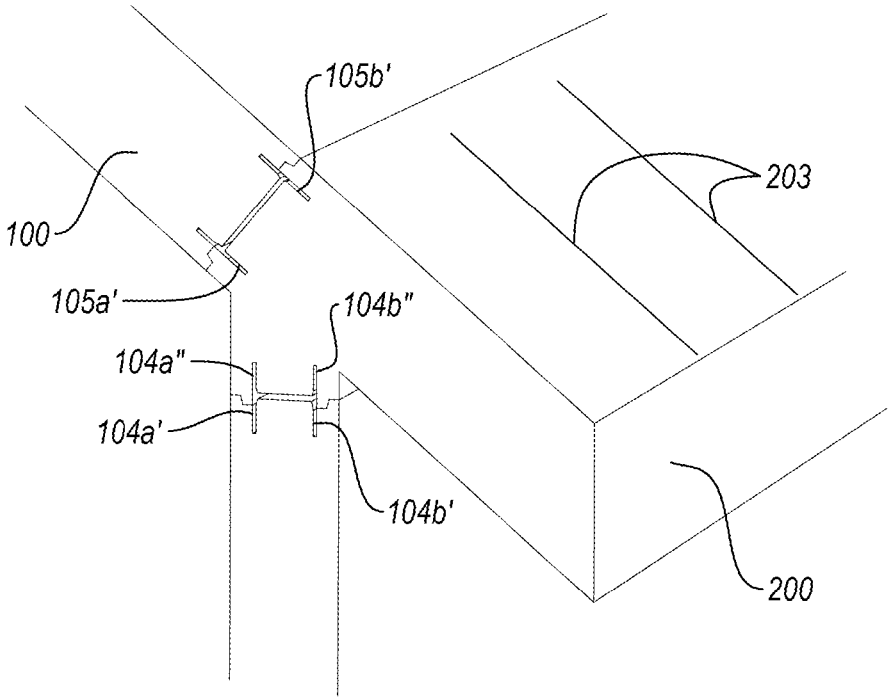
FIG. 12A shows a close up of the wall-to-roof transition panel of FIG. 11, between the top most panel of the wall structure and the adjacent roof panel.

Wall-to-roof Transition panel 200 thus allows in-situ formation of an I-beam between the wall-to-roof transition panel 200 and the top most wall panel 100, and another I-beam between the wall-to-roof transition panel 200 and the adjacent roof panel 100. Wall-to-roof Transition panel 200 can include slots 203 for insertion of stiffening members (e.g., furring splines or strips), as shown, to provide additional attachment points for attachment of covering materials placed over the panel. FIG. 12A shows a close up of the eave area of FIG. 11, better showing how the wall-to-roof transition panel 200 integrates with the adjacent roof panel 100 and the adjacent top most wall panel 100. Another similar wall-to-roof transition panel is shown and described in conjunction with FIGS. 13-28, below.

FIG. 11 further shows a roof cap transition panel 202, configured to transition between standard roof panels 100, at the apex of such a pitched roof. Roof cap panel 202 also includes 2 pairs of edge channels, configured to be aligned with the top channels 104*a*' and 104*b*' of the two adjacent roof panels 100. The pairs of edge channels of the roof cap transition panel are angled relative to one another, e.g., at double the angle defined between the pairs of channels in wall-to-roof transition panel 200, as dictated by the pitch of the roof. Such wall-to-roof transition panels 200 and roof cap transition panels 202 may be custom provided to the building site, along with a desired number of standard panels (for walls and roof), as determined from the plan or blueprint of the building being constructed. Wall-to-floor transition panels may also similarly be provided, as described herein.

Figure 12B:
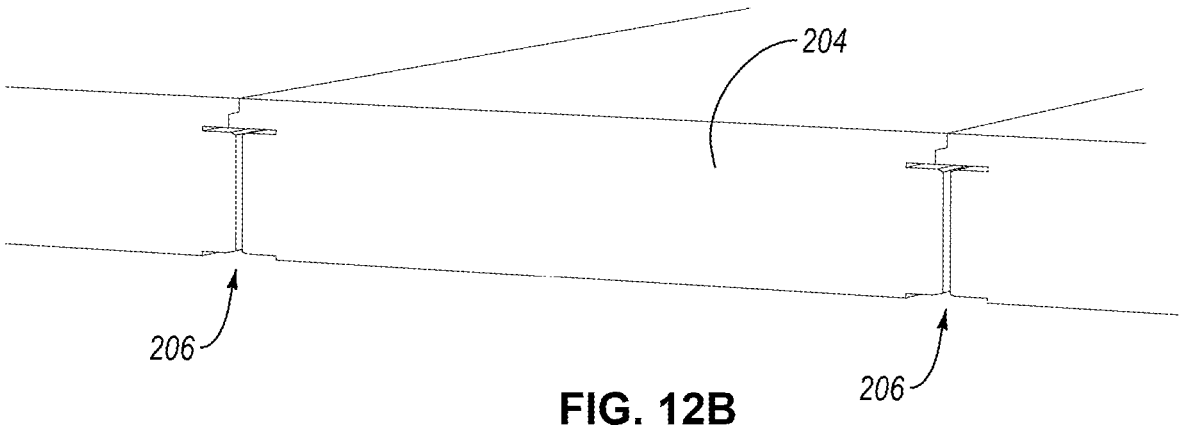
FIG. 12B shows a close up of the floor panel of FIG. 11.

FIGS. 11 and 12B further shows how panels similar or identical to standard panels 100 may be used to form the floor. Such floor panels 204 in FIGS. 11 and 12B are shown similar to the standard wall and roof panels 100, except that they may only include one "top" channel, and one "bottom" channel adjacent the face of the panel that becomes the interior floor. Because the panels are rotated (laid on the ground instead of oriented vertically, as in a wall construction), what would be "top" and "bottom" channels are now simply both adjacent to the upper floor face of the panel, one to the right, and one to the left (rather than top and bottom).

The floor panel optionally may not include channels adjacent the bottom face of the floor panels 204 (such panels may simply be positioned over a pea gravel base or the like). Alternatively, as shown in FIGS. 13-28, the same standard panels as used for the walls may also be used for the floor. As shown in FIGS. 11 and 12B, a notch 206 that is exposed on the bottom face of such floor panels 204 may be provided, e.g., to raise at least that portion of the floor panels up off such a gravel or other base, should such be desired. FIG. 12B shows a close up of such a floor panel, showing the notch 206.

FIGS. 13-28 illustrate a building system according to the present invention, in further detail, as a progressive construction of a simple, exemplary structure. It will be appreciated that more complex structures, in an essentially unlimited variety, may be constructed using the described building system. As shown, a plurality of standard panels 100 as described herein are used for the floor, the walls, and the roof. Specialized transition panels are provided to make the transition from wall-to-floor, (i.e., in a uniquely configured wall-to-floor transition panel), and from wall to roof (i.e., in a uniquely configured wall-to-roof transition panel). Where the roof is a pitched roof, a roof cap transition panel 202 may be provided, to make the transition from one standard panel to the next standard panel, both present in the roof (e.g., on different sides of the apex of a pitched roof).

The building system includes a frame that carries loads from the splines to the frame to the foundation. The frame can be designed to include any conceivable architectural shape, and can be engineered to handle appropriate external loads. The frame can act as a template to which splines and the insulating lightweight panels can be attached. This allows the splines and lightweight panels to remain standardized, with unique frames (formed from frame members) and unique transition panels defining the shape of the structure. This system makes it possible to construct walls, floors and roof of the system with precisely the same method.

Figure 13:
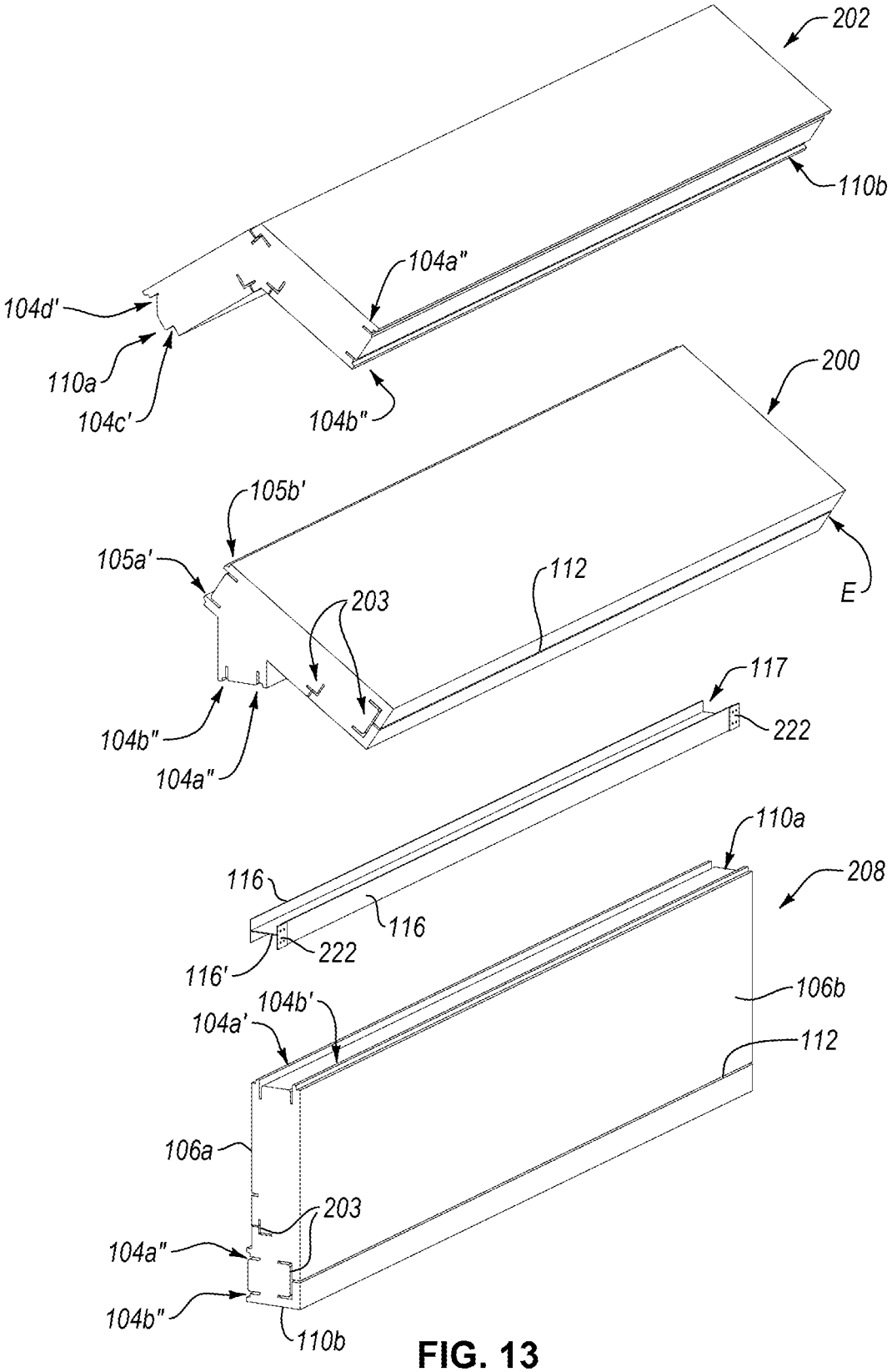
FIGS. 13-28 illustrate another progressive construction according to an exemplary building system according to the present invention.

FIG. 13 shows various transition panels, including the uniquely shaped roof cap transition panel 202. As shown, panel 202 may include channels 104*a*" and 104*b*" identical to those of a standard panel 100 on one end, with the same channels 104*c*' and 104*d*' on the other end, but in which the top end 110*a* of the panel adjacent such channels 104*c*', 104*d*' is differently configured (e.g., includes cut-away portions) to better facilitate insertion of the roof cap transition panel 202 onto the apex of the roof, in a manner so as to mate with the adjacent standard panels 100, mating on either side of panel 202. The illustrated cut-away portions in top end 110*a*, adjacent channels 104*c*' and 104*d*' allows the "bottom end" 110*b* (configured the same as bottom end 110*b* of panel 100) of panel 202 to be pressed into the flanges 116 of I-beam 117, while the other end 110*a* is simply able to rotate downward towards the adjacent standard roof panel 100, so that the flanges 116 of the corresponding I-beam 117 rest in channels 104*c*' and 104*d*'. The cut-away top end 110*a* as shown in panel 202 allows simplified assembly as compared to requiring longitudinal sliding of panel 202 relative to the I-beams 117 mated on either end (at ends 110*a* and 110*b*).

FIG. 13 also illustrates a wall-to-roof transition panel 200 similar to that shown in FIGS. 11-12A. For example, transition panel 200 includes a pair of lower channels 104*a*" and 104*b*", for mating with an I-beam the same as with any of the standard wall panels 100, between the top most wall panel 100 and transition panel 200. Panel 200 is also shown as including an additional pair of channels 105*a*' and 105*b*', which are analogous to the top channels 104*a*' and 104*b*' of any of the standard wall panels 100, but which are oriented at an angle (other than 180°) relative to bottom channels 104*a*", 104*b*", where the angle corresponds to the pitch of the roof being constructed. Actual angles for given pitch values are easily calculated using standard trigonometry (e.g., for pitches of from 12/1 to 12/18 (e.g., 12/1; 12/2, 12/3; 12/4; 12/5; 12/6; 12/7; 12/8; 12/9; 12/10; 12/11; 12/12; 12/13; 12/14; 12/15; 12/16; 12/17; or 12/18)). Channels 105*a*', 105*b*' thus line up with the bottom channels 104*a*" and 104*b*", respectively, of the standard panel 100 positioned as the first roof panel, adjacent transition panel 200, as described herein. Transition panel 200 thus facilitates placement of an I-beam between the transition panel 200 and the top most wall panel 100, and another I-beam between the transition panel 200 and the adjacent roof panel 100 (through channels 104*a*", 104*b*" and channels 105*a*', 105*b*', respectively).

Transition panel 200 is also shown as including various shaped slots 203 for insertion of stiffening members, e.g., to provide attachment points for facia, etc. The illustrated configuration includes a C-shaped slot 203 running horizontally, parallel to the free eave end E of the transition panel 200. As shown, a pre-cut slot 112 may be provided in eave end E, e.g., centered on C-shaped slot 203. In the illustrated configuration, the open end of the C is oriented inward, away from eave end E, providing an attachment point into which facia or other covering structures can be screwed, nailed, or otherwise fastened into. Other shaped slots could be provided, for receiving other shaped spline members (e.g., I-beam shaped, H-beam shaped, L-beam shaped, etc.).

Wall-to-roof transition panel 200 may be described as including 3 portions—a wall leg (terminating in channels 104*a*", 104*b*") that mates with the adjacent top-most wall panel of the wall being constructed; a roof leg (terminating in channels 105*a*', 105*b*') that mates with the adjacent first roof panel of the pitched roof being constructed; and an eave portion, e.g., coplanar with the roof portion, but extending oppositely, away from channels 105*a*', 105*b*' and the roof portion, so as to form an eave of a desired configuration. It will be apparent that the length of the wall leg and the length of the roof leg can be independently specifically selected as needed, to accommodate a desired wall height (that is not an even multiple of the height of the standard panel 100), as well as to accommodate a desired roof plane length (that is not an even multiple of the width of the standard panel 100 used on the roof). Adjustments in roof plane length can also be made by adjusting the lengths of the two ends of the roof cap transition panel 202.

FIG. 13 further shows an exemplary wall-to-floor transition panel 208.

Transition panel 208 is shown as similar to the standard wall and roof panels 100, including the top channels 104*a*' and 104*b*', with the top end of panel 208 being identically configured to any of the standard panels 100. Such top channels 104*a*' and 104*b*' receive flanges 116 of I-beam 117, connecting the transition panel 208 to the bottom most standard panel 100 of the wall structure. In order for transition panel 208 to connect in the same manner (through I-beams 117) to an adjacent standard panel 100 that makes up the floor, a pair of channels are provided in the inside face, near the bottom of transition panel 208, with otherwise identical characteristics to any of the other bottom channels 104*a*" and 104*b*", except that these channels are in the face 106*a* of panel 208 rather than in bottom end 110*b*. As shown, one or more additional furring slots 203 may additionally be provided, e.g., for providing attachment points, similar to slots 203 shown in wall-to-roof transition panel 200. For example, a C-shaped spline or furring strip could be inserted into the C-shaped slot 203, while an L-shaped spline or furring strip could be inserted (e.g., either or both horizontally) into the illustrated C and L-shaped slots. Of course other shaped slots could also be provided, as desired, to accommodate differently shaped splines in such slots.

Figure 13A:
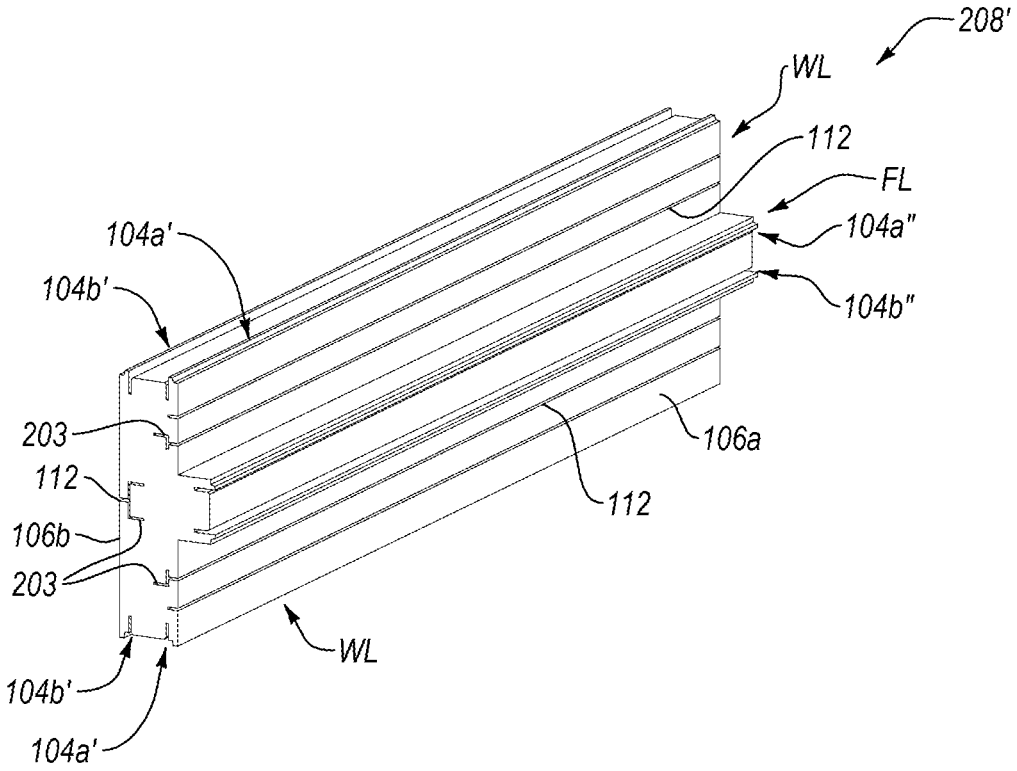
FIG. 13A shows another embodiment of a wall-to-floor transition panel, configured for use in transitioning to an upper story, from a lower story.

It will be appreciated that a differently configured wall-to-floor transition panel may be provided, e.g., for providing the floor of an upper floor (e.g., a $2^{nd}$ floor) in a multistory building construction. An example of such is shown in FIG. 13A. For example, such a $2^{nd}$ story wall-to-floor transition panel 208' may include an additional lower wall leg as compared to the configuration 208 shown in FIG. 13, so as to be T-shaped. For example, the top of the "T" may provide the 2 wall legs WL (e.g., in-line, 180° apart), with the floor leg FL being at 90° relative to both wall legs WL. The upper wall leg thus forms the lowest portion of the $2^{nd}$ story wall, while the lower wall leg forms the topmost portion of the $1^{st}$ story wall. It will of course be appreciated that such T-shaped wall-to-floor transition panels may be used for any story (e.g., $2^{nd}$, $3^{rd}$, etc.) above the first story. In FIG. 13A, the channels of the lower wall leg are also labeled 104*a*' and 104*b*', as they may be similarly or identically configured as the analogous channels of the upper wall leg.

In such a building construction, the wall-to-roof transition panel 200 may thus only be used on the top-most story, adjacent the roof, while any lower stories would include the T-shaped "$2^{nd}$ story" wall-to-floor transition panel 208', at the transition from a lower story, to the adjacent higher story.

Figure 14:
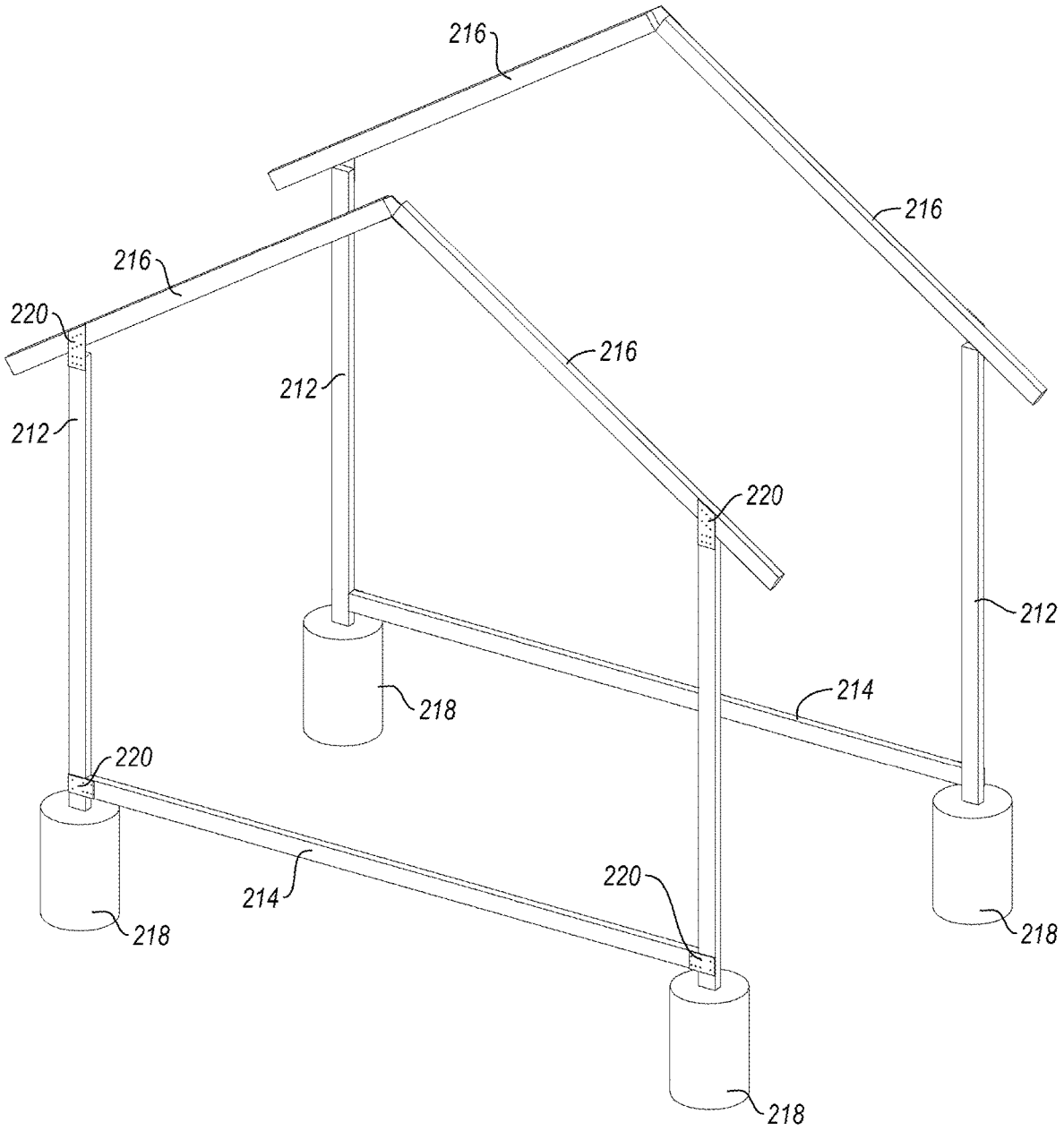

FIGS. 14-28 illustrate progressive steps according to which an exemplary building may be constructed, using the presently described building systems. For example, FIG. 14 shows assembly of an exemplary frame formed from exemplary vertical post frame members 212, horizontal beam frame members 214, and angled truss frame members 216. Such individual members may be connected to one another through appropriate brackets 220, as shown. It will be appreciated that where the building to be constructed may not include a pitched roof, the illustrated truss members may instead simply run horizontally, defining where the roof structure will be. Such a frame, in conjunction with the fact that the panels are cut using a CNC precision device, acts as a jig, ensuring that the walls, floor, and roof structure will be nearly perfectly square and plumb, as desired. Such is advantageous over traditional stick frame construction methods, where walls, floors, and roof often deviate slightly from the desired square and plumb relationships. Such frame members 212-216 may be of any desired material (e.g., steel, other metal, wood lumber, etc.). Steel may be preferred, as wood lumber can be notorious for being warped, etc. The frame may actually bear any load applied to the building, such that the panels 100 used to construct the walls are not necessarily load bearing (but merely fill the opening in).

As shown, the structure can be supported on a plurality of pier footings 218. Such a configuration as described does not require the use of any continuous footings, or the use of a typical concrete or similar slab. The present configurations may advantageously be void of such features, which otherwise increase costs, and result in decreased comfort (e.g., the present configuration provides for an insulated, "soft" floor, as compared to a concrete slab, as will be apparent from the present description).

Figure 15:
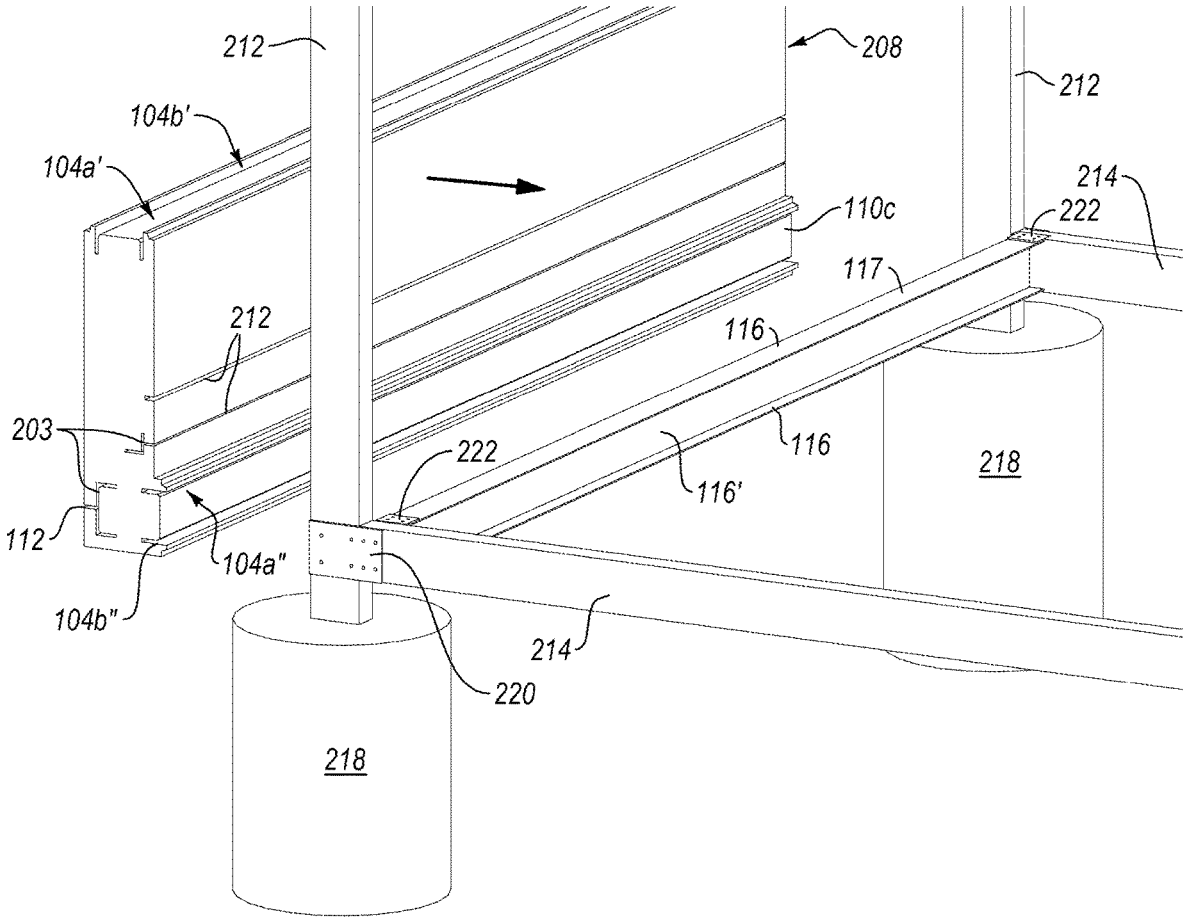

Turning to FIG. 15, one of the standard I-beams 117 may be attached between frame members (e.g., members 214), and wall-to-floor transition panel 208 positioned so that flanges 116 of I-beam 117 are received into channels 104*a*" and 104*b*". Web 116' of I-beam 117 rests against face 110*c* (analogous to bottom face 110*b* in a standard panel 100). It will be appreciated that the I-beams 117 could be provided prefabricated, as shown, or could be assembled in-situ, as described elsewhere herein. Such I-beams may be of aluminum or other suitable metal material, wood (e.g., OSB), plastic, or other suitable material.

While I-beam configurations are shown in particular, it will be appreciated that other geometry beams (e.g., C-beams, H-beams, L-beams, or other shapes, providing other moment of inertia characteristics) could alternatively be used for positioning in between any of the various modular panels, as splines. The description and claims generally reference "I-beam" for simplicity, although it will be appreciated that other such geometries can be included within the scope of the claimed invention.

Figure 16:
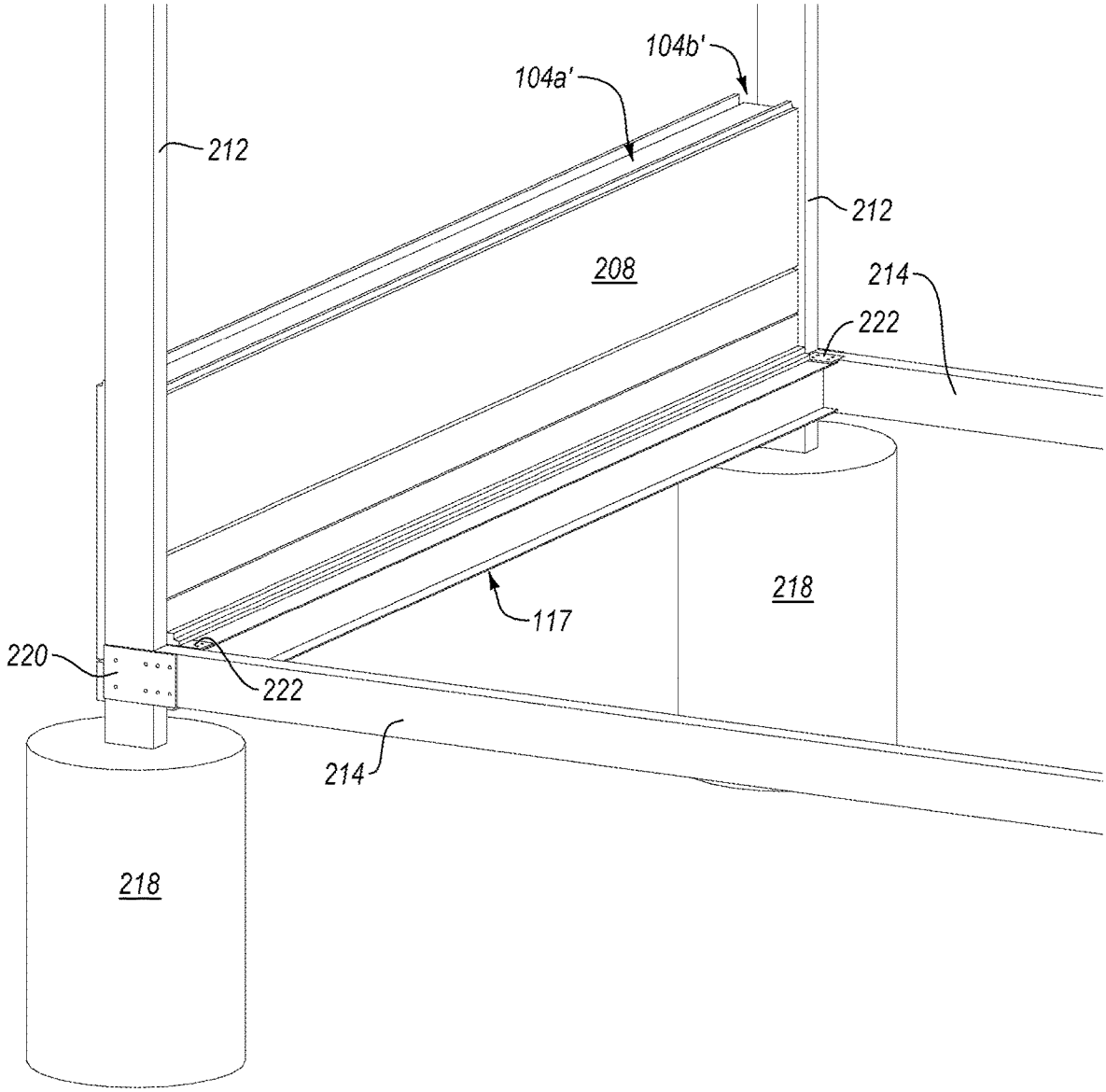

FIG. 15 further illustrates the use of connecting "ear" brackets 222. Such ear brackets can simply be fastened as shown, to appropriate frame members (e.g., as shown to frame members 214), securing I-beam 117 to members of the frame. Of course, panel 208 can be secured to I-beam 117 as described herein (e.g., use of an adhesive, or even just a friction fit between flanges 116 and channels 104*a*" and 104*b*"). FIG. 16 shows the same configuration as FIG. 15, once panel 208 has been fully inserted (i.e., flanges 116 into channels 104*a*" and 104*b*") relative to I-beam 117.

Figure 29:
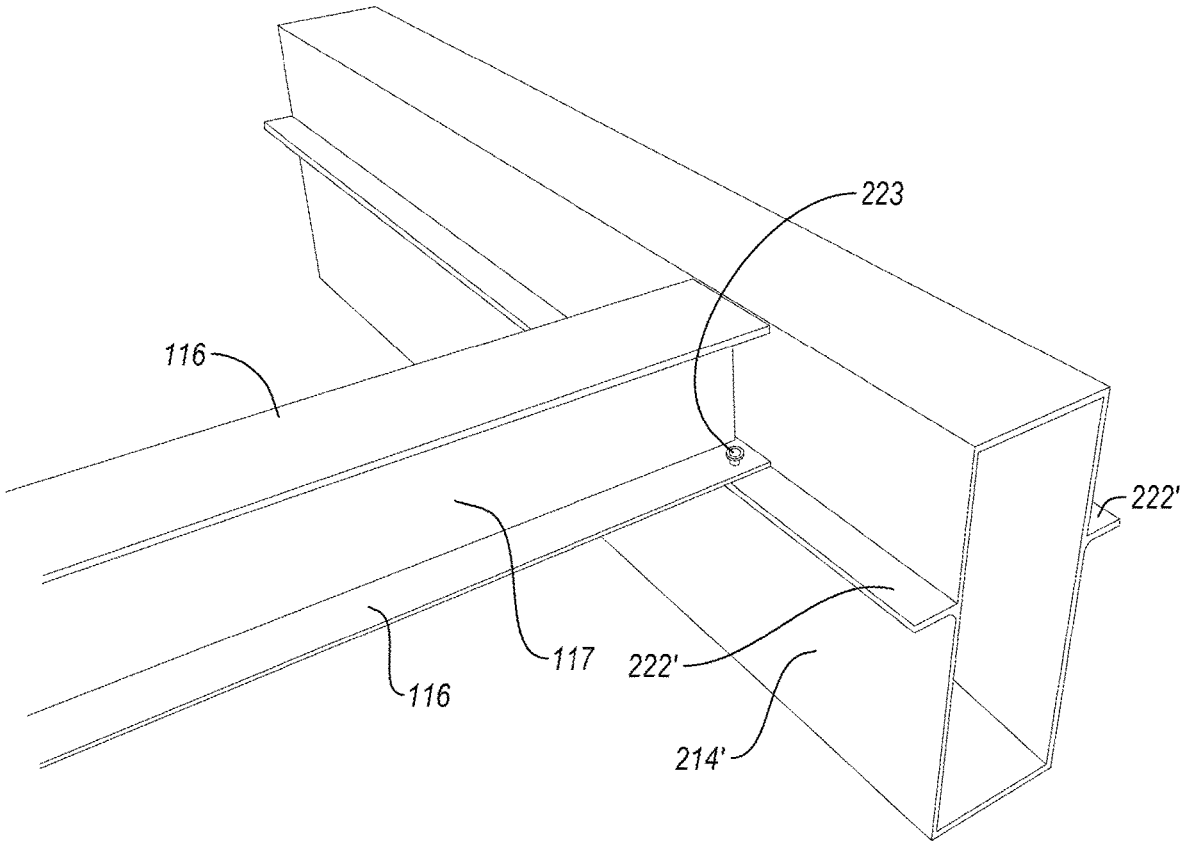
FIG. 29 shows an alternative connection between the spline and frame member, according to the present invention.

FIG. 29 illustrates an alternative connection mechanism between an I-beam or other configured spline 117 and the frame member (e.g., illustrated frame member 214'). While a horizontal frame member analogous to frame member 214 is shown in FIG. 29, it will be appreciated that other frame members (e.g., 212, 216) may be similarly configured. For example, as shown in FIG. 29, the frame member may include its own flange or ear 222' (e.g., an ear bracket flange portion 222'), to which the flange 116 of I-beam spline 117 is attached, e.g., with screw 223. It will be apparent that numerous connection mechanisms between the splines and frame members (as well as between other connected components of the system) are possible, such that the particular configurations illustrated are simply exemplary.

Figure 17:
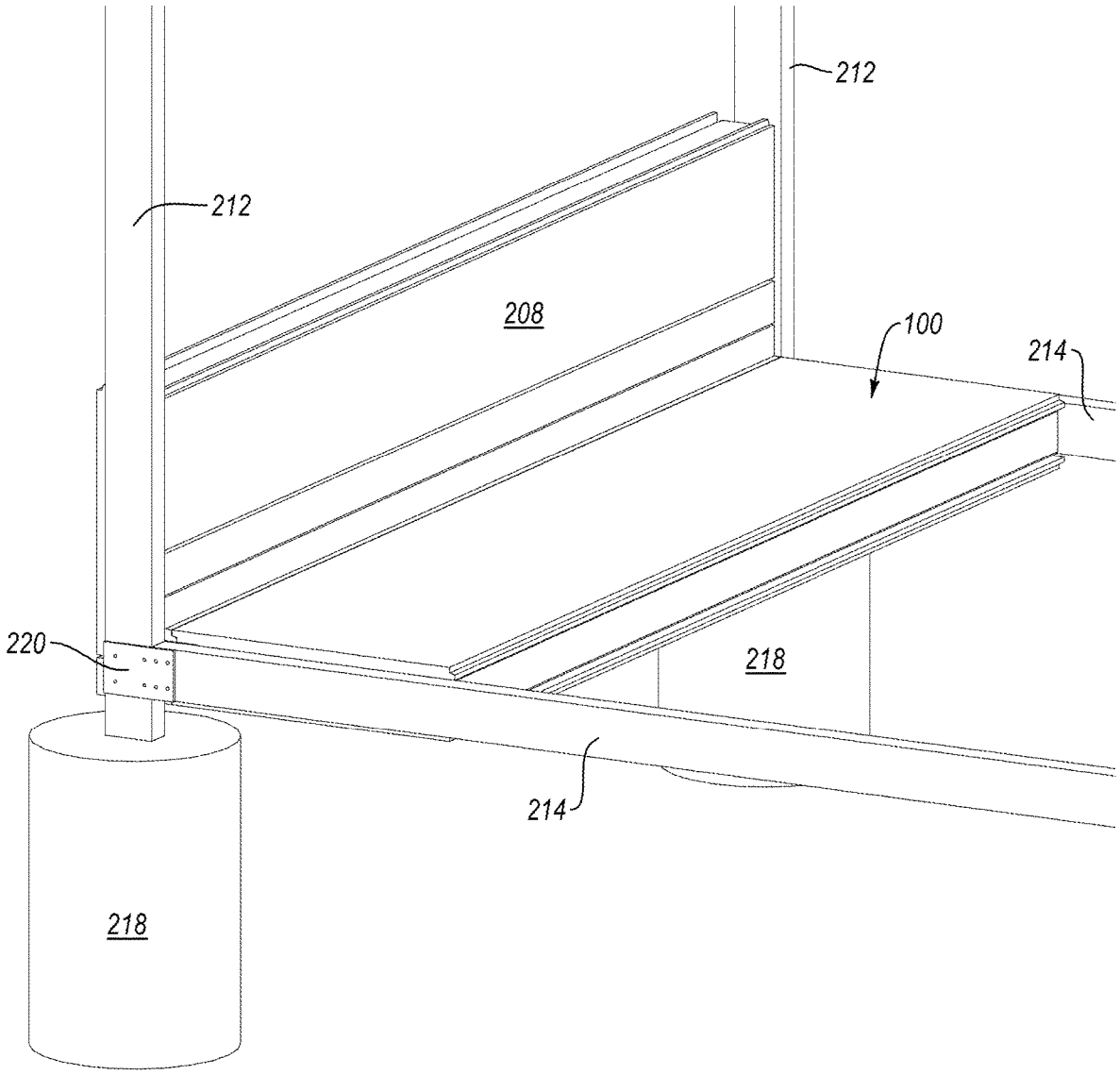
Figure 18:
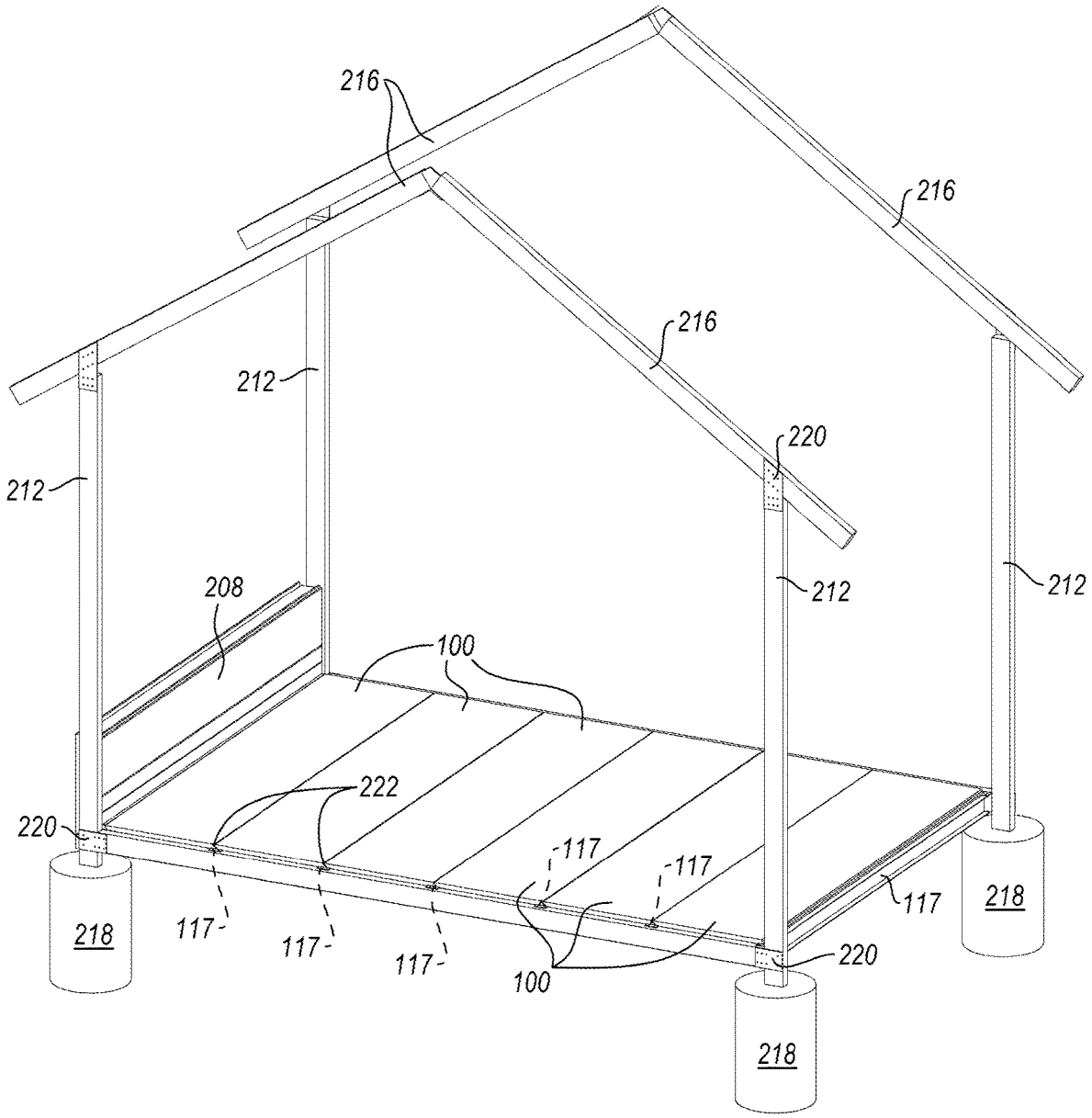
Figure 19:
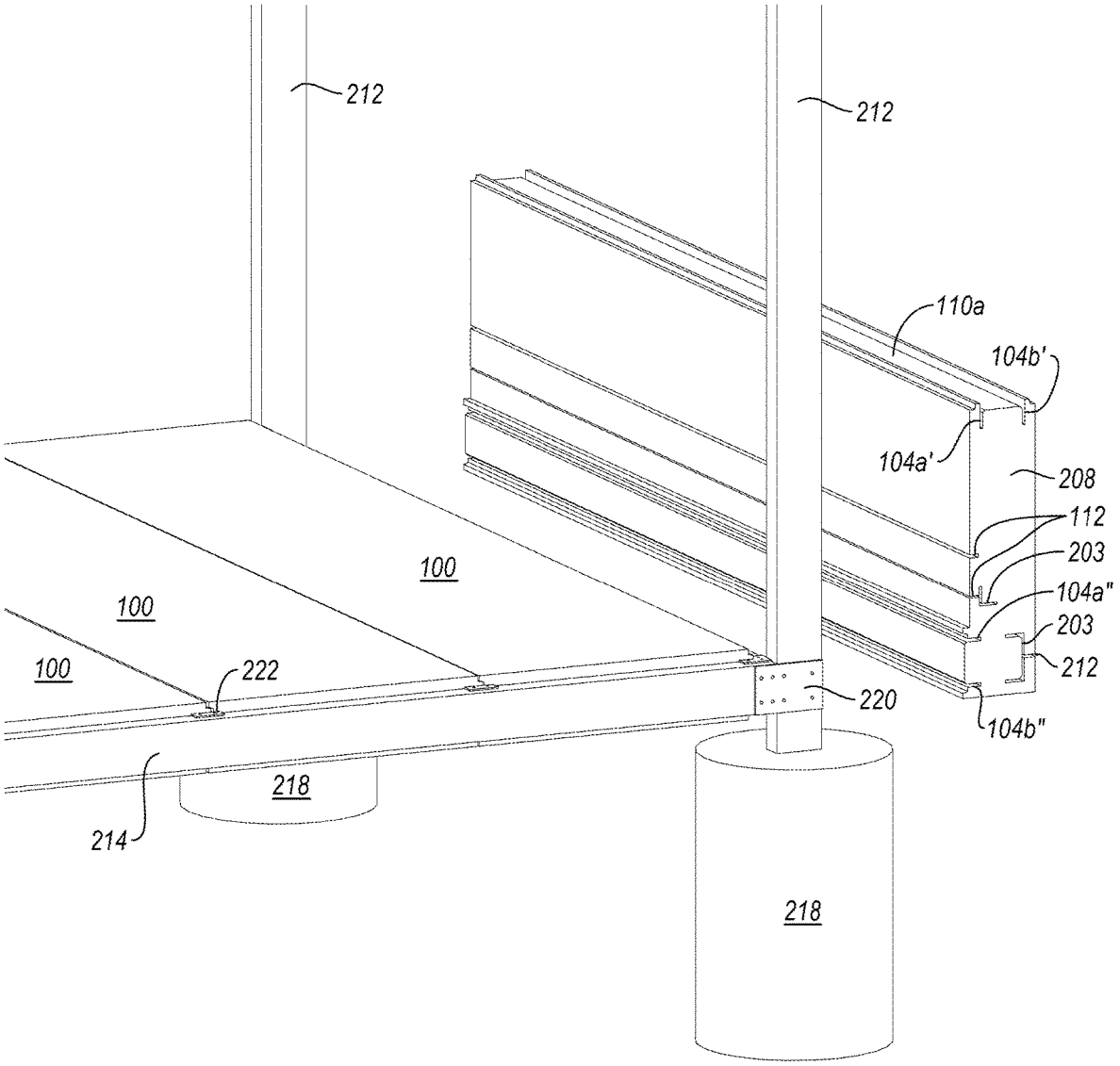
Figure 20:
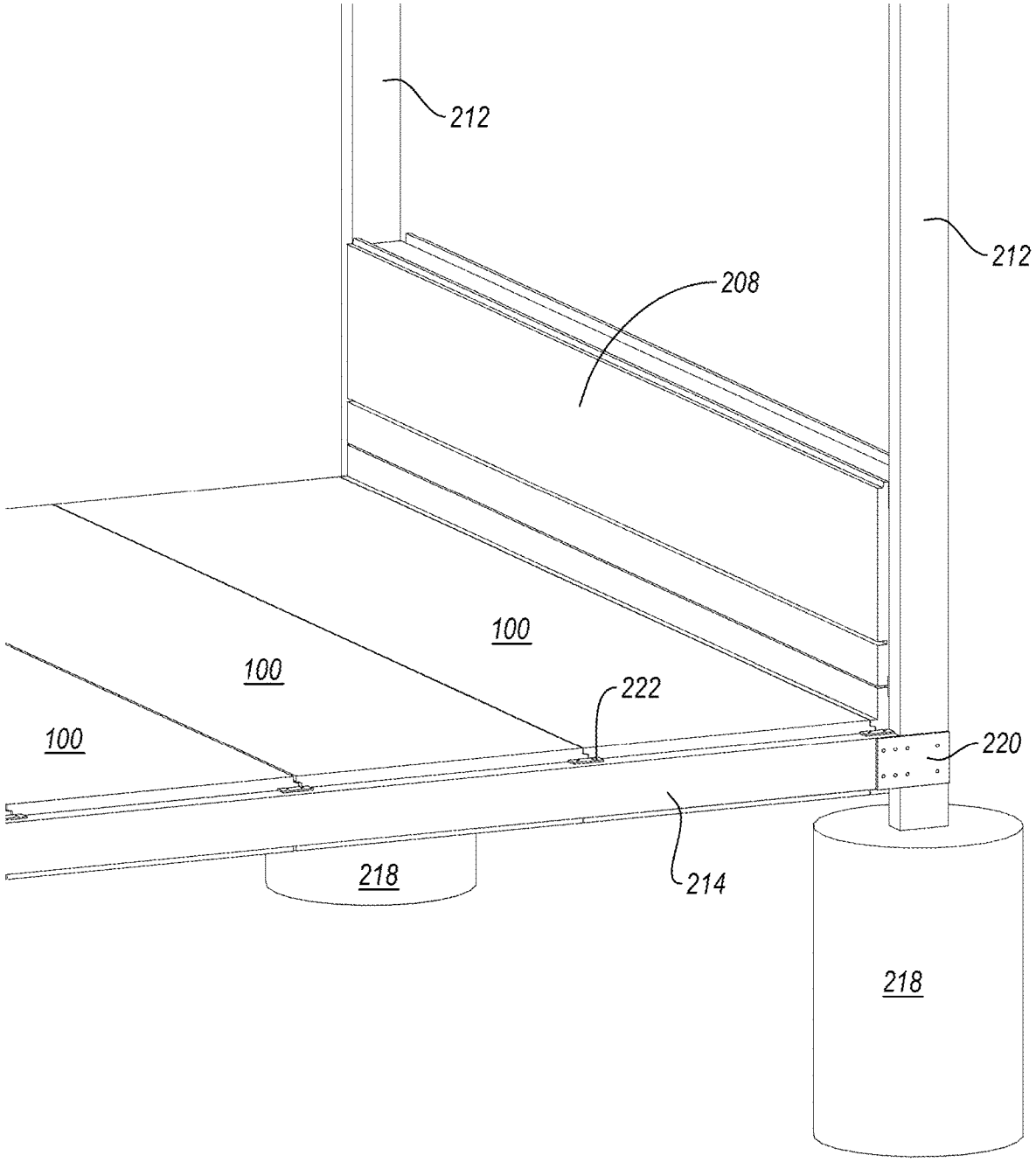

FIG. 17 illustrates the same configuration, but once a standard panel 100 has been positioned (e.g., slid) adjacent the I-beam 117 mated into the corresponding channels adjacent surface 110*c* of transition panel 208. As shown in FIG. 18, additional standard panels 100 can be positioned, to provide the floor structure of the building, with the standard I-beam or other splines 117 positioned in between each pair of adjacent panels. FIGS. 19-20 show attachment of another wall-to-floor transition panel 208, at the other end of the floor, where the opposite wall is to be constructed. Positioning and attachment of the panel 208 is similar to attachment of the panel 208 at the opposite end of the floor.

Because the panels 100 used on the floor are rotated (laid horizontally (e.g., "on the ground" instead of oriented vertically, as in a wall construction), what would be "top" and "bottom" channels are now simply adjacent to the top and bottom faces of the panel, on the right, and left sides. As shown, the floor may actually be a "floating floor", positioned above the ground in which the pier footings are positioned. While a pea gravel other base could be provided, such is not necessary, and may not be present.

Figure 21:
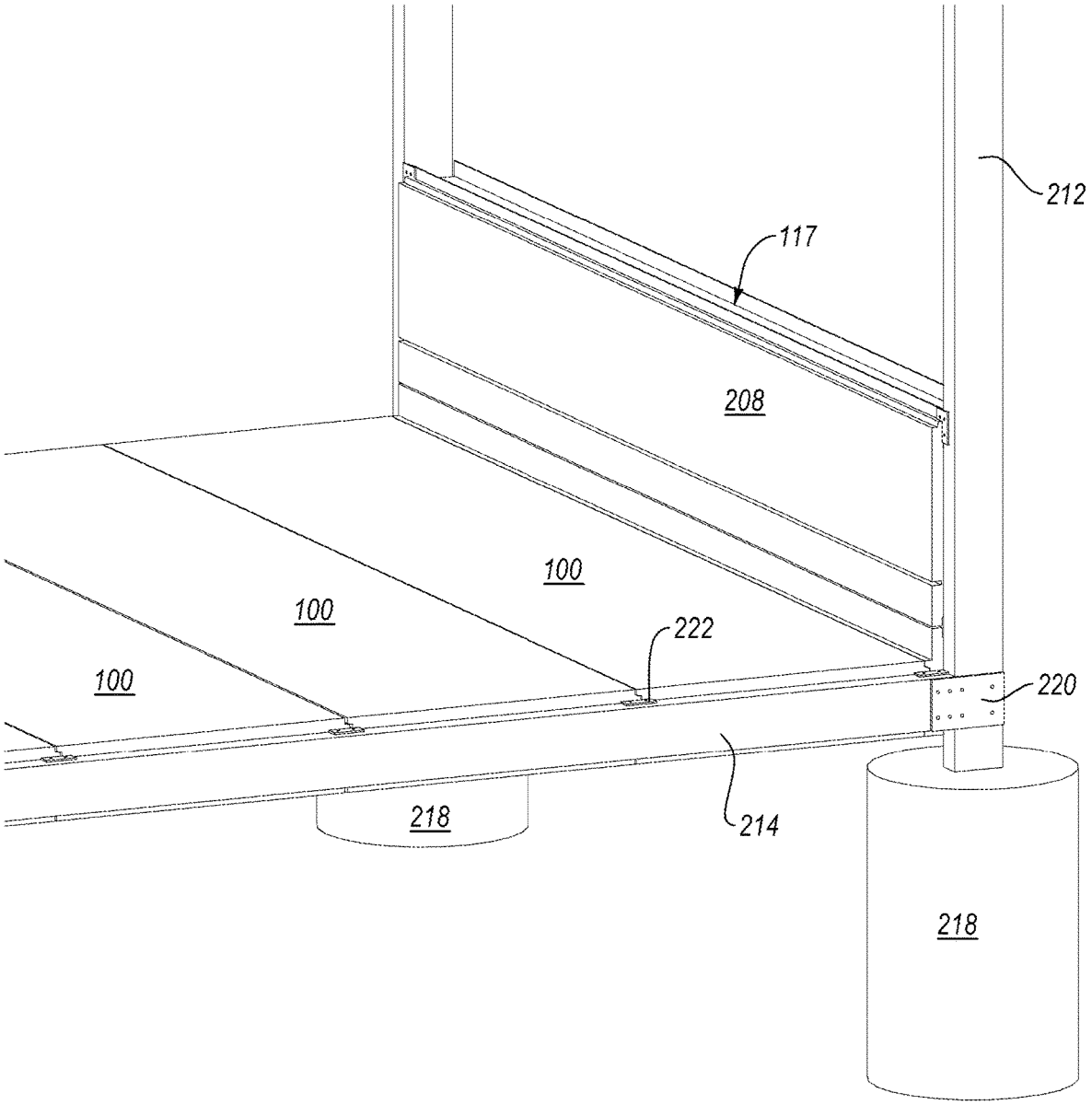

FIG. 21 shows the same configuration of FIG. 20, but with the addition of another of the standard I-beams, positioned in top channels 104*a*' and 104*b*', and adjacent surface 110*a*, in preparation for construction of the vertical wall that the transition panel 208 provides the transition to. As is apparent in the construction of the floor and walls, the I-beams 117 become embedded, and fully concealed within the constructed wall or floor or roof, without any exposure of such I-beams on the external major planar faces of the panels 100. Such lack of exposure is advantageous for preventing ghosting, and other benefits, as described herein.

Figure 22:
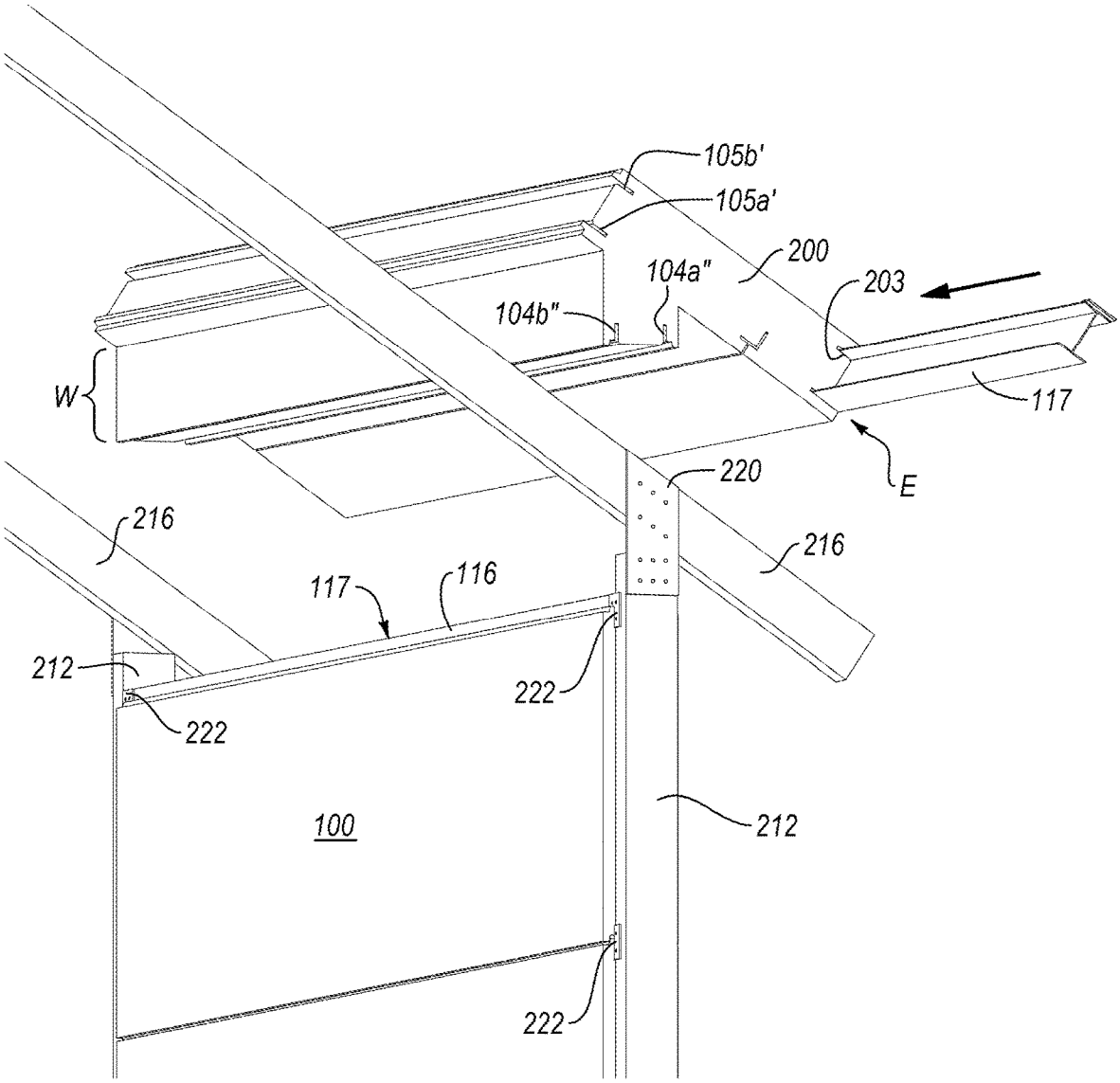
Figure 23:
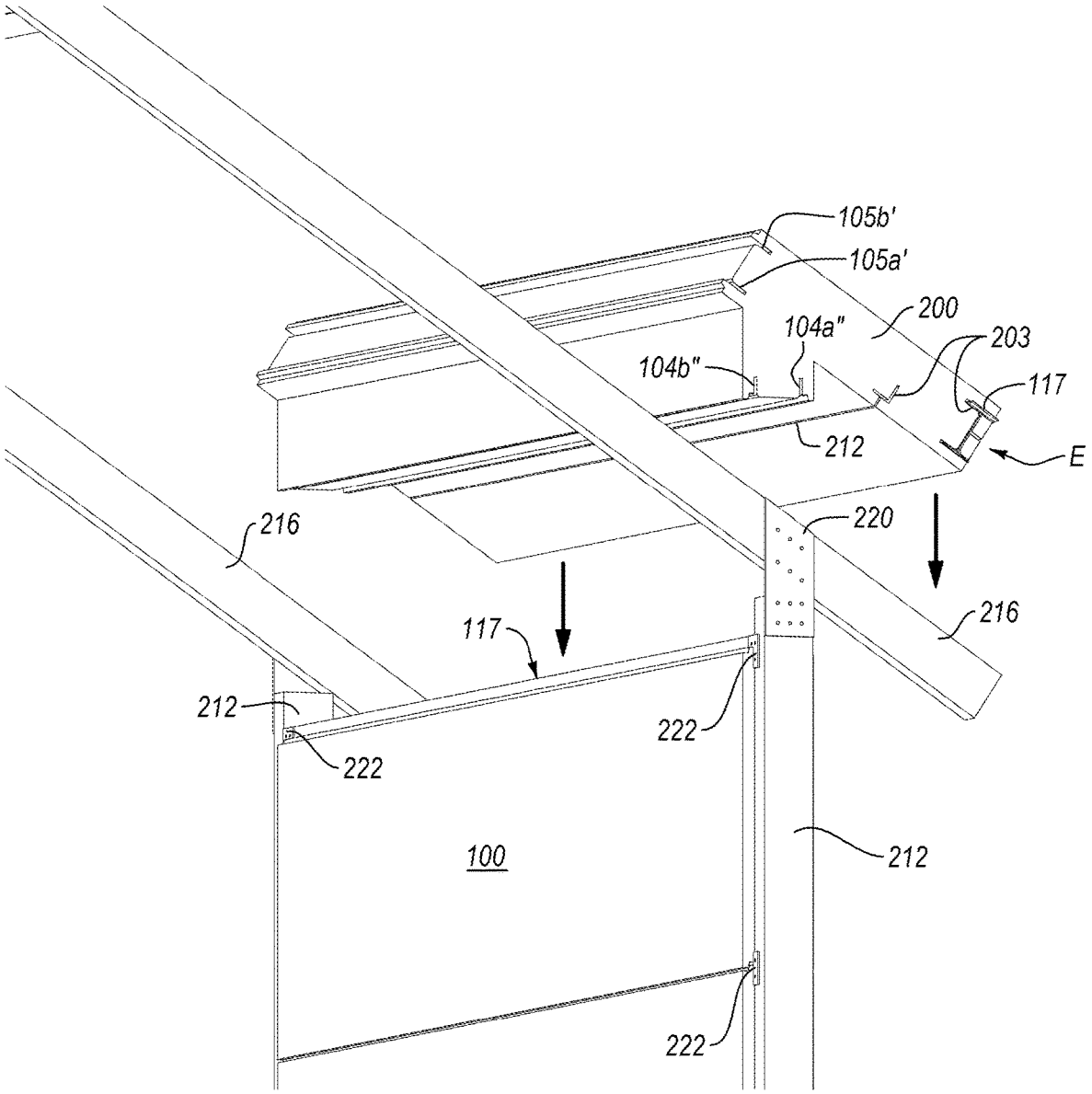
Figure 24:
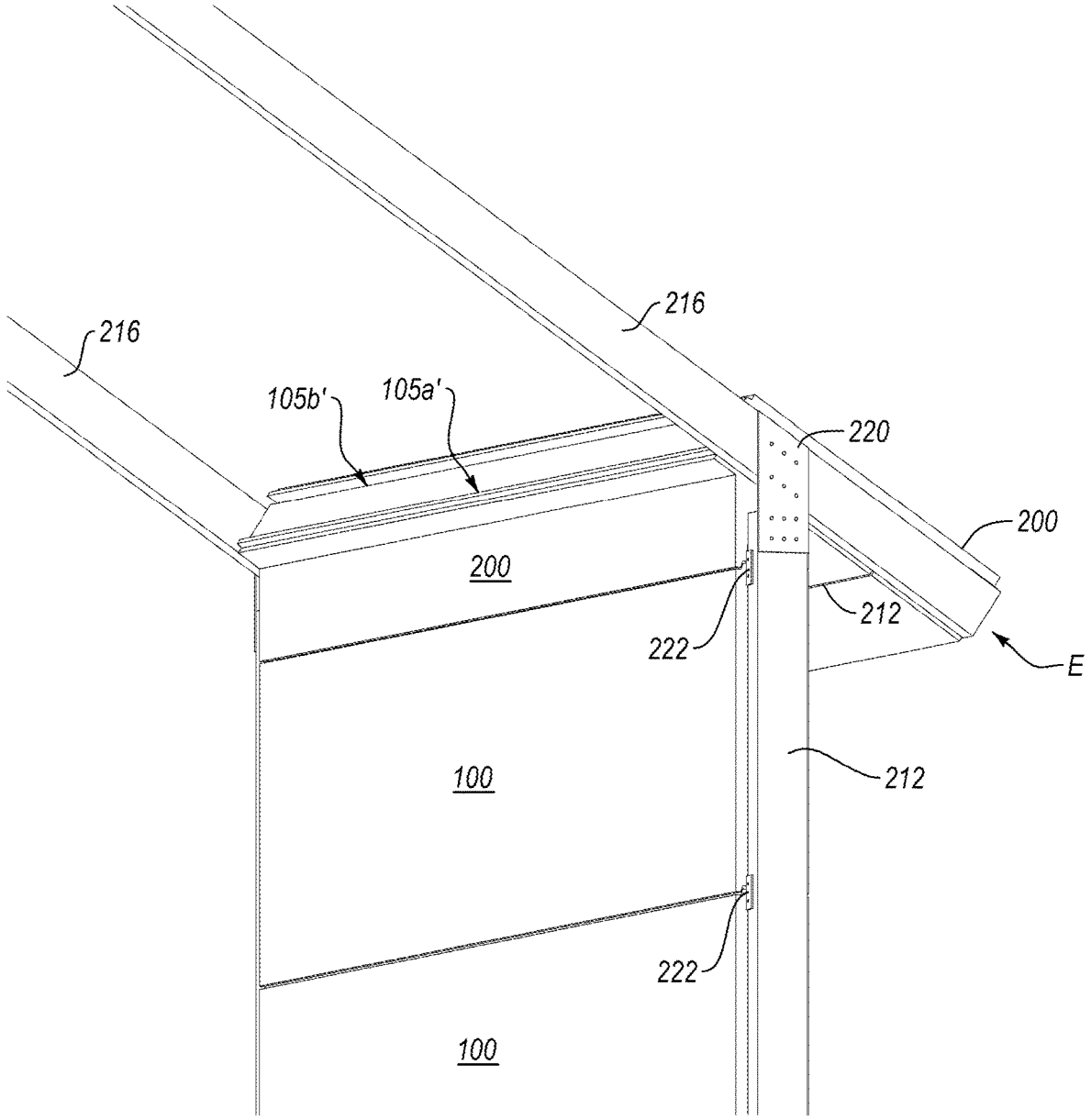

As shown in FIG. 22, once the desired number of wall panels 100 have been stacked, one upon another (with I-beams 117 in between each), the top of the wall structure can be capped with another transition panel, this time a wall-to-roof transition panel 200, already described in conjunction with FIG. 13. As is apparent from FIG. 22, an appropriate spline (e.g., I-beam 117) may be inserted into the slot 203 of transition panel 200, in the eave portion thereof. While FIG. 13 illustrates a C-shaped slot 203 adjacent the eave end E, FIG. 22 illustrates use of an alternative I-shaped slot, configured to receive one of the standard I-beam splines 117. It will be appreciated that various configurations are possible, to provide desired attachment points within eave end E of transition panel 200. With slot 203 filled with an appropriate stiffening member (e.g., I-beam 117 or other spline), panel 200 is maneuvered into position and mated into the I-beam 117 or other spline inserted into the corresponding slots of the top most panel 100 of the wall structure, as shown, in FIG. 23-24.

The height of any desired wall can be accommodated (even where the height does not correspond to an even multiple of the standard panel height, such as 2 feet), by adjusting the length of the vertical wall leg W (FIG. 22) of the transition panel 200. For example, for a 9 foot wall height, 4 panels each of 2 feet in height will provide 8 feet of the wall height, such that the length of the vertical wall leg W may be set at the needed 1 foot, to accommodate the desired height. It will be apparent that such configuration accommodates any desired wall height.

A similar adjustment to the length of the roof plane is similarly provided by the length that is selected for the roof leg (the leg that is adjacent to the wall leg W, which is angled therefrom, at an angle corresponding to the pitch of the roof being formed). In other words, accommodation of specific roof plane lengths are possible by adjusting the length of the roof leg of panel 200, (i.e., that leg including channels 105*a*' and 105*b*'). The length of this roof leg portion of the wall-to-roof transition panel 200 allows selection of an appropriate length to accommodate a desired roof length for the roof which it forms a top portion of.

It is also apparent that the transition panel also dictates the shape and length of the eave associated with the roof. Such integration of the eave into the transition panel 200 is advantageous, as it eliminates the need for construction of separate eave members (which is time consuming, and tedious, as those in the construction trade will appreciate). For example, the eave portion of the panel 200 is shown as being coplanar with the roof leg, extending oppositely therefrom (i.e., on the other side from the roof leg, relative to the wall leg W that separates the eave portion from the roof leg of the transition panel 200).

Figure 25:
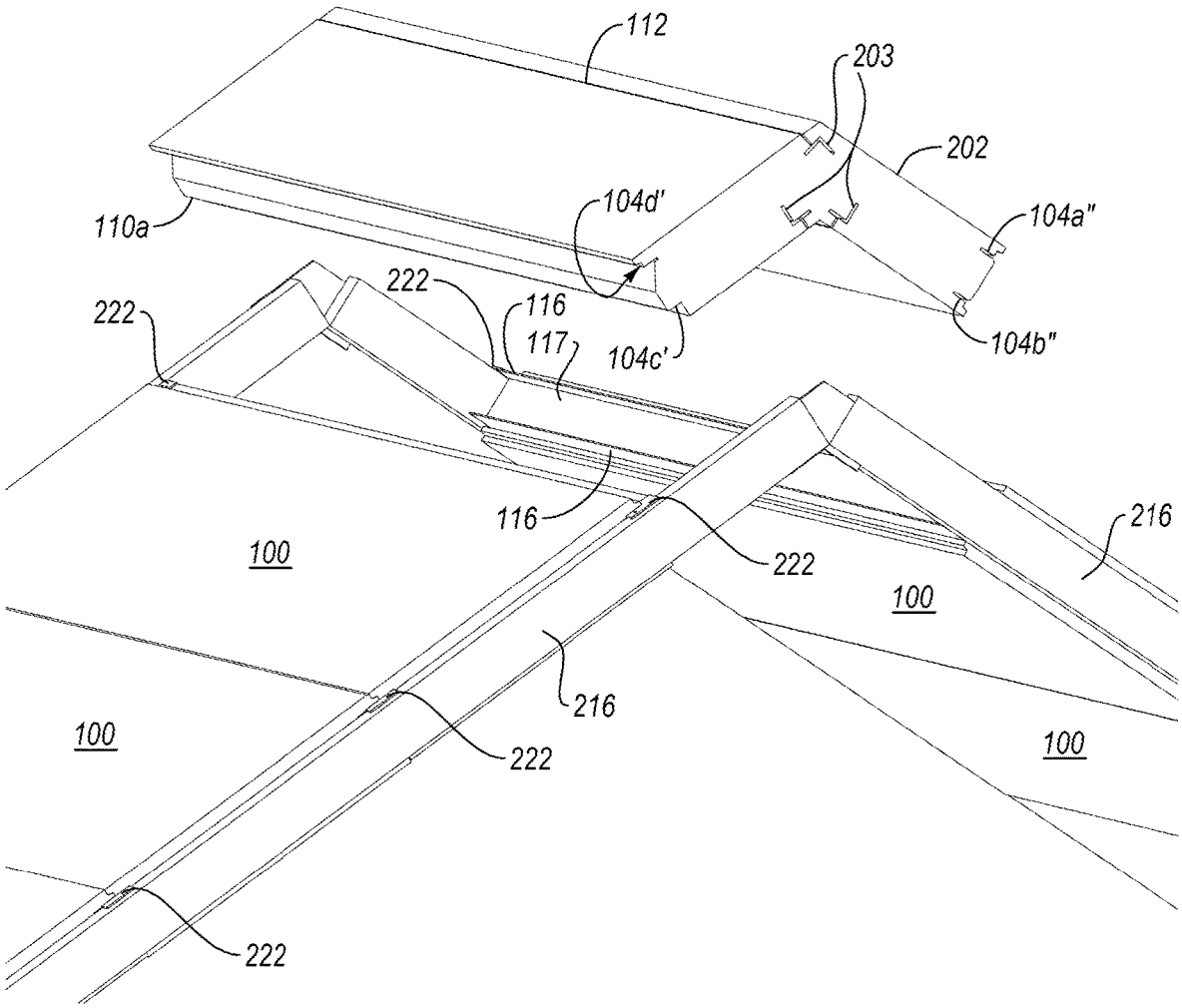

As shown in FIG. 25, with the wall-to-roof transition panel 200 in place, the roof can be constructed by using the same standard panels 100 that were used on the walls and floor, by simply positioning each panel between the truss members 216 of the building frame, inserting an I-beam spline into the channels 104*a*', 104*b*' of one panel, and 104*a*", 104*b*" of the adjacent panel. Of course, the flanges 116 of the I-beam positioned between the first standard roof panel 100 and the transition panel 200 is accommodated in the same manner, with one side of the flanges 116 of I-beam 117 received into channels 105*a*' and 105*b*' of transition panel 200, and the other side of the flanges 116 of the same I-beam 117 received into channels 104*a*" and 104*b*" of the standard panel 100 of the roof. As shown in FIG. 25, both sides of such a pitched roof are formed in this manner until reaching the area of the apex of such a pitched roof.

Figure 26:
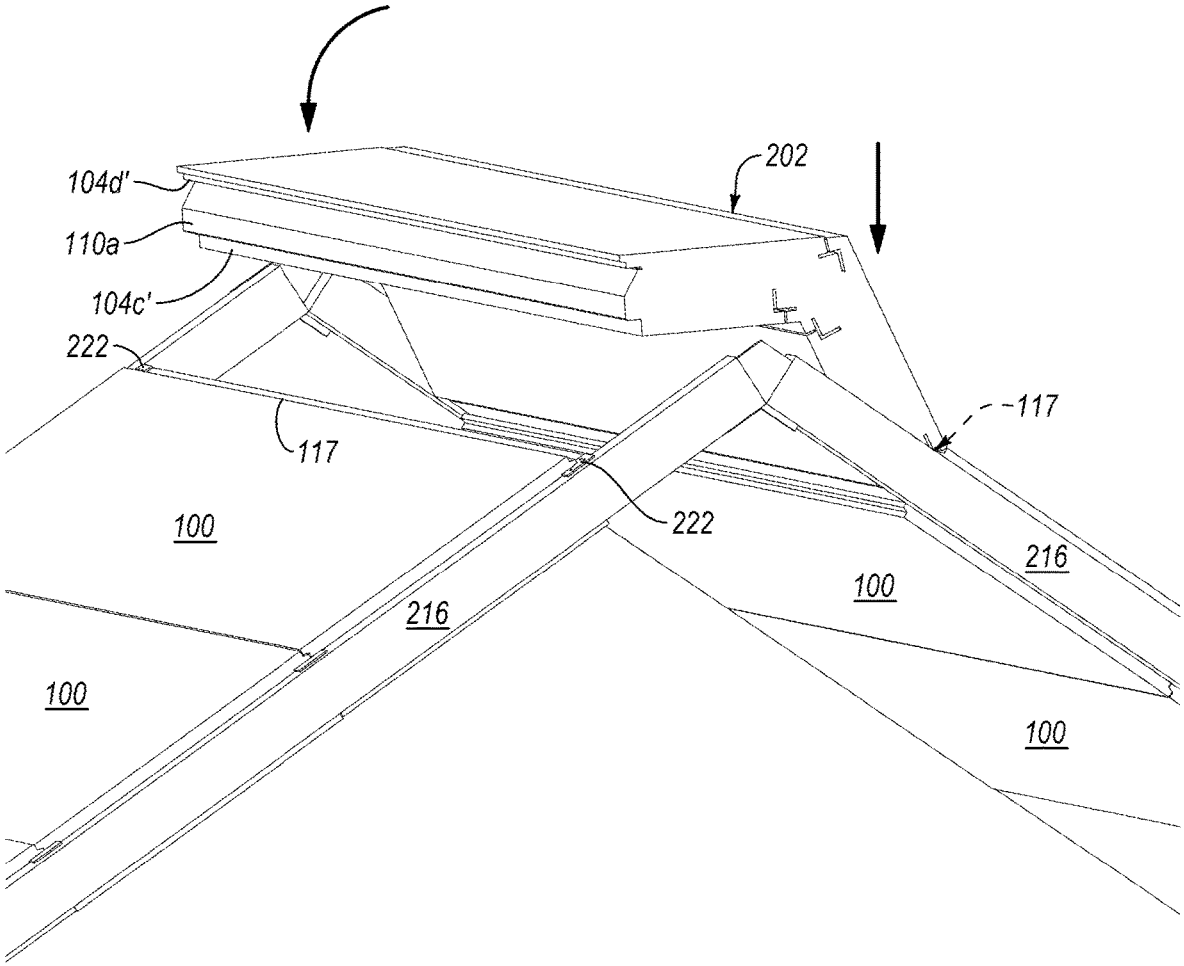
Figure 27:
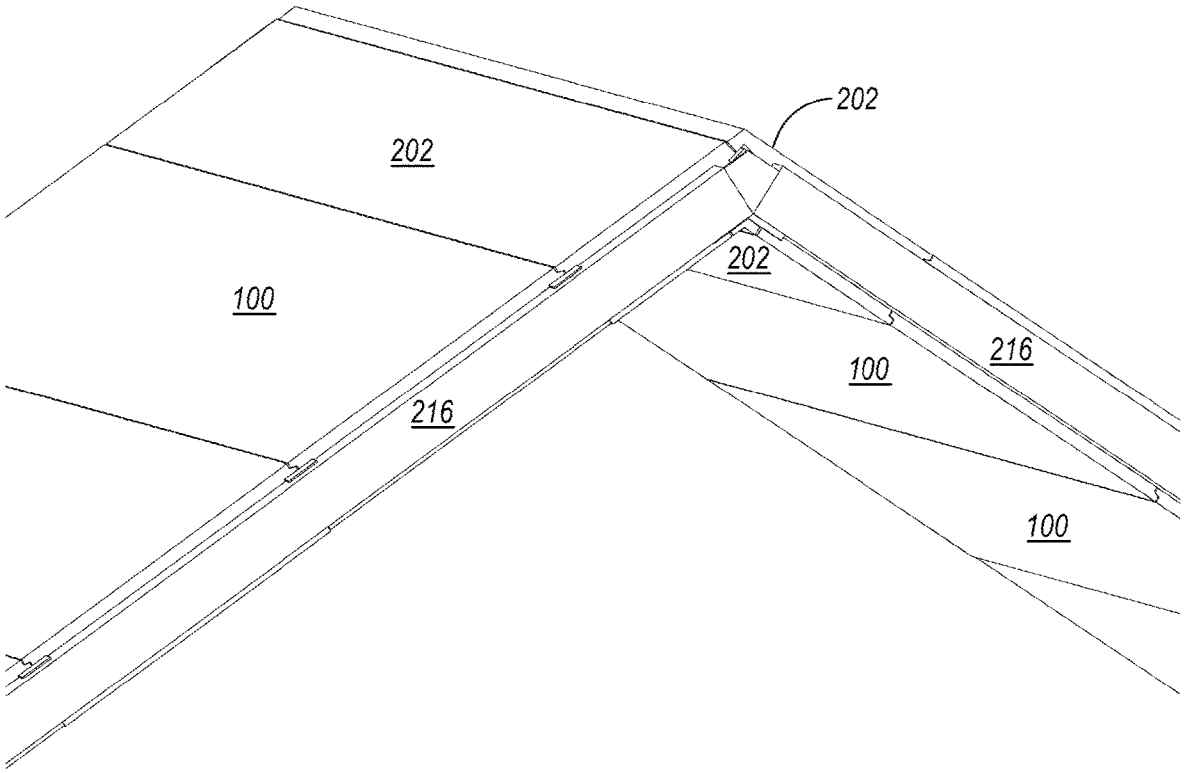

As shown in FIGS. 25-27, the roof cap transition panel 202 is used to complete the apex portion of the roof structure. As shown in FIG. 26, once the more standard channels 104*a*" and 104*b*" are engaged with their corresponding I-beam 117, the roof cap transition panel 202 may be rotated downward, and because of the cut-away portion at surface 110*a* of transition panel 202, its rotation is unimpeded as it rotates into proper engagement with the I-beam 117 on the other end, for reception into channels 110*c*' and 110*d*'.

Figure 28:
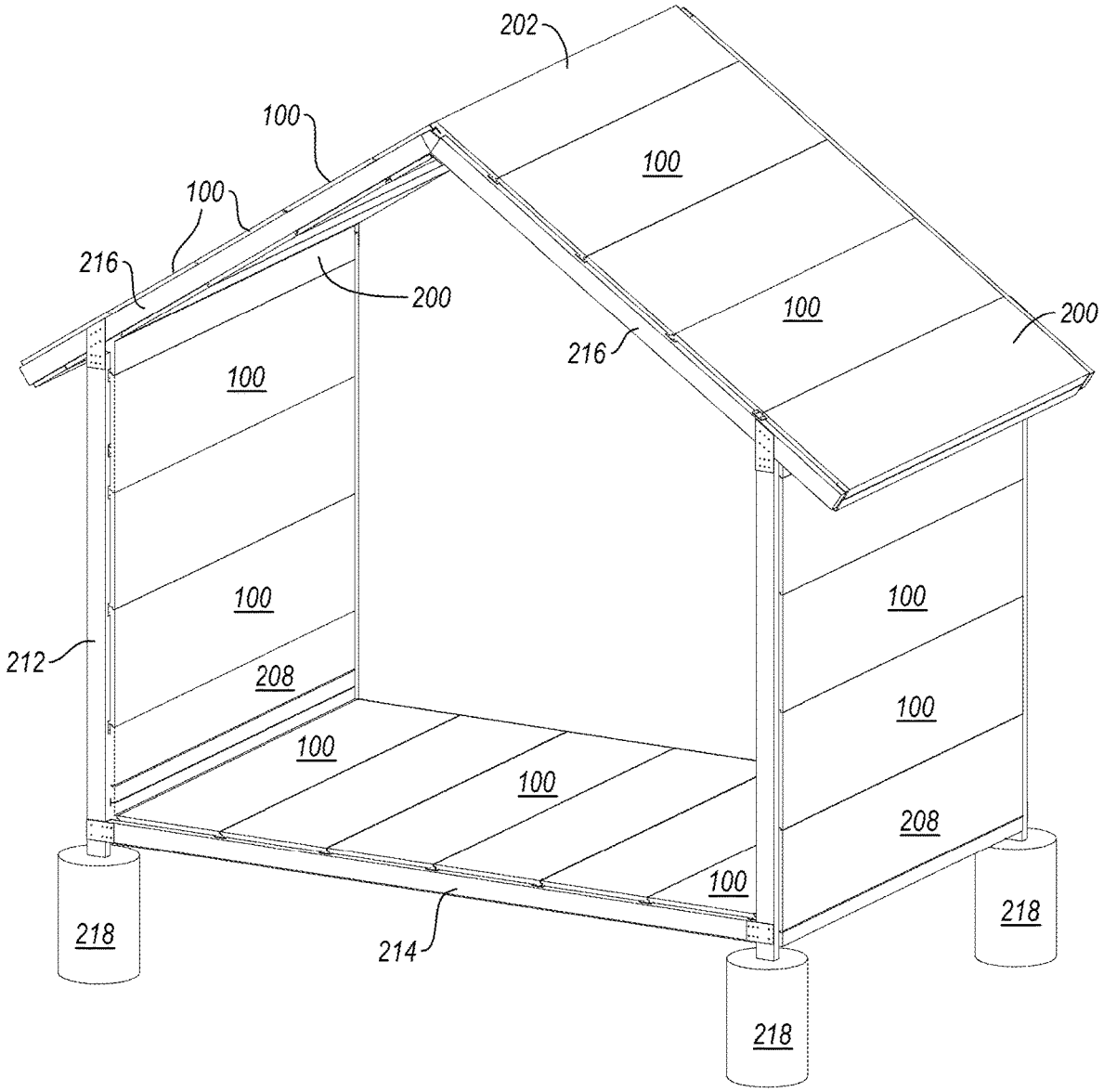

FIG. 28 shows the exemplary structure complete, with floor, walls, and roof. The other walls at either end are shown open to better illustrate the other structures, although it will be appreciated that these walls may be filled in with standard wall panels using the same building system and techniques as described herein.

By way of example, the standard (and other panels) may each be provided in a standard dimension, such as 2 feet in height, by 8 feet in length. Such exemplary panels are lightweight, for example, weighing about 6 lbs for the standard panels 100 shown. If pre-fabricated I-beams 117 are used, e.g., made of aluminum, such similarly only weigh about 7 lbs. The system is thus easily employed by those of limited strength, and without any skilled training.

Figure 30:
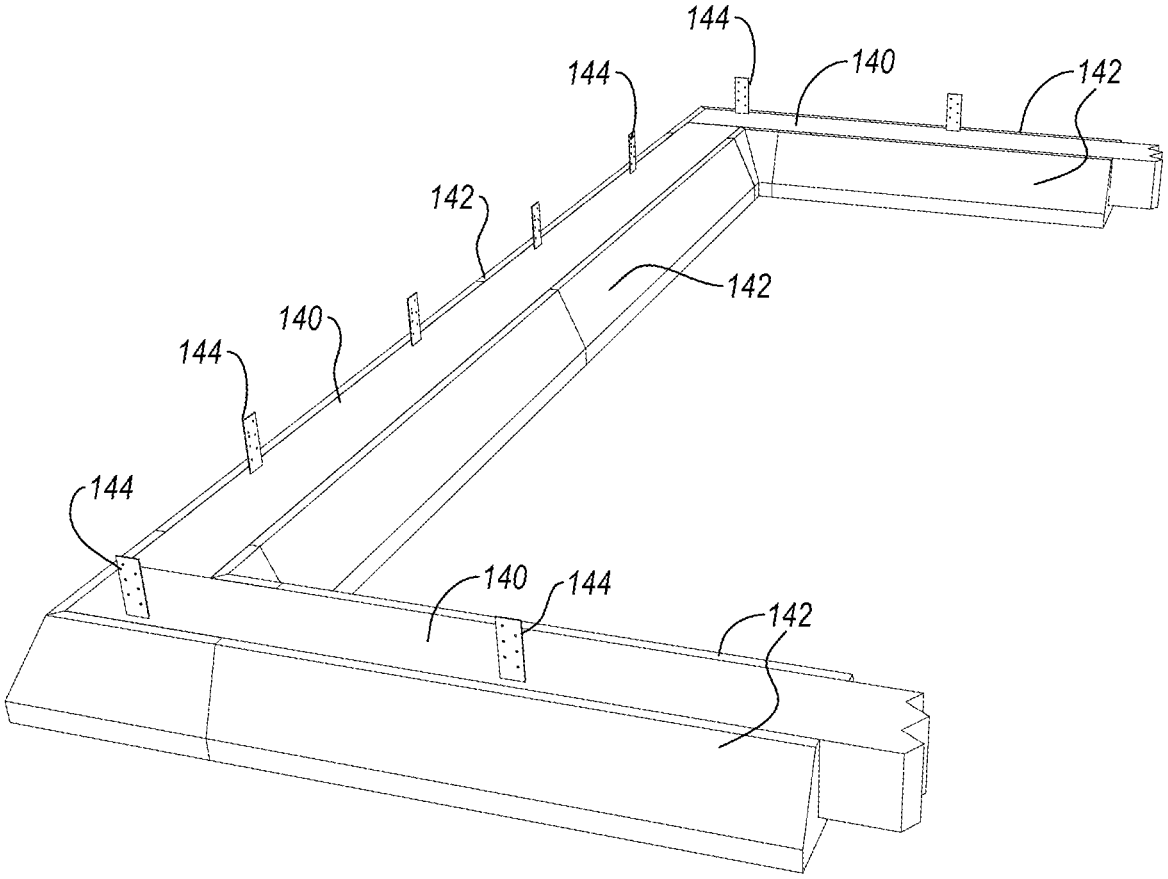
FIGS. 30-39 show a building progression according to another embodiment of the present invention.

FIGS. 30-39 illustrate progressive assembly of another building construction system, using panels and C-channel members (positioned back-to-back to form an I-beam), according to another embodiment. FIG. 30 shows pouring or other formation of a continuous concrete footing 140, poured into a frost foam form 142. The stay in place frost foam form 142 can be laid down in any shape, depending on the shape of the building to be constructed. Such a form 142 can be a single piece of foam, wrapping around the sides and bottom of the footing 140. Where such is the case, the footing need not extend below the frost line (e.g., 30 inches in many temperate climates with a winter season), which is otherwise needed in order to ensure frost does not form under the footing, and result in undesired uplift. Rather, the footing may need be only 16 inches or less, 14 inches or less, 12 inches or less, or 10 inches or less in depth. The stay in place frost foam form 142 may remain in place, even after the building is completed (e.g., covered over with soil), to inhibit penetration of frost under the footing, which would cause uplift. Footing 140 can include cast in place tie hold downs 144, as shown, for subsequent attachment to the frame members (C-channel frame members) which are later added.

Figure 31:
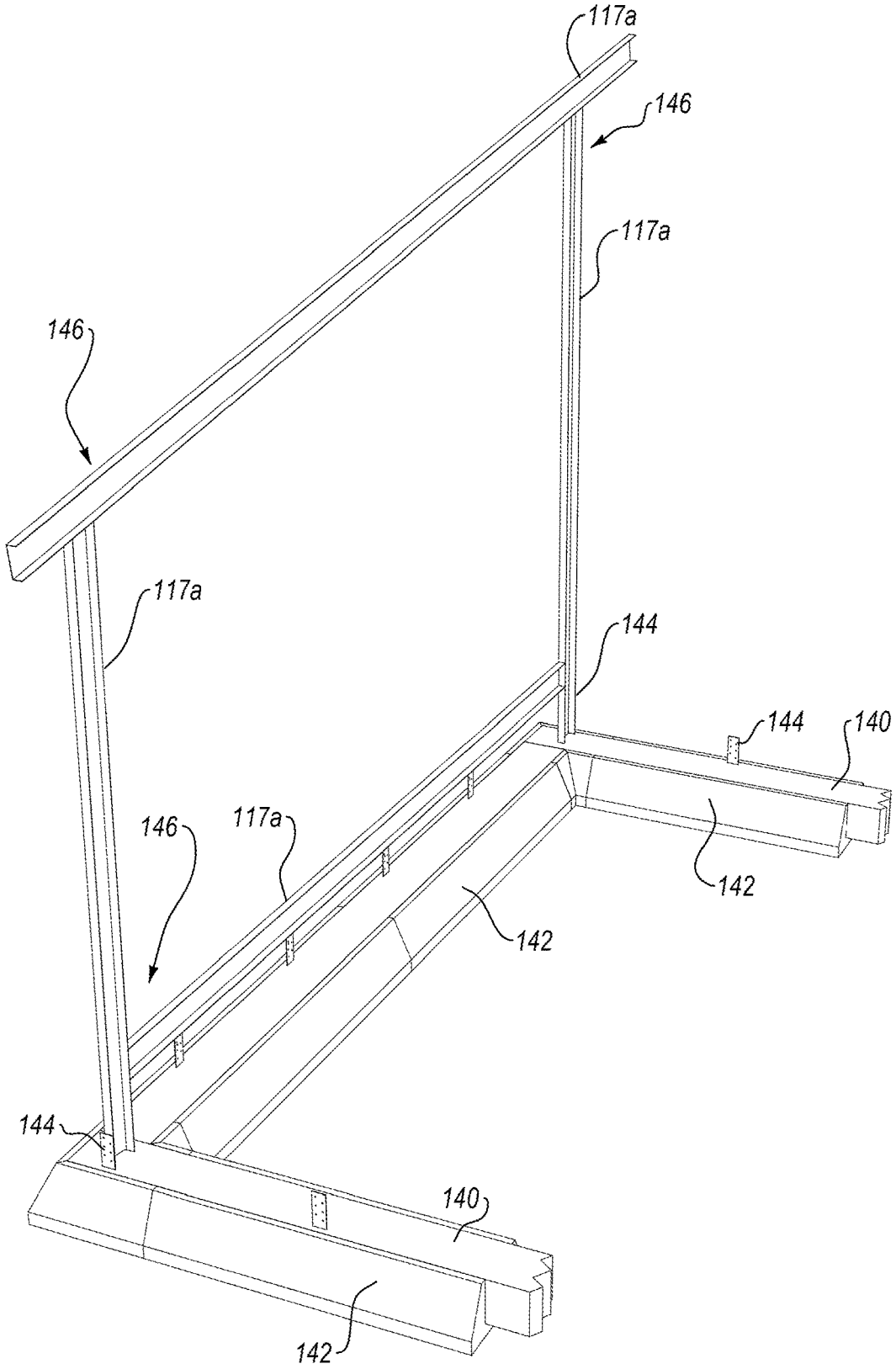

As shown in FIG. 31, once the continuous footing 140 is cured, an endwall frame 146 may be installed, where the endwall frame 146 is made up of a plurality of C-channel frame members 117*a*, as shown. The enwall frame 146 may be assembled on the ground, and then lifted into place. Because the endwall frame is not made up of back-to-back C-channel members, it is relatively lightweight, e.g., less than about 200 lbs for a typical building, so that no crane or other heavy equipment is needed for lifting. Manual labor of relatively unskilled workers is advantageously sufficient. As shown in FIG. 31, the tie hold downs 144 may be attached (e.g., bolted, screwed, etc.) to the vertical C-channel frame members 117*a* of the endwall frame 146, as shown. The endwall may also be braced (with braces 162), as shown in FIGS. 43-56. Because the frame 146 is an endwall, it is not necessary that the frame members be I-beams (to allow attachment to panels on both sides thereof), but half of such an I-beam is sufficient, so that the C-channel frame members 117*a* can be used. Where a subsequent frame assembly (e.g., a wall frame assembly, roof frame assembly, or floor frame assembly) is interior, 2 C-channel frame members 117*a* may be placed back-to-back, forming an I-beam 117, although this assembly is not assembled on the ground, but connected one frame member at a time to the intervening foam panels, as described herein.

Figure 32:
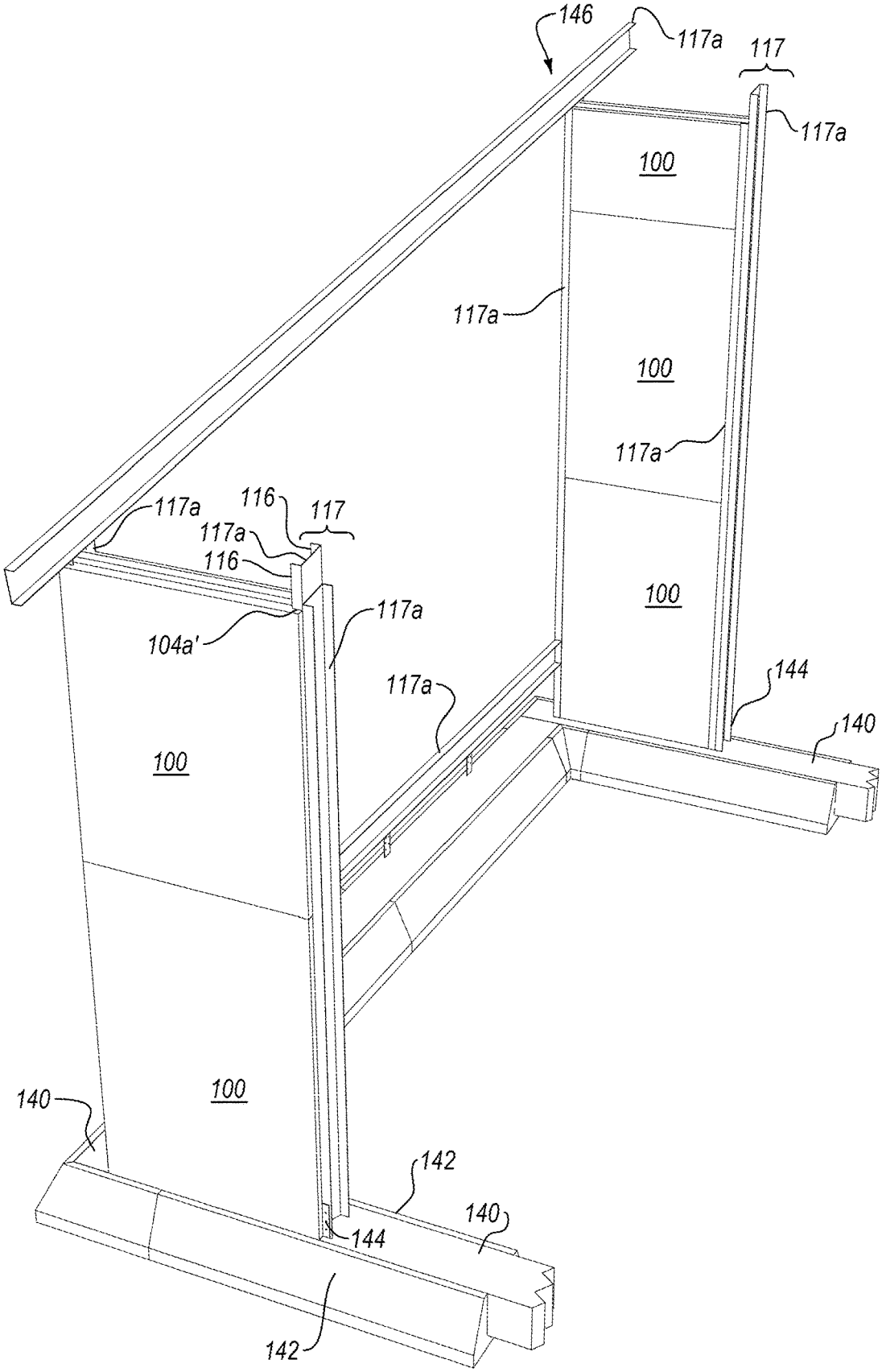
Figure 42A:
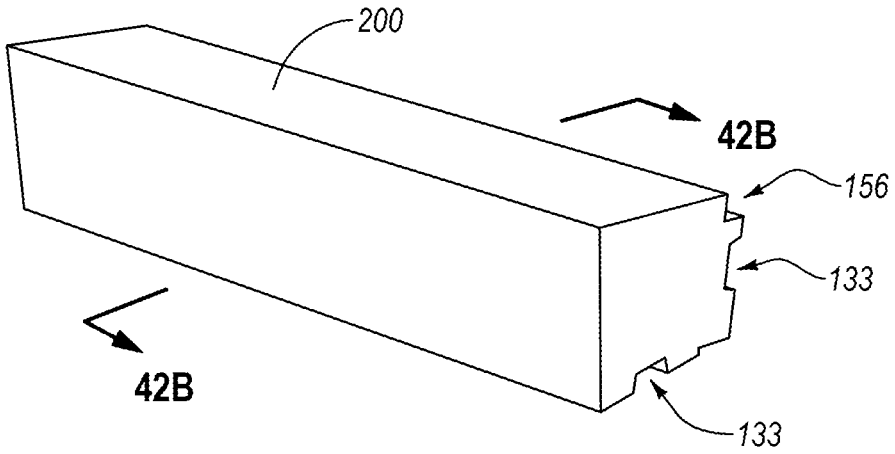
FIGS. 42A-42C show various views of an exemplary modular wall-to-roof transition panel 200, as may be used for transitioning from wall to roof sections in the building construction of FIGS. 30-39.
Figure 42B:
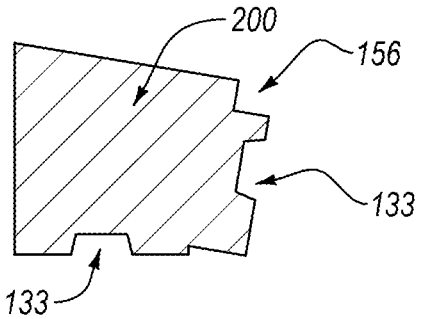
Figure 42C:
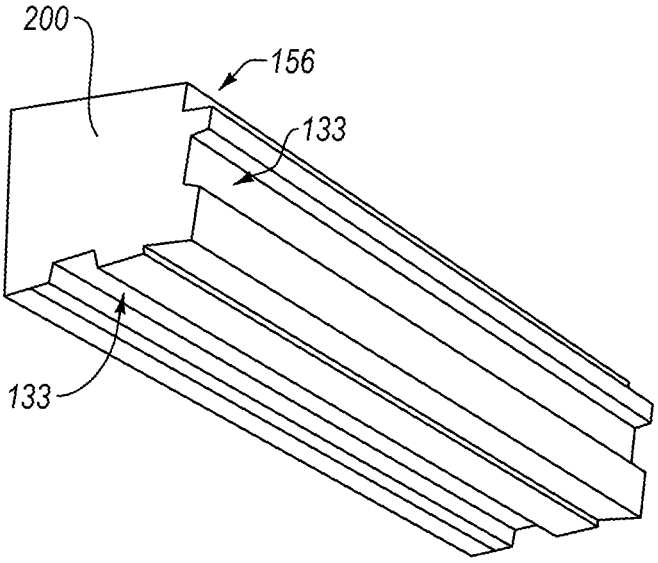
Figure 43:
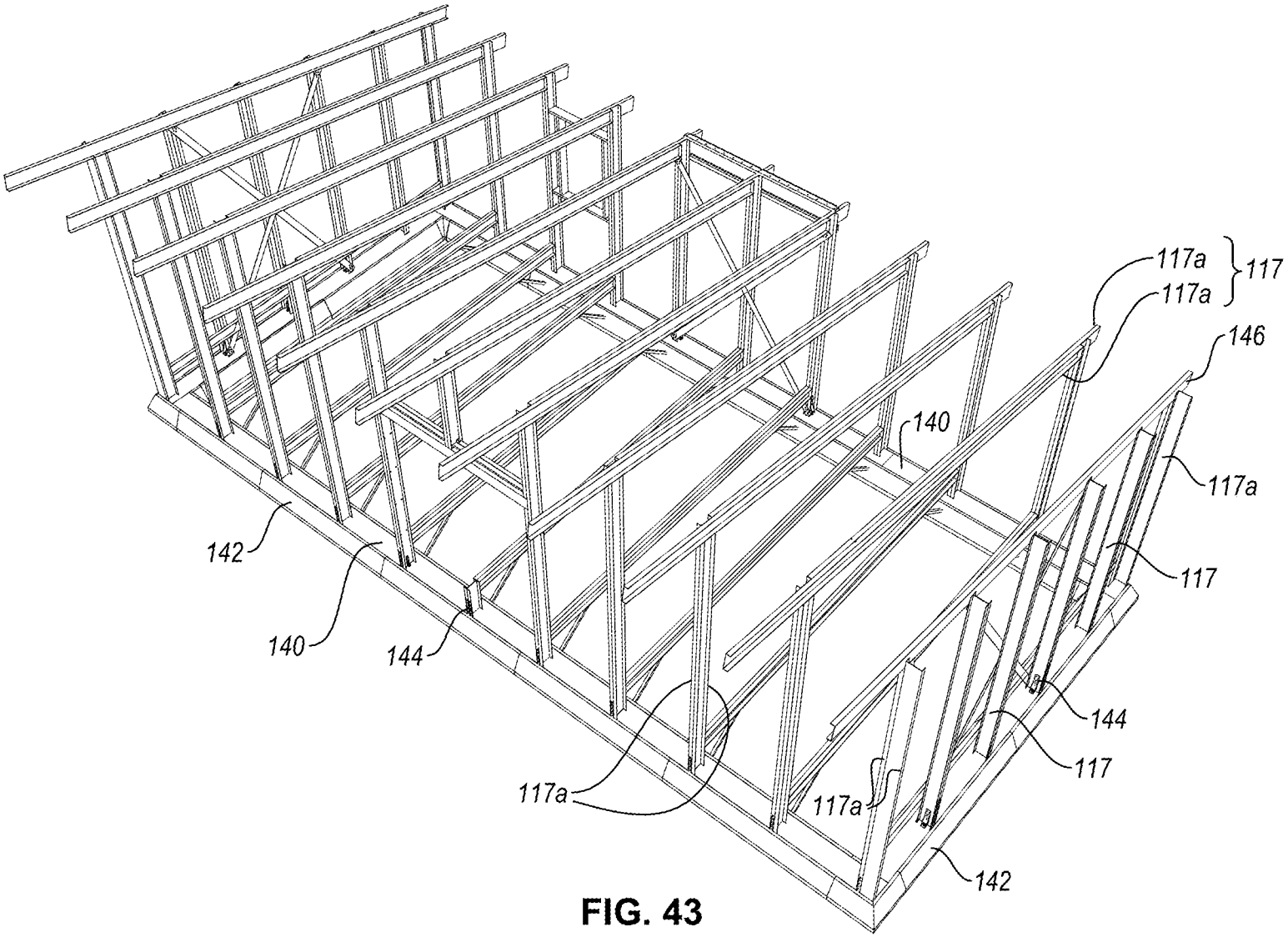
FIG. 43 shows another building construction, just showing the frame, where the foam panels are omitted to better show the frame, in FIGS. 43-56. It will be understood that the frame is not assembled this way, without the foam panels, but that a panel is installed between installation of each frame member, for the reasons noted herein.

FIG. 32 shows installation of foam modular wall panels 100. With the endwall 146 in place, and plumb (i.e., vertical) relative to the level footing 140, the endwall frame acts as an anchor, against which the next component (the foam panel 100) can be installed. Such panels may be similar or identical to any of the other modular panels disclosed herein. FIGS. 40A-40D show views of an exemplary modular panel 100, as may be used in any building construction, such as that of FIG. 30-39 or 43-56. Such panels 100 are installed into place (mating the channel 104*a*' of each panel with one of the flanges 116 of the vertical C-channel frame member 117*a* of endwall frame 146). Modular panel 100 differs from some of the other panels described herein, in that panel 100 may include only a shingle channel 104*a*', in each of the right and left sides 110*a*, 110*b* of the generally rectangular panel 100. One of flanges 116 may therefore engage in channel 104*a*', while the other flange 116 may wrap around a corner edge of the generally rectangular panel 100, as shown in the Figures. FIG. 42 perhaps best illustrates this configuration. In any case, it is important that the "ear" at the edge of the panel, where the channel 104*a*' is located, be fully engaged with the C-channel frame member 117*a*. The space between flanges 116 is filled with the foam panel ear, ensuring that if such an ear portion of panel 100 is pressed on in this configuration, the ear is not under tension (which would cause it to break off with moderate pressure), but is under compression, because this ear portion is positioned between the flanges 116 of the C-channel frame member 117*a*.

Once panels 100 of the wall section are in place, the subsequent vertical I-beams 117 (formed by back-to-back C-channel frame members 117*a* forming an I-beam wall frame assembly 117) are slid into place, with a flange 116 on one side of such I-beams 117 inserted into the corresponding channel of the foam panels 100 forming the wall, and the other of the flanges wrapping around a corner edge of the foam panel 100. By way of example, in FIG. 32, such wrapping is shown as occurring on the interior surface of the wall. The system could alternatively be configured to provide this wrapping on the exterior surface of the wall. This configuration ensures the ear of the panel is positioned between the flanges, for the reasons noted. It is important that the present method progresses by installation of a flanged frame member (e.g., the C-channel frame member 117*a* or I-beam 117), followed by installation of the adjacent foam panel 100, before installation of the next, adjacent flanged frame member. Intervening placement of the foam panel acts as the tape measure really, ensuring that the next adjacent frame member will be positioned in exactly the correct spot, without any measurements required. Such a method differs from another method where the entire frame (or a significant portion thereof) were installed (i.e., installation of adjacent frame members, without intervening placement of the foam panel that gets positioned therebetween), as it provides distinct advantages in simplicity (no tape measure required), no bracing of frame members required, etc. This order of placing a frame member, followed by engaging the foam panel into such frame member, before placing the next adjacent frame member is an important aspect of the present invention.

Figure 35:
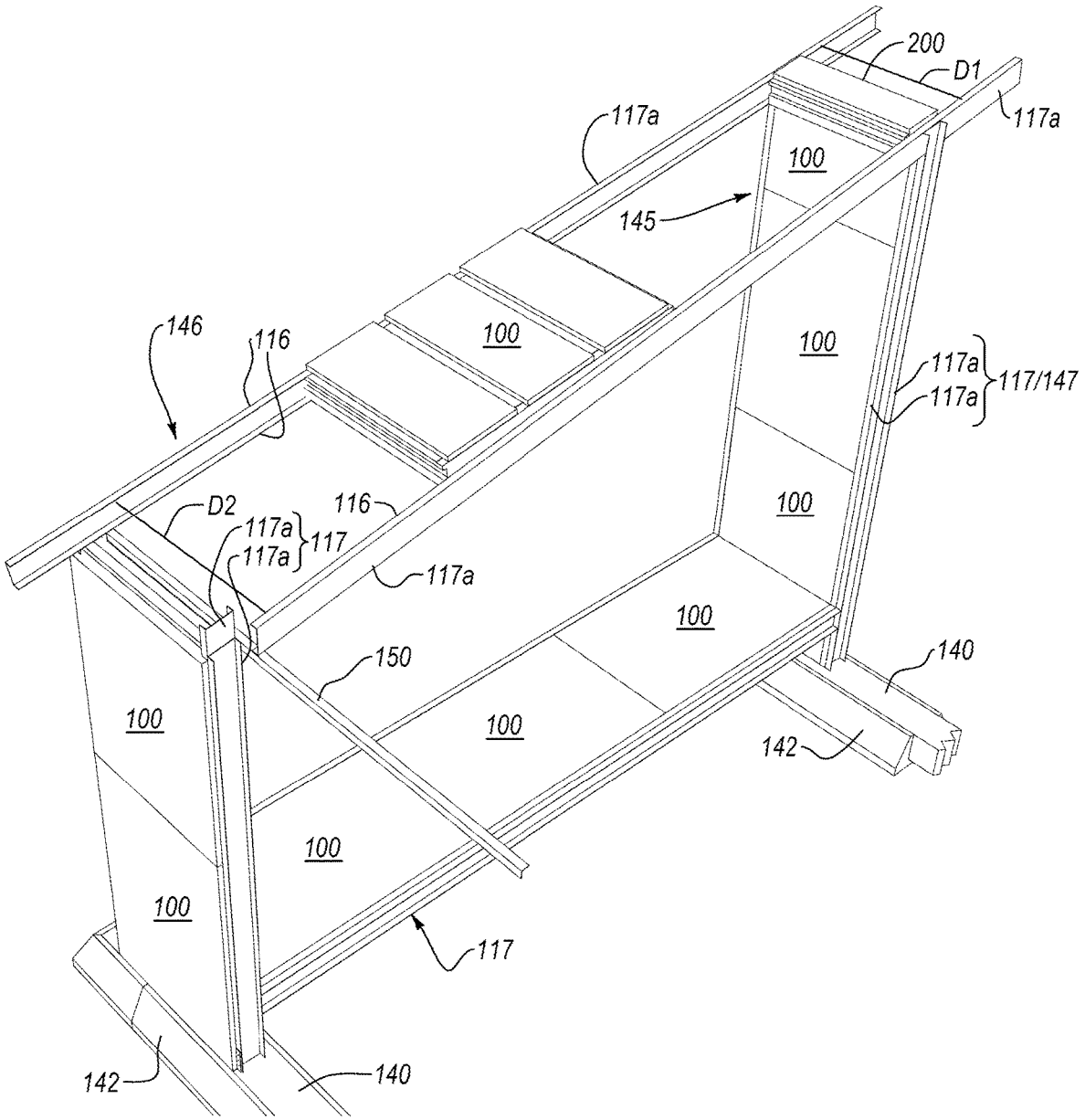

As shown in FIG. 32, one of the C-channel members 117*a* making up the vertical I-beam wall frame assembly 117 between wall sections is longer than the other C-channel member 117*a*, where they are attached back-to-back. The vertical I-beams 117 are also shown as mirror images of one another, with the inward C-channel member being longer in the near I-beam wall frame assembly 117 (designated 147'), and the outward C-channel member being longer in the far I-beam wall frame assembly 117 (designated 147) (near and far being relative to the perspective seen in FIG. 32 and subsequent Figures). Such a configuration allows attachment of a roof truss C-channel frame member 117*a* to the longer vertical C-channel member 117*a* at the far end 147 (as shown in FIG. 35), where the unattached near end 147' of the roof truss C-channel member 117*a* can be temporarily supported on a temporary ledger, providing a temporary splayed configuration, to facilitate easier insertion of roof panels, from the wide end at the bottom of the roof, towards the narrow end at the top of the roof.

Figure 33:
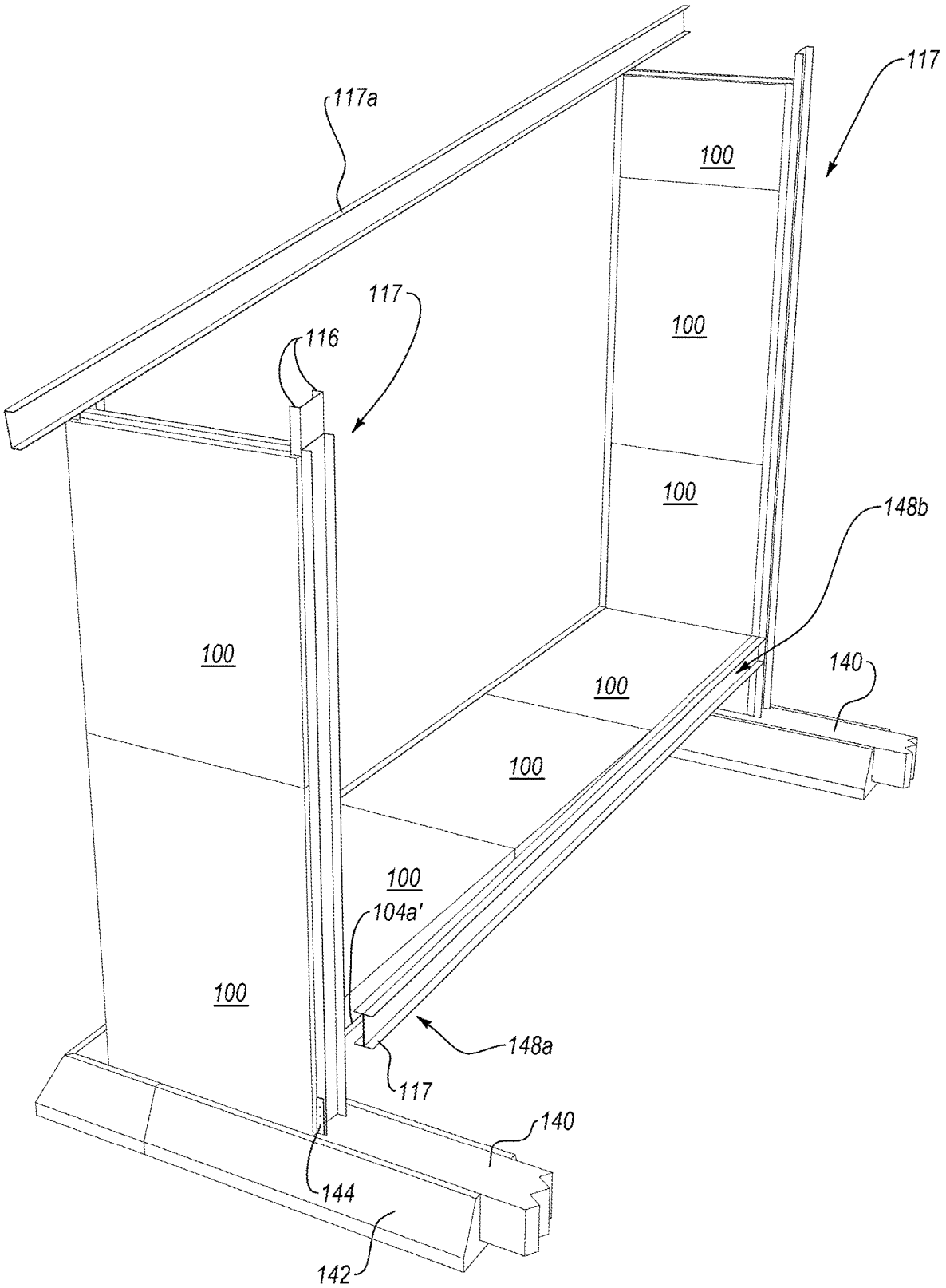

FIG. 33 shows installation of foam floor panels 100 as one end of an I-beam floor frame assembly 117 (formed from back-to-back C-channel members 117*a*) is connected to one side (e.g., the far side in the perspective view of FIG. 33) of the vertical I-beam wall frame assembly 117 (designated 147), allowing the floor panels 100 to be slid in place from the wide end (at 148*a*), where the floor frame assembly 117 is unattached (at 148*a*), towards the narrow end, where the floor frame member is attached (at 148*b*).

Figure 34:
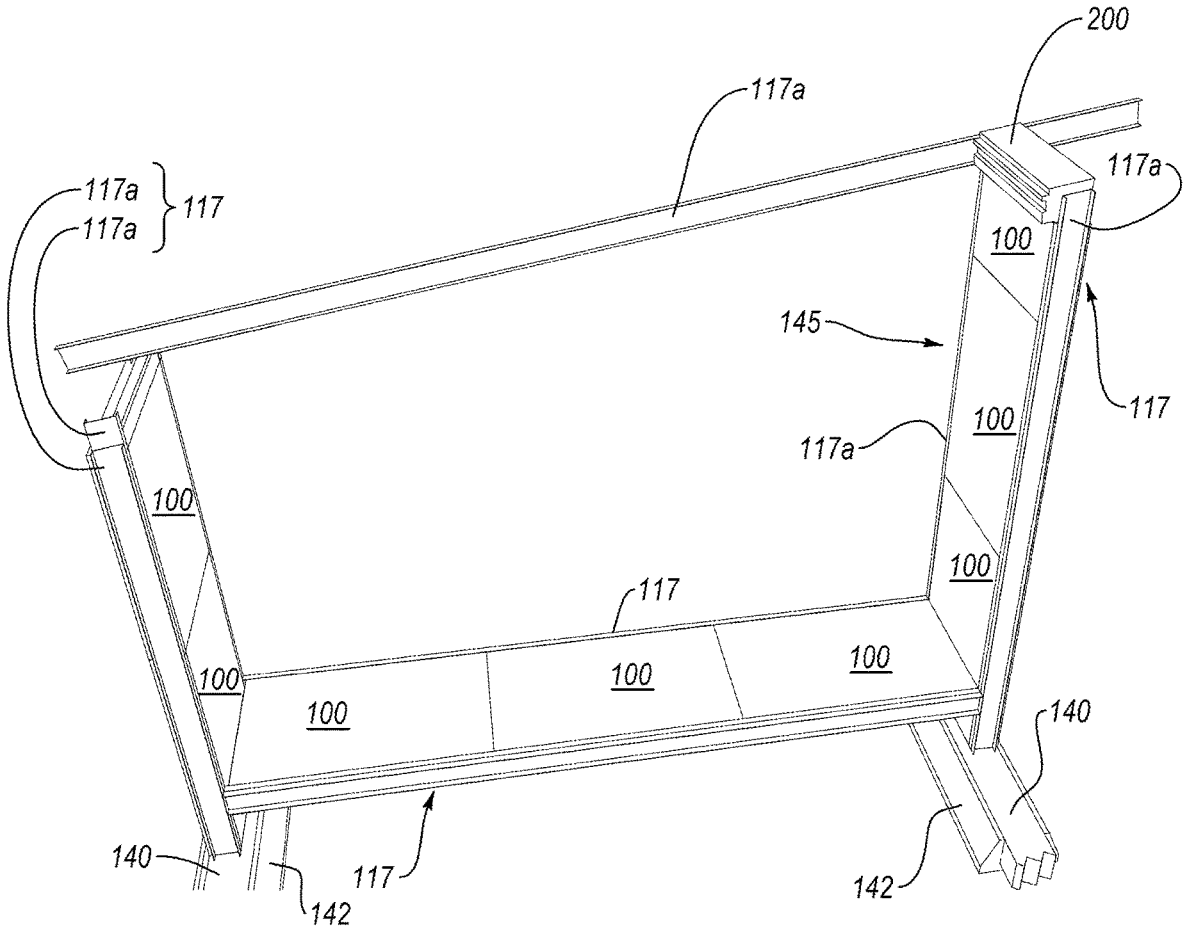
Figure 36:
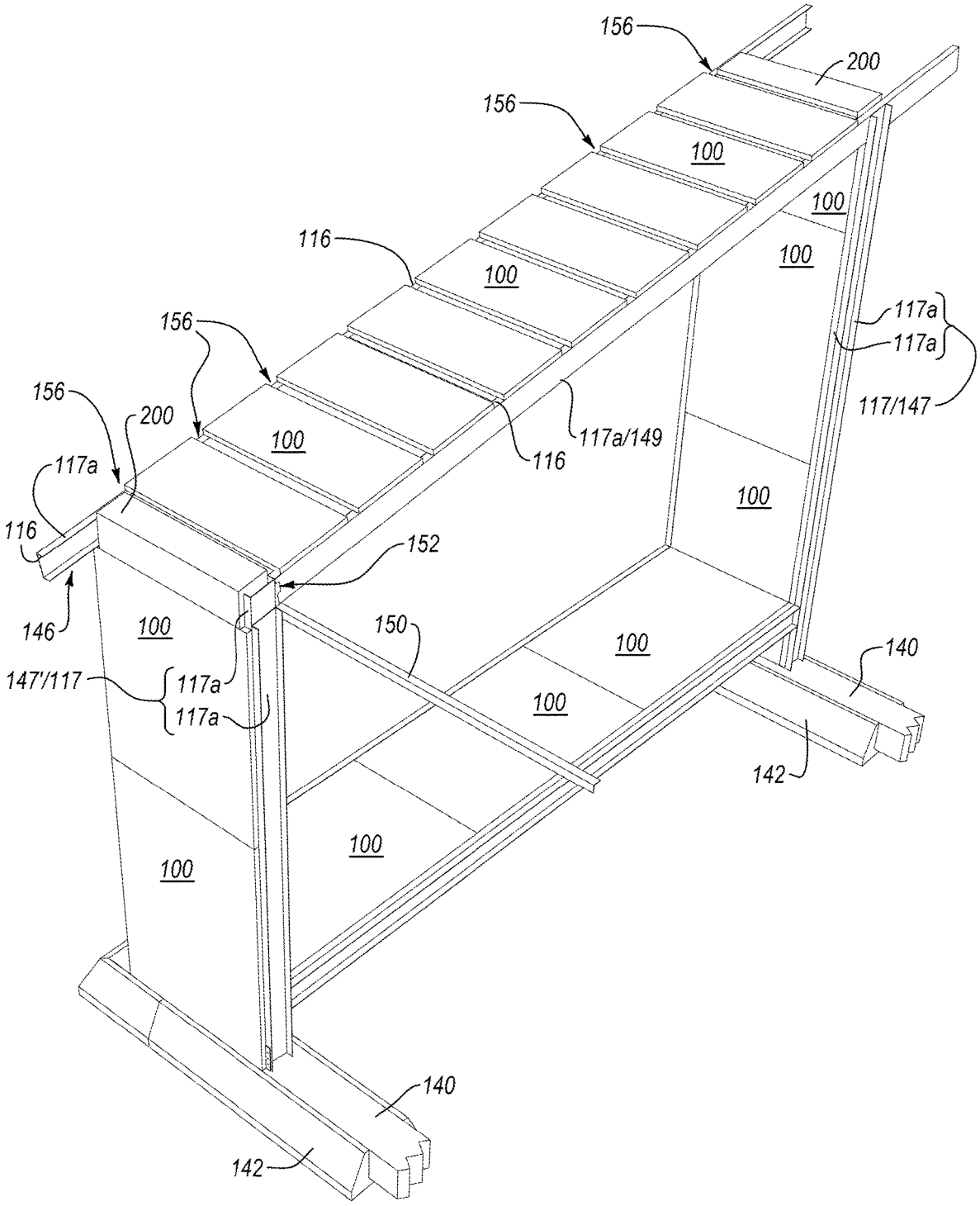

FIG. 34 shows installation of a wall-to-roof transition panel 200 at the top of one of the stack of wall panels 100, that forms the vertical wall section 145 at the far end 147 of FIG. 34. As shown in FIG. 35 one end of the I-beam wall frame assembly 117 (designated 147 in FIG. 35) is attached to a C-channel roof frame member 117*a*, with the opening of the C-channel oriented towards the opening of the C-channel of the opposing roof frame member 117*a* of the endwall frame 146. FIG. 35 also shows installation of a temporary support ledger 150 to support the C-channel roof frame member 117*a* that is rotated out of parallel relative to the roof frame member 117*a* of the endwall frame 146, to facilitate easy insertion of roof foam panels 100. Roof panels 100 may be identical, or substantially identical to the foam panels 100 used to form the vertical walls, and the floor. FIGS. 41A-41D show such a foam modular roof panel, identical to the wall panel, but for the inclusion of the optional purlin channel 156 in the top major planar face of the roof panel. The bottom major planar face may not include any such purlin channel, but may be entirely planar. As shown in FIG. 35, the distance (D1) between the adjacent roof frame members 117*a* is narrower at the far end than the distance (D2) between these same roof frame members 117*a*, at the near end, to facilitate easy insertion of the roof panel members 100, by sliding them into the space between such frame members 117*a*, as shown. Roof panels 100 are slid until the channels on each end of such panel engage with one of the flanges 116 of the respective C-channel frame members. One flange 116 is received into the channel 104*a'* formed into the right and left sides of the roof panel, while the other flange wraps around the corner edge (e.g., the bottom corner edge) of the roof panel. This ensures that the space between the flanges 116 is filled with the foam panel, providing benefits as described herein. Each roof panel can be slid across the roof space, as needed, to fill the space between such C-channel frame members 117*a*, with the roof panels 100 that form the roof, in combination with the C-channel frame members 117*a* of the roof (e.g., serving as trusses). FIG. 36 shows the configuration of such a portion of the roof once the full row of roof foam panels 100 have been slid into place, and the wall-to-roof transition panel 200 at the opposite stack of vertical wall panels 100 is installed. Each wall-to-roof transition panel 200 may include a purlin channel (half a purlin channel really), to form a full purlin channel with the end of the adjacent roof panel, which includes the other half of the purlin channel, as shown. In FIG. 36, the C-channel roof frame member 117*a* that was initially supported on ledger 150 has been moved in position, so as to be parallel with the opposing roof frame member 117*a* of endwall 146. No tape measure is needed to ensure that the frame member 117*a* as rotated to parallel is in fact parallel, as the foam panels in between frame members 117*a* ensure that the spacing and positioning of the adjacent frame member 117*a* is exactly where it should be. The near end of this roof frame member 117*a* can be connected (e.g., using an ear bracket 152, or similar connection bracket) to the vertical wall frame assembly 117 (2 C-channel members 117*a*, positioned back to back), designated 147'. Similar connections (e.g., using an ear bracket) can be made between any of the C-channel or other shaped frame members, as needed, within the construction.

Figure 37:
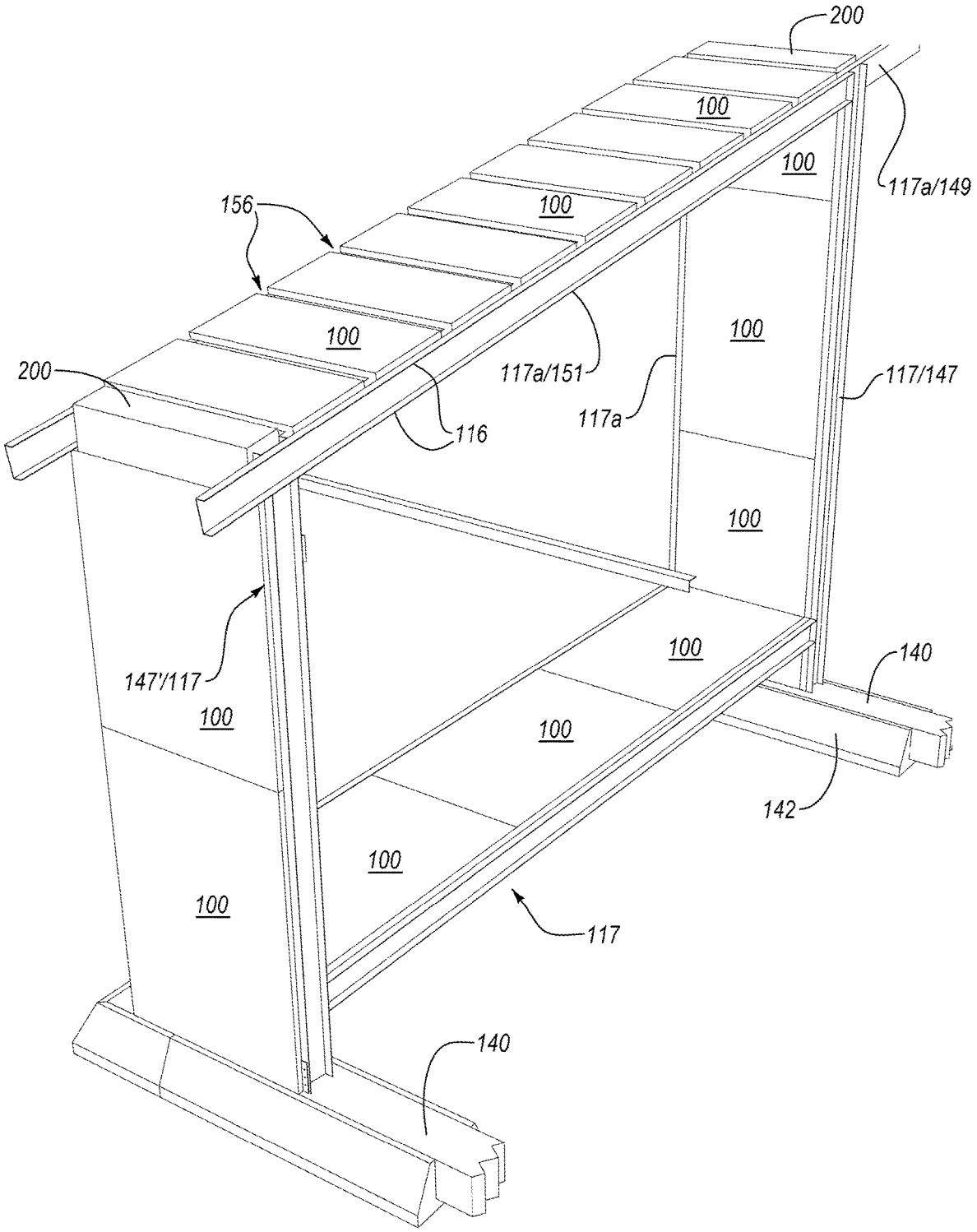

FIG. 37 shows attachment of the next C-shaped channel roof frame member 117*a* (designated 151), positioned back-to-back with that designated 149, to provide the exposed flange 116 for mating with the channel of the next column of roof panels. The other exposed flange 116 wraps around the bottom corner edge of the roof panel, similar to the configuration of the roof section just completed. Again, no tape measure is needed, as correct spacing and placement of each subsequently placed component (frame member or foam panel) is ensured because of use of the precision machined foam panels, between each pair of adjacent frame members 117*a*. The length of frame member 151 may be sufficiently long to provide an eave, as shown, on the near side of the building. The eave on the far side of the building can be provided by C-channel frame member 149, as shown. Providing the vertical wall frame members 117 (designated 147 and 147', respectively), with one short and one longer C-channel member as shown is advantageous, for providing support for the roof frame members 149, and 151. For example, at the far end (at 147), roof frame member 149 (a C-channel member 117*a*) is supported on the shorter of the back-to-back C-channel members 117*a*, forming I-beam wall frame assembly 117. On the opposite near end (at 147'), roof frame member 151 (also a C-channel member 117*a*) is supported on the shorter of the back-to-back C-channel members117*a*, also forming an I-beam wall frame assembly 117 (at near side 147). The vertical I-beam frame assemblies at 147 and 147' are shown as mirror images of one another, in whether it is the inner or outer C-channel member 117*a* of each back-to-back assembly that is shorter, or longer. For example, at 147, it is the outer C-channel member that is longer (while the inner is shorter), and at 147', it is the inner that is longer, and the outer that is shorter, as shown.

Figure 38:
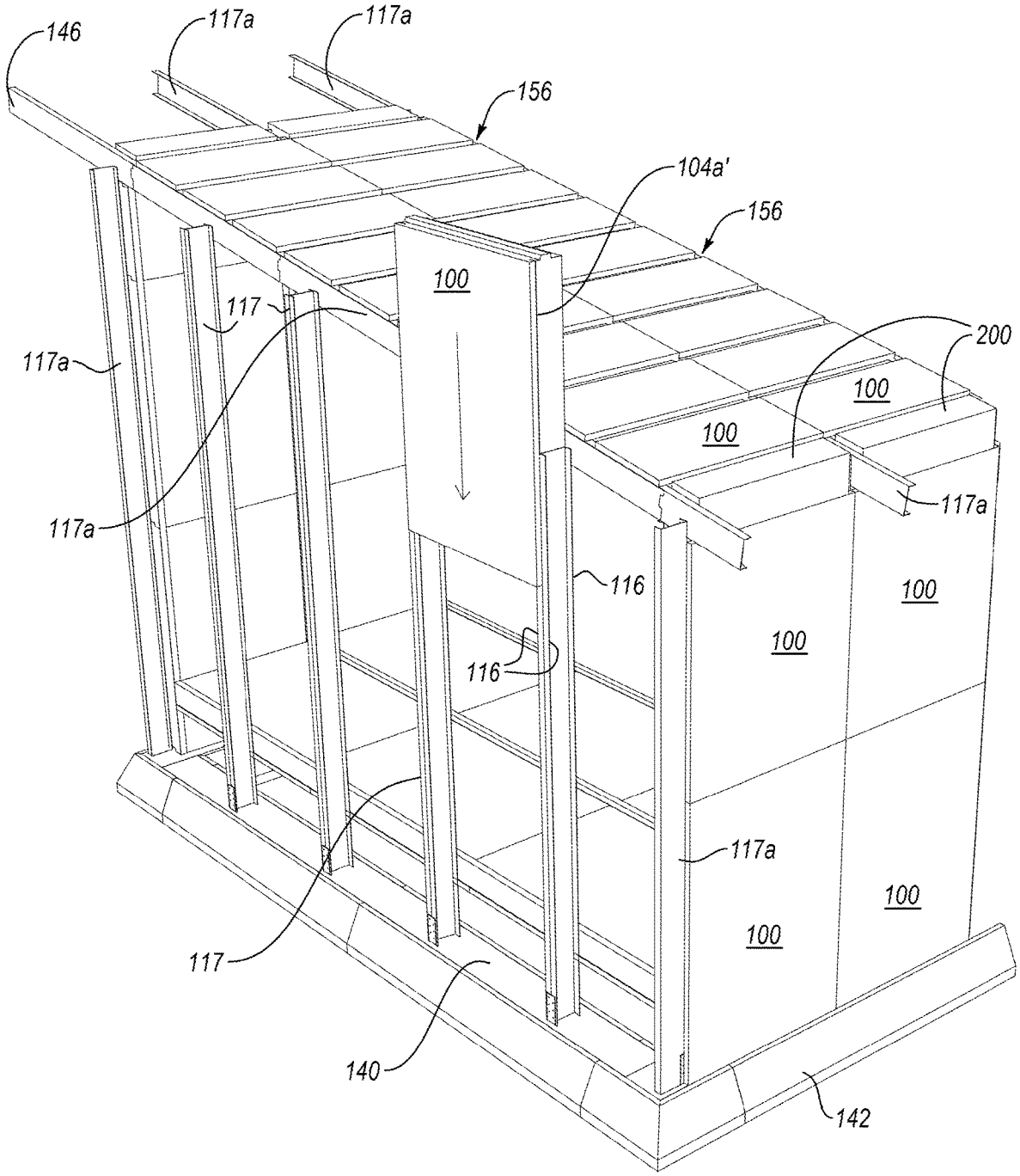

FIG. 38 shows the assembly that results once the steps associated with FIGS. 32-37 are repeated, as necessary, to add additional wall sections, roof sections, and floor sections to the building. By way of example, a typical frame member spacing (and panel width) may be 4 feet. For example, a standard panel may be 4×8 feet, although a panel can be cut as needed (e.g., see the shorter wall panel at the top of the wall section at the far side, at 147). This shorter panel wall height could alternatively be made up by providing the corresponding wall-to-roof transition panel with a longer wall leg, as will be apparent. In any case, because the panels are foam, where cutting may be desired, this is easily achieved. In another embodiment, the panel dimensions may be different, such as 4×2 feet. (4 foot width, for the same 4 foot spacing, with a 2 foot panel height), for perhaps easier handling and placement, and channel/flange engagement. Different panel dimensions could be used in the same construction (e.g., 4×2 panels and 4×8 panels, if desired).

Figure 39:
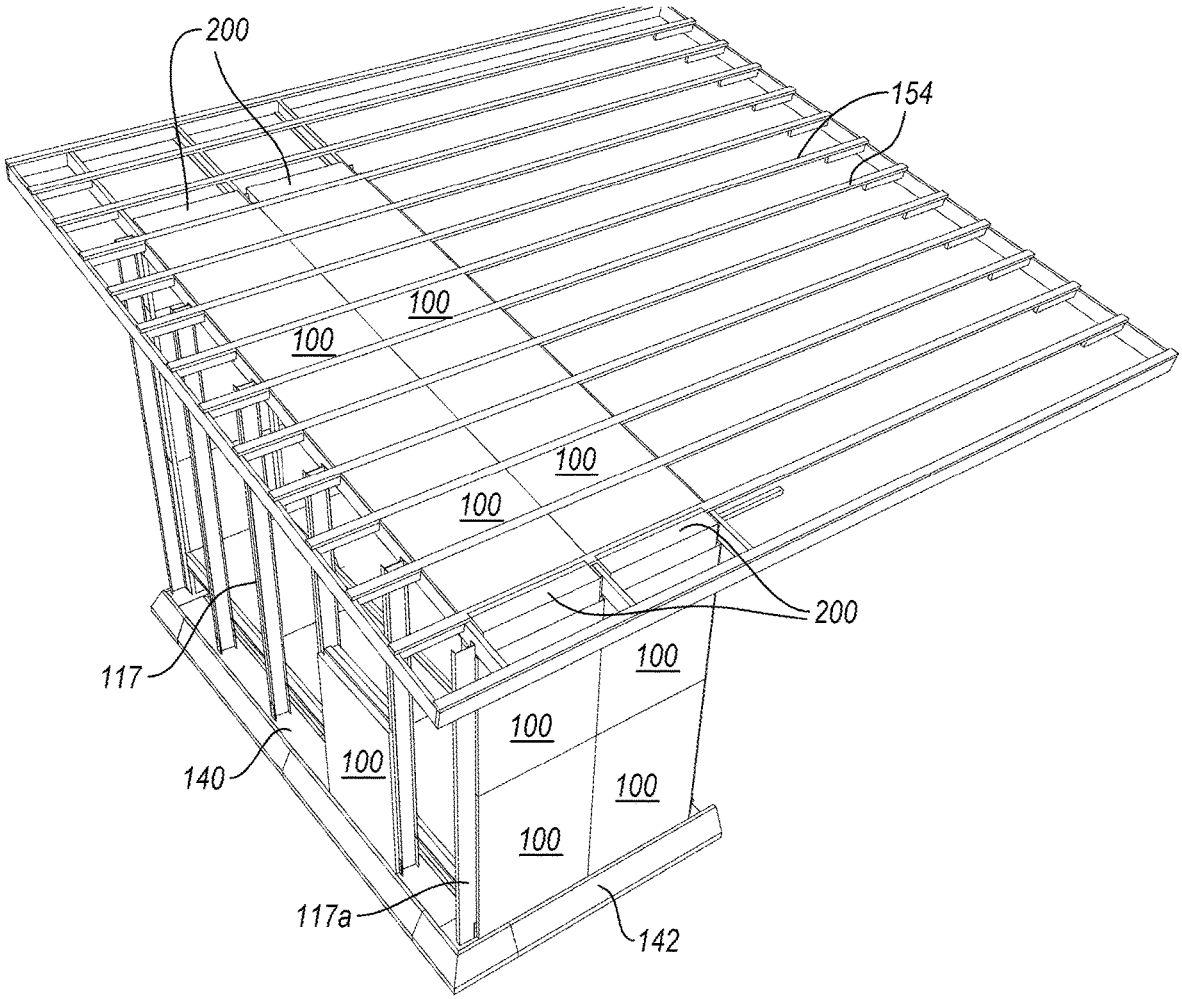
Figure 40A:
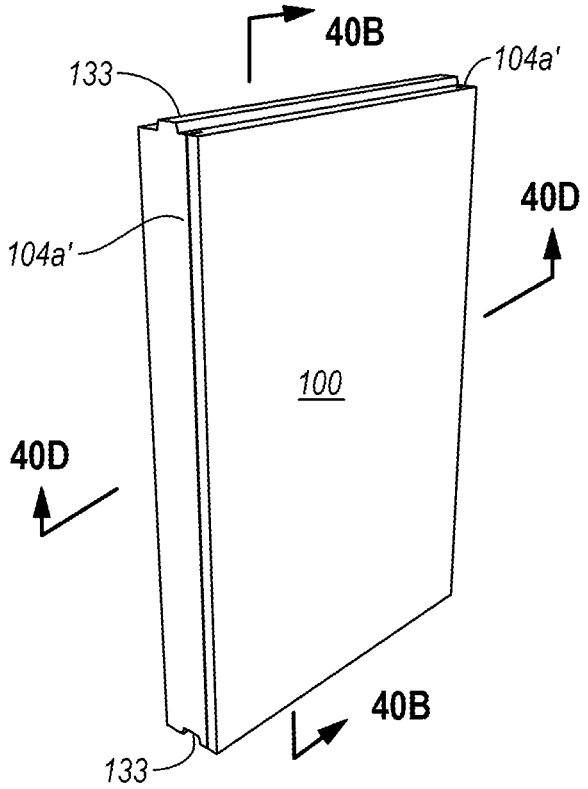
FIGS. 40A-40D show various views of an exemplary modular panel, as may be used for constructing wall sections and floor sections in the building construction of FIGS. 30-39.
Figure 40B:
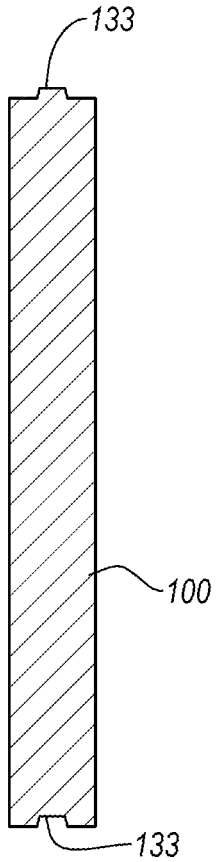
Figure 40C:
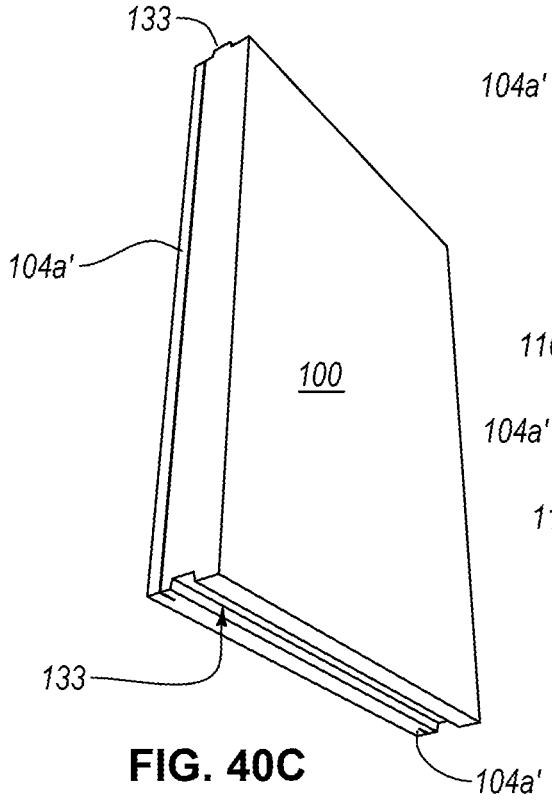
Figure 40D:
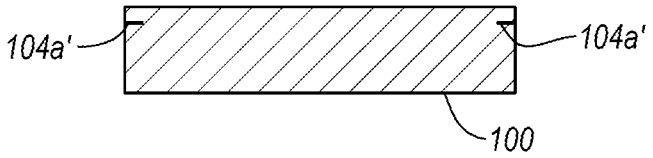
Figure 40E:
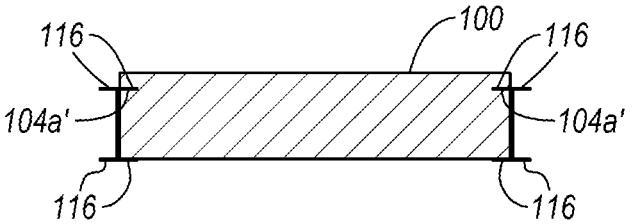
FIG. 40E shows the panel of FIG. 40A-40D, with a C-channel frame member engaged therewith, with one of the flanges of the C-channel received into the single slot of the modular panel in the right or left side of the panel, and the other of the flanges wrapping around the corner edge on the same right or left side of the panel.
Figure 41A:
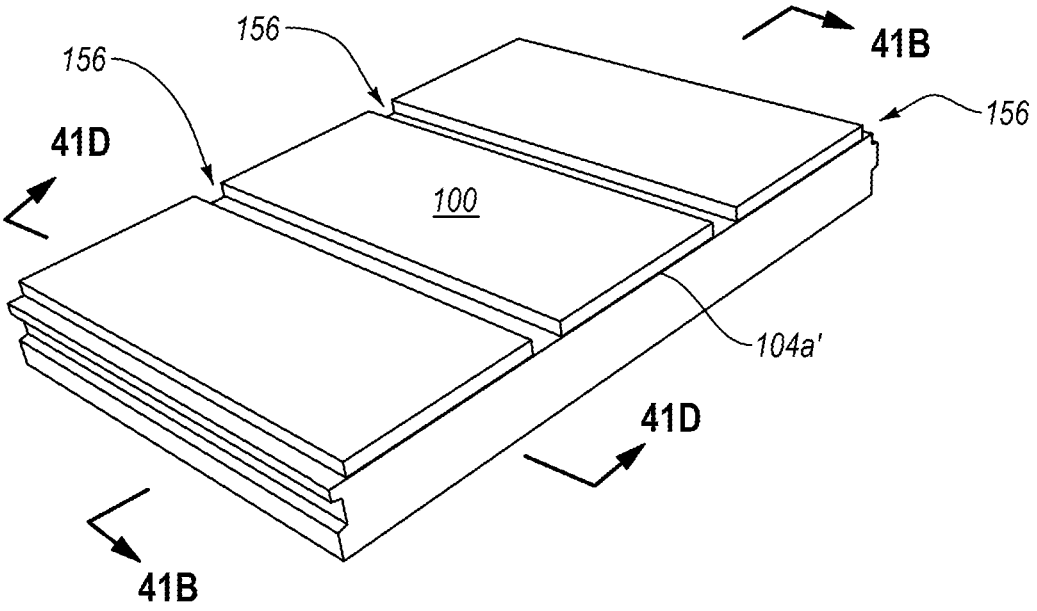
FIGS. 41A-41D show various views of an exemplary modular panel, as may be used for constructing roof sections in the building construction of FIGS. 30-39. The modular roof panel of FIGS. 41A-41D may be substantially identical to the modular panel of FIGS. 40A-40D, but for the purlin channel included in the modular roof panel.
Figure 41B:
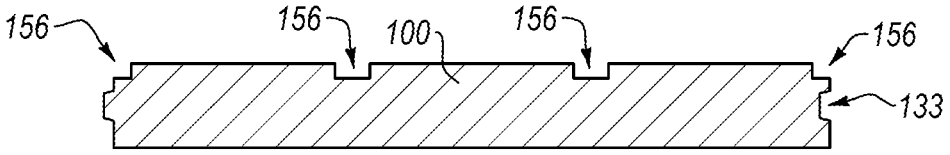
Figure 41C:
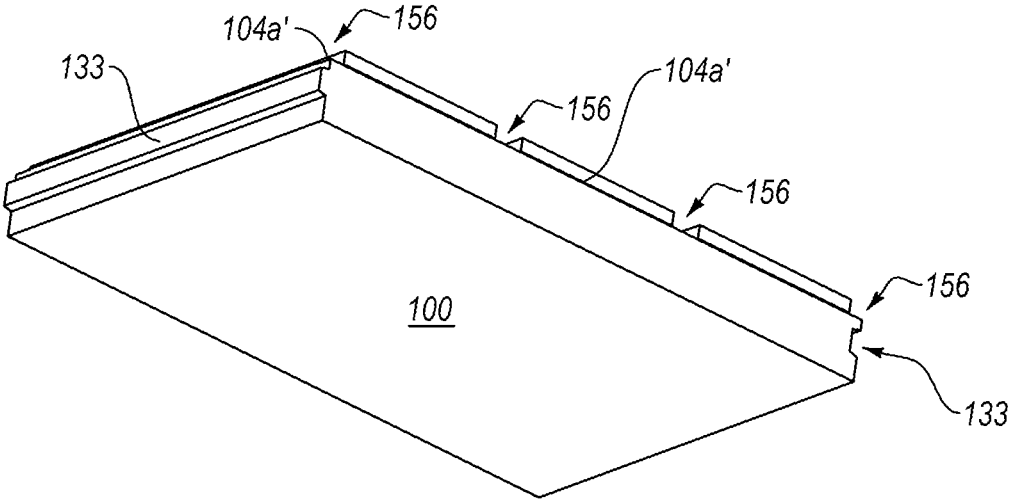
Figure 41D:
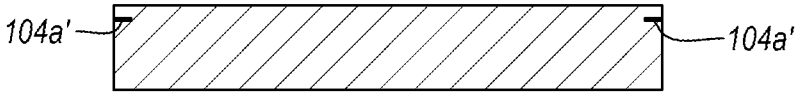

FIG. 39 shows placement of purlins 154 (e.g., wood or metal) to which roofing material (e.g., shingles, sheet metal, etc.) can later be attached to. The top of the purlins 154 may be flush with the top of the foam roof panels 100.

The present building systems provide various advantages. For example, no tape measure, or other measuring device typically needed to construct a building is required, because the precision shape and size of the modular panels ensures that no measurements need be taken. The components can simply be assembled, like a LEGO set. The use of wall-to-roof transition panels is also helpful, as the transition panels also render use of a tape measure unnecessary, when making the transition from wall to roof. Mistakes occur where measurements are needed, and the present system does not require any measurements for assembly, as as soon as the flange of a C-channel member disappears into the foam panel channel, the user knows the flange is fully inserted into the channel of the foam panel, and no tape is needed, as the dimensions will be exactly correct, due to the modular nature of the system, and the precision cut characteristics of the foam panels.

The present system does not require screws or other fasteners (e.g., nails) in the roof to go through the foam panels, but attachment can be directly into the purlins. This addresses an issue with previous systems where shear rating of the wall or roof can be reduced due to such screws or other fasteners passing through the foam.

Another benefit of the use of transition panels at transitions from the wall to roof is that without such a transition, the flanges 116 of the vertical frame members in the wall are in the way, of the roof pitch. While such flanges could be cut away, this would undesirably reduce transfer of shear load from the roof to the wall. In addition, the roof foam could be allowed to run wild, so to speak, but this would still require taking of a measurement, to know where to cut the roof foam at the intersection, and then the resulting gap would need to be filled with something (effectively forming a transition). The use of prefabricated transition panels is particularly advantageous as it eliminates any such issues.

FIGS. 43-56 illustrate another construction that may be formed, using the present inventive methods and systems. The foam panels which are placed after each frame member, and before each adjacent frame member are not shown in this set of Figures, to better illustrate the frame portion of the construction, although it will be understood that such foam panels are an important part of the construction, and their placement at the same time as assembly of the frame (by positioning a frame member, followed by placement of a foam panel, followed by placement of the next frame member) is a very important aspect of the present building system and method, as such ensures that no tape measure is needed, no cranes or other heavy equipment is needed to lift assemblies of components, as they are positioned generally one component at a time, or in very small assemblies (e.g., back-to-back C-channels to form an I-beam frame member), so as to be lightweight.

The present configuration provides positive engagement between the foam panel and the associated inserted flange of the C-channel frame member. The foam ends up filling the interior space of the C-channel frame member, between the flanges, where one flange wraps around the corner edge of the modular foam panel, and the other flange is received into the single channel running along the length of the right or left side of the modular panel. This positive engagement and filling of the space between the flanges of the C-channel provides the combination of the modular foam panel and the C-channel frame member with great strength, ensuring that the foam ear at the edge of the panel will not easily break off.

While some of the drawings illustrate progressive construction in a particular order, it will be appreciated that some variation is possible. One could build one or more wall sections, floor sections, roof sections, for connection together in any desired order, such that the progression illustrated in the Figures is merely exemplary. That said the component by component assembly is greatly advantageous, as no cranes are required, as may be needed if larger sections were assembled first. Brackets (e.g., ear brackets) may be used throughout the construction to connect floor C-channel members to wall C-channel members, and roof C-channel members to wall C-channel members, as needed. An important advantage of the present system is that the frame system can be built in pieces, component by component, so that no heavy equipment (e.g., cranes and the like) is needed. Everything can be accomplished with simple manual labor, without even a tape measure. All that is required is a level (to ensure that the concrete footing is level) and a plumb or similar tool to ensure that the first placed vertical frame member is plumb (i.e., vertical, at a right angle relative to the level footing).

Figure 44:
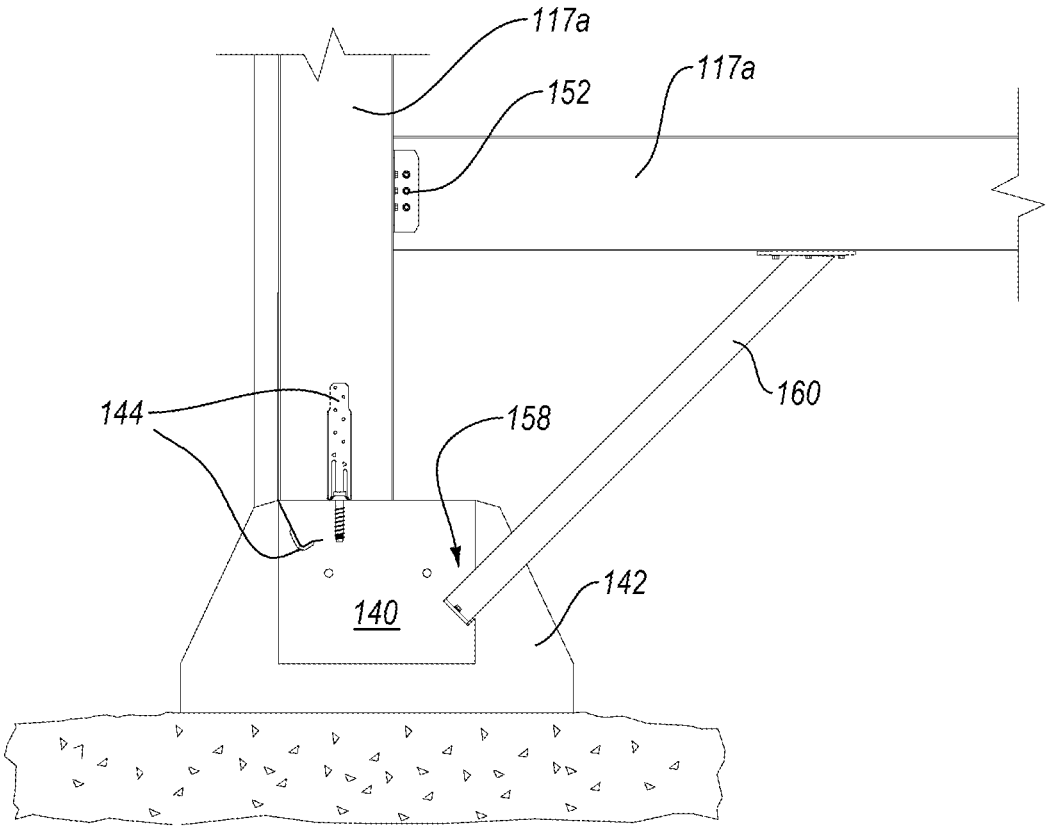
FIG. 44 shows the exemplary footing, similar to that of FIG. 30.
Figure 45:
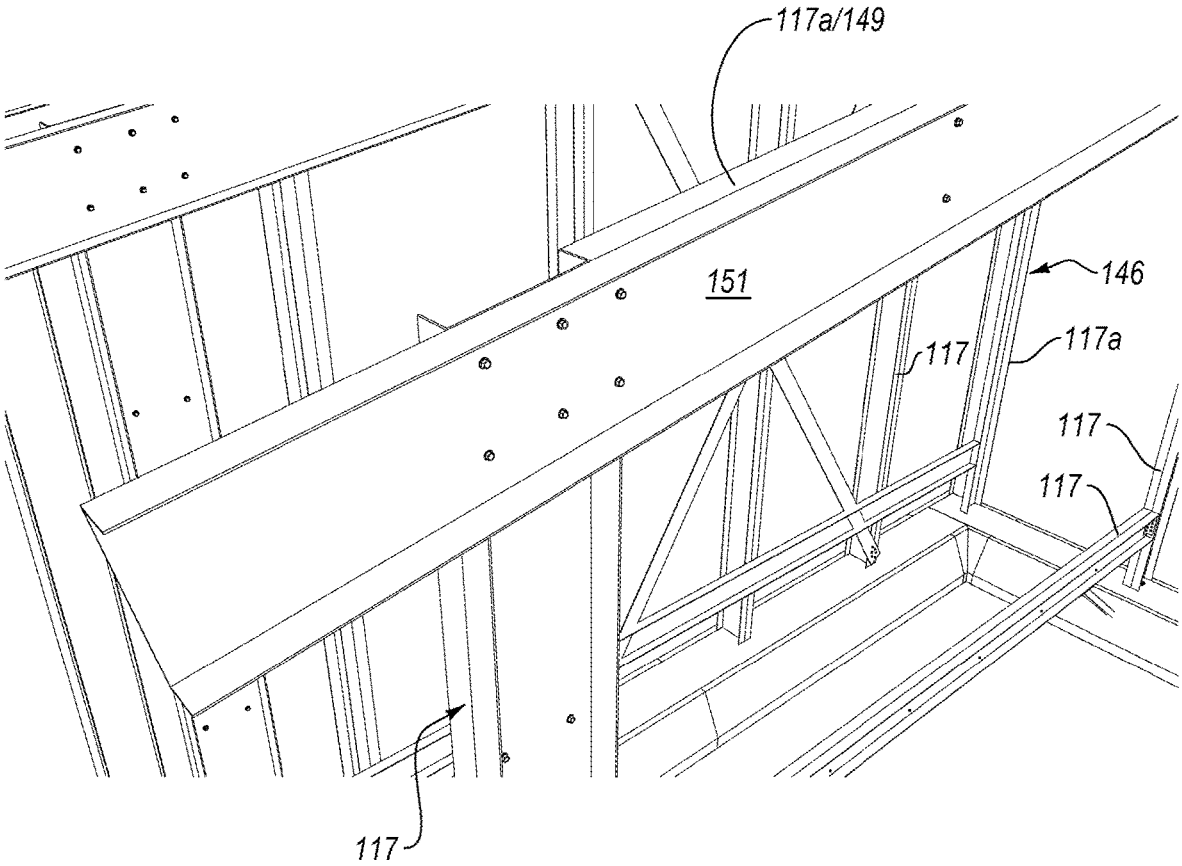
FIG. 45 shows a perspective of the frame of FIG. 43, from a perspective on the low end of the roof wall.
Figure 46:
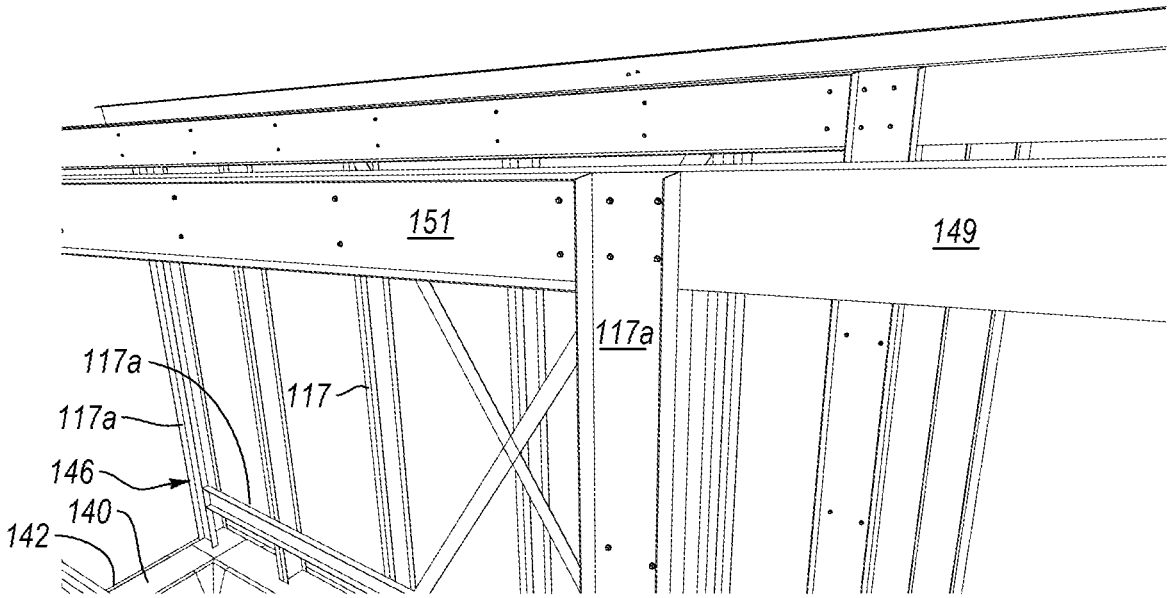
FIG. 46 shows a perspective of the frame of FIG. 43, from a perspective on the high end of the roof wall.
Figure 47:
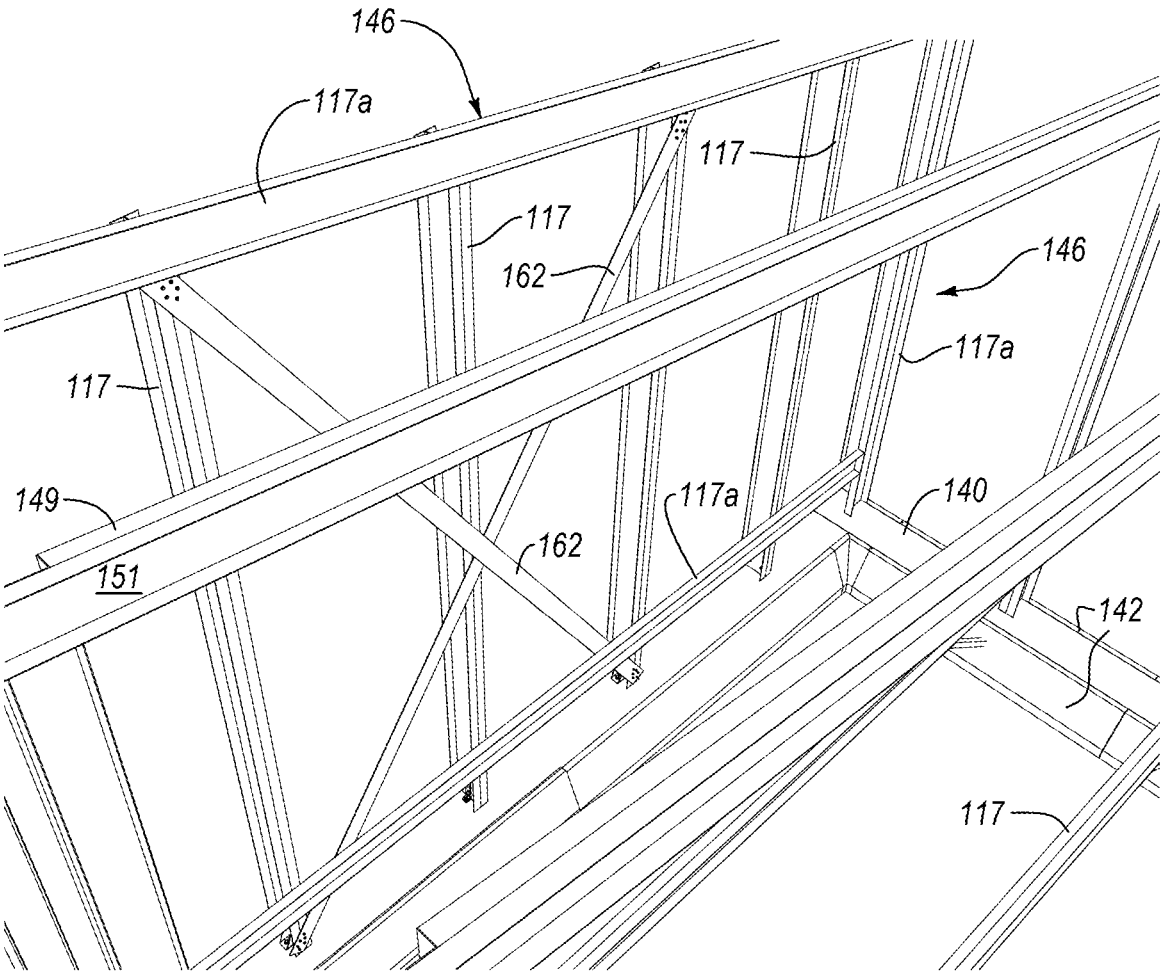
FIG. 47 shows how the endwall may be braced (as this may be the only place where the frame members are assembled first, before foam is inserted between frame members).
Figure 48:
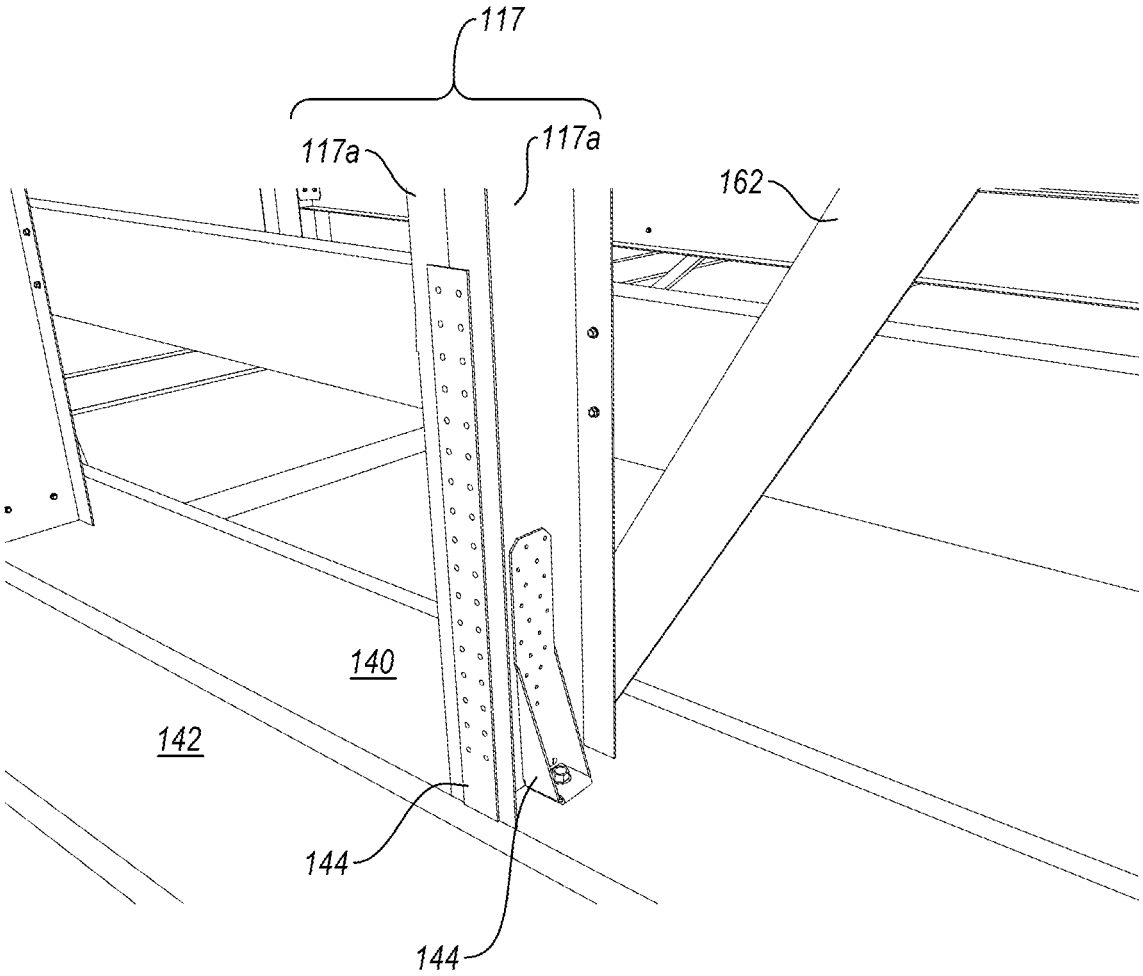
FIG. 48 shows an exemplary hold down brace or tie.

Stripped down to its basics, the present method of construction includes pouring a concrete footing (e.g., in a single piece frost foam mold, as shown in FIG. 30). It is important to ensure that the concrete footing is level. Because the concrete footing is provided in a frost foam mold, it is not actually necessary that the footing extend below ground, below the frost line (e.g., 30 inches in many temperate climates, that experience a winter season). Rather, because the footing is provided inside of the frost foam mold, which wraps around the sides and bottom of the concrete footing, no frost can penetrate under the footing, to cause undesired lifting. Thus a relatively shallow (e.g., 16 inches or less, 14 inches or less, 12 inches or less, or 10 inches or less) continuous footing in such a frost foam mold is sufficient. An internal notch 158 may be provided in the footing 140 by the frost foam form 142, providing an attachment location for a brace 160, as shown in FIG. 44, and the other figures of FIGS. 43-56. The foam of form 142 may simply be cut out at this particular location (near 158), to provide attachment of such a brace, on the inside of the building being constructed, as shown.

With a level footing provided, the next step (FIG. 31) is to position the endwall frame vertically, attached to the leveled concrete footing. With the vertical frame member 117*a* of the endwall that becomes the end of the wall plumb (i.e., vertical), the rest of the building can be constructed easily, without skilled labor, without a tape measure, without a need for a crane or other equipment, etc. This is so because once the vertical frame member 117*a* of the endwall 146 is in place, and is verified to be plumb (e.g., using a plumb line, level, square or similar tool for verification), the precision characteristics of the foam panel that is installed next, ensures that the following components (flanged frame members alternated with foam panels) installed to extend the length of the wall, are all exactly where they need to be, without the need for a tape measure, etc. So long as each panel and frame member flange are firmly and fully engaged with one another, the resulting wall (or other structure such as the floor or roof) will be perfectly plumb, square, level, etc.

Such is possible because the method does not involve formation of the entire frame, followed by filling in the space between frame members (which would require skilled labor, measurements, etc., to ensure that the various frame members are in the right position, and correctly aligned (e.g., square, plumb, etc.). Rather, the present method does not assemble the entire frame, but once the endwall is up, the frame and foam panels are installed alternatingly, where an adjacent frame member is not installed until the foam panel intervening between the first frame member and the adjacent frame member has been installed, as illustrated in the Figures. Installation of the foam panel before attachment of the adjacent frame member ensures that the proper spacing is automatically provided between frame members, as the precision characteristics of the foam panel itself in a sense serve as the tape measure (without requiring anyone to actually read a measurement). All that is needed is to fully seat the foam panel, and then install the adjacent next frame member in the opposite flange on the right or left side of the foam panel.

Such a system and method causes the foam panel to create a connection to the already placed frame member, and creates a restraining connection between adjacent frame members, with the foam panel positioned therebetween. This reduces the degrees of freedom when each "next" component (foam panel or frame member) is to be installed, making it far easier to install each component, from one to the next, because of the restraining characteristics provided by the interaction of each "next" piece, due to its engagement with the adjacent piece, as a set of LEGOs.

If one were to attempt to form a similar frame, but without placement of the foam panels intermediately, between placement of each adjacent frame member, this creates several problems. First a tape measure is needed, to know where the "next" frame member should be placed (if no foam panels were installed after the first frame member, dictating where the next frame member goes because of the precision machined characteristics of each foam panel). Second, if no foam panels were installed intermediate, but one attempted to put up all (or even just two adjacent) frame members, bracing would be required, to ensure that the frame members are in their proper place, and that they stay there. The placement of a foam panel after placement of a frame member (and before placement of the next frame member) ensures that no tape is required (as the panel ensures that the next frame member will be placed in exactly the right place), and no bracing of the two adjacent frame members is required, as the foam panel also serves this purpose, of retaining or bracing the adjacent frame members in their proper positions. Third, if no foam panels were installed intermediate the installation of adjacent frame members, this would require laying out the frame members of a given wall (e.g., building such structure on the ground), where it can be difficult to ensure that the wall is square and plumb, particularly without any tape measure, on unlevel ground. In addition, such larger assemblies assembled on the ground become quite heavy, often requiring the use of a crane or other heavy equipment, to lift them into place once assembled. The piecemeal alternative method of the present invention is far simpler to execute.

One other important characteristic of the present building system is that the space in the frame member (e.g., C-channel) between flanges 116 be substantially fully filled by the thickness of the foam panel, as shown in the Figures. This configuration ensures that this "ear" of the foam panel does not easily break off. Rather, the foam engages on the inside of the C-channel, on both sides (between the flanges). This causes forces applied against the composite structure of the foam panel and the C-channel frame member to put the foam in compression, rather than tension, so that such an ear of the foam panel that engages in the space between the flanges is not easily broken off, as it is in compression, rather than tension.

The use of the wall-to-roof transition panels is greatly advantageous, as it ensures that the transition from wall to roof is made at the right location, without the need for any tape measure, etc. While an alternative building system could "let the roof foam run wild" so to speak, and simply cut the roof where needed to intersect or transition to the wall, this creates a significant headache for the user, as such transitions then require use of a tape measure, and there is significant possibility that a mistake will occur (as requiring measurement with a tape measure or other measuring device introduces the potential for mistakes to occur).

While the endwall frame assemblies 146 may be assembled on the ground and then raised into position, for attachment to the footing 140 (with ties 144), advantageously, these endwall frames are formed of single C-channel frame members, not requiring use of another C-channel member positioned back-to-back to the first. As a result, these endwall frame members are relatively lightweight (e.g., less than about 200 lbs). If it is desired to have the endwall frame assembly be even lighter, the top roof truss member could be left off, for attachment after the endwall frame assembly (including the vertical wall frame members, and the horizontal floor frame member) is already raised.

Figure 49:
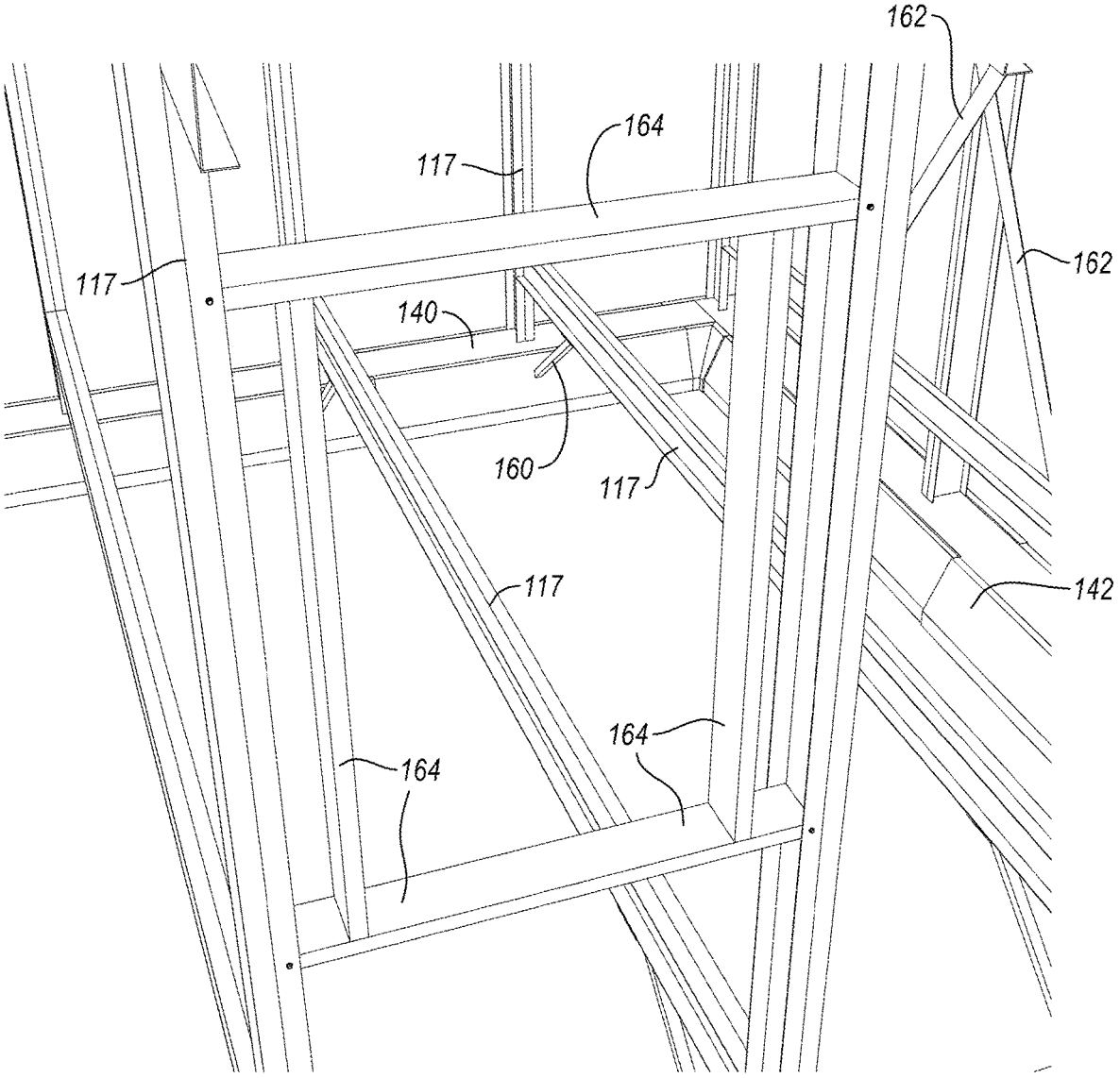
FIG. 49 shows detail in the frame of FIG. 43, where a window or door may be accommodated.

FIG. 49 shows how a window or door may be accommodated, e.g., by inserting frame members 164 between frame members 117, to frame in a desired window, door, or other structural feature.

Figure 50:
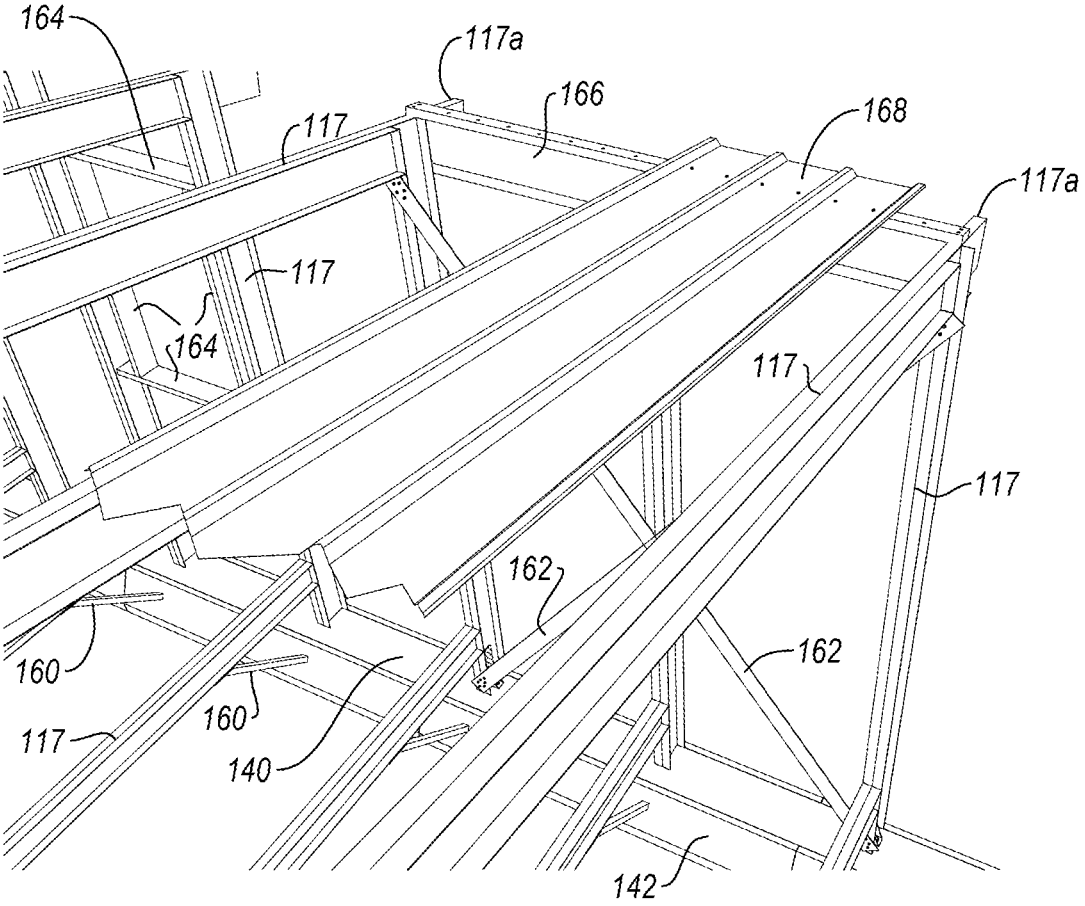
FIG. 50 shows optional bracing.
Figure 51:
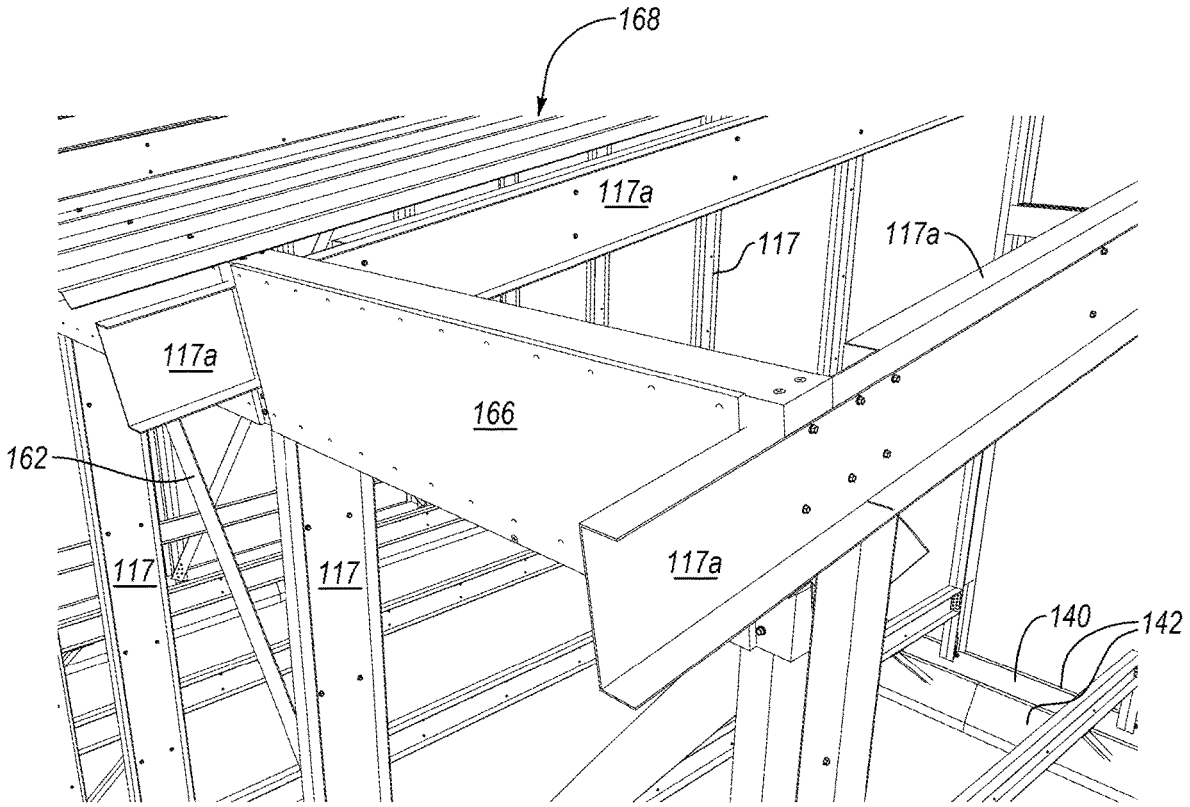
FIG. 51 shows "brace blocking" at the top of the view showing bracing, of FIG. 50.
Figure 52:
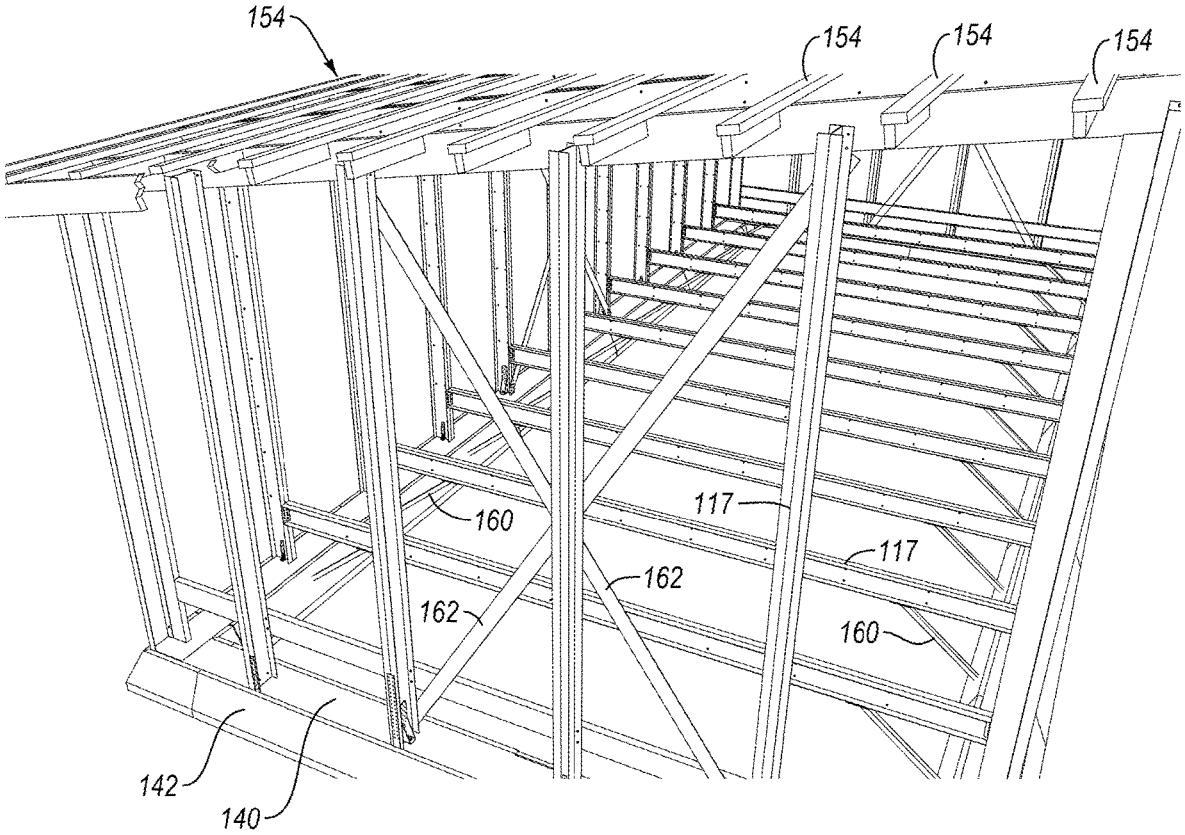
FIG. 52 shows one of the endwalls of the frame of FIG. 43.

FIG. 50-51 further shows the bracing 162, also showing how brace blocking members 166 could be positioned between roof truss frame members (members 117*a*, of the roof), if desired. A sheet metal or other desired roofing material 168 can also be attached, as shown.

Figure 53:
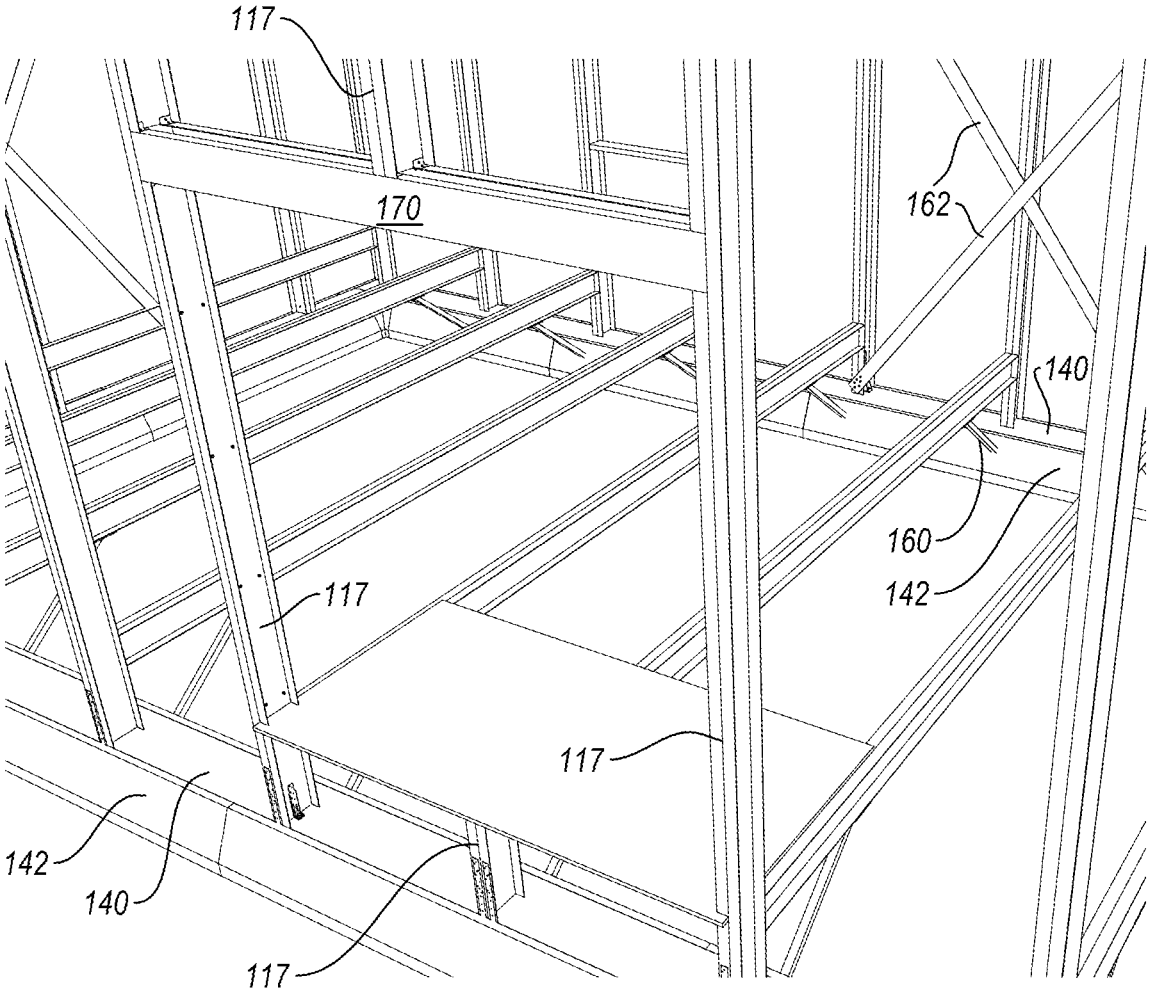
FIG. 53 shows use of an optional header.
Figure 54:
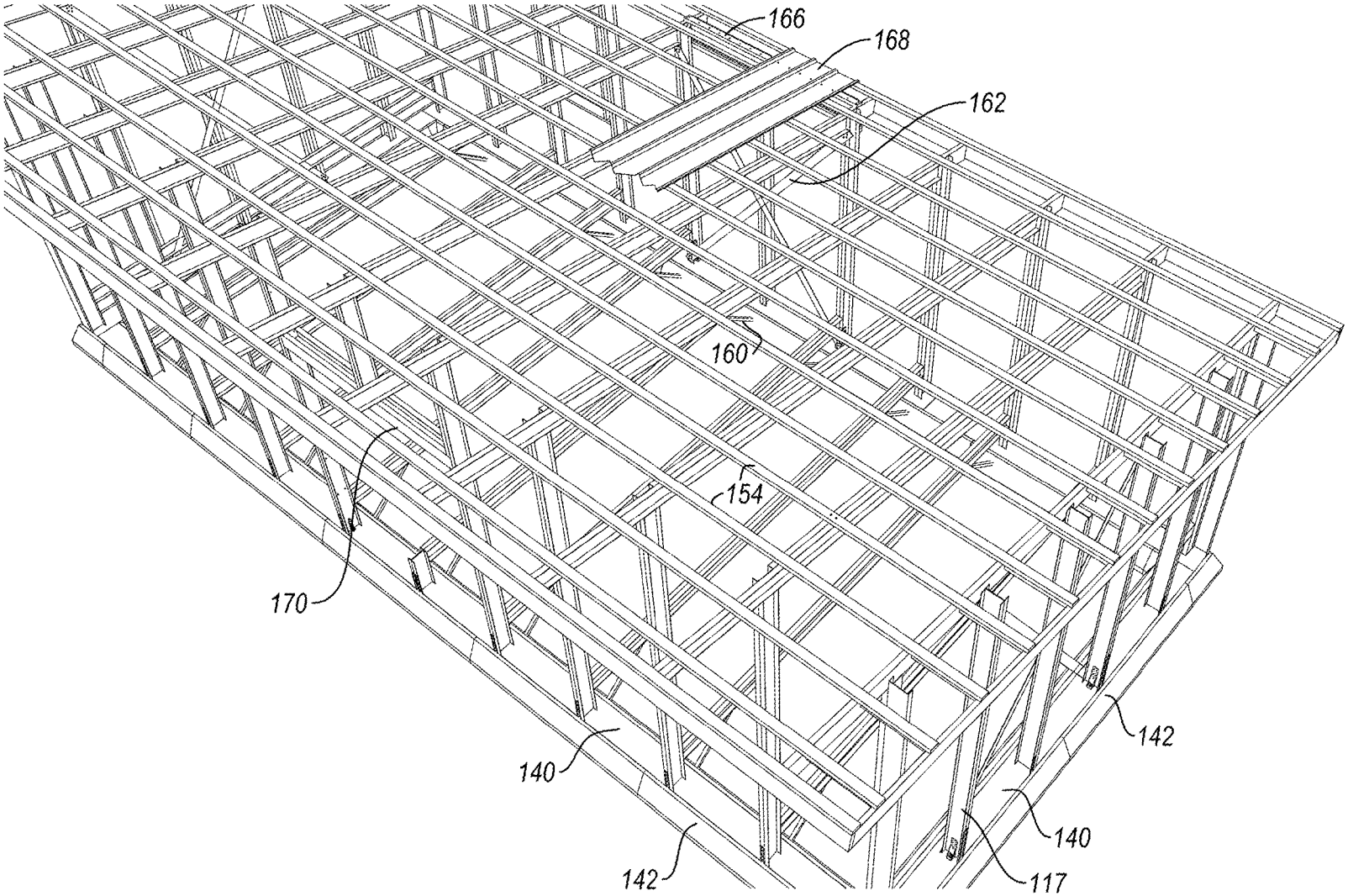
FIG. 54 shows use of the purlins in the roof section, to accommodate easier attachment of a roofing material (e.g., sheet metal roof).
Figure 55:
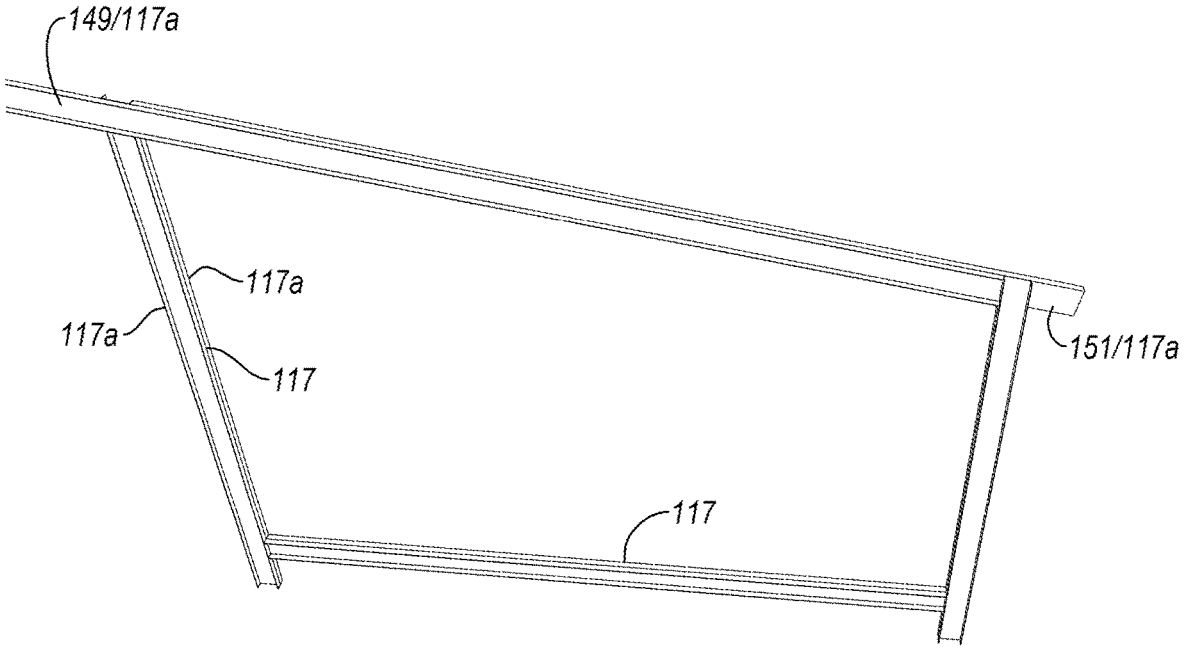
FIG. 55 shows a standard. I-beam frame, formed from back-to-back C-channel members.
Figure 56:
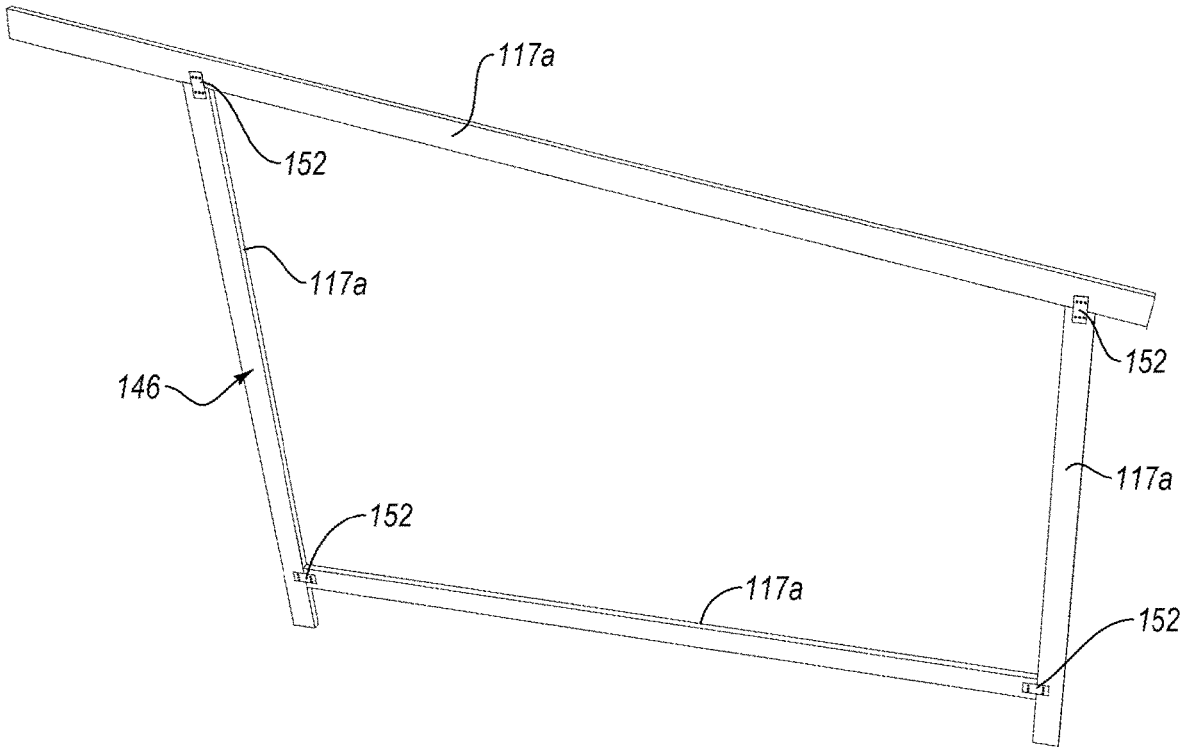
FIG. 56 shows an endwall frame, formed from single (not back-to-back) C-channel members.
Figure 57A:
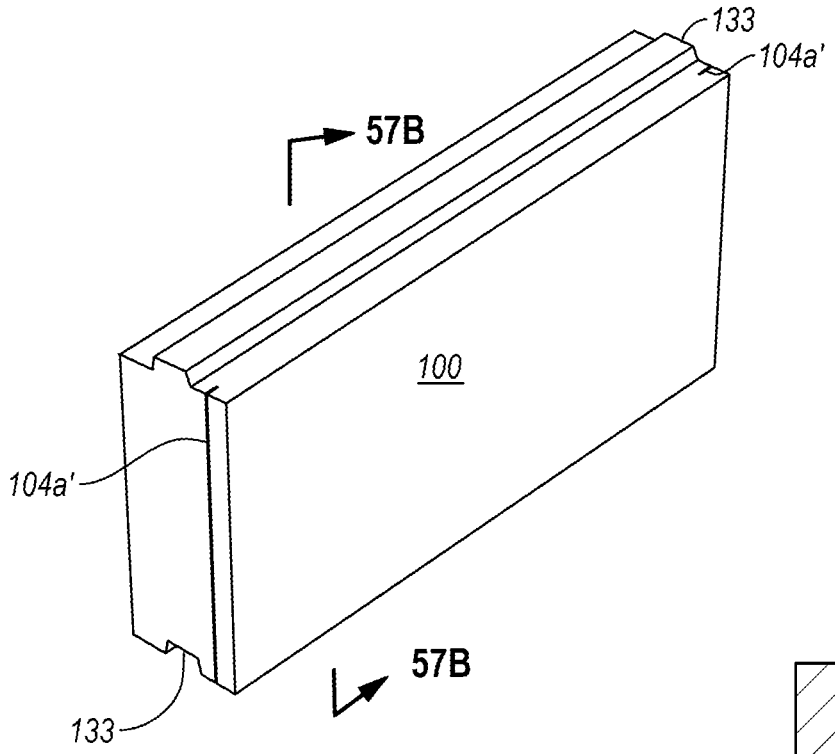
FIGS. 57A-57C show a top perspective view, a cross-sectional view, and a bottom perspective view of an exemplary panel similar to that shown in FIGS. 40A-40D, but of different dimensions (e.g., 4×2 feet, rather than 4×8 feet).
Figure 57B:
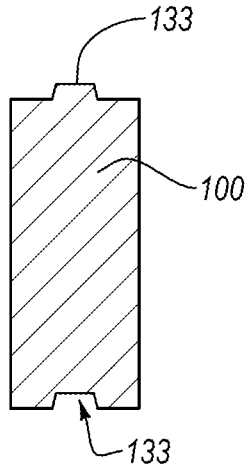
Figure 57C:
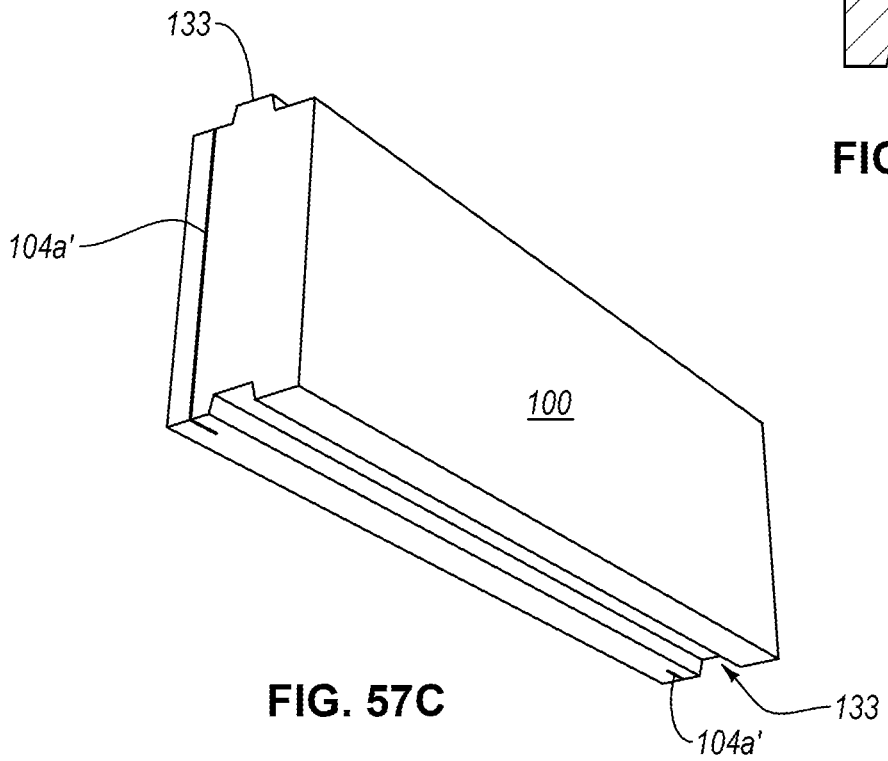

FIG. 53 shows a header 170 may be installed, where a portion of the vertical frame member 117 is removed (e.g., for a large window, door, or other opening).

Figure 58:
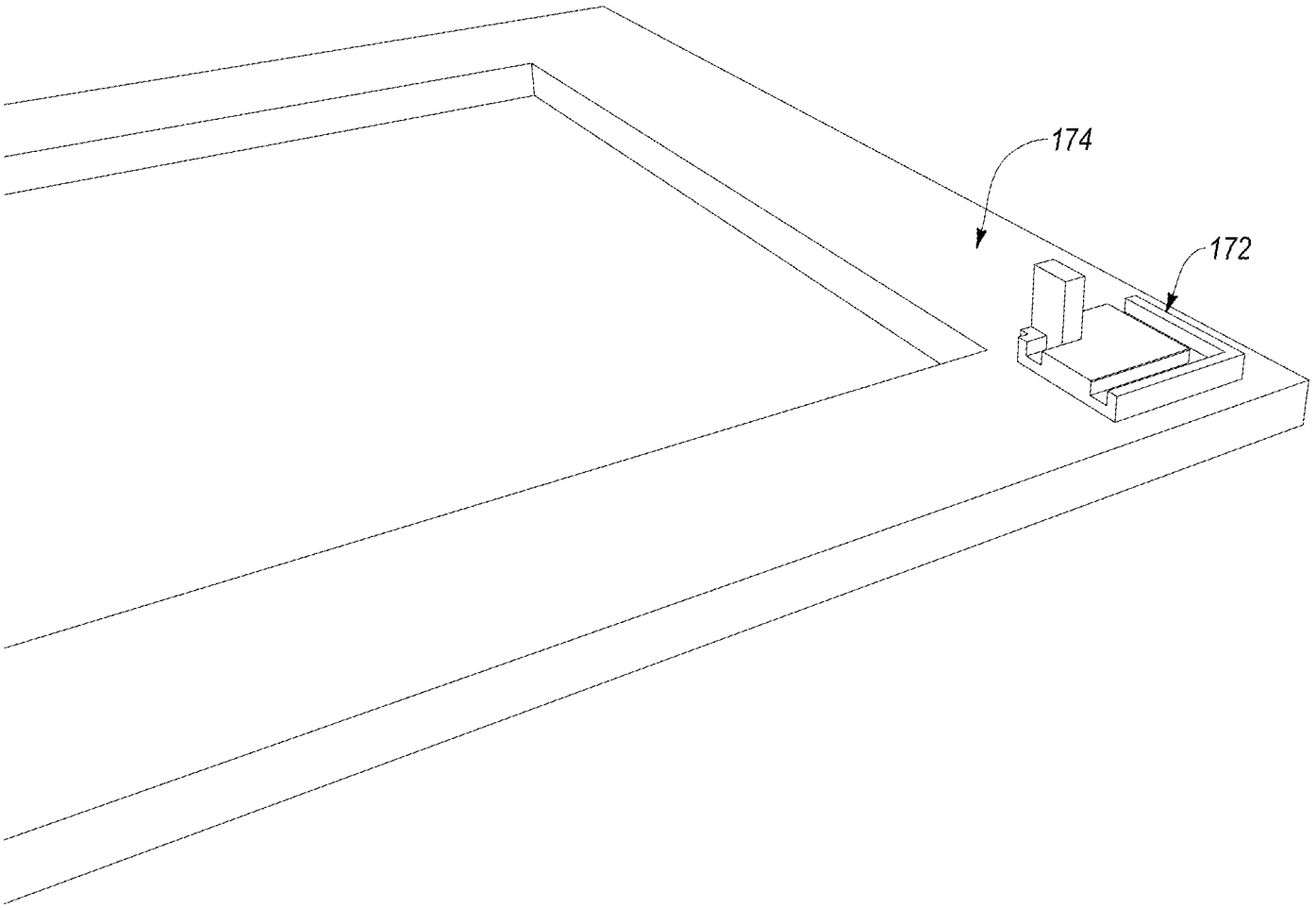
FIGS. 58-118 show progressive construction of another embodiment according to the present invention.

FIGS. 58-118 show progressive construction of another embodiment according to the present invention, that employs standard modular panels for the walls, floor, and roof, as well as wall-to-floor transition panels, and wall-to-roof transition panels, with C-channel frame members used as splines for placement between adjacent panels, as will be shown. As shown, each standard panel 100 (as well as the various transition panels) may include a body, and one or more channels extending through a length or width of the panel, each channel being configured to receive an elongate spline therein, wherein each elongate spline once received in the channel is disposed within the body, so that the elongate spline is restrained once received within the channel. The splines are received within a channel of the body of the modular panel, and the splines can be flanges of a C-channel frame member or back-to-back C-channel frame members that form an I-beam that runs vertically along a length of the modular panel.

Furthermore, as shown, each wall-to-floor transition panel 208*a* can be configured for transitioning from a wall to a floor in a building construction, the wall-to-floor transition panel being configured to be positioned between one or a stack of the modular panels 100 forming a wall, and one or more of the modular panels that form a floor structure. The transition panel 208 includes (i) a floor leg or a floor connection portion where a floor panel is attachable and (ii) a wall leg where a wall panel is attachable, where the floor leg or floor connection portion is at an angle (e.g., 90° as shown) relative to the wall leg. A wall-to-roof transition panel 200 can also be provided for use in transitioning from a wall to a roof in a building construction, the wall-to-roof transition panel being configured to be positioned between one or a stack of the modular panels forming a wall, and one or more of the modular panels that form a roof structure. The wall-to-roof transition panel includes (i) a roof leg or a roof connection portion and (ii) a wall leg or a wall connection portion, which are at an angle relative to one another, a vertical length of the wall leg or wall connection portion accommodating an increased height to the wall by including a vertical length that adds to a height of the wall, the angle between the roof leg or roof connection portion and the wall leg or wall connection portion dictating a roof pitch or angle associated with the roof.

Figure 59:
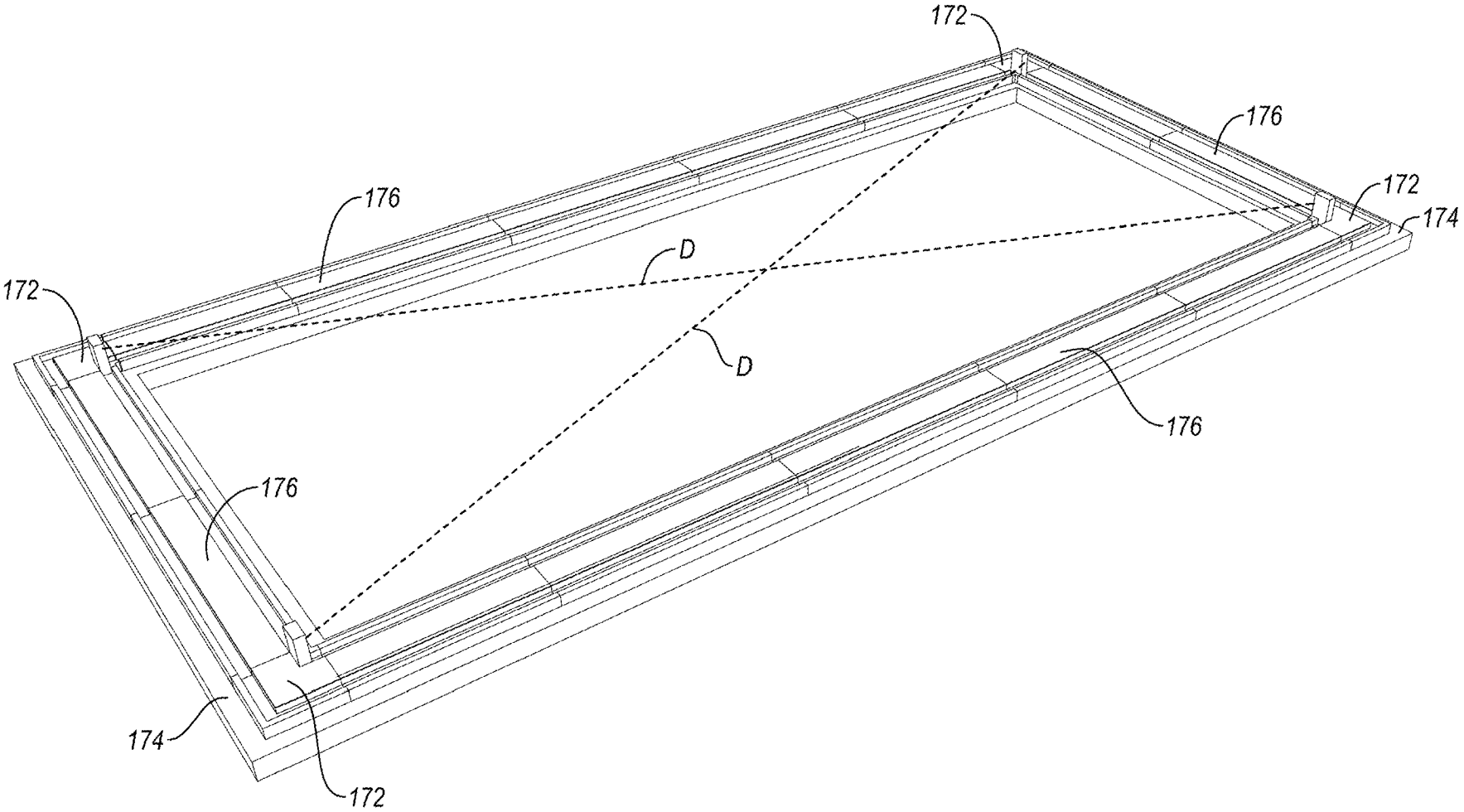
FIG. 59 shows positioning of the remainder of the base of the foam form over the pea gravel base, and measurement of the diagonals across the foam form, from corner to diagonal corner, to ensure that the foam form is square.

For example, FIG. 58 shows positioning of a base corner member 172 of a frost foam form over a compacted pea gravel base 174. Providing the corner members 172 as full corners, as shown, eliminates the need for users to make any miter cuts of the foam to accommodate such corners, which can require some degree of skill. This is helpful as the entire building system is designed to minimize the degree of skill needed for a group of users to build a given structure using the system. FIG. 59 shows positioning of the remainder of the base members 176 of the foam form over the pea gravel base 174. At this point, or later (e.g., once the foam form is placed, but before the concrete footing is poured), the user may take measurements of the diagonals D across the foam form, from corner to diagonal corner, to ensure that the foam form is square. So long as the two diagonals D measure the same, then the foam form is confirmed to be square. Adjustments can be made to correct any skew in the foam form at this stage, before concrete is poured.

Figure 60:
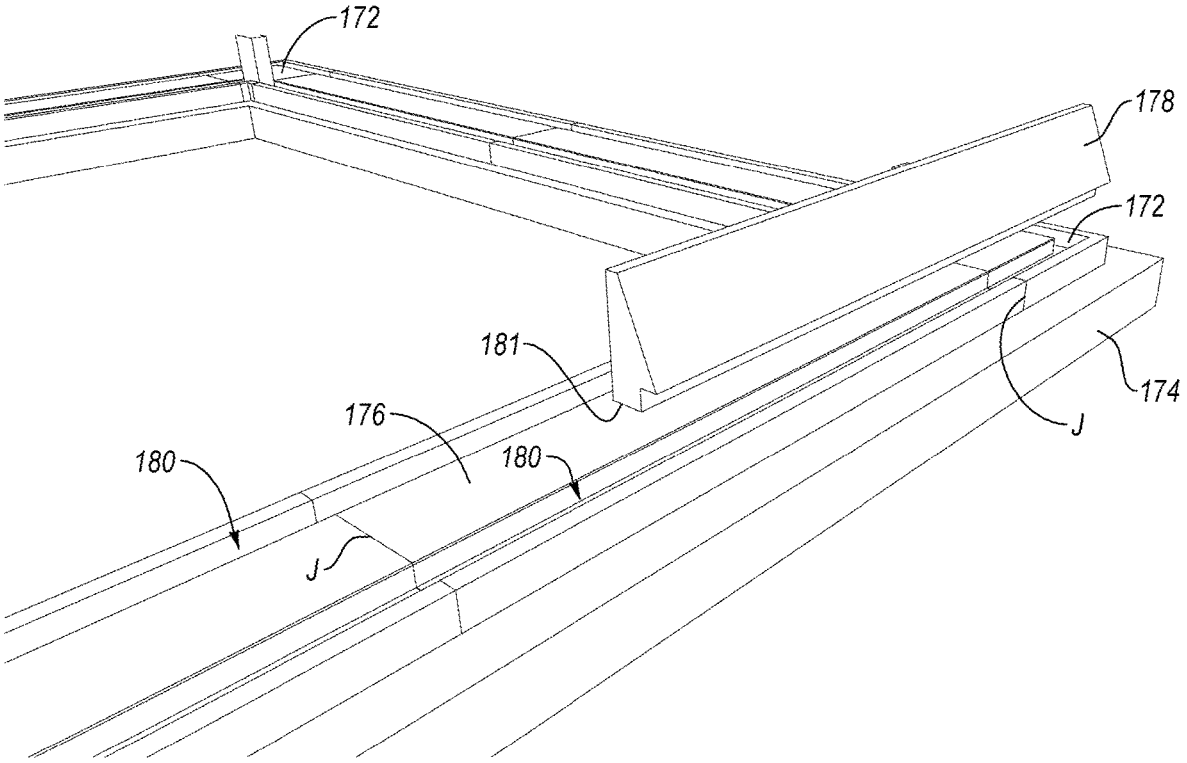
FIG. 60 shows positioning of the substantially vertical foam form wall member in the base of the foam form, showing overlapping of joints in the base members of the foam form, by the wall member of the foam form. The sidewall members can be glued into the corresponding recess of the base members of the foam form.

FIG. 60 shows positioning of the substantially vertical foam form wall member 178 in the base member 176 of the foam form, showing overlapping of joints J in the base members 176 of the foam form, by the wall member 178 of the foam form. The projection 181 of sidewall members 178 can be glued into the corresponding recess 180 of the base members 176 of the foam form, to hold the foam form together.

Figure 61:
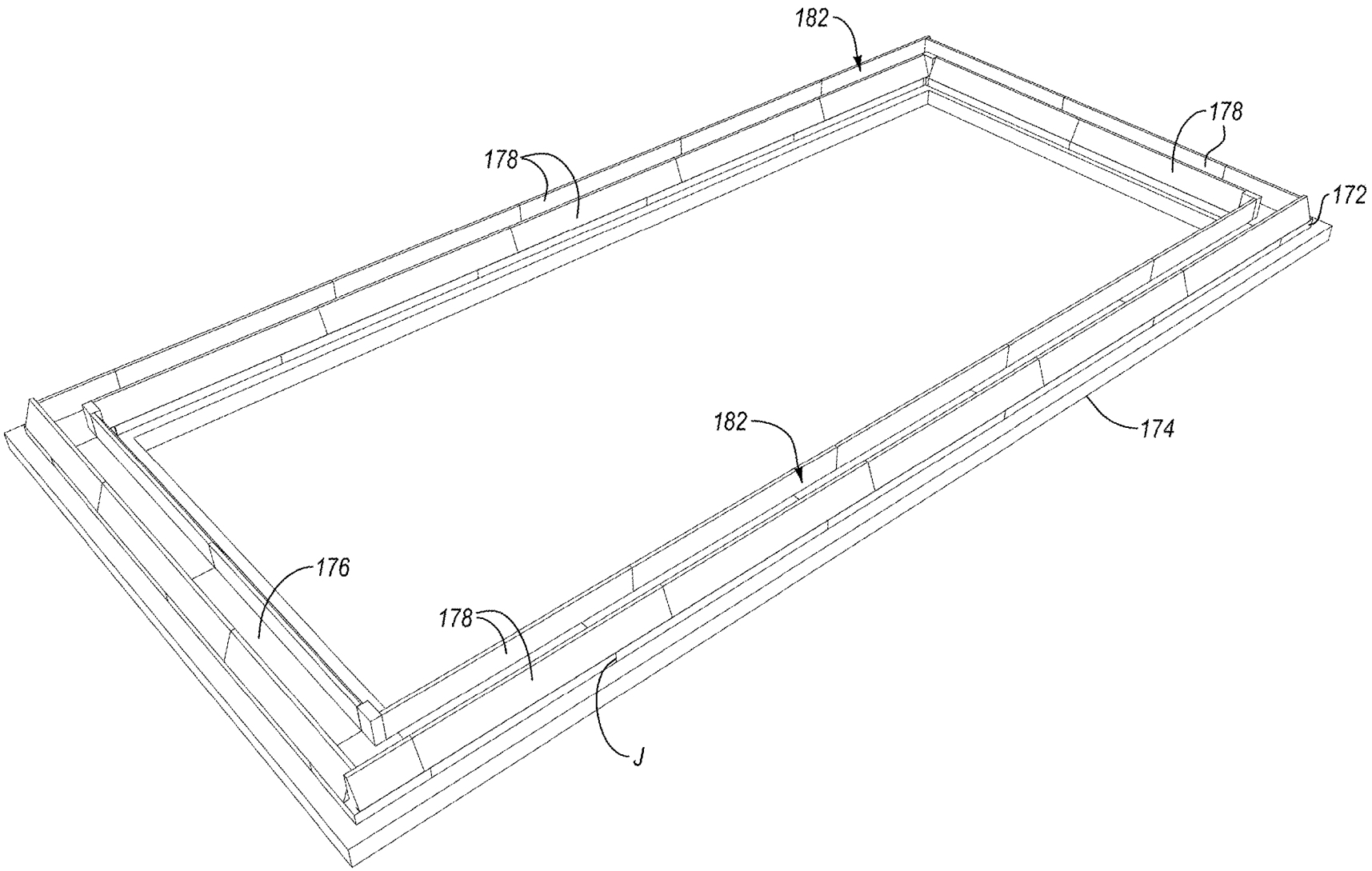
FIG. 61 shows positioning of the remaining substantially vertical foam form wall members in the base of the foam form, both on the outside perimeter and inside perimeter of the foam form, in the respective channels of the base of the foam form, to form a channel in which concrete can be poured.
Figure 62:
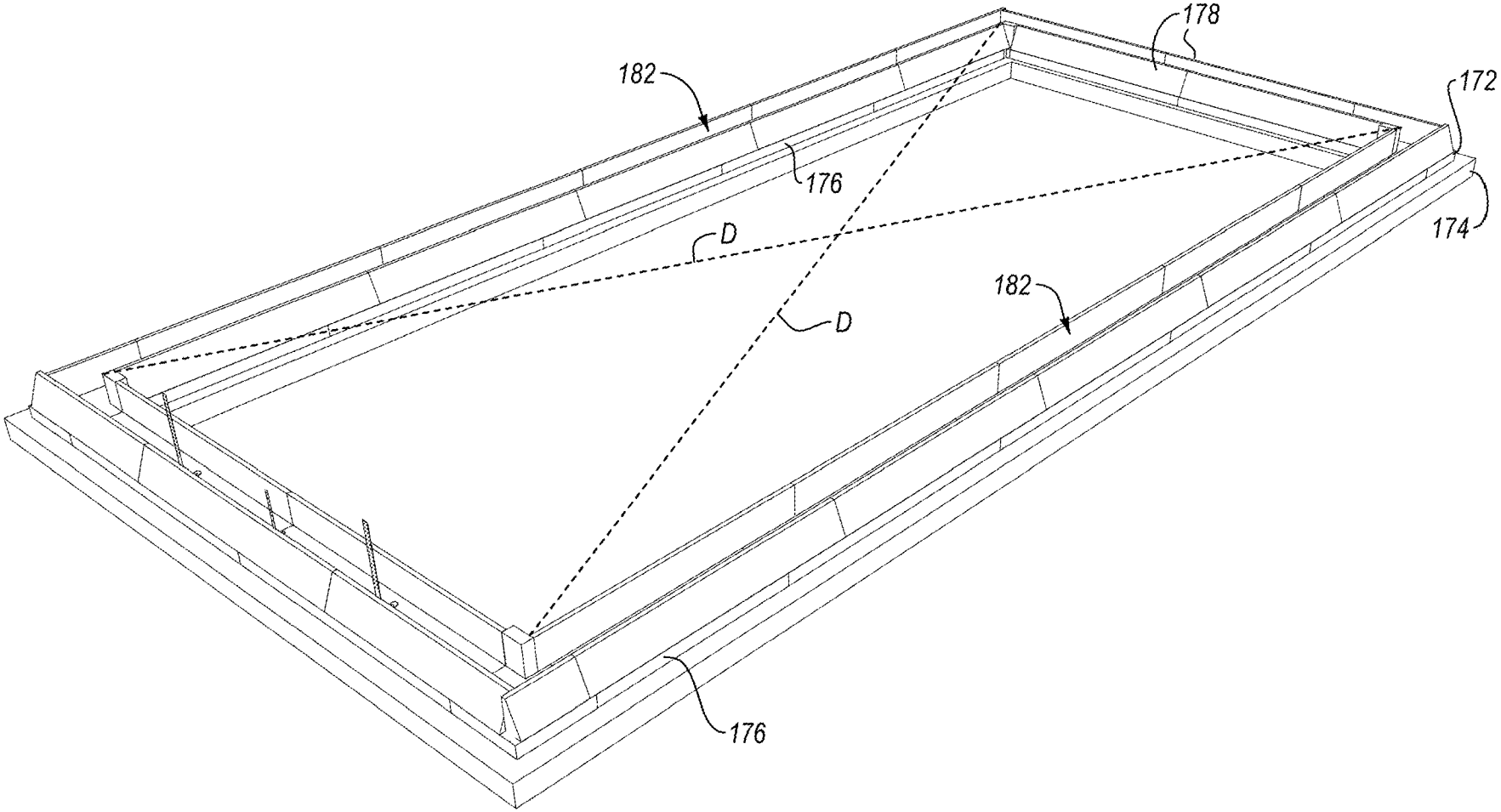
FIG. 62 shows the completed foam form. Before pouring concrete, the diagonal corners can be measured again, to ensure the foam form is square. Spikes (e.g., metal spikes) can be driven through the corners of the foam form once the form is square, to ensure it does not move.

FIG. 61 shows positioning of the remaining substantially vertical foam form wall members 178 in the base members 176 of the foam form, both on the outside perimeter and inside perimeter of the foam form, in the respective recesses 180 of the base members 176 of the foam form, to form a channel 182 in which concrete can be poured. FIG. 62 shows the completed foam form. Before pouring concrete into channel 182, the diagonals D from one corner to the opposite diagonal corner can be measured (or measured again), to ensure that the foam form is square. Spikes (e.g., metal spikes) can be driven through the corner base members 172 of the foam form once the form is square, to ensure it does not move during pouring of the concrete footing.

Figure 63:
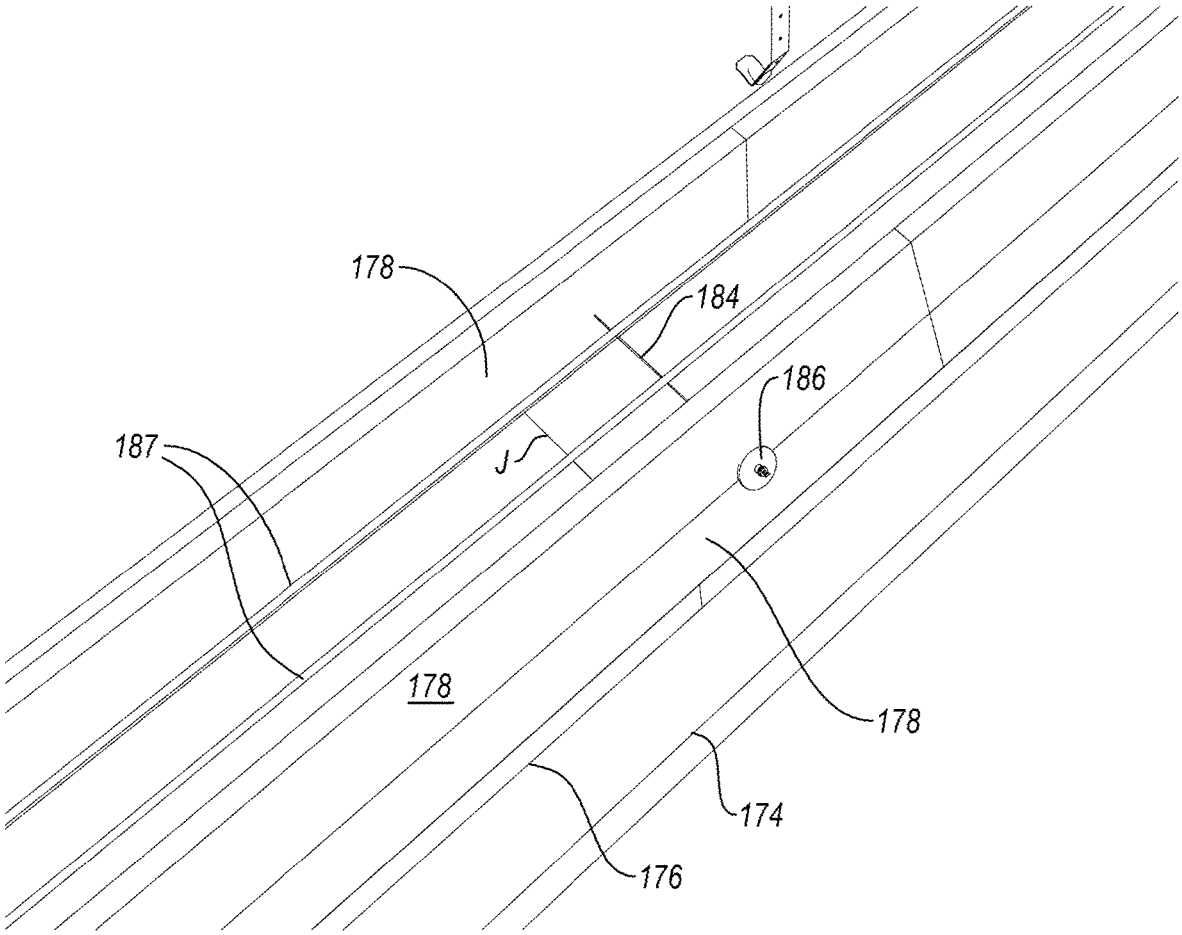
FIG. 63 shows insertion of wire ties through the sidewall members of the foam form, spanning the channel for the concrete. A washer (e.g., plastic washer) can hold the each end of the tie in place. Such ties help to hold the foam form together, while concrete is poured in the channel. At least one tie should be provided for each form section (e.g., placement of a tie at least every 3 feet). Rebar is also shown, supported on the tie wires in the channel.
Figure 64:
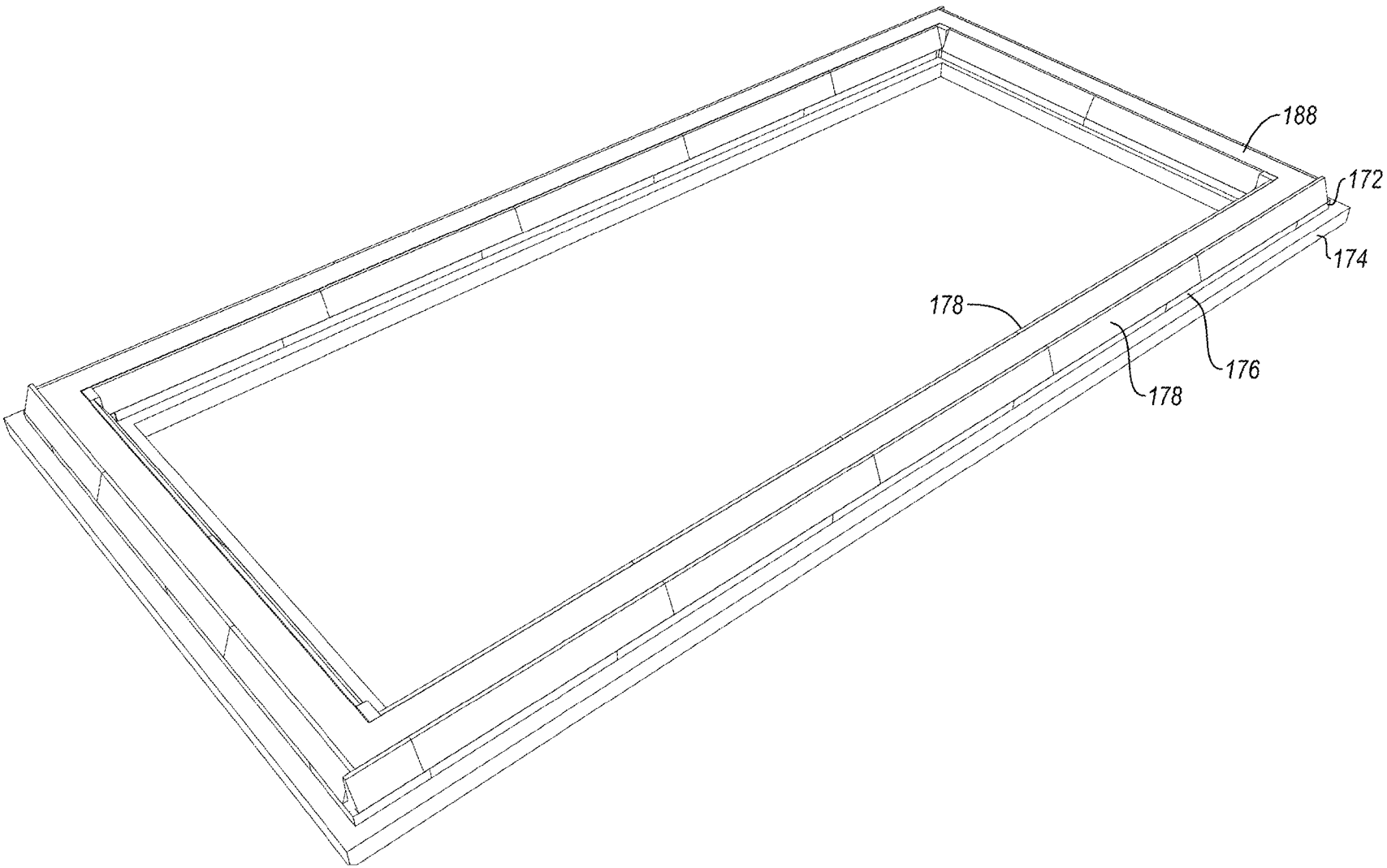
FIG. 64 shows concrete having been poured into the channel of the foam form, covering the rebar and tie wires.
Figure 65:
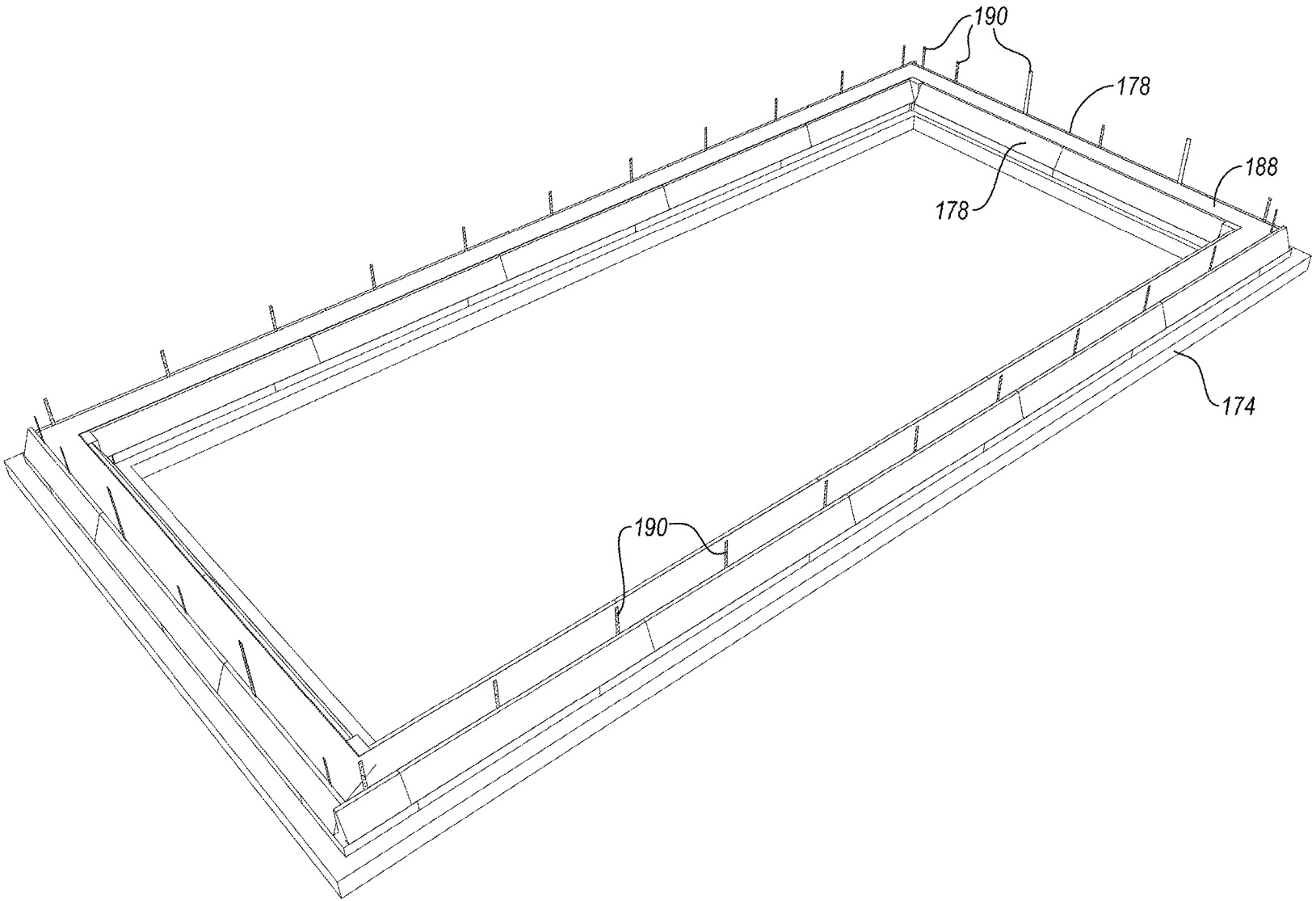
FIG. 65 shows placement of holddowns at appropriate intervals in the uncured concrete footing, which holddowns will be used to attach frame members to the footing, later.

FIG. 63 shows insertion of wire ties 184 through the sidewall members 178 of the foam form, spanning the channel 182 for the concrete. A washer (e.g., plastic washer) 186 can maintain the tie 184 in place (e.g., on the outside of each sidewall 178, as shown). Such ties 184 help to hold the foam form together, while concrete is poured in the channel 182. At least one tie should be provided for each form section 178 (e.g., placement of a tie at least every 3 feet). Rebar 187 is also shown, supported on the tie wires 184 in the channel 182. FIG. 64 shows concrete 188 having been poured into the channel of the foam form, covering the rebar and tie wires. FIG. 65 shows placement of holddowns 190 at appropriate intervals in the uncured concrete footing 188, which holddowns 190 will be used to attach frame members to the footing 188, later. Additional examples and details of such foam forms are described in U.S. Provisional Patent Application Nos. 63/278,042 (18944.24), already herein incorporated by reference in its entirety.

Figure 66:
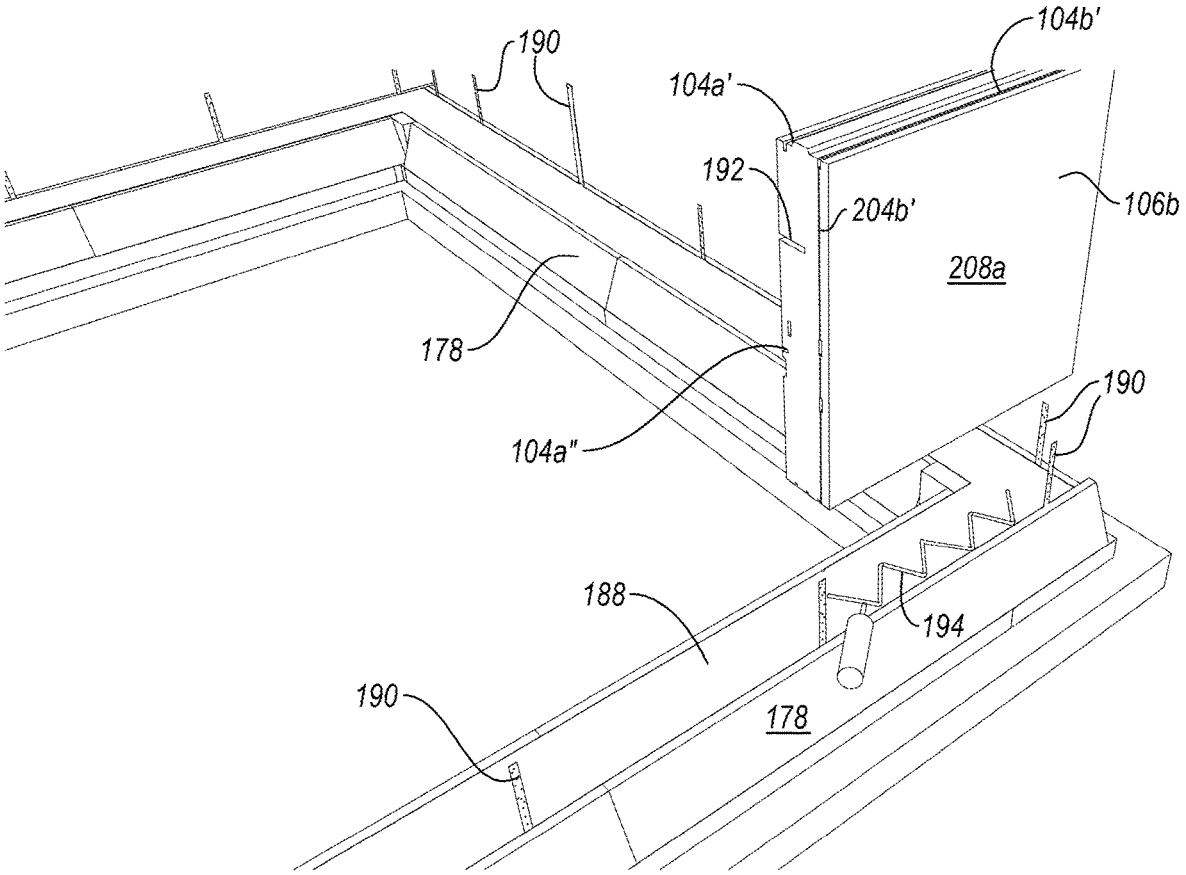
FIG. 66 shows preparation for placement of a wall-to-floor transition panel, which also includes pre-cut electrical cutouts for outlets at a desired height above the floor. As shown, the outside corner of this transition panel may be positioned 7 inches from the concrete corner, so the transition panel is flush with the exterior edge of the foam footing form. This transition panel may be secured to the concrete footing with an adhesive (e.g., expanding adhesive).

FIG. 66 shows preparation for placement of a wall-to-floor transition panel 208*a*, which is very similar to transition panel 208 described elsewhere herein, including such features as already described relative to the contemplated wall-to-floor transition panels. Wall-to-floor transition panel 208*a* is shown as including a pre-cut electrical cutout 192 or slot for running of electrical wiring, at a typical height for outlets at a desired height (e.g., 12 to 24 inches) above the floor. As shown, the outside corner of this transition panel 208*a* may be positioned 7 inches or another appropriate distance from the concrete corner, with the major exterior face 106*a* of transition panel 208*a* being flush with the exterior edge of the foam footing form defined by sidewall 178. This transition panel 208*a* may be secured to the concrete footing with an adhesive (e.g., an expanding adhesive) 194 as shown.

Figure 67:
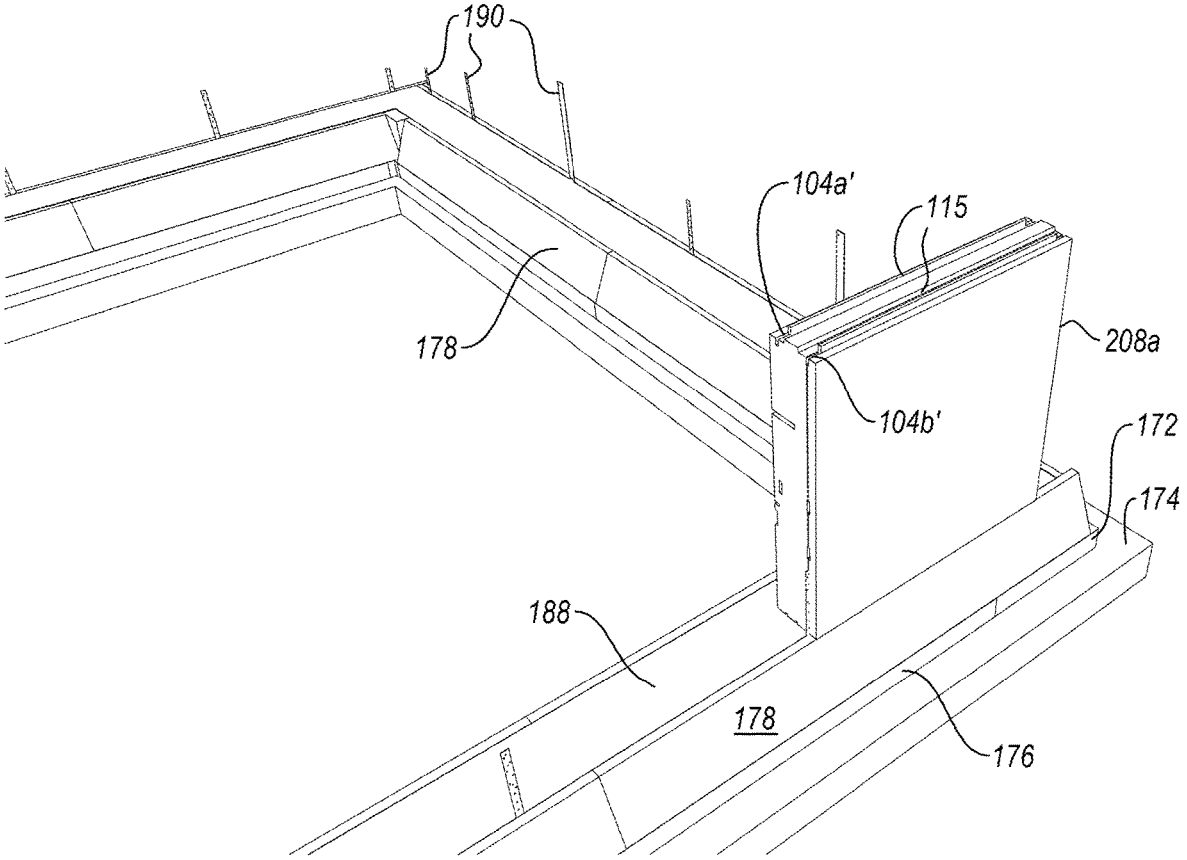
FIG. 67 shows insertion of furring strips into the top channels of the transition panel.
Figure 68:
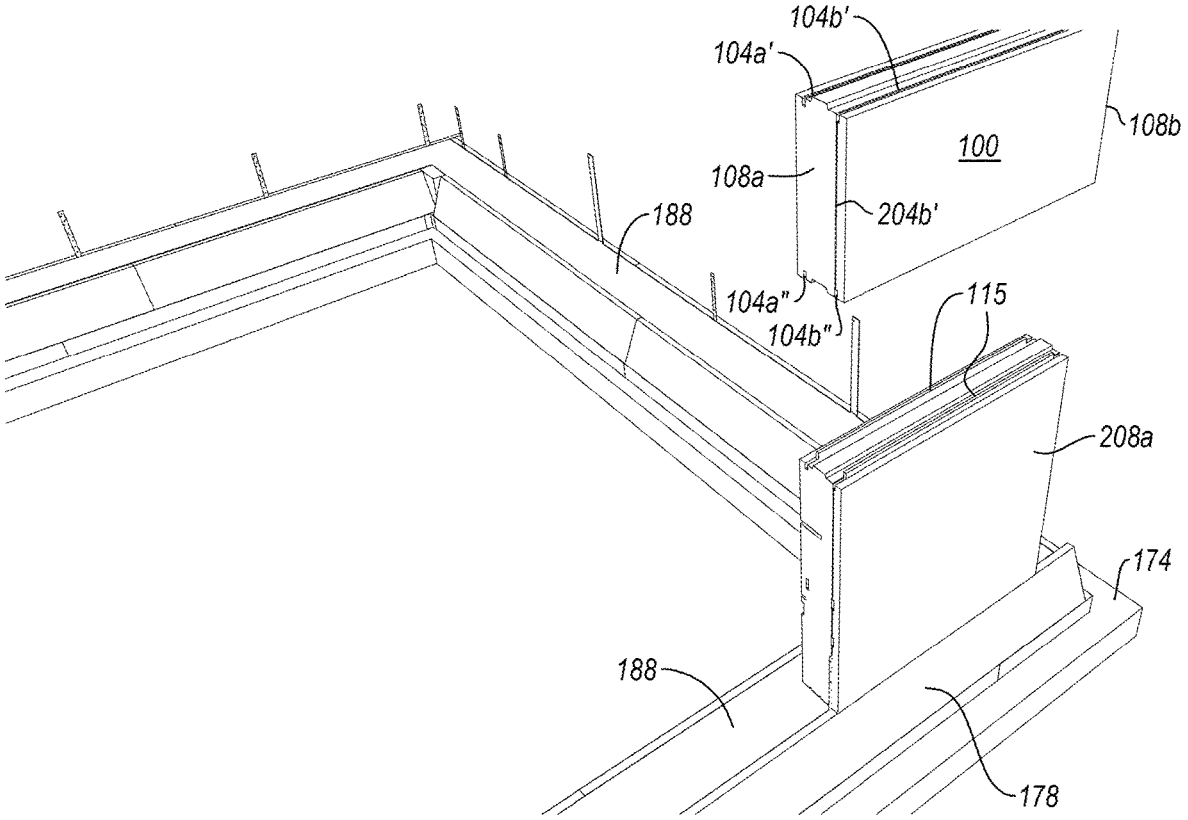
FIG. 68 shows positioning of a standard wall panel atop of the transition panel. The two panels may be glued together for increased strength, although this is not required in order to meet typical building codes.

FIG. 67 shows insertion of furring strips 115 into the top channels 104*a*', 104*b*' of the transition panel 208*a*. FIG. 68 shows positioning of a standard wall panel 100 atop of the transition panel. Panel 100 shown in FIG. 67 is nearly identical to panel 100 seen in FIGS. 1-3. One difference is that panel 100 of FIG. 67 includes an additional channel 204*b*' (as does transition panel 208*a*). In panel 100 of FIG. 67, channel 204*b*' runs from the top to the bottom of the panel (e.g., from channel 104*b*' to channel 104*b*"), in one or both of the left and right sides 108*a*, 108*b*, of such panel. The two panels 100 and 208*a* may be glued together for increased strength, although this is not required in order to meet typical building codes. Furring strips 115 engaged in top slots 104*a*' and 104*b*' of panel 208*a* also become engaged in bottom slots 104*a*" and 104*b*" of standard panel 100, holding the two panels together.

Figure 69:
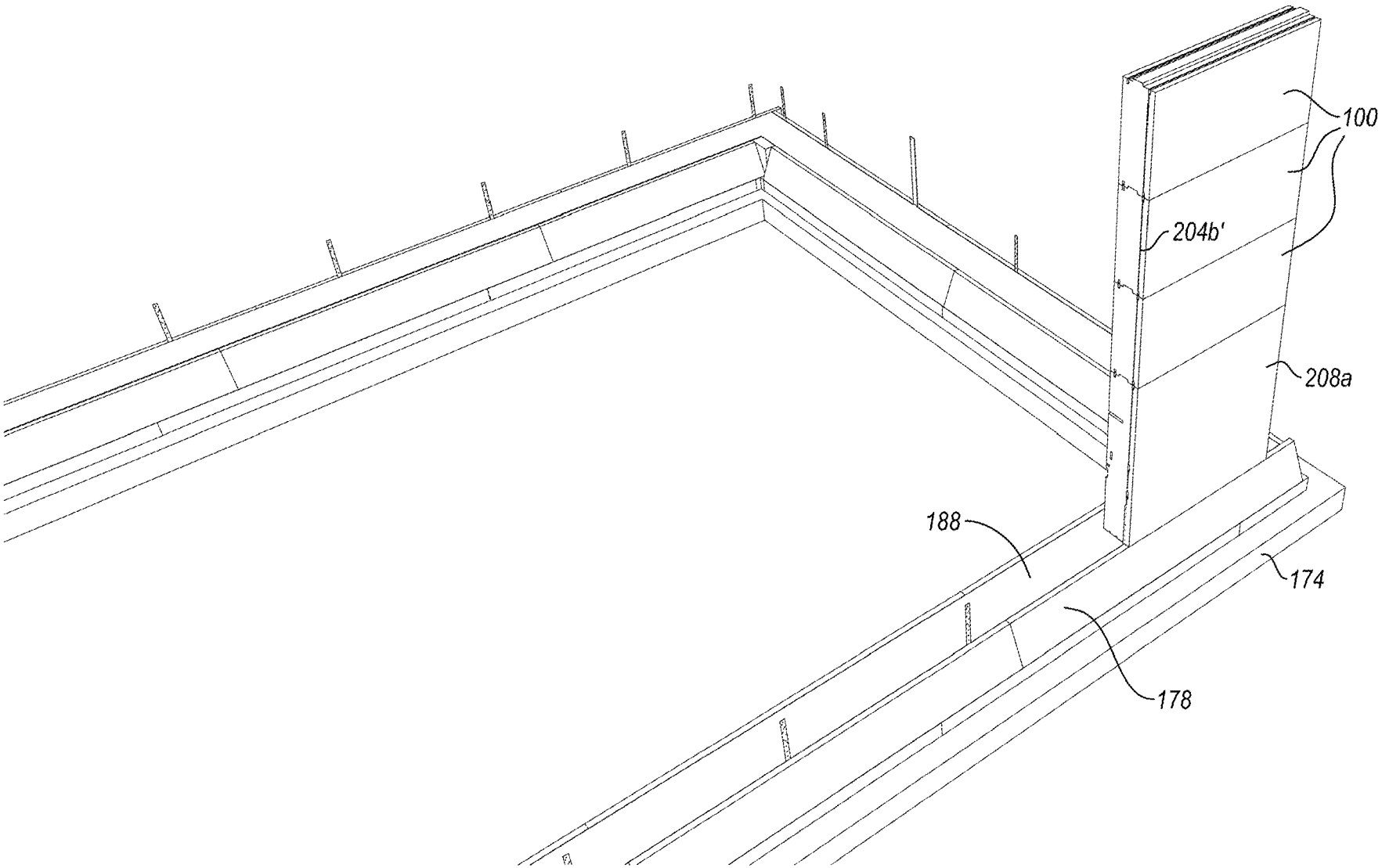
FIG. 69 shows positioning of additional standard wall panels, to form the wall.
Figure 70:
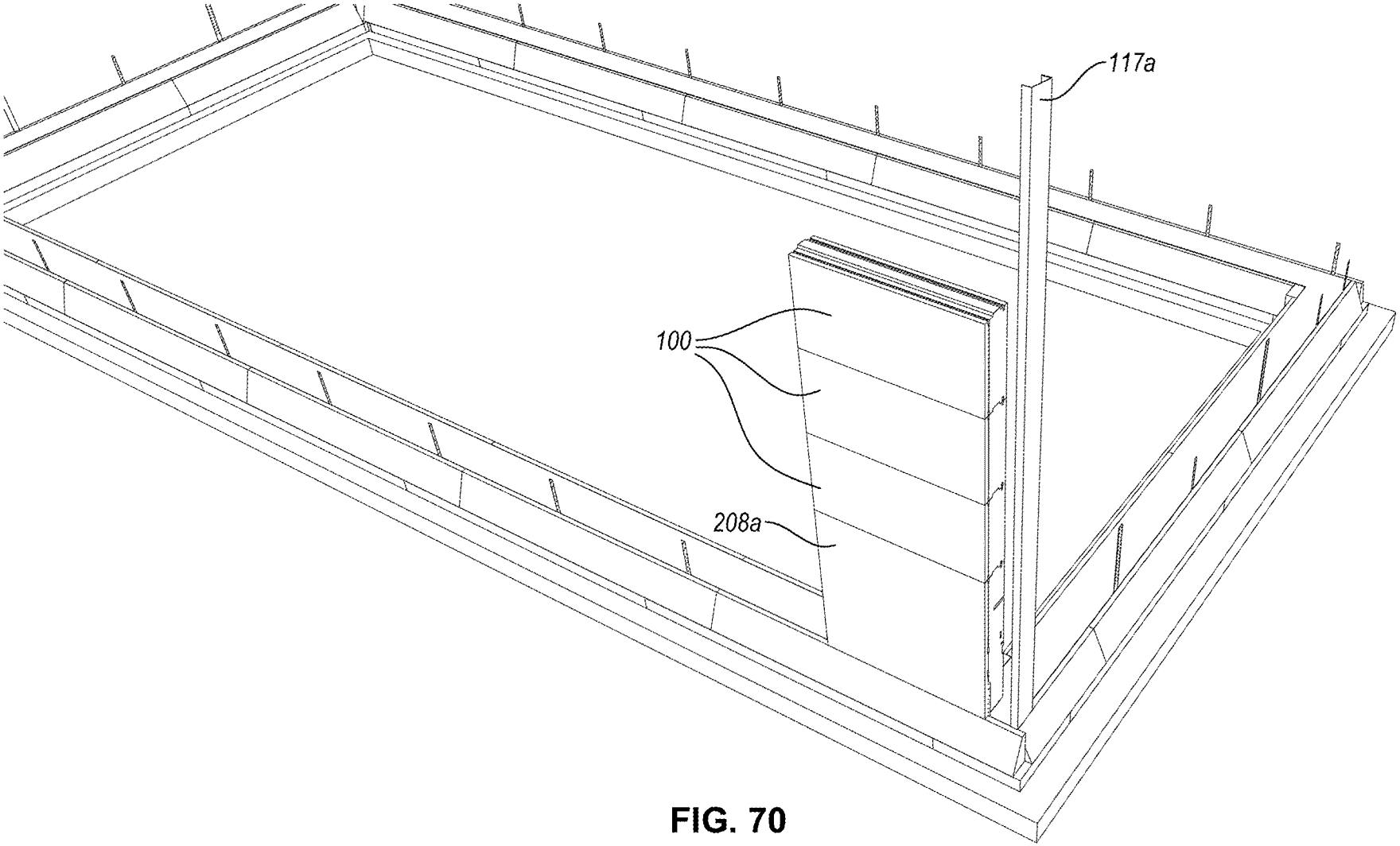
FIG. 70 shows positioning of a C-channel frame member, for insertion into corresponding channels of the transition panel and the standard wall panels.
Figure 71:
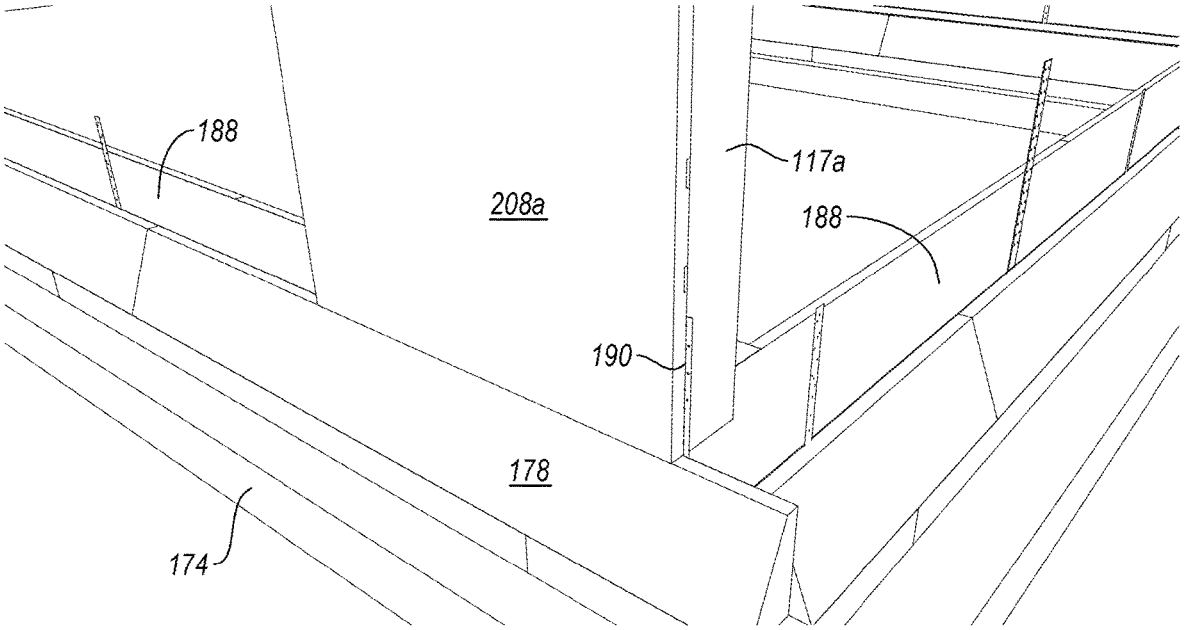
FIG. 71 shows the C-channel frame member having been inserted into the channels of the transition panel and standard wall panels, with screws used to secure said C-channel member to the correspondingly positioned holddown in the concrete footing.

FIG. 69 shows positioning of additional standard wall panels 100, to forth the wall. FIG. 70 shows positioning of a C-channel frame member 117*a*, for insertion into corresponding channels 204*b*' of the transition panel 208*a* and the standard wall panels 100. FIG. 71 shows the vertical C-channel frame member 117*a* having been inserted into the vertically aligned channels 204*b*' of the transition panel 208*a* and standard wall panels 100. Screws may be used to secure the C-channel member 117*a* to the correspondingly positioned holddown 190, anchored in the concrete footing 188.

Figure 72:
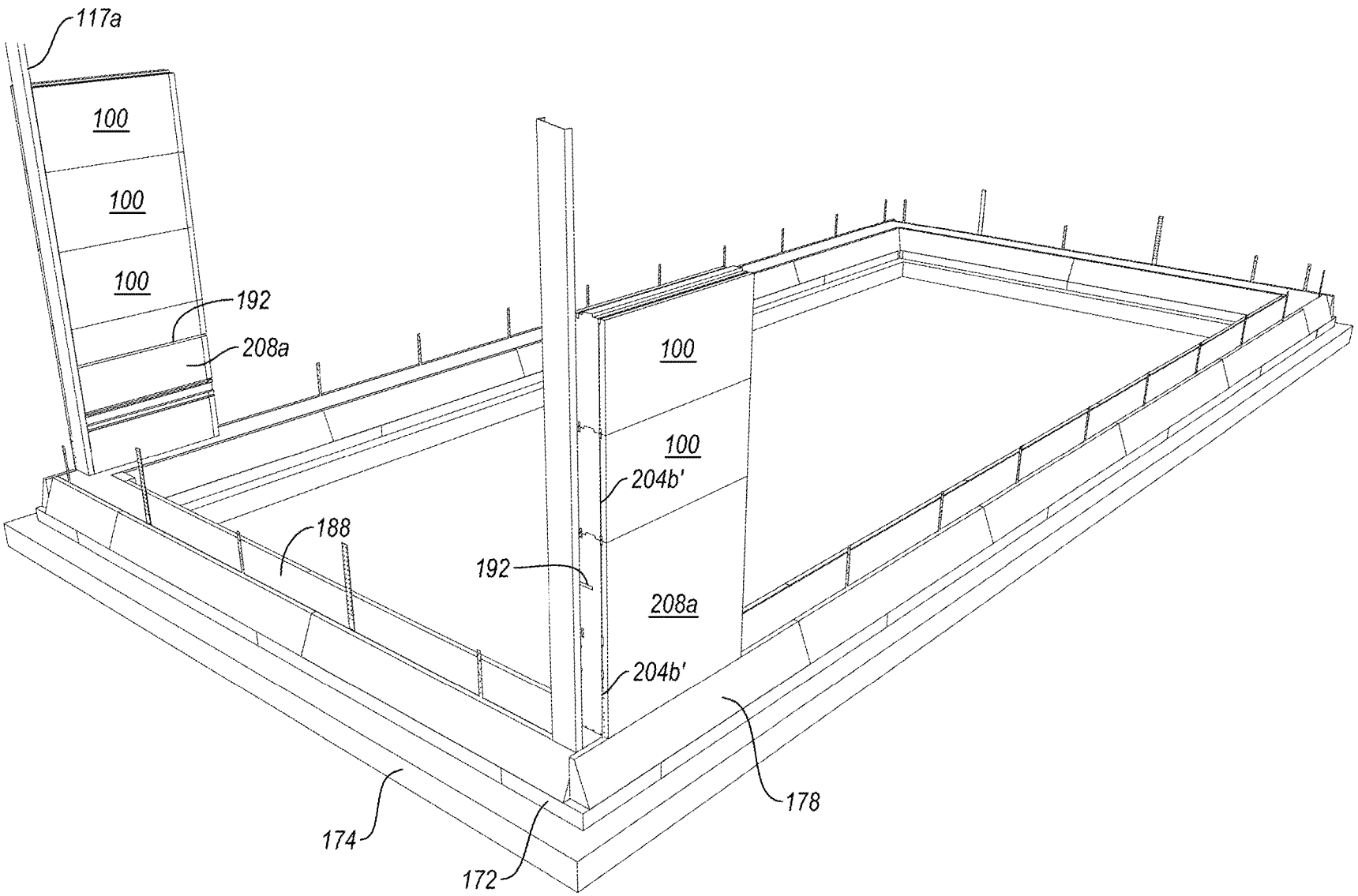
FIG. 72 shows assembly of a similar wall stack of a transition panel and standard wall panels on the opposite wall, from the opposite corner of the concrete footing.
Figure 73:
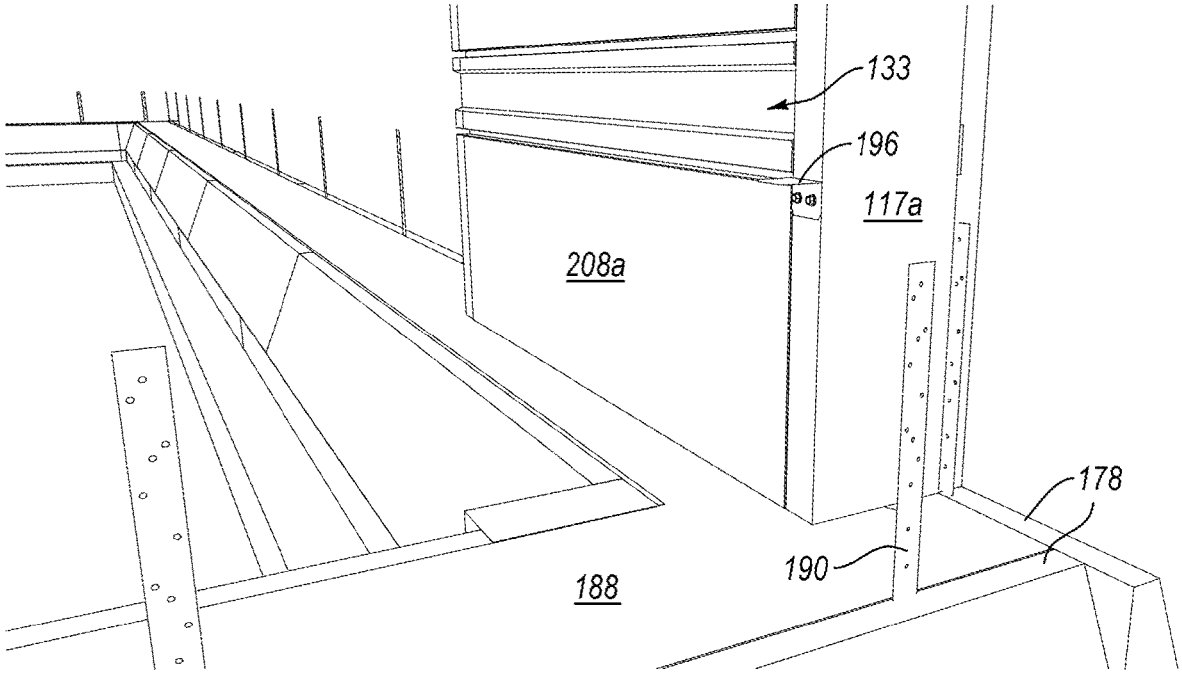
FIG. 73 shows attachment of an ear bracket to the C-channel member for support of a horizontal C-channel member for support of floor panels to be attached to the wall-to-floor transition panel.

FIG. 72 shows assembly of a similar wall stack of a transition panel 208*a* and standard wall panels 100 on the opposite wall, from the opposite corner of the concrete footing 188. FIG. 73 shows attachment of an ear bracket 196 to the C-channel member 117*a* for support of a horizontal C-channel member for support of floor panels to be attached to the wall-to-floor transition panel 208*a*. The ear bracket 196 is shown as positioned at an appropriate height, relative to the wall-to-floor transition panel 208, for the floor panels to engage with the stair-stepped configuration 133 included within transition panel 208, allowing the correspondingly shaped outer edges (i.e., top and bottom sides) of a standard panel 100 to mate therewith. Thus, this stair-stepped or inclined surface or interface is provided at the interface of all panels attaching to one another, whether one standard panel to another standard panel (as in a wall, floor, or roof), or a transition panel attaching to a standard panel (as is the case in FIGS. 76-77).

Figure 74:
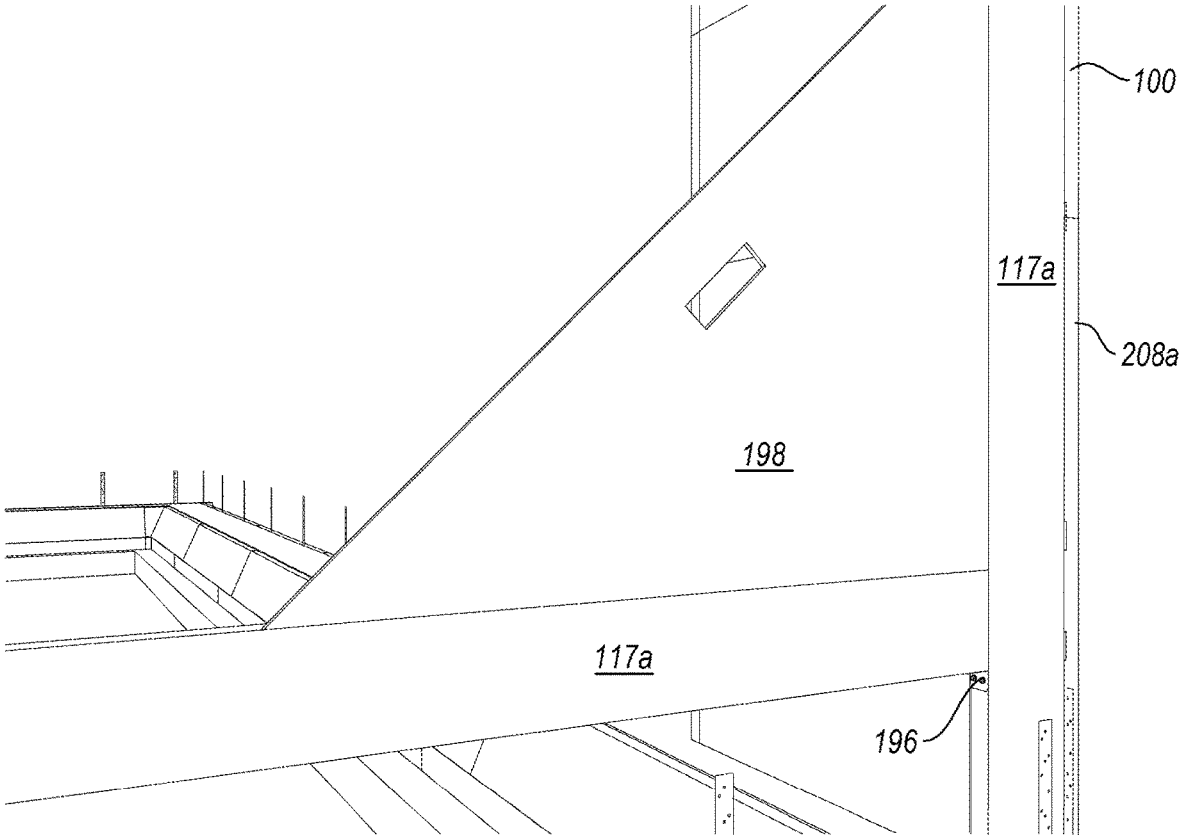
FIG. 74 shows attachment of the horizontal C-channel member for the floor.

FIG. 74 shows attachment of the horizontal C-channel member 117*a* for the floor. For example, the horizontal C-channel member 117 a can be secured to the vertical C-channel member through ear bracket 196, with screws or the like. A corner of a sheet of plywood, OSB or similar square material 198 (in conjunction with a level, e.g., placed vertically against the vertical C-channel member 117) can be used to ensure that the horizontal and vertical C-channel frame members 117*a* are square. FIG. 75 shows placement of additional standard wall panels 100. As shown at the top end of one of the walls in FIG. 75, a shorter wall panel 100' (otherwise identical to the standard 2'×4' wall panels) may be used, to achieve a desired wall height. As described elsewhere herein, a similar result can be achieved by adjusting the length of the wall leg of a wall-to-roof transition panel 200, which can be placed later (described in conjunction with FIGS. 96-99).

FIG. 76 shows placement of a furring strip 115 into a channel 104*a*" (corresponding to channel 104*a*' of the standard panel, that the furring strip 115 is also received into) of the transition panel 208*a*, and positioning of a first standard floor panel 100 (the same as a standard wall panel 100) for attachment to the transition panel 208*a* and the horizontal C-channel frame member 117*a*. FIG. 77 shows positioning of a next furring strip 115 for receipt into channels 104*a*', 104*a*" of the standard floor panels 100, as well as positioning of a next standard floor panel. As will be apparent, the bottom flange 116 of horizontal C-channel member 117*a* is received into channel 204*b*', while the top flange 116 of horizontal C-channel member 117*a* wraps around the corner edge of panel 100, wrapping around to cover a portion of face 106*a* of each standard floor panel 100. The vertical C-channel frame members 117*a* similarly engage with panels 208*a* and standard wall panels 100, with one flange 116 of such C-channel member 117*a* engaging in channel 204*b*' (which extends along the length of end faces 108*a*, 108*b*) of the stack of panels, while the other flange 116 of such C-channel member 117*a* wraps around to the interior face, covering a small portion of interior major face 106*a* of each of such panels.

FIG. 78 shows positioning of additional floor panels 100 (and furring strips) for attachment to the horizontal C-channel member 117*a* of the floor. The top flange 116 of the horizontal C-channel member 117*a* wraps over the top face 106*a* of the standard floor panels 100, while the bottom flange 116 of the horizontal C-channel member 117*a* is received into the corresponding channel 204*b*' formed into a bottom portion of the standard floor panels, adjacent major planar face 106*b*. FIG. 79 shows insertion of a final furring strip 115 of the row of floor panels, connecting the final floor panel 100 of the row of floor panels 100 to the opposite wall-to-floor transition panel 208*a*, with the furring strip 115 received into corresponding channels 104*a*", 104*a*' of the floor panel 100 and the wall-to-floor transition panel 208*a*.

FIG. 80 shows positioning of vertical back-to-back C-channel frame members 117*a* (forming I-beams 117) between stacks of wall panels 208*a*, 100 forming the wall. FIG. 81 shows engagement of the vertical I-beams 117 into the stack of panels 208*a*, 100 (particularly channel 204*b*' of such panels) of the wall. As shown in FIG. 81, the flange 116 that is not engaged in such a channel wraps around the edge of the wall panels, covering a portion of the panel interior major face. As shown in FIG. 80, it will be noted that one of the vertical C-channel members 117*a* of each back-to-back pair 117 is taller than the other, to facilitate attachment of roof I-beam frame members 117 (also formed from back-to-back C-channel members 117*a*), as will be explained hereafter.

FIG. 82 shows positioning of a floor I-beam 117 (formed from back-to-back C-channel frame members 117*a*) in preparation for positioning another row of floor panels 100, to form another floor section. FIG. 83 shows use of ear brackets 196 to attach the horizontal floor C-channel frame members 117*a* to the vertical wall C-channel frame members 117*a*. FIG. 83 also shows use of a corner of a sheet of plywood, OSB or similar square material 198 (e.g., used in conjunction with a level) to ensure that the horizontal and vertical C-channel frame members 117*a* are square. A hole in the vertical C-channel frame member 224 can be provided so as to be aligned with the pre-cut electrical cutout or slot 192 (for electrical wiring and electrical outlets) of the wall-to-floor transition panel 208*a*.

FIG. 84 shows positioning of an adjustable floor jack 226 in e.g., a center of the floor span, if needed, e.g., to support floor spans of greater than 14 feet. A spot footing 228 may be provided under any such optional adjustable floor jack 226. The floor jack may engage with the corresponding floor I-beam member 117, located above such jack 226.

FIG. 85 shows placement of additional wall panels (e.g., another wall-to-floor transition panel 208*a*, and associated standard wall panels 100). FIG. 85 also shows positioning of a specialized window module panel 300 that takes the place of any desired panel(s), where a window is to be placed. Such specialized functional modules may be used for placement of windows, doors, or other desired structures (e.g., plumbing, electrical or other modules for sinks, toilets, ovens, or the like). Additional examples of such functional modules are described in U.S. Provisional Patent Application Nos. 63/278,040 (18944.23), already herein incorporated by reference in its entirety.

FIG. 86 shows the window module panel 300 of FIG. 85 in an exploded configuration, showing how it can be formed from pane(s) of window glass 302 surrounded by appropriate foam members 304, so that the exterior surfaces (particularly the top and bottom ends 110*a*, 110*b*, and the left and right sides 108*a*, 108*b*) include the same channels 104*a*', 104*a*", 104*b*', 104*b*" and other structure as any other of the standard or transition modular panels that the specialized panel is replacing, allowing such a window module panel 300 (or other functional module) to simply replace one or more standard panels 100 (or combination of transition panel(s) 208*a* and standard panels 100). For example, the window module panel 300 of FIG. 85 is sized identical to a standard 2'×4' wall panel 100, with identical channels and other features on the 4 minor surfaces (108*a*, 108*b*, 110*a*, 110*b*) thereof, so that such surfaces function identically to any other standard wall panel 100.

FIG. 87 shows completion of the wall stack of panels shown in FIG. 85, incorporating an exemplary window module panel 300, while also showing positioning of vertical I-beam members 117 between adjacent stacks of wall panels. FIG. 87 also shows completion of the opposite stack of wall panels, also incorporating another exemplary window module 300*a* (this one replacing 4 standard wall panels 100). FIG. 88 shows the vertical I-beams 117 having been engaged with the stacks of wall panels in the manner described previously (with one flange 116 received into channel 204*b*', and the other wrapping around face 106*a* of the engaged panels). FIG. 88 also shows the row of next floor panels 100 (and associated furring strips) positioned for placement.

FIG. 89 shows the row of floor panels 100 of FIG. 88 having been appropriately engaged, and the next I-beam member 117 of the floor being positioned, in preparation for the next row of floor panels 100. FIG. 90 shows the next I-beam member 117 engaged with the floor panels 100 (with the lower flange 116 engaged into channel 204*b*' and the upper flange wrapping around the top edge of panels 100, as already described). FIG. 90 also shows an adjustable floor jack 226 positioned under the most recently placed horizontal I-beam 117. Such floor jacks 226 are optional, e.g., depending on the span of the floor.

FIG. 91 shows how such wall and floor sections may be placed, in the same manner as already shown, until the endwalls are to be assembled. FIG. 91 shows the incorporation of additional functional module panels into the walls, e.g., including an exemplary door panel 300*b*, as well as various window panels.

FIG. 92 shows attachment of floor sheathing 230 (e.g., ¾ inch tongue and groove OSB or plywood sheathing). The floor sheathing 230 may be attached before the endwalls are assembled. As shown, the C-channel member 117*a* at the end of each wall is not made up of dual back-to-back C-channel members (forming an I-beam 117), as such is not needed at the end of the wall (or ends of the floor). The metal C-channel member 117*a* (e.g., steel) may be glued to the wall panels, e.g., when inserting the flanges 116 of the C-channel frame member 117*a* into the wall panels. Back-to-back C-channel members (i.e., forming I-beams 117) can be secured together with screws.

FIG. 93 shows attachment of a temporary ear bracket 196 to the taller C-channel member 117*a*, at a height so as to be flush with the shorter C-channel member 117*a* of the first I-beam vertical frame member 117. FIG. 93 also shows positioning of furring strips 115 adjacent the top end of the last wall panel in the stack of wall panels. As shown in FIG. 93, the top wall panel 100' may be shorter, if desired to accommodate a desired wall height (such adjustments in wall height can also be accomplished by adjusting the height of the wall leg of the wall-to-roof transition panel 200).

FIG. 94 shows attachment of a roof C-channel frame member 117*a*, with the lower end 232 of such roof frame member 117*a* supported on the temporary ear bracket 196 shown in FIG. 93, and the higher end 234 of the roof frame member 117*a* attached to the higher of the vertical back-to-back C-channel members 117*a* of the opposite higher wall. Attachment of any 2 back-to-back C-channel members 117*a* may be made with screws (e.g., 2 screws every 24").

FIG. 95 shows attachment of an associated roof C-channel frame member, 117*a* attached back-to-back with the C-channel frame member 117*a* shown as being installed in FIG. 94. The high end 234 of the $2^{nd}$ roof C-channel member 117*a* is positioned so as to abut against the taller vertical C-channel frame member 117*a* of the taller wall, while the lower end 232 may rest on the top of the shorter vertical C-channel frame member 117*a* of the shorter wall. The lower end 232 of the $2^{nd}$ roof C-channel member 117*a* may be attached to the taller vertical wall C-channel member 117*a* with screws where they abut one another. While the walls shown are exemplary of a roof sloped in only 1 direction, it will be appreciated that the present building systems can be used for any type roof (e.g., pitched, sloped, flat, etc.), with appropriate accommodations that will be apparent to those of skill in the art, in light of the present disclosure.

FIG. 96 shows positioning of a first wall-to-roof transition panel 200 at the top of a stack of wall panels. Furring strips can be received within corresponding channels, to help hold the two panels in alignment and connected with one another. FIG. 97 shows the wall-to-roof transition panel 200 in place at the top of the wall, with a furring strip 115 inserted into the channel 236 in the top of the wall-to-roof transition panel 200, with a portion of the furring strip 115 extending out of the end of the channel 236 so that the plane of the furring strip 115 can be positioned against the plane of the adjacent flange 116 of the taller of the C-channel vertical frame members 117*a*, as shown. This ensures that when a roof panel is placed adjacent the transition panel 200, the transition panel 200 remains in place where it should be, rather than splaying in or out, relative to the wall. FIG. 98 shows positioning of the first roof panel 100*a*, with an associated furring strip 115, for insertion into corresponding channels 104*a*', 104*a*" of the transition panel 200 and the roof panel 100*a*. Roof panel is similar to standard panels 100, including many of the same features already described relative to such panels. Differences may include the inclusion of a purlin channel 156 in the top face of the panel, and the inclusion of only a single channel 104*a*", rather than pairs of such channels in each end 110*a*, 110*b*.

FIG. 99 shows the roof panel 100*a* and furring strip 115 of FIG. 98 attached, where the roof panel 100*a* is attached to the transition panel 200 by the furring strip 115, and through engagement of the flanges 116 of the roof C-channel member 117*a* with corresponding channel 204*b*' of the roof panel 100*a*. FIG. 100 shows positioning of the rest of the roof panels 100*a* to form a row of roof panels, which will form a section of the roof. Furring strips 115 may similarly be used, along with the flanges 116 of the roof C-channel member 117*a*, to secure these components together. The roof panels 100*a* may be slid into the flange 116 of the roof C-channel member 117*a*. The male/female profile associated with the stair-stepped ends 110*a*, 110*b* of the roof panels 100*a*, as well as furring strips 115 between adjacent roof panels, may serve to support the roof panels in place against gravity, until the next roof C-channel member 117*a* is installed, on the other side of the roof panel 100*a* (one on each end 108*a*, 108*b* of each roof panel 108*a*). The row of roof panels may be allowed to sag somewhat until the next C-channel member is installed, which is not a problem.

FIG. 101 shows positioning of the next wall-to-roof transition panel 200 at the opposite wall. FIG. 102 shows insertion of the final roof panel 100*a* of the row, as well as the furring strip into channels 104*a*', 104*a*", to secure the final roof panel to the wall-to-roof transition panel 200. FIG. 103 shows insertion of the next roof C-channel member 117*a* into the channels 204*b*' of the panels 100*a*, and positioning of another roof C-channel member 117*a*, to form the roof I-beam 117, to support the next row of roof panels 100*a*. FIG. 104 shows attachment of the $2^{nd}$ roof C-channel member 117*a* of the back-to-back C-channel members 117*a* that form the roof I-beam member 117 that provides support for and between rows of roof panels 100*a*.

FIG. 105 shows placement of the rest of the roof panels 100*a* and the roof C-channel frame members 117*a*. It will be appreciated that panels 100*a* and C-channel members 117*a* are placed intermittently, with placement of a row or stack of panels 100*a* followed by placement of back-to-back C-channel members 117*a*, followed by placement of another row of panels 100*a* (or stack of panels 100 for a wall), when constructing walls, floors, or the roof structure.

FIG. 106 shows attachment of a special C-channel member 238 (special in that it includes return lips 240 on the flanges 116) to the outside of the end C-channel member 117*a* at the ends of each wall, with the open portion of the special C-channel member 238 facing outwards, towards where the endwall will be assembled. The special C-channel member 238 may be attached to the underlying standard C-channel member 117*a* every 3 feet. FIG. 107 shows insertion of a 2×4 purlin 154 into purlin channels 156 of the roof panels 100*a*, with the purlin 154 overhanging the roof panels 100*a* and final roof C-channel member 117*a*, for use in tying the roof frame members of the endwall to the remainder of the building. The purlin 154 may be attached to the roof C-channel members 117*a* already shown in place, with screws (e.g., two 2½ inch long #12 screws).

FIG. 108 shows installation of a first vertical C-channel frame member 117*a* of the endwall. This C-channel member may be installed ½ inch inward (gap G) from the other labeled vertical C-channel member 117*a*, on the tall wall of the building. It may be attached with two screws at the top, connecting the C-channel member 117*a* of the endwall to the adjacent C-channel member 117*a* of the roof, and two screws at the bottom, connecting the C-channel member 117*a* of the endwall to the horizontal C-channel member 117*a* of the floor.

FIG. 109 shows stacking of a wall-to-floor transition panel 208*a*, and standard wall panels 100, and insertion of vertical back-to-back C-channel members 117*a* at the end, with flanges 116 of one of the C-channel members 117*a* received into the channels 204*b*' of the wall panels, and the other flange wrapping around to the interior major face 106*a* of the panels. The I-beam 117 formed from back-to-back C-channel members 117*a* may be attached with screws to the roof C-channel member 117*a* and the floor C-channel member 117*a*.

FIG. 110 shows installation of another stack of wall panels 100, 208*a*, and associated I-beam member 117 formed from back-to-back C-channel members 117*a* (or simply a single C-channel member 117*a*). FIG. 111 shows how if a vertical end wall frame member 117*a* is not at a shear brace location, then an L-shaped angle frame member 242 may be attached to the C-channel frame member 117*a*, as shown. Such may be used anywhere where shear brace holddowns (e.g., 190) were not placed.

FIG. 112 shows construction of the remainder of the endwall, showing how specialized window modules or other specialized functional modules (e.g., window module panel 300*c*, or a similar panel providing functionality of a door, plumbing, or specialized electrical modules) can be included in the endwall (just as they can be included anywhere in any wall, floor, or roof).

FIG. 113 shows positioning of corner foam members 244, which can be slid vertically down, over the special C-channel member 238 having flanges 116 with a return lip 240. The corner foam members 244 may include correspondingly shaped channels formed therein, to receive the flanges 116 with a return lip 240. In other words, the corner foam member 244 may be keyed in shape to the flange, allowing insertion of one into the other. Because of the return lip 240, such insertion may only be achieved by sliding the corner foam member 244 down over the flange from above, rather than laterally from the side.

FIG. 114 shows insertion of roof purlins 154 into the purlin channels 156 of the roof panels 100*a*. Each 2×4 purlin may be attached to each roof C-channel member 117*a* at the intersections thereof, with screws (e.g., two 2½ inch #12 screws at each intersection). As shown, for each overhanging portion, short lengths of 2×4 246 may be attached under the overhanging portion of purlins 154 (e.g., with screws). Such small 2×4 segments 246 can be pushed snugly against the metal roof C-channel member 117*a* prior to screwing to the corresponding purlin 154. 2×8 facia boards 248 may be attached under the purlins 154, and to the short segments of 2×4s 246, as shown.

FIG. 115 shows how bracing may be added to the endwalls, or any desired wall, e.g., as 4" flat metal strap bracing 162 extending diagonally between desired vertical C-channel members 117, as shown. Attachment may be made with six ¼ inch screws at each attachment location (e.g., top and bottom). Such shear bracing may be positioned as desired, to achieve desired engineering objectives. FIG. 116 shows an inside view of the shear bracing of FIG. 115.

FIG. 117 shows how at any shear brace locations, a 2×4 250 may be attached above and below the roof frame members 117*a*, e.g., with two screws into each intersecting frame member. The purlins 154 and other lumber members provide attachment points for attaching metal roofing 168 (e.g., screw metal roofing at 6" centers to the 2×4s), as shown in FIG. 118. FIG. 118 shows attachment of plywood or OSB (e.g., 7/16" thick) sheathing 230 to the top and bottom 2×4s 250 (e.g., every 6"), essentially forming a header, as shown.

While the Figures illustrate construction of simple exemplary walls and buildings to illustrate concepts of the present construction methods and systems, it will be appreciated that the methods and systems may be used to construct a nearly endless variety of buildings.

It will also be appreciated that the present claimed invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope. Additionally, as used in this specification and the appended claims, the singular forms "a," "an" and "the" include plural referents unless the context clearly dictates otherwise.

The invention claimed is:

1. A building system comprising:

a plurality of modular panels, each modular panel comprising:

a body; and one or more channels extending through a length or width of the modular panel, each channel being configured to receive an elongate spline therein, wherein each elongate spline once received in the channel is disposed within the body, so that the elongate spline is restrained once received within the channel; and a plurality of elongate splines, wherein the splines are received within the one or more channels of the bodies of the modular panels, the splines being flanges of a C-channel frame member or back-to-back C-channel frame members that form an I-beam that runs vertically along a length of the modular panel;

a wall-to-floor transition panel for use in transitioning from a wall to a floor in a building construction, the wall-to-floor transition panel being configured to be positioned:

between one or a stack of the modular panels forming the wall; and one or more of the modular panels that form a floor structure;

wherein the wall-to-floor transition panel comprises (i) a floor leg or a floor connection portion where a floor panel is attachable and (ii) a wall leg where a wall panel is attachable, where the floor leg or floor connection portion is at an angle relative to the wall leg; and a wall-to-roof transition panel for use in transitioning from the wall to a roof in the building construction, the wall-to-roof transition panel being configured to be positioned:

between one or a stack of the modular panels forming the wall; and one or more of the modular panels that form a roof structure;

wherein the wall-to-roof transition panel comprises (i) a roof leg or a roof connection portion and (ii) a wall leg or a wall connection portion, which are at an angle relative to one another, a vertical length of the wall leg or wall connection portion accommodating an increased height to the wall by including a vertical length that adds to a height of the wall, the angle between the roof leg or roof connection portion and the wall leg or wall connection portion dictating a roof pitch or angle associated with the roof.

2. A building system as in claim 1, wherein the body is a foam body.

3. A building system as in claim 1, wherein the modular panels of the wall are substantially identical to the modular panels of the roof structure, and/or the floor structure.

4. A building system as in claim 1, wherein the modular panels of the wall are substantially identical to the modular panels of the roof structure, other than the modular panels of the roof structure optionally including one or more purlin channels running through a width or length thereof, the purlin channels being formed into at least one of the major planar faces of the modular panels of the roof structure.

5. A building system as in claim 1, wherein the building construction is constructed to include the back-to-back C-channel frame members, forming I-beams, between adjacent vertical wall sections of the wall.

6. A building system as in claim 5, wherein the building construction is constructed to include back-to-back C-channel members, forming I-beams, between adjacent horizontal floor sections of the floor structure.

7. A building system as in claim 5, wherein the building construction is constructed to include back-to-back C-channel members, forming I-beams, between adjacent roof sections of the roof structure.

8. A building system as in claim 6, wherein the modular panels of the vertical wall sections and modular panels of the horizontal floor sections include a channel extending along their length or width, one flange of the C-channel member being engaged therein, while the other flange of the C-channel member wraps around a corner edge of the modular panel.

9. A building system as in claim 8, wherein a space between the flanges of the C-channel frame members is filled with the body of the modular panel, ensuring that forces applied to the modular panel place that portion of the modular panel in between the flanges of the C-channel frame member in compression, rather than in tension.

10. A building system as in claim 1, wherein top and bottom ends of the modular panels include a stair-stepped or inclined configuration, so that when stacking one modular panel atop another modular panel, a horizontal seam therebetween is defined by an inclined or stair-stepped surface interior to the horizontal seam, so as to minimize or prevent water seepage between stacked modular panels.

11. A building system as in claim 1, further comprising a continuous footing in a frost foam form, the C-channel frame members of at least walls of the building construction being anchored to the continuous footing, which footing is surrounded on the sides and bottom by the frost foam form.

12. A building system as in claim 1, wherein the C-channel frame members include back-to-back C-channel frame members that form the I-beam that runs vertically along a length or width of the modular panels placed to form the wall, the I-beam being a first I-beam including a shorter C-channel frame member and a longer C-channel frame member, wherein the building system further comprises a second I-beam also extending vertically, positioned in an opposite wall, wherein the second I-beam is also formed from back-to-back C-channel frame members, also including a shorter C-channel frame member and a longer C-channel frame member, where the shorter and longer C-channel frame members of the first I-beam are configured as a mirror image of the shorter and longer C-channel frame members of the second I-beam, to aid in placement of a roof member I-beam.

13. A building system comprising:

a modular panel comprising:

a generally rectangular foam body having two major planar faces, a top end, a bottom end, and right and left sides; and a channel extending through a length or width of the panel on the right and left sides of the modular panel, the channel in each of the right and left sides being configured to receive a flange of a C-channel member therein, wherein the flange of the C-channel member once received in the channel is disposed within the foam body, without the received flange of the C-channel member being exposed on either of the major planar faces of the body, so that the flange is restrained once received within the channel;

a wall-to-floor transition panel for use in transitioning from a wall to a floor in a building construction, the wall-to-floor transition panel being configured to be positioned:

between one or a stack of the modular panels forming the wall; and one or more modular panels that form a floor structure;

wherein the wall-to-floor transition panel comprises (i) a floor leg or a floor connection portion where a floor panel is attachable and (ii) a wall leg where a wall panel is attachable, where the floor leg or floor connection portion is at an angle relative to the wall leg; and a wall-to-roof transition panel for use in transitioning from the wall to a roof in the building construction, the wall-to-roof transition panel being configured to be positioned:

between one or a stack of the modular panels forming the wall; and one or more modular panels that form a roof structure;

wherein the wall-to-roof transition panel comprises (i) a roof leg or a roof connection portion and (ii) a wall leg or a wall connection portion, which are at an angle relative to one another, a vertical length of the wall leg or wall connection portion accommodating an increased height to the wall by including a vertical length that adds to a height of the wall, the angle between the roof leg or roof connection portion and the wall leg or wall connection portion dictating a roof pitch or angle associated with the roof.

14. A building system as recited in claim 13, wherein the other flange of the C-channel member wraps around a corner edge of the modular panel, from the right or left side to one of the major planar faces, when the flange of the C-channel that is received into the channel in the right or left side is received therein.

15. A building system as recited in claim 14, wherein a space between the flanges of the C-channel member is filled with the foam body of the modular panel, ensuring that forces applied to the panel place that portion of the panel in between the flanges of the C-channel member in compression, rather than in tension.

16. A building system as recited in claim 13, further comprising the C-channel member, wherein the other flange of the C-channel member wraps around a corner edge of the modular panel, from the right or left side to one of the major planar faces, when the flange of the C-channel that is received into the channel in the right or left side is received therein, wherein a space between the flanges of the C-channel member is filled with the foam body of the modular panel, ensuring that forces applied to the panel place that portion of the panel in between the flanges of the C-channel member in compression, rather than in tension.

17. A building system comprising:

a plurality of modular panels, each modular panel comprising:

a body; and one or more channels extending through a length or width of the modular panel, each channel being configured to receive an elongate spline therein, wherein each elongate spline once received in the channel is disposed within the body, so that the elongate spline is restrained once received within the channel; and a plurality of elongate splines, wherein the splines are received within the one or more channels of the bodies of the modular panels, the splines being flanges of a C-channel frame member or back-to-back C-channel frame members that form an I-beam that runs vertically along a length of the modular panel;

a wall-to-floor transition panel for use in transitioning from a wall to a floor in a building construction, the wall-to-floor transition panel being configured to be positioned:

between one or a stack of the modular panels forming the wall; and one or more of the modular panels that form a floor structure;

wherein the wall-to-floor transition panel comprises (i) a floor leg or a floor connection portion where a floor panel is attachable and (ii) a wall leg where a wall panel is attachable, where the floor leg or floor connection portion is at an angle relative to the wall leg; and a wall-to-roof transition panel for use in transitioning from the wall to a roof in the building construction, the wall-to-roof transition panel being configured to be positioned:

between one or a stack of the modular panels forming the wall; and one or more of the modular panels that form a roof structure;

wherein the wall-to-roof transition panel comprises (i) a roof leg or a roof connection portion and (ii) a wall leg or a wall connection portion, which are at an angle relative to one another, a vertical length of the wall leg or wall connection portion accommodating an increased height to the wall by including a vertical length that adds to a height of the wall;

wherein the building construction is constructed to include back-to-back C-channel members, forming I-beams, (a) between adjacent vertical wall sections of the wall; (b) between adjacent horizontal floor sections of the floor structure; or (c) between adjacent roof sections of the roof structure.

* * * * *